US010670361B2

(12) United States Patent
Galie et al.

(10) Patent No.: US 10,670,361 B2
(45) Date of Patent: Jun. 2, 2020

(54) SINGLE LOOP USER-ADJUSTABLE ELECTROMAGNETIC TRIGGER MECHANISM FOR FIREARMS

(71) Applicant: Sturm, Ruger & Company, Inc., Southport, CT (US)

(72) Inventors: Louis M. Galie, Leander, TX (US); Rob Gilliom, Conway, AR (US); John Klebes, New Franken, WI (US); John M. French, Meridian, ID (US); Gary Hamilton, Enfield, CT (US); Rafal Slezok, Newington, CT (US)

(73) Assignee: STURM, RUGER & COMPANY, INC., Southport, CT (US)

( * ) Notice: Subject to any disclaimer, the term of this patent is extended or adjusted under 35 U.S.C. 154(b) by 0 days.

(21) Appl. No.: 16/667,009

(22) Filed: Oct. 29, 2019

(65) Prior Publication Data

US 2020/0080812 A1 Mar. 12, 2020

Related U.S. Application Data

(63) Continuation-in-part of application No. 16/530,545, filed on Aug. 2, 2019, which is a continuation of (Continued)

(51) Int. Cl.
*F41A 19/59* (2006.01)
*F41A 19/17* (2006.01)
(Continued)

(52) U.S. Cl.
CPC ..... *F41A 19/17* (2013.01); *F41A 19/10* (2013.01); *F41A 19/58* (2013.01)

(58) Field of Classification Search
None
See application file for complete search history.

(56) References Cited

U.S. PATENT DOCUMENTS 1,875,941 A 9/1932 Schwartz
2,424,247 A 7/1947 Mccaslin
(Continued)

FOREIGN PATENT DOCUMENTS

CA 2701446 10/2011
CN 204301599 4/2015
(Continued)

OTHER PUBLICATIONS

Moving Magnet Technologies SA, *Bistable Actuators*, Actuators and Solenoids for stable positions without current; See description and rotary actuator figure. Http://www.movingmagnet .com/en/bistable-actuators-rotary-solenoids/, Printed Jun. 19, 2018.
(Continued)

*Primary Examiner* — Reginald S Tillman, Jr.
(74) *Attorney, Agent, or Firm* — The Belles Group, P.C.

(57) ABSTRACT

A hybrid magnetically variable firing system for a firearm includes a trigger mechanism configured to allow a user to selectively adjust the trigger pull force-displacement profile. In a closed magnetic flux loop configuration, the trigger mechanism includes a selectively energizable electromagnetic and mechanical biasing member providing a static holding torque which creates resistance opposing movement of the trigger. Energizing the electromagnetic at a user-preselected point during the trigger pull event creates a magnetic force opposing the static holding torque, which dynamically changes the trigger pull force required to discharge the firearm. The electromagnetic assists the user in completing the trigger pull thereby creating an adjustable lighter trigger pull. In one embodiment, the electromagnet is energized when the actual trigger pull force applied or trigger displacement reaches a corresponding trigger set-point preprogrammed into a control circuit. A microcontroller may control operation of the trigger mechanism.

35 Claims, 67 Drawing Sheets

Related U.S. Application Data application No. 16/283,338, filed on Feb. 22, 2019, now Pat. No. 10,458,736, which is a continuation-in-part of application No. 15/908,883, filed on Mar. 1, 2018, now Pat. No. 10,228,208.

(60) Provisional application No. 62/754,062, filed on Nov. 1, 2018, provisional application No. 62/635,598, filed on Feb. 27, 2018, provisional application No. 62/468,632, filed on Mar. 8, 2017.

(51) Int. Cl.
*F41A 19/10* (2006.01)
*F41A 19/58* (2006.01)

(56) References Cited

U.S. PATENT DOCUMENTS

| | | | |
|---|---|---|---|
| 2,702,841 | A | 2/1955 | Bernstein |
| 2,780,882 | A | 2/1957 | Temple |
| 2,957,391 | A | 10/1960 | Lovercheck |
| 2,978,825 | A | 4/1961 | Tichenor |
| 3,065,560 | A | 11/1962 | Bumiller |
| 3,184,651 | A | 5/1965 | Albosta |
| 3,208,181 | A | 9/1965 | Calhoun et al. |
| 3,250,034 | A | 5/1966 | Simmons |
| 3,650,174 | A | 3/1972 | Nelsen |
| 3,854,231 | A | 12/1974 | Broyles |
| 3,982,347 | A | 9/1976 | Brandl et al. |
| 4,009,536 | A | 3/1977 | Wolff |
| 4,134,223 | A | 1/1979 | Hillenbrandt |
| 4,236,132 | A | 11/1980 | Zissimopoulos |
| 4,275,521 | A | 6/1981 | Gerstenberger et al. |
| 4,329,803 | A | 5/1982 | Johnson et al. |
| 4,347,679 | A | 9/1982 | Grunig |
| 4,510,844 | A | 4/1985 | Fritz et al. |
| 4,727,670 | A | 3/1988 | Krouse |
| 4,730,407 | A | 3/1988 | DeCarlo |
| 4,793,085 | A | 12/1988 | Surawski et al. |
| 5,074,189 | A | 12/1991 | Kurtz |
| 5,083,392 | A | 1/1992 | Bookstaber |
| 5,272,828 | A | 12/1993 | Petrick et al. |
| 5,303,495 | A | 4/1994 | Harthcock |
| 5,544,439 | A | 8/1996 | Grember et al. |
| 5,625,972 | A | 5/1997 | King et al. |
| 5,713,150 | A | 2/1998 | Ealovega |
| 5,755,056 | A | 5/1998 | Danner et al. |
| 5,784,821 | A | 7/1998 | Gerard |
| 5,901,488 | A | 5/1999 | Oberlin |
| 6,286,241 | B1 | 9/2001 | Constant |
| 6,354,033 | B1 | 3/2002 | Findley |
| 6,360,469 | B1 | 3/2002 | Mikuta et al. |
| 6,425,199 | B1 | 7/2002 | Vaid |
| 6,430,861 | B1 | 8/2002 | Ayers et al. |
| 6,442,880 | B1 | 9/2002 | Allan |
| 6,668,700 | B1 | 12/2003 | Danner et al. |
| 6,694,963 | B1 | 2/2004 | Taylor |
| 6,732,464 | B2 | 5/2004 | Kurvinen |
| 6,802,305 | B1 | 10/2004 | Hatcher |
| 6,951,071 | B1 | 10/2005 | Acosta |
| 7,049,915 | B2 | 5/2006 | Delamare et al. |
| 7,231,911 | B2 | 6/2007 | Hatcher |
| 7,441,362 | B1 | 10/2008 | Kley |
| 7,457,096 | B2 | 11/2008 | Brundula |
| 7,819,051 | B1 | 10/2010 | Beckmann et al. |
| 8,015,911 | B2 | 9/2011 | Hellstrom et al. |
| 8,109,024 | B2 | 2/2012 | Abst |
| 8,113,103 | B2 | 2/2012 | Beckmann et al. |
| 8,234,969 | B2 | 8/2012 | Beckmann |
| 8,336,438 | B2 | 12/2012 | Compton |
| 8,461,951 | B2 | 6/2013 | Gassmann et al. |
| 8,522,466 | B2 | 9/2013 | Arduini |
| 8,677,665 | B1 | 3/2014 | Huber |
| 8,692,636 | B2 | 4/2014 | Reuber |
| 8,807,007 | B2 | 8/2014 | Alicea |
| 9,011,151 | B1 | 4/2015 | Jones et al. |
| 9,190,234 | B2 | 11/2015 | Reuber |
| 9,347,726 | B1 | 5/2016 | Thomas |
| 9,395,134 | B2 | 7/2016 | Swensen |
| 10,228,208 | B2 | 3/2019 | Galie et al. |
| 2001/0039751 | A1 | 11/2001 | Kurvinen |
| 2006/0005447 | A1 | 1/2006 | Lenner |
| 2009/0300961 | A1 | 12/2009 | Ruhland et al. |
| 2012/0131832 | A1 | 5/2012 | Arduini |
| 2015/0377574 | A1 | 12/2015 | Cooke et al. |
| 2016/0061549 | A1 | 3/2016 | Patterson et al. |
| 2016/0233012 | A1 | 8/2016 | Lubinski et al. |
| 2019/0186857 | A1* | 6/2019 | Galie ..... F41A 19/10 |

FOREIGN PATENT DOCUMENTS

| | | | |
|---|---|---|---|
| DE | 2926559 | A1 | 1/1981 |
| DE | 9301009 | | 5/1994 |
| DE | 202013005117 | | 7/2013 |
| EP | 1132929 | B1 | 9/2001 |
| EP | 2887002 | A1 | 6/2015 |
| EP | 2887003 | B1 | 12/2016 |
| GB | 2313655 | A | 12/1997 |
| JP | 200133091 | A | 7/2001 |
| JP | 2001250716 | | 9/2001 |
| JP | 3240351 | | 12/2001 |
| JP | 4887993 | B2 | 2/2012 |
| JP | 561373 | B2 | 10/2014 |
| KR | 20010035913 | | 5/2001 |
| RU | 2101839 | | 1/1998 |
| SU | 1133960 | | 9/1987 |
| SU | 1830443 | | 9/1987 |
| WO | WO2005/116567 | | 12/2005 |

OTHER PUBLICATIONS

International Search Report issued in PCT/US2018/020355, dated May 21, 2018, pp. 1-2.

* cited by examiner

Where:
S1 = trigger activation switch
R1 = force setpoint selection potentiometer
L1 = magnetic coil Closed-loop sliding magnet design Closed-loop rotating magnet design R1 – selection of trip force
FSR – trigger force sensor
Vout – power to coil

SINGLE LOOP USER-ADJUSTABLE ELECTROMAGNETIC TRIGGER MECHANISM FOR FIREARMS

CROSS-REFERENCE TO RELATED APPLICATIONS

The present application claims the benefit of U.S. Provisional Application No. 62/754,062 filed Nov. 1, 2018 and is a continuation-in-part of U.S. patent application Ser. No. 16/530,545 filed Aug. 2, 2019, which is a continuation of U.S. patent application Ser. No. 16/283,338 filed Feb. 22, 2019, which claims the benefit of U.S. Provisional Application No. 62/635,598 filed Feb. 27, 2018, and is a continuation-in-part of U.S. patent application Ser. No. 15/908,883 filed Mar. 1, 2018 (now U.S. Pat. No. 10,228,208), which claims the benefit of U.S. Provisional Application No. 62/468,632 filed Mar. 8, 2017. The foregoing applications are all incorporated herein by reference in their entireties.

BACKGROUND OF THE DISCLOSURE

The present invention relates to firearms, and more particularly to an energizable electromagnetic trigger mechanism for the firing system of a firearm which provides a dynamically adjustable force and displacement profile for a trigger customizable by a user.

Traditional triggers for firearms provide a decisive intent-to-fire signal through mechanical motion that utilizes a displacement and force profile developed by using mechanical linkages, springs and the release of energy stored in a spring-biased hammer, striker, or sear. The trigger force and displacement curve or profile is normally fixed by these mechanical linkages and springs. A number of designs exist that provide adjustable characteristics for the force and displacement of the trigger using set screws, additional springs, or part changes to customize the force-displacement profile of firearm triggers mechanically. Such adjustment techniques, however, modify the trigger pull force resistance in a purely mechanical manner which is limited by the physical interaction of trigger parts and associated linkages alone. To provide adjustment of the trigger pull force, these trigger mechanical linkages may therefore become quite complex, require multiple individual mechanical components, and hence are susceptible to wear and failure.

An improved variable force trigger for the firing system of a firearm is desired which allows the trigger force-displacement profile to be more quickly and easily altered in a dynamically changeable manner without resort to strictly adjusting the position of mechanical components or physically exchanging such mechanical components and/or other hardware of the trigger mechanism.

SUMMARY OF THE DISCLOSURE

An electromagnetically variable firing system for a firearm according to the present disclosure includes a trigger assembly or mechanism having an electromagnetically-operated control device which allows the user to preselect and adjust the trigger pull force-displacement profile electronically in an expeditious non-mechanical manner in one embodiment. The preselected trigger force may be implemented automatically and dynamically during the course of a trigger pull event based on sensing an applied force to the trigger by the user to initiate the firing sequence.

The electromagnetic control device is an integral part of the trigger mechanism, which in turn operably interfaces with other components of the firing system for discharging the firearm. The electromagnetically variable firing system may include a movable energy storage device such as a spring-biased cockable striking member such as a pivotable hammer or linearly-movable striker for striking a chambered ammunition cartridge or round, a movable sear operable to hold and release the hammer or striker from the cocked position, and other associated firing mechanism components which collectively operate together to discharge the firearm when actuated via a manual trigger pull. In some embodiments, the sear may be formed as an integral unitary structural part of the trigger mechanism instead of being a separate component.

In certain implementations, the trigger pull force and displacement profile is electrically/electronically adjustable via the trigger control device by changing or altering a magnetic field acting on a portion of the trigger mechanism, thereby increasing or decreasing resistance of the trigger to movement. The trigger pull force required may vary with displacement distance or travel of the trigger when actuated by the operator or user such that the initial trigger pull force may have an initial value or magnitude during the first stage or phase of the trigger pull (e.g. hard or easy) which is then followed by either a constant or varying different second values or magnitudes of trigger pull force during the subsequent and final phases of the trigger pull until the firearm is discharged.

To power, monitor, and control operation of the trigger control device and trigger mechanism including adjustment of the trigger pull force and displacement profile, the firearm may include a control system including a suitable power source (e.g. battery) mounted to a frame of the firearm or module attached thereto, and a programmable electronic processor such as a microprocessor or microcontroller including circuitry, memory, data storage devices, sensors, sensor and drive circuits, communication devices and interfaces (e.g. wired or wireless protocols), and other electronic devices, components, and circuits necessary for a fully functional microprocessor based control system. The microcontroller may preferably be disposed onboard the firearm. The microcontroller is operably coupled to the power source to control via an actuation control circuit to energize or de-energize the trigger control device.

In one embodiment, the electromagnetically-operated trigger control device may comprise a magnetorheological fluid device or operator which is selectably alterable electrically/electronically via the microcontroller to vary the trigger pull force and displacement profile characteristics.

In another embodiment, the electromagnetically-operated trigger control device may comprise a magnetic device or operator such as an electromagnetic snap actuator of a non-bistable design which is selectably alterable electrically/electronically via the microcontroller to vary the trigger pull force and displacement profile characteristics by altering the magnet field force of the trigger mechanism. The electromagnetic actuator forms an integral part of the trigger mechanism, and in some embodiments may constitute substantially the entirety of the trigger mechanism with minimal appurtenances for operational simplicity and reliability. The electromagnetic actuator may generally include a stationary yoke attached to the firearm frame, a rotatable member pivotably movable relative to the yoke, and an electromagnet coil electrically connected to the on-firearm electric power source. In some implementations, the trigger mechanism may be configured to establish a closed single or double flux loop that limits susceptibility to external magnetic fields which might inadvertently change the trigger pull force or displacement of the trigger mechanism. This completely contained flux loop around the permanent magnet optimizes the magnetic coupling force between the yoke and rotating member making this design inherently resistant to external magnetic fields.

Certain implementations of the control device may also employ mechanical components to assist with adjusting the trigger pull force and displacement profile. The trigger control device may be used as an on/off safety in some embodiments, and/or to vary trigger pull force which may be adjusted by the user to meet personal preferences.

Embodiments of the present electromagnetic trigger mechanisms may be employed with any type of trigger-operated small arms including without limitation as some examples pistols, revolvers, long guns (e.g. rifles, carbines, shotguns), grenade launchers, etc. Accordingly, the present invention is expressly not limited in its applicability and breadth of use.

Accordingly, embodiments of the present invention provide a trigger mechanism or assembly for use in a firearm that provides a changeable and variable force of resistance (i.e. trigger pull force) as the trigger moves and is displaced in distance.

The foregoing or other embodiments of the present invention may control the change in resistance force dynamically during the actual displacement of the trigger linkage by the operator or user at the time of operation.

The foregoing or other embodiments of the present invention provide that the trigger force can be controlled by varying the viscosity of a magnetorheological fluid incorporated into the trigger mechanism.

The foregoing or other embodiments of the present invention provide that the trigger force can be controlled by varying the magnetic field of an electromagnetic snap actuator incorporated into and configured as a trigger mechanism or assembly for discharging the firearm.

The foregoing or other embodiments of the present invention provide that the trigger force can be programmed remotely from an external smartphone, tablet, personal wearable device, or other remote device using a wireless communications standard such as Bluetooth, BLE (Bluetooth Low Energy), NFC (Near-Field Communication), LoRa (Long Range wireless), WiFi, or a proprietary wireless protocol or other protocol.

The foregoing or other embodiments of the present invention may be configured to capture cycle count and direct sensing of the trigger mechanism for the implementation of data collection on the performance and operation of the device. Shot counting, shot timing, pre-fire trigger analysis, and post firing performance analysis can be tied to internal sensing of the trigger event and electrically interfaced to the user through external electronic devices, such as without limitation cellphones, tablets, pads, wearables, or web applications.

In one aspect, an electromagnetically variable trigger force firing system comprises: a frame; a striking member supported by the frame for movement between a rearward cocked position and forward firing position for discharging the firearm; an electromagnetic actuator trigger unit affixed to the frame and comprising: a stationary yoke comprising an electromagnet coil; a rotating member movable about a pivot axis relative to the stationary yoke and operable for releasing the striking member from the cocked position to the firing position; a trigger operably engaged with the rotating member, the trigger manually movable by a user from a first position to a second position which rotates the rotating member for discharging the firearm; and a permanent magnet generating a static magnetic field in the stationary yoke and rotating member, the static magnetic field creating a primary resistance force opposing movement of the trigger when pulled by the user; an electric power source operably coupled to the coil; the electromagnet coil when energized generating a user-adjustable secondary magnetic field interacting with the static magnetic field, the secondary magnetic field operating to change the primary resistance force dynamically during a trigger pull event initiated by the user.

In another aspect, an electromagnetic firing system for a firearm comprises: a frame; a striking member supported by the frame and movable between a rearward cocked position and forward firing position for discharging the firearm; an electromagnetically adjustable trigger mechanism operably coupled to the striking member for discharging the firearm, the trigger mechanism comprising an electromagnetic actuator including: a stationary yoke comprising an electromagnet coil operably coupled to an electric power source, the coil having an energized state and a de-energized state; a rotating member pivotably coupled to the stationary yoke for movement between an unactuated and actuated positions, the rotating member operably coupled to the striking member for moving the striking member from the cocked position to the firing position; a trigger movably coupled to the stationary yoke and interacting with the rotating member, the trigger manually movable by a user from a first actuation position to a second actuation position which rotates the rotating member for discharging the firearm; and a permanent magnet generating a static magnetic flux in the yoke and rotating member, the static magnetic flux creating a primary resistance force opposing movement of the trigger when pulled by the user; a programmable microcontroller operably coupled to the electromagnetic actuator of the trigger mechanism and pre-programmed with a trigger force setpoint, the microcontroller configured to: receive an actual trigger force applied to the trigger by a user and measured by a trigger sensor communicably coupled to the microcontroller; compare the actual trigger force to the preprogrammed trigger force setpoint; and selectively energize the electromagnetic actuator based on the comparison of the actual trigger force to the trigger force setpoint; wherein the electromagnet coil when energized generates a user-adjustable secondary magnetic flux interacting with the static magnetic field, the secondary magnetic field operating to increase or decrease the primary resistance force when the trigger is pulled by the user.

In another aspect, an electromagnetic firing system for a firearm comprises: a frame; a striking member supported by the frame and movable between a rearward cocked position and forward firing position for discharging the firearm; a pivotable sear configured to selectively hold the striking member in the cocked position; an electromagnetic actuator trigger mechanism supported by the frame, the trigger mechanism configured to create a dual loop magnetic flux circuit and comprising: a stationary yoke comprising an electromagnet coil operably coupled to an electric power source, the coil having an energized state and a de-energized state; a rotating member pivotably coupled to the stationary yoke about a pivot axis, the rotating member movable between an unactuated position engaging with the sear and an actuated position disengaging the sear; a trigger operably engaged with the rotating member and manually movable by a user for applying an actual trigger force on the rotating member; and a permanent magnet generating a static magnetic flux holding the rotating member in the unactuated position, the permanent magnet generating a static magnetic flux creating a primary resistance force opposing movement of the trigger when pulled by the user; a programmable microcontroller operably coupled to the power source and communicably coupled to a trigger sensor configured to sense the applied trigger force, the microcontroller when detecting the applied trigger force being configured to transmit an electric pulse to the electromagnet coil of the trigger mechanism; the electromagnet coil when energized generating a secondary magnetic flux interacting with the static magnetic field, the secondary magnetic field being configurable by the user via the microcontroller to increase or decrease the primary resistance force when the trigger is pulled by the user.

In another aspect, an electromagnetically variable trigger system comprises: a frame; an electromagnetic actuator trigger unit affixed to the frame and comprising: a stationary yoke comprising an electromagnet coil; a rotating member movable about a pivot axis relative to the stationary yoke; a trigger operably engaged with the rotating member, the trigger manually movable by a user from a first position to a second position which rotates the rotating member; and a permanent magnet generating a static magnetic field in the stationary yoke and rotating member, the static magnetic field creating a primary resistance force opposing movement of the trigger when pulled by the user; an electric power source operably coupled to the coil; the electromagnet coil when energized generating a user-adjustable secondary magnetic field interacting with the static magnetic field, the secondary magnetic field operating to change the primary resistance force dynamically during a trigger pull event initiated by the user. The trigger system may further comprise an electronic actuation control circuit operably coupled between to the power source and coil, the actuation control circuit configurable by the user to selectively energize the coil upon detection of a trigger pull and de-energize the coil in an absence of the trigger pull, and a trigger sensor communicably coupled to the actuation control circuit and operable to detect movement of the trigger initiated by the user.

The present application further discloses non-electric magnetic only trigger mechanisms of the closed and open magnetic loop designs.

According to one aspect, a closed loop magnetically variable trigger force trigger mechanism for a firearm comprises: a stationary yoke configured for mounting to the firearm; a rotatable trigger member pivotably coupled to the stationary yoke about a pivot axis, the trigger member and stationary yoke collectively configured to form a closed magnetic loop; an openable and closeable first air gap formed between the trigger member and the stationary yoke; a permanent magnet arranged to generate a static magnetic field in the closed magnetic loop, the static magnetic field creating a primary resistance force opposing movement of the trigger member when pulled by the user; a control insert selectively movable relative to a second control air gap formed in the yoke which attenuates the static magnetic field, the control insert constructed and operable to change the static magnetic field; wherein the static magnetic field is changeable via varying position of the control insert relative to the control air gap to adjust a trigger pull force of the trigger mechanism.

In another aspect, a closed loop magnetically variable trigger force trigger mechanism for a firearm comprises: a stationary yoke configured for mounting to the firearm; a rotatable trigger member pivotably movable about a pivot axis relative to the stationary yoke, the trigger member and stationary yoke collectively configured to form a closed magnetic loop; an openable and closeable first air gap formed between the trigger member and the stationary yoke; a control insert selectively movable into and out of a second control air gap formed in the yoke which attenuates the static magnetic field, the control insert operable to change the static magnetic field; the control insert comprising a non-magnetic carrier and a permanent magnet operable to generate a static magnetic field in the closed magnetic loop, the static magnetic field creating a primary resistance force opposing movement of the trigger member when pulled by the user; wherein the static magnetic field is changeable via varying position of the permanent magnet in the control insert relative to the second control air gap to adjust a trigger pull force of the trigger mechanism.

In another aspect, a closed loop magnetically variable trigger force trigger mechanism for a firearm comprises: a stationary yoke configured for mounting to the firearm; a rotatable trigger member pivotably movable about a pivot axis relative to the stationary yoke, the trigger member and stationary yoke collectively configured to form a closed magnetic loop; an openable and closeable first air gap formed between the trigger member and the stationary yoke; a control insert comprising a permanent magnet rotatably disposed in a second control air gap formed in the yoke which attenuates the static magnetic field, the permanent magnet operable to generate a static magnetic field in the closed magnetic loop, the static magnetic field creating a primary resistance force opposing movement of the trigger member when pulled by the user; wherein the static magnetic field is changeable via rotating the permanent magnet of the control insert relative to the second control air gap to adjust a trigger pull force of the trigger mechanism.

In another aspect, a method for adjusting the trigger pull force of a closed loop magnetically variable trigger force trigger mechanism for a firearm comprises: providing a stationary yoke configured for mounting in the firearm, a rotating trigger member pivotably movable about a pivot axis relative to the stationary yoke, the trigger member and stationary yoke collectively configured to form a closed magnetic loop, and an openable and closeable first air gap being formed between the trigger member and the stationary yoke; providing a control insert comprising a non-magnetic carrier and a permanent magnet operable to generate a static magnetic field in the closed magnetic loop, the static magnetic field creating a primary resistance force opposing movement of the trigger member when pulled by the user; rotating an actuator operably coupled to the control insert in a first direction to advance the permanent magnet into a second control air gap formed in the stationary yoke, the magnet creating a first static magnetic field strength in the closed magnetic loop which resists movement of the trigger member relative to the stationary yoke at the first air gap; rotating the actuator in an opposite second direction to withdraw the magnet from the second control air gap, the magnet creating a second static magnetic field strength in the closed magnetic loop less than the first magnetic field strength; wherein the strength of the static magnetic field is changeable via varying position of the permanent magnet in the control insert relative to the second control air gap in order to adjust a trigger pull force of trigger mechanism.

U.S. Pat. No. 10,228,208 entitled "Dynamic Variable Force Trigger Mechanism For Firearms" which is incorporated herein by reference discloses a trigger mechanism wherein the trigger release force felt by the user when pulling the trigger can be varied electrically. This variable force feature is accomplished by using both a permanent magnet and an electromagnet selectively activated by an electric coil. Specifically, the permanent magnet is used to provide a static holding force creating resistance to movement of the trigger via a trigger pull by the user, and the electric coil is used to both 1) diminish the magnetic holding force of the permanent magnet, and 2) produce an opposing magnetic force within an air-gap to assist in completion of the trigger pull.

The present disclosure and invention provides a further embodiment of a variable force trigger mechanism wherein the function of the permanent magnet is replaced by a mechanical biasing member such as a spring. Specifically, the mechanical spring is used to provide a static holding force which creates a primary resistance force opposing movement of the trigger when pulled by the user, and an electrical coil which when energized creates an electromagnetic used to selectively produce a magnetic force within a control air gap of the trigger mechanism which opposes the static holding force of the mechanical spring. The magnetic field acts in a single closed loop magnetic flux circuit created by the electrical coil wound around the magnetic yoke in one embodiment. Such a trigger mechanism may therefore be referred to as a hybrid "single closed magnetic loop" variable trigger mechanism combining features of both the electrical coil and mechanical spring. The hybrid trigger mechanism is advantageously configured and operable to discharge the firearm in a purely mechanical mode of operation in the event the electrical/electromagnetic portions of the mechanism were to fail to operate for some reason.

To power, monitor, and control operation of the hybrid trigger mechanism, the firearm may include an electrical/electronic control system operably coupled to power source (e.g. battery) and mounted to a support structure of the firearm. The control system may comprise an analog control circuit or a digital actuation control circuit including a programmable electronic processor such as a microcontroller including the circuitry, memory, data storage devices, sensors, sensor and drive circuits, communication devices and interfaces (e.g. wired or wireless protocols), and other electronic devices, components, and circuits necessary a fully functional programmable microprocessor based control system.

Accordingly, in one aspect an electromagnetically variable trigger mechanism for a firearm of the foregoing type comprises: a stationary yoke configured for attachment to a support structure of the firearm; a movable trigger bar pivotably coupled to the stationary yoke, the trigger bar and yoke collectively configured to form a closed magnetic flux loop; a trigger member operably interacting with the trigger bar at an interface, the trigger member manually movable by a user to rotate the trigger bar for discharging the firearm; a trigger biasing member acting on the trigger bar, the biasing member creating a mechanical primary resistance force opposing movement of the trigger when pulled by the user; and an electromagnetic coil operably coupled to a power source and disposed on the stationary yoke or trigger bar; the electromagnet coil when energized generating a user-adjustable magnetic field interacting with the primary resistance force to dynamically change a trigger pull force required to be exerted by a user to overcome the primary resistance force and discharge the firearm.

In another aspect, a user-adjustable closed loop electromagnetically variable trigger mechanism for a firearm comprises: a support structure; a stationary yoke supported by the support structure; a trigger bar pivotably movable relative to the yoke, the trigger bar and yoke collectively configured to form a closed magnetic flux loop openable and closeable at a control air gap controlled by the trigger bar; the trigger bar comprising a vertically elongated working portion configured to engage a firing component of a firing mechanism of the firearm and a cantilevered actuating extension angularly disposed to the working portion; a trigger member pivotably coupled to the stationary yoke about a first pivot axis, the trigger member operably interacting with the trigger bar at an interface and comprising a downwardly extending grip portion for grasping, and a cantilevered operating extension angularly disposed to the grip portion; the trigger bar movable via pulling the trigger portion between an upright unactuated position associated an open control air gap and an angled actuated position associate with a closed control air gap for discharging the firearm; a trigger spring biasing the trigger bar towards the unactuated position, the biasing member creating a mechanical primary resistance force opposing movement of the trigger when pulled by the user; and an electromagnetic coil disposed on the stationary yoke or trigger bar, the electromagnetic coil operably coupled to a power source and selectively energized via pulling the trigger member; the electromagnet coil when energized generating a user-adjustable magnetic field counterbalancing a primary resistance force generated by the trigger spring which pulls the trigger bar towards the stationary yoke into the actuated position, thereby lessening a trigger pull force required to be exerted by a user to discharge the firearm.

In another aspect, an electromagnetically variable trigger mechanism for a firearm comprises: a stationary yoke configured for attachment to a support structure of the firearm; a movable trigger bar having a lower portion pivotably coupled to the stationary yoke and an upper portion selectively engageable with the stationary yoke at a control air gap, the trigger bar and yoke collectively configured to form a closed magnetic flux loop; a trigger member rotatably coupled to the stationary yoke and operably interacting with the trigger bar at an interface; the trigger bar pivotably movable via a trigger pull between an unactuated position associated with an open control air gap, and an actuated position associated with a closed control air gap for discharging the firearm; a trigger spring biasing the trigger bar towards the unactuated position, the trigger bar creating a mechanical primary resistance force opposing movement of the trigger when pulled by the user; an electromagnetic coil operably coupled to a power source and disposed on the stationary yoke or trigger bar; an actuation control circuit operably coupled to power source, the actuation control circuit configured to selectively energize the electromagnetic coil at a predetermined trigger pull setpoint during a trigger pull event which creates an electromagnetic field in the closed magnetic flux loop; the electromagnetic field interacting with the primary resistance force to dynamically change a trigger pull force required to be exerted by a user to overcome the primary resistance force and discharge the firearm.

A method for operating a closed loop electromagnetic trigger mechanism of a firearm of the foregoing type is disclosed. The method comprises: providing a stationary yoke disposed in the firearm, a pivotably movable trigger bar selectively engageable with the stationary yoke at a control air gap, an electromagnetic coil disposed on the stationary yoke or trigger bar, and a rotatable trigger member operably engaged with the trigger bar, the trigger member operable to rotate the trigger bar, the stationary yoke and trigger bar forming a closed magnetic flux loop; providing a control system having a preprogrammed trigger pull setpoint; applying a biasing force on the trigger bar which is biased into an unactuated position disengaged from the stationary yoke at the control air gap, the biasing force creating a mechanical primary resistance force on the trigger member; applying a trigger pull force to the trigger member to rotate the trigger member from a forward position towards a rearward position; measuring the trigger pull force with a sensor operably coupled to the control system, the control system comparing the measured trigger pull force with the trigger pull setpoint; energizing the electromagnetic coil when the measured trigger pull force reaches the trigger pull setpoint to create a force in the closed magnetic flux loop acting in a direction opposite the biasing force; the magnetic force drawing the trigger bar into engagement with the stationary yoke at the control air gap, the trigger bar being in an actuated position; wherein the magnetic force counterbalances the biasing force to lessen the trigger pull force required to be exerted by a user to fully pull the trigger member to discharge the firearm.

These and other features and advantages of the present invention will become more apparent in the light of the following detailed description and as illustrated in the accompanying drawings.

BRIEF DESCRIPTION OF DRAWINGS

The features of the exemplary embodiments will be described with reference to the following drawings where like elements are labeled similarly, and in which:

All drawings are schematic and not necessarily to scale. Any reference herein to a whole figure number (e.g. FIG. 1) which may include several subpart figures (e.g. FIGS. 1A, 1B, 1C, etc.) shall be construed as a reference to all subpart figures unless explicitly noted otherwise. Numbered parts appearing in some figures which appear un-numbered in other figures are the same parts unless explicitly noted otherwise.

DETAILED DESCRIPTION

Figure 1:
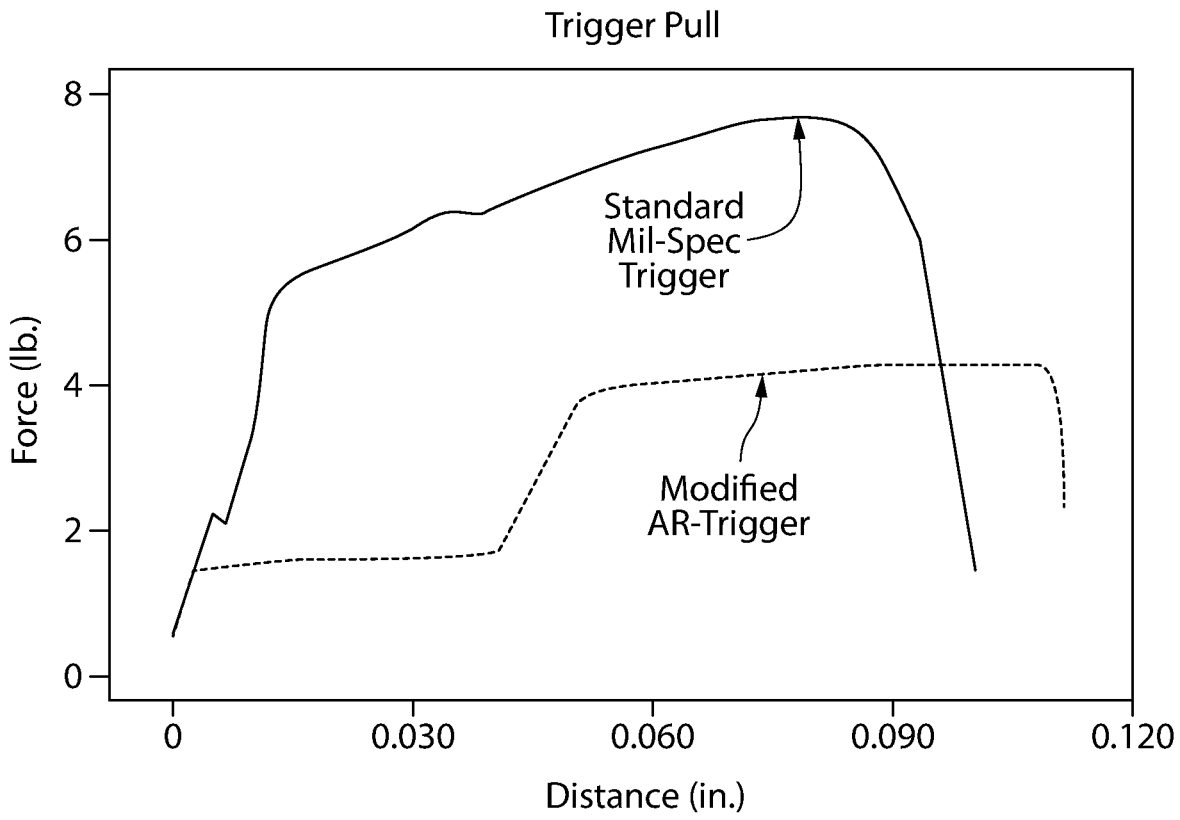
FIG. 1 is a graph depicting variation in trigger pull force versus displacement (distance) for two different trigger actions or mechanisms.
Figure 2A:
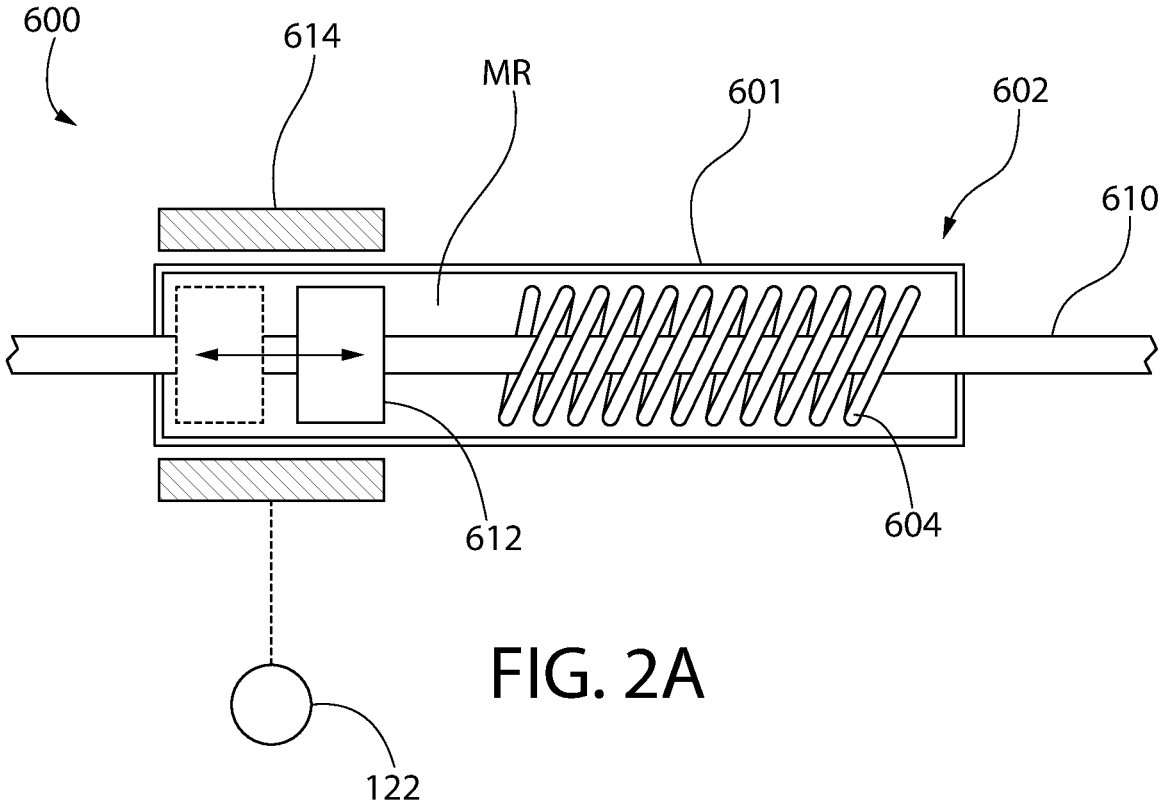
FIG. 2A is a side cross-sectional view of a control device comprising an electromagnetic magnetorheological fluid piston assembly for a trigger mechanism of a firearm.
Figure 2B:
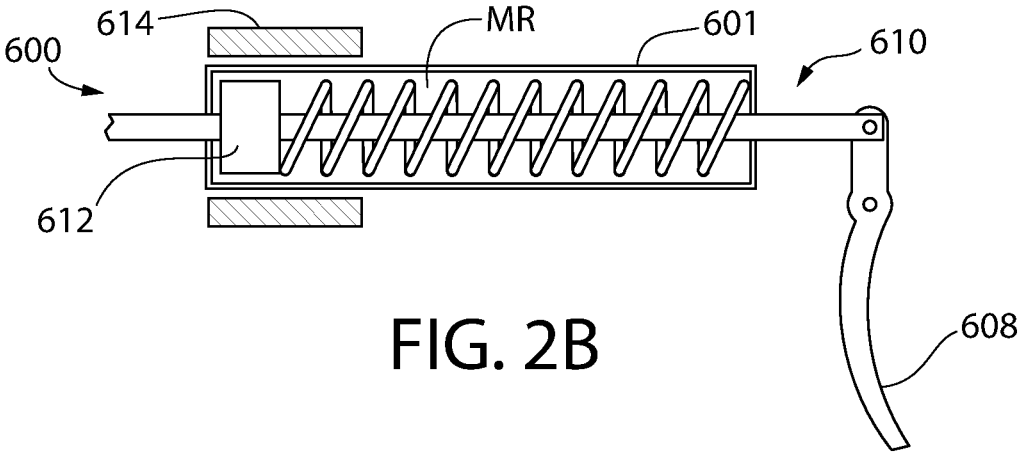
FIGS. 2B-D show sequential views of the piston assembly thereof embodied in a variable force trigger mechanism during different stages in the process of pulling the trigger.
Figure 2C:
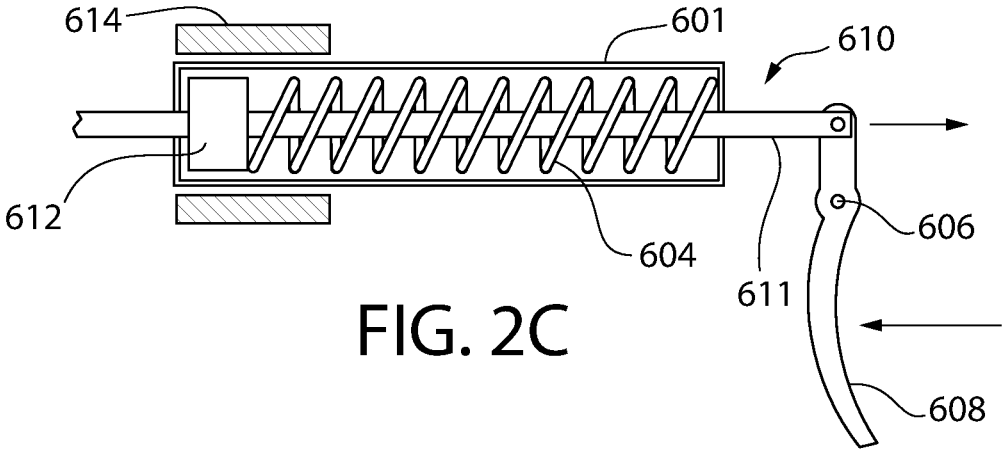
Figure 2D:
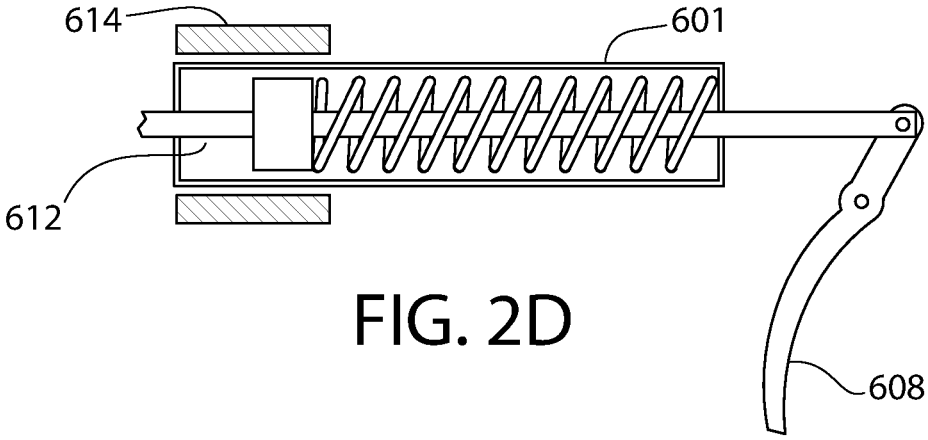

The features and benefits of the invention are illustrated and described herein by reference to example ("exemplary") embodiments. This description of exemplary embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," and "interconnected," refer to a relationship wherein structures are secured or attached to one another either directly or indirectly through intervening structures, as well as both movable or rigid attachments or relationships, unless expressly described otherwise. Accordingly, the disclosure expressly should not be limited to such exemplary embodiments illustrating some possible non-limiting combination of features that may exist alone or in other combinations of features.

As used throughout, any ranges disclosed herein are used as shorthand for describing each and every value that is within the range. Any value within the range can be selected as the terminus of the range.

The dynamics of the trigger feel are one of the most important aspects of the shooter's experience, impacting accuracy, repeatability, and safety of the firearm. A conventional trigger pull consists of three stages: take-up or pre-travel, the break-over point of release of stored energy in the hammer, striker, or sear, and finally over-travel. In a conventional trigger mechanism, these stages are fixed by the springs, linkages, and mechanical components that make up the trigger system. An adjustable trigger allows adjustments to the travel distance, force, and feel of the trigger pull during one or more of these stages or phases.

The desired trigger pull force and displacement characteristic is dependent upon the type of firearm, application, safety, reliability, and individual preferences. For example, a shooter may wish for a medium to heavy trigger pull weight for hunting and a significantly lighter and different feel for competition shooting. FIG. 1 shows a comparison of a conventional military spec trigger pull force profile versus a modified version of an AR type rifle trigger exhibiting a lower pull force profile over the range from the initial trigger pull through release of the hammer or striker of the firearm.

The current state of the art for making changes in the trigger pull force requirement and shape of the force profile (e.g. between a heavy and light trigger pull) is to physically adjust spring or linkage tensions within the trigger mechanism or directly replace existing and install alternate parts to attain the desired trigger force and displacement characteristics. These approaches both limit the shape of the possible trigger force verses displacement curve and the timing of how it can be adjusted. Additionally, the adjustment is usually only possible over a narrow range of trigger pull forces unfortunately due to physical limitations of the physical trigger mechanism components.

The present invention includes a novel trigger mechanism which allows the trigger pull force and displacement to be controlled by a magnetic field. By actively adjusting the magnetic field, dynamic real-time variability of the trigger pull force over a wide range of displacement can advantageously be achieved. In addition, the "feel" of the trigger may be improved by tailoring this force-displacement curve to provide a large range of variation that is not possible with conventional mechanical springs, linkages, and levers.

One method disclosed herein to control the force-displacement profile may be to use a theological fluid. An electric or magnetic field can influence the viscosity of certain fluids. This characteristic can be exploited to design a variable force trigger for firearms, turn on or off a manual safety feature, or provide active damping of recoil.

Magnetorheological (MR) fluids have the unique property of changing from a free-flowing liquid to a semi-solid state in the presence of a magnetic field. This dynamically changeable viscosity property has significant potential for control applications in firearms. Currently, magnetorheological fluids, such as the commercially available MRF-132DG by LORD Corporation, provide a range of fast response time, dynamic yield strength, temperature resistance to meet the needs of an adjustable force trigger system in firearms. Other materials such as ferro-fluids, electrorheological fluids, and devices based on the Giant Electrorheological effect may also provide a reliable alternative to the use of magneto-rheological fluids in this application.

Embodiments of Dynamic Variable-Force Trigger Using MR Fluids

Magneto-rheological (MR) fluids can respond almost instantly to varying levels of a magnetic field precisely and proportionally for controlled force loading. By dynamically adjusting the viscosity of the MR fluid, it is possible to construct a dynamically variable trigger force apparatus. If the movement of a trigger transfer linkage is constrained by using an MR fluid-filled spring loaded piston as disclosed herein, the viscosity of the MR fluid using a magnetic field, we can then be dynamically changed. The resulting viscosity change results in a significant change in force loading necessary to move the trigger transfer linkage to the fire position, which translates into a user-variable trigger pull force resistance opposing movement of the trigger linkage.

FIGS. 2A-D and 4-5 depict one embodiment of an electromagnetic MR fluid actuator 600 comprising an MR fluid-filled piston assembly 602 comprising a disk-shaped piston 612 movably disposed inside an MR fluid-filled cylinder 601. An electromagnet coil 614 is wound around a portion of the cylinder 601 and operably coupled to an electric power source 122 onboard the firearm and further described herein. The piston 612 is spring loaded so that the trigger linkage 610 would have a low return spring force sufficient to reliably return the trigger to it's original vertical ready-to-fire position with the MR fluid in it's free-flowing most liquid state (i.e. lowest viscosity condition). Approximately 1.0 lbs. might be a good baseline in one example for spring force imparted by piston spring 604. By increasing a magnetic field via the electromagnet coil 614 operably coupled to a power source 122, applied in such a way as to change the viscosity of the MR fluid, the force necessary to move the trigger bar could be adjusted upward to as much as 10-15 lbs. force in some embodiments. The trigger linkage 610 may comprise an elongated rod 611 pivotably coupled to a trigger member 608 rotatable about a transverse pivot axis 606 formed by a pin. Trigger member 608 may be mounted to a frame of a firearm.

Figure 3:
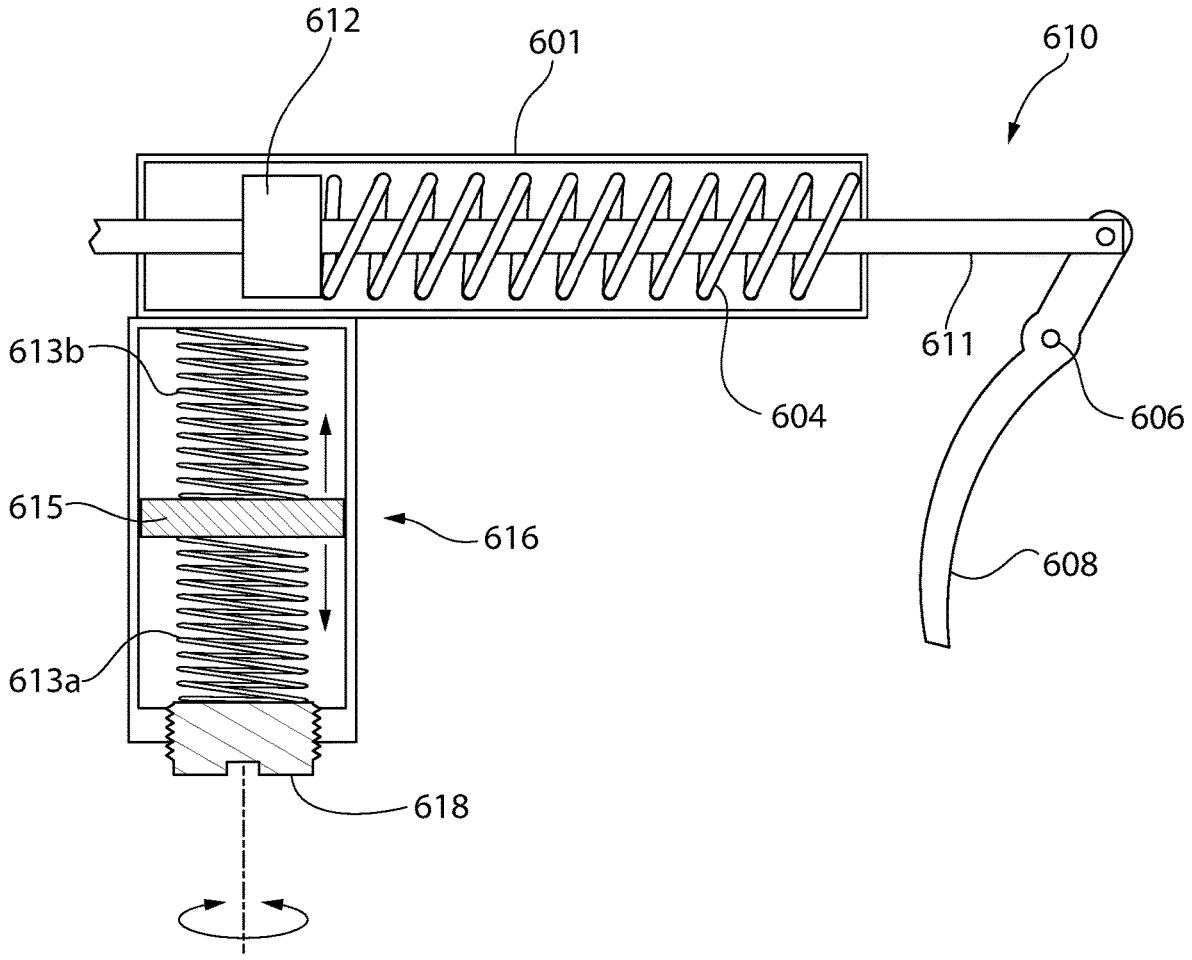
FIG. 3 is a side cross-sectional view thereof including an alternative embodiment of a user-adjustable magnetic control device for altering the trigger pull force comprised of a permanent magnet control linkage that provides the magnetic field in lieu of an electromagnetic shown in FIGS. 2A-D.

In a basic implementation of a simple non-electromagnetic MR fluid actuator shown in FIG. 3, the magnetic field may be created by a spatially adjustable permanent magnet 615 mounted in close proximity to the piston cylinder 601 via an adjustable mechanical linkage 616. The linkage 616 may comprise a permanent magnet 615 slideably disposed inside a guide tube 616 and acted upon by a pair of springs 613*a* and 613*b*. One spring is disposed on each side of the permanent magnet. By adjusting the linkage up or down using a rotary adjustment device 618 such as set-screw or other manual device, the position of the permanent magnet 615 relative to the piston cylinder 601 can be adjusted. In one embodiment, the guide tube 616 may be disposed perpendicularly to the piston cylinder 601. Other arrangements are possible. This allows the relationship of the magnetic field in respect to the MR fluid filled spring-loaded piston to be changed for increasing or decreasing the viscosity of the MR fluid (i.e. viscosity increasing with decreasing proximity to cylinder). This simple non-electromagnetic adjustment means can be used by the user to increase or decrease the trigger pull force required to actuate the firing mechanism of the firearm (e.g. trigger linkage 610). This would allow for a user selectable fixed trigger force profile.

By replacing the permanent magnet 615 with an electromagnet coil 614 as already described herein, one can dynamically change the MR fluid viscosity and hence resulting trigger pull force-displacement profile examples of which are shown in FIG. 1. This would allow a number of force profiles to be defined, selected, and implemented under electrical control. For example, one might want a very high trigger force when used in a self-defense, holstered, or concealed carry situation. Or one might choose a very light trigger force when target shooting, something in between when recreational shooting, or perhaps a different trigger force for the first round and lighter trigger profile for subsequent shots.

Figure 4A:
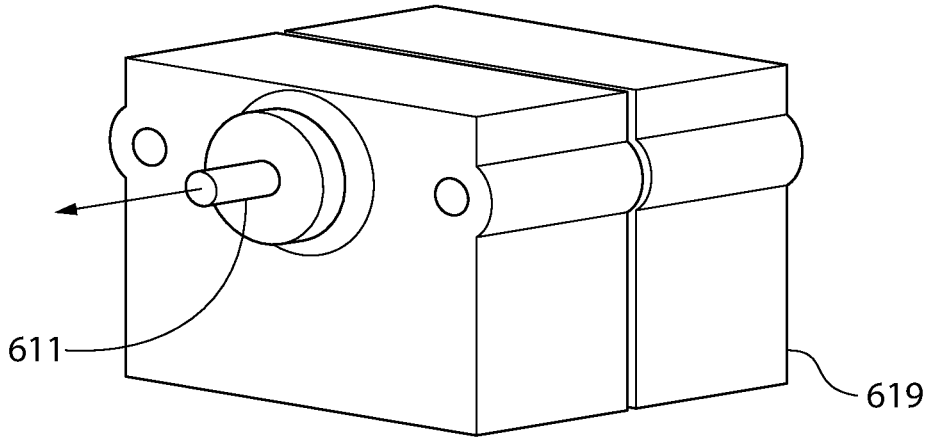
FIG. 4A is a perspective view of a housing incorporating the foregoing magnetorheological fluid piston assembly and a user-adjustable electromagnetic control device for altering the trigger pull force.
Figure 4B:
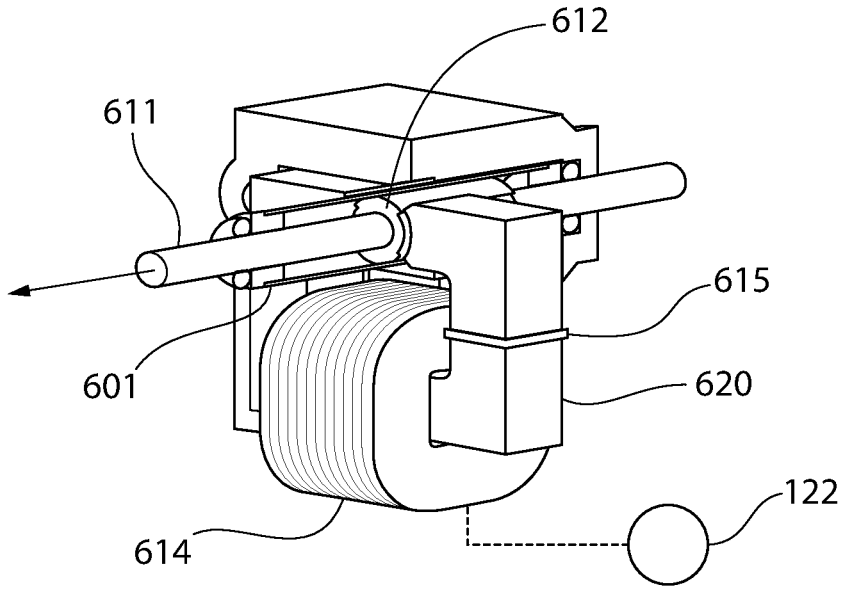
FIG. 4B is a partial cutaway view thereof showing the coiled electromagnetic device which includes a permanent magnet in greater detail.
Figure 4C:
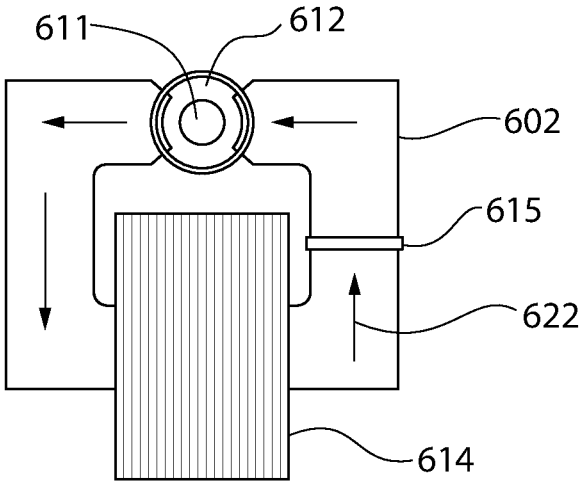
FIG. 4C is an end view thereof showing a closed loop magnetic flux path or circuit formed by the electromagnetic device incorporated with the magnetorheological fluid piston assembly.

FIGS. 4A-C depicts an embodiment of a complete electromagnetic MR fluid actuator 600 assembly according to one embodiment. The actuator 600 may be mounted at least partially or fully inside a housing 619 which is configured for mounting to a frame of a firearm. Actuator 600 further comprises a stationary magnetic yoke 620 around which the electromagnet coil 614 (shown only schematically in FIGS. 2A-D) may be wound. Coil 614 is operably connected to the power source 122, which may be a battery. In this embodiment, a permanent magnet 615 is mounted to the yoke 620 to create a static or fixed magnetic field which may be biased to automatically maintain the trigger in the upright ready-to-fire position shown in FIG. 2B when the trigger is not pulled by the user. The yoke 602 is configured to form a single closed flux loop with lines of flux represented by flux arrows 622. When energized, the coil 614 creates a secondary electromagnetic field which interacts with the static magnetic field and dynamically changes the viscosity of the MR fluid and trigger pull force required to move the trigger 608.

Figure 5:
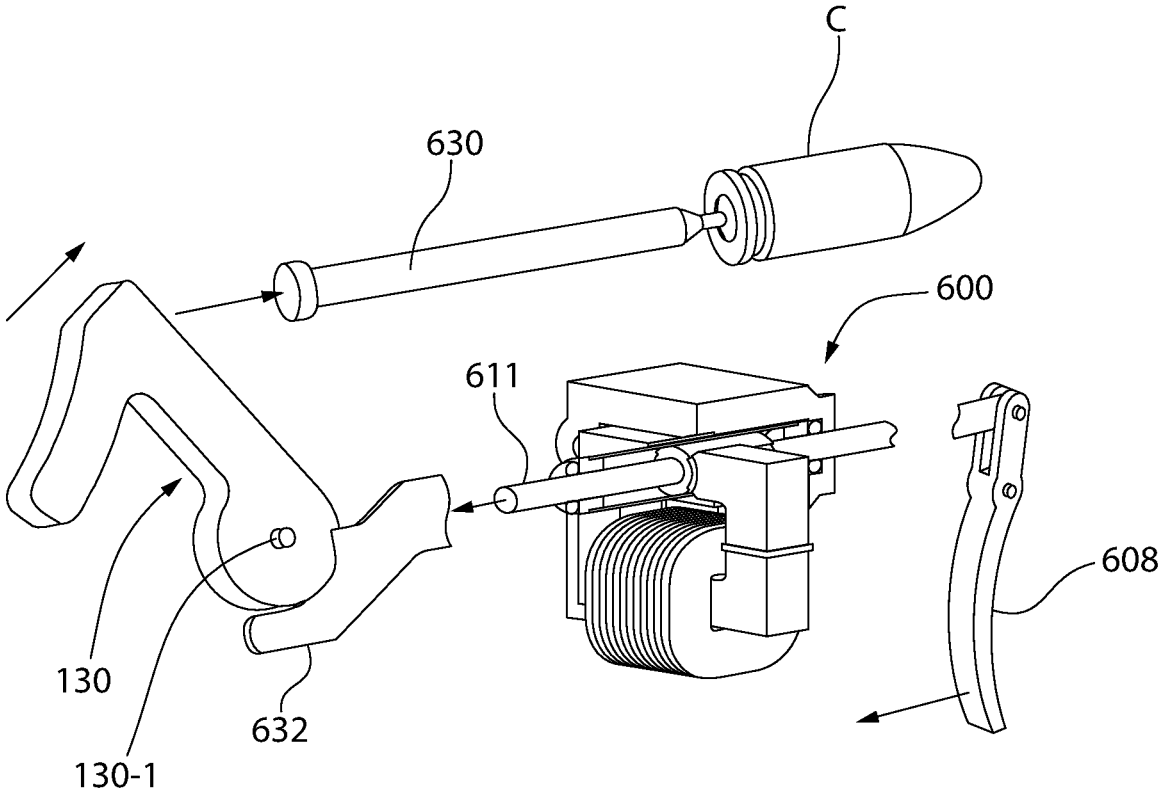
FIG. 5 is a perspective view showing the magnetorheological fluid piston assembly and electromagnetic control device incorporated in a firing mechanism or system of a firearm.

FIG. 5 shows the complete electromagnetic MR fluid actuator 600 embodied in a firing mechanism of a firearm. The firing mechanism may comprise a movable spring-biased striking member 130 which may be a rotatable hammer about hammer pin 130-1 as shown or alternatively a linear movable striker (not shown). The striking member 130 is arranged to strike the rear end of a firing pin 630 which in turn strikes a chambered ammunition cartridge C held in the barrel of the firearm. The striking member 130 is movable between a rearward cocked and forward firing position. A sear 632 is releasably engaged with the striking member 130 which is held in the cocked position by sear. The sear 632 is operably coupled to the trigger rod 611 at a rear end opposite the front end of the rod which is pivotably coupled to the trigger 608. Pulling the trigger which has a trigger pull force-displacement profile created by energizing the coil 614 moves the sear, which releases the striking member 130 to strike the firing pin and discharge the firearm. Variations of the firing mechanism are possible for use with the electromagnetic MR fluid actuator 600. The actuator 600 and its operation to energize and adjust the MR fluid viscosity and trigger pull force may be adjusted and control via a suitable programmed microcontroller 200; an example of which is discussed elsewhere herein. In some embodiments, the electromagnetic MR fluid actuator 600 may be configured to be additive during one portion or phase of the trigger pull, and changed to subtractive over another portion or phase of the pull based on the trigger displacement distance via properly configuring the control logic executed by the microcontroller which controls the electric power supplied to the electromagnet coil 614. For example, a higher initial trigger pull force may be desired for the initial portion or phase of the trigger pull and a lower pull force for the remaining portion or phase of the trigger pull as the trigger continues to move rearward. The timing of when each phase is initiated, its duration, and change in value or magnitude of the pull force required may be selected via appropriately programming and configuring the microcontroller 200.

Using multiple magnetic force concentration points, or a piston plunger port configuration that extends through an adjustable magnetic field during the full travel of the trigger, it is possible to dynamically change the viscosity (trigger force) during a single trigger pull. Such a configuration allows dynamically changing force verses displacement curves of an unlimited nature that could allow custom trigger feel optimized for certain users and use profiles.

Another embodiment related to the variable force-displacement effect is the use of MR fluids as an ON/OFF Trigger Safety. Movement of a trigger transfer mechanism would move freely through a MR fluid reservoir when no magnetic field is applied. When a magnetic field is applied to the MR fluid, its yield stress increases inhibiting movement of the trigger transfer mechanism. Ideally the use of a permanent magnet could be used as a fail-safe always on trigger safety.

In its most basic form, this could be implemented by a permanent magnet mounted on a mechanical linkage that could be manually moved in and out of the critical proximity to the MR fluid like a manual safety lever. While functional this provides no advantage over a conventional mechanical safety.

To take full advantage of the magnetic on/off nature of the MR fluid, an electro-magnet may be included to control the on/off function. This would allow an electrical signal to control the on/off function of the trigger. The reversible and almost instantaneous changes from a free-flowing liquid to a semi-solid with high yield strength would allow the safety to be electrically controlled based on control logic.

Only when an electromagnet is actuated would the effects of the permanent magnet be nulled and allow the MR fluid become more liquid and allow free movement of the trigger mechanism (reference FIG. 5).

To minimize power consumption, an enhancement to the concept would place a fixed permanent magnet in place so that the trigger linkage is in the blocked state when at rest. To reverse the MR fluid back to a flowing liquid state, a secondary electro-magnet could be energized to balance out the permanent magnets field. In this configuration, the electromagnet could enable the trigger operation at almost the point that the operator fires while using no power at any other time. The default static unpowered state of the system would be in the no-fire or ready-to-fire condition.

While the use of a MR fluid could be used as a standalone ON/OFF trigger safety feature, the preferred embodiment would combine this active safety feature with a dynamic variable force trigger configuration that acts as both an adjustable trigger force and trigger on/off safety. By applying a fixed permanent magnet field in proximity to the MR fluid filled piston, sufficient to block movement when the firearm is not require to operate, we would have the features of a firearm safety. The magnet field could then be nulled out by the addition of a reverse magnetic field using an electromagnet and thus enabling the dynamic variable force trigger features.

Embodiments of Dynamic Variable-Force Trigger Using Electromagnetic Actuators

Figure 6:
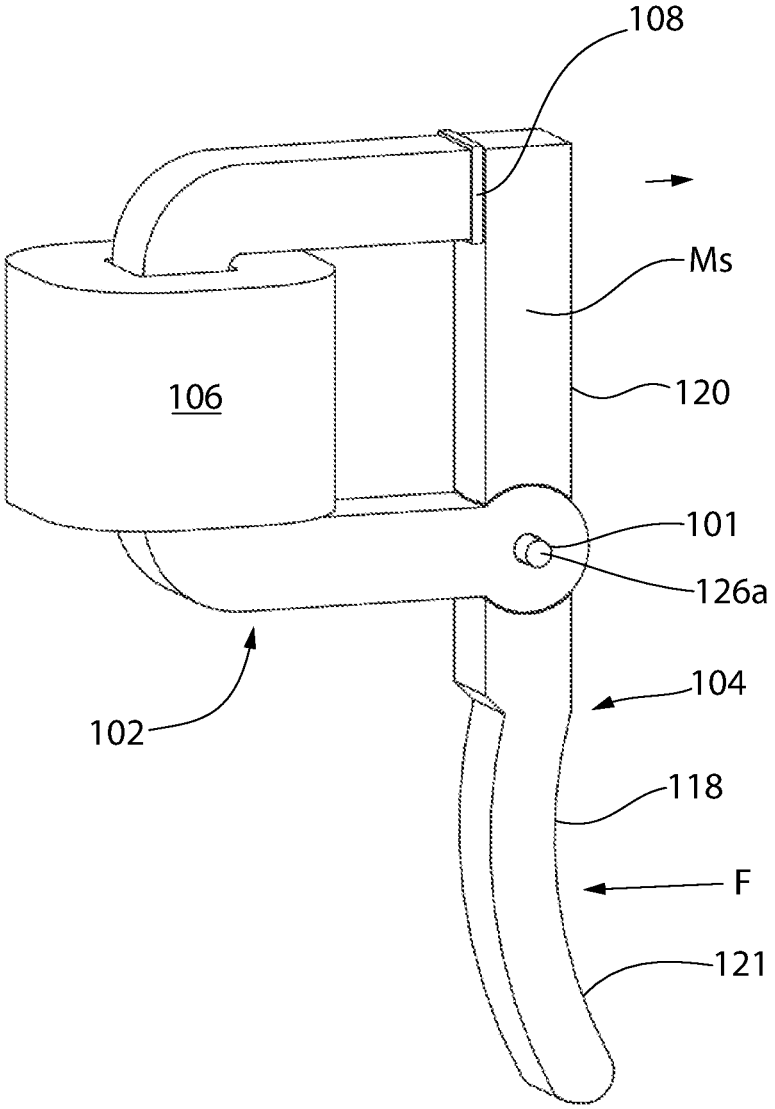
FIG. 6 is a perspective view of an electrically variable and adjustable electromagnetic trigger mechanism comprising an electromagnetic control device in the form of an electromagnetic actuator designed with a single magnetic flux loop.
Figure 7:
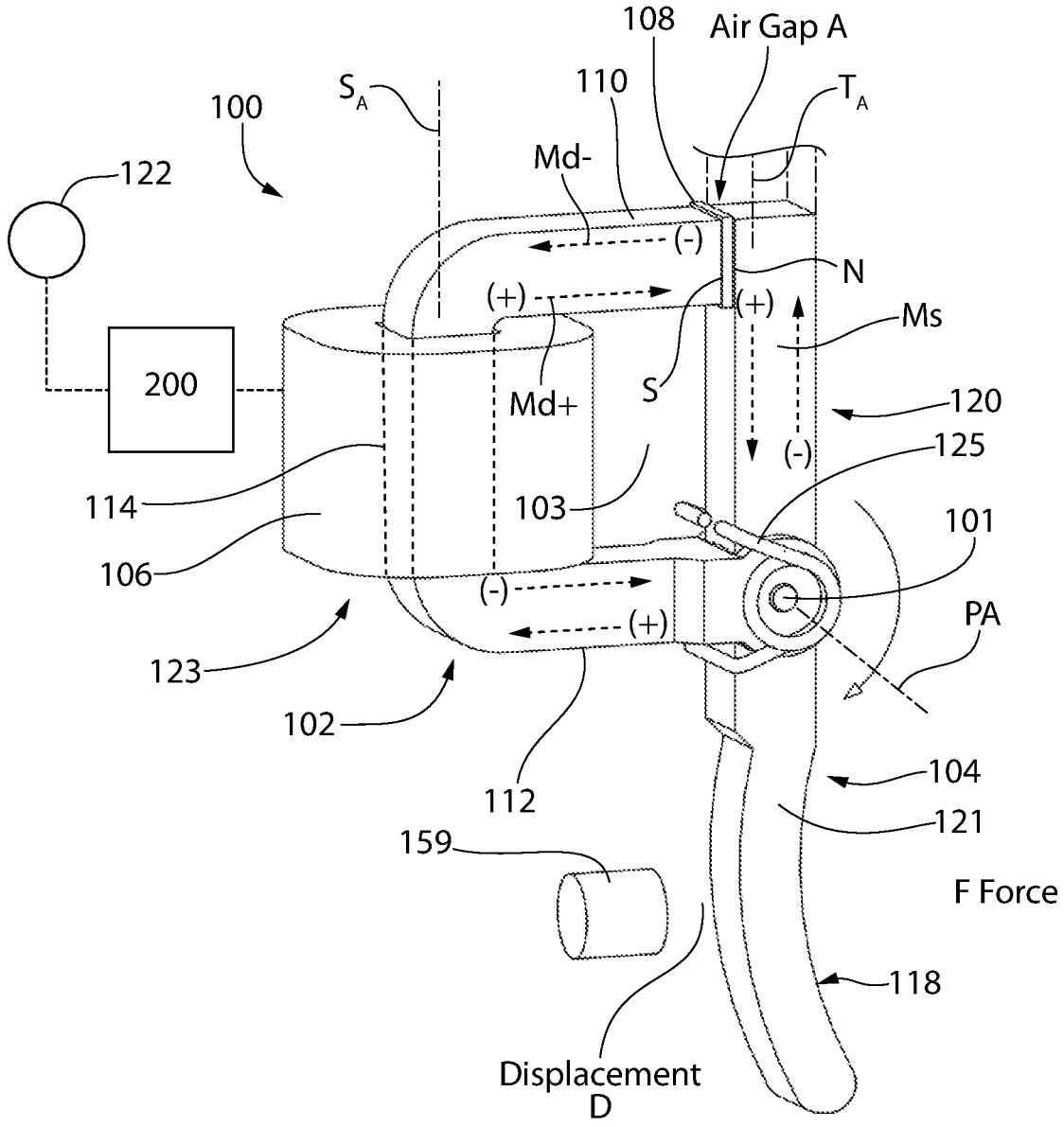
FIG. 7 is a perspective view of a second embodiment thereof adding spring assist and control feedback from a trigger displacement sensor.

Another embodiment for dynamically controlling the displacement force profile of a firearm trigger utilizes magnetic fields to directly constrain the movement of the trigger linkage until a preselected release force is reached. In one embodiment, a combination of a continuous primary static magnetic field and an intermittently acting dynamic electromagnetic field may be used. FIGS. 6 and 7 depict non-limiting examples of an electrically-variable electromagnetic trigger release mechanism or simply "electromagnetic trigger mechanism" is presented. FIG. 6 depicts a one-piece rotating trigger member whereas FIG. 7 depicts a trigger member in which an upper portion is pivotably movable relative to the lower portion.

Figure 15:
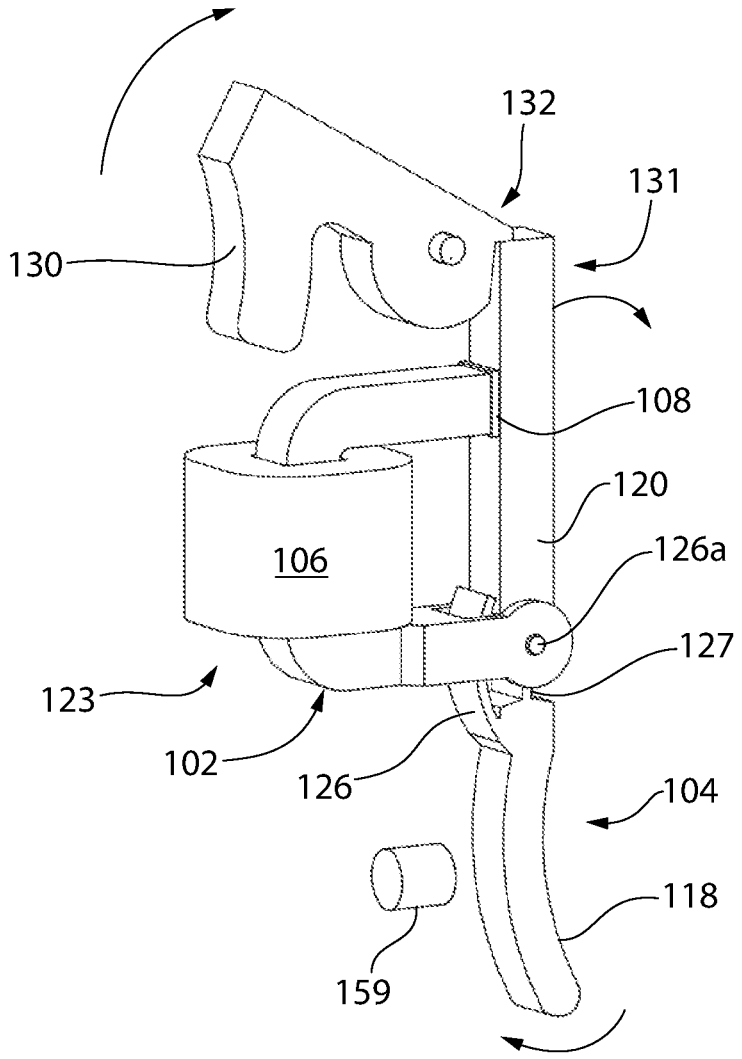
FIG. 15 is a perspective view thereof with the upper rotating member of the electromagnetic trigger mechanism configured as a sear for interacting with a firing system component for discharging the firearm.
Figure 16:
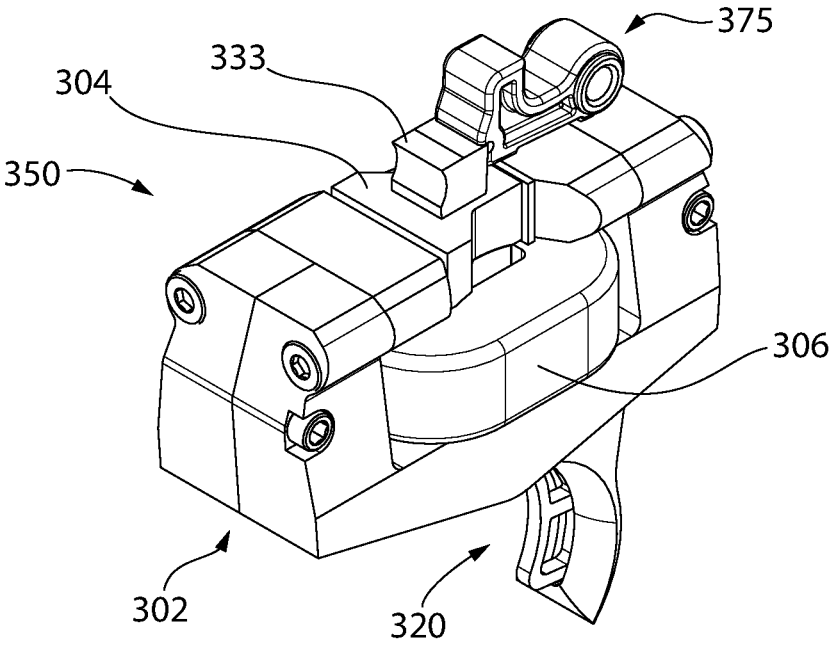
FIGS. 16 and 17 are front and rear top perspective views respectively of a second embodiment of an electromagnetic trigger mechanism comprising an electromagnetic actuator designed with a dual closed magnetic flux loop.
Figure 17:
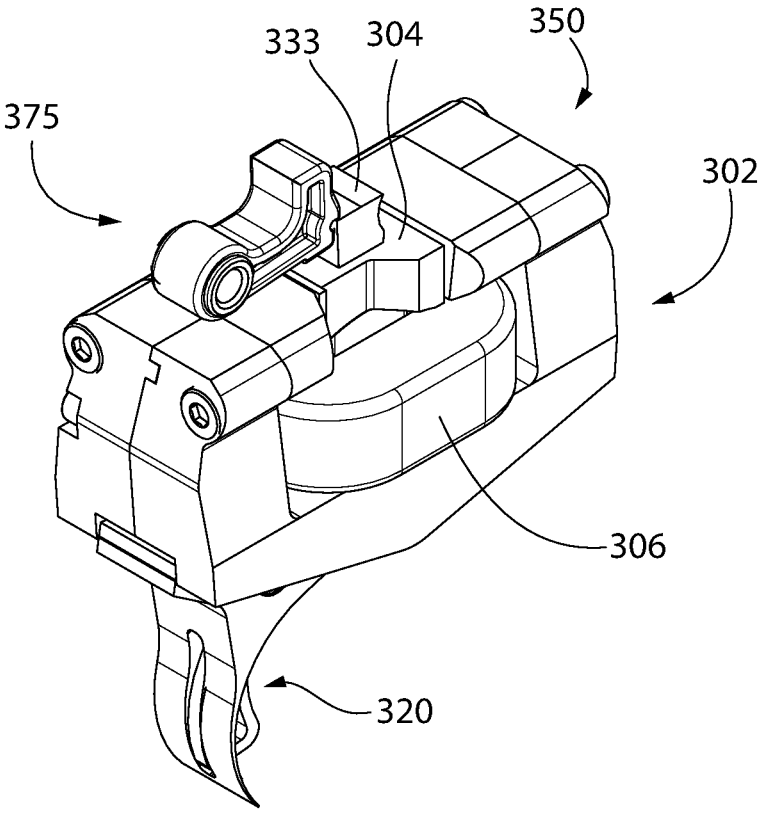
Figure 18:
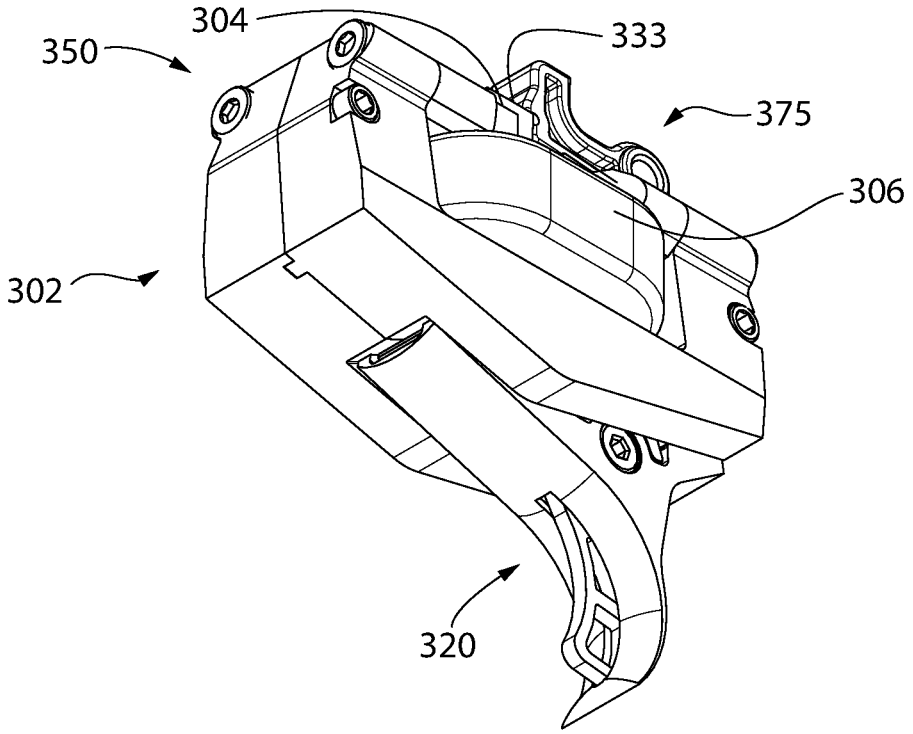
FIGS. 18 and 19 are front and rear bottom perspective views respectively thereof.
Figure 19:
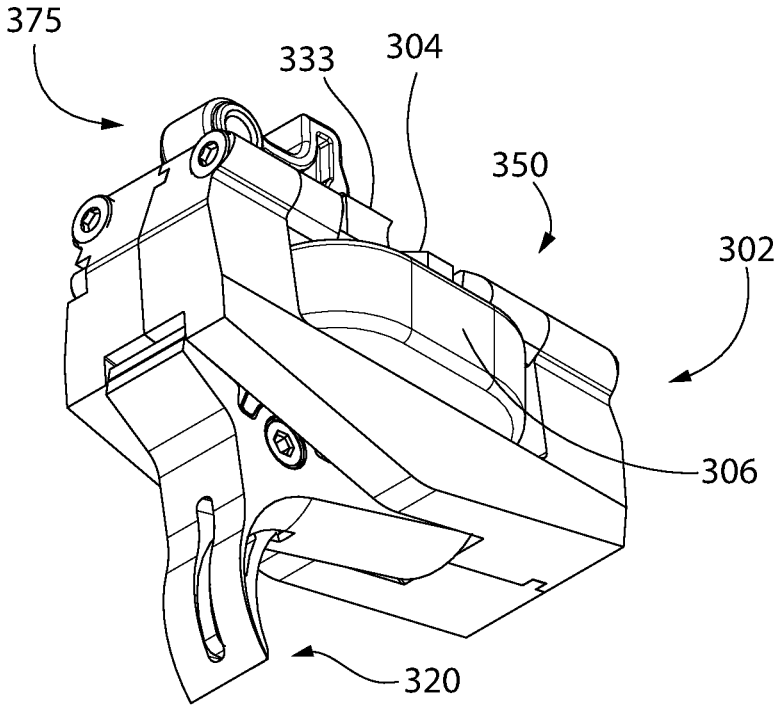

The electromagnetic trigger mechanism 100 generally comprises an electromagnetic snap actuator 123 configured as a trigger assembly for discharging the firearm. The trigger mechanism 100 forms an integral part of the firing system or mechanism of the firearm itself, and does not merely act on the firing mechanism. Actuator 123 is configured as a release type actuator which directly or indirectly releases the energy in the energy storage device such as a spring-biased striking member (e.g. rotatable hammer or linearly movable striker) operable to strike a chambered cartridge positioned in the barrel of the firearm. If a sear which releases the striking member is built directly into the release actuator 123 as shown in FIG. 15, then the actuator is directly releasing the hammer or striker. If the sear is a separate secondary component as shown in FIGS. 16-29, then the release actuator can release the sear which in turn releases the hammer or striker. In either case, energy applied to the actuator directly results in the firing of the weapon.

Referring now again to FIGS. 6 and 7, trigger mechanism 100 includes a magnetic stationary yoke 102, a rotating trigger member 104, and an electromagnet coil 106 disposed and wound around a portion of the stationary yoke. The yoke 102 may be fixedly and rigidly but removably attached to the frame 22 of the firearm 20 (see, e.g. FIG. 30), receiver 39, or trigger housing 1220 (see, e.g. FIG. 70) by any suitable manner, including for example without limitation entrapment in an open trigger unit receptacle of the frame, fasteners, couplers, pins, interlocking features, etc. The mode of attachment is not limiting of the invention. The trigger mechanism 100 may have a generally annular shape in one embodiment which is collectively formed in part by the yoke 102 and in the remaining part by the rotating trigger member 104 to form the annulus. An open central space 103 is defined by the trigger mechanism 100. This space 103 provides room for receiving a portion of the coil 106 when wound around the trigger mechanism.

The stationary yoke 102 of the electromagnetic trigger mechanism 100 may be substantially C-shaped in one embodiment including a horizontal upper portion 110, horizontal lower portion 112 spaced apart and parallel to the upper portion, and a vertical intermediate portion 114 extending between the upper and lower portions. The intermediate portion 114 is integrated with captive ends of the upper and lower portions 110, 112 being a unitary structural part of the entire yoke 102 in one embodiment. The portions 110, 112, and 114 may have any suitable transverse cross-sectional shape including polygonal such as rectilinear as shown, non-polygonal (e.g. circular), or combinations thereof which lend themselves to winding the coil 106 thereto. Although the stationary yoke 102 is illustrated herein as have a C-shaped configuration, it will be appreciated that other configurations of the yoke are possible and may be used.

The rotating trigger member 104 may have a vertically elongated and substantially linear shaped body in one embodiment as shown. The rotating trigger member 104 may lie in the same vertical reference plane as the yoke 102 and is pivotably movable within that plane. The vertical reference plane may intersect the longitudinal axis of the firearm in one embodiment.

Rotating trigger member 104 is pivotably disposed in the frame of the firearm. In one embodiment, rotating trigger member 104 may be pivotably coupled to stationary yoke 102 via pivot 101 formed by cross pin 126*a* which defines a pivot axis PA of rotation oriented transversely to the longitudinal axis LA of the firearm (see, e.g. FIG. 30). As shown in FIGS. 6 and 7, rotating trigger member 104 may be pivotably coupled to the lower portion 112 of yoke 102 at a terminal end thereof. The rotating trigger member 104 and lower portion 112 are thus each configured to receive pivot 101 therethrough for forming the pivotable coupling. Any suitable type of pivot connection may be used for pivot 101, such as without limitation a pin or rod as some examples so long as the rotating trigger member 104 may be moved relative to the yoke 102. The rotating trigger member 104 defines an axis of tilt TA which is angularly movable with respect to a stationary axis SA defined by the vertical portion 114 of yoke 102 when the trigger mechanism is activated.

It will be appreciated that in alternative embodiments, for example, the rotating trigger member 104 may alternatively be pivotably mounted to the frame 22 of the firearm 20 instead of via the pivot 101 to achieve the same manner of movement relative to the yoke 102. Either arrangement may be used in various embodiments to best fit the design of the firearm in which the trigger mechanism 100 will be used.

With continuing reference to FIGS. 6 and 7, the rotating trigger member 104 includes a lower trigger segment or portion 118 below pivot 101 and an upper working segment or portion 120 above pivot 101. These portions may simply be referred to herein as lower and upper portions 118, 120 for brevity. In the case of FIG. 7, the lower portion 118 is pivotably movable relative to the upper portion. The lower portion 118 is configured to define a trigger 121 in one embodiment, and may include an arcuately curved shape typical of some forms of a firearm trigger for better engaging a user's finger. The upper portion 120 forms part of the magnetic flux circuit of the electromagnetic trigger mechanism 100 and is arranged to selectively and releasably engage the stationary yoke 102. In one embodiment, the rear surface of the upper portion 102 is engageable with the upper portion 110 of the yoke 102 as shown. The combination of the C-shaped yoke 102 and upper portion 120 of the rotating trigger member 104 including the pivot portion including the pivot 101 collectively define an openable and closeable annulus and magnetic flux loop via operation of the trigger (see magnetic flux path arrows). The lower portion 118 therefore may be considered to extend downwards from the annulus.

In one embodiment, as shown in FIG. 15, the upper portion 120 of the rotating trigger member 104 may be vertically elongated forming an extension that projects upwards beyond the upper portion 110 of yoke 102. This extension defines a sear 131 integrally formed with the trigger member. A sear surface 132 formed on the sear 131 is operably engageable with the striking member 130 (a pivotable hammer in the illustrated embodiment) to selectively hold or release the striking member 130 in/from the rearward cocked position for discharging the firearm. The sear surface 132 may be formed on the upward facing top surface on the top end of the sear 131 in one embodiment. In this example embodiment, the striking member 130 is a pivotable hammer. In other embodiments, the striking member 130 may be linearly movable and cockable striker well known in the art which operably interfaces with the sear 131. In yet other possible implementations, the sear surface 132 may operably interface with a separately rotatable sear disposed in the firearm frame which in turn interfaces with the striking member 130 similarly to that shown in FIG. 30. Numerous other variations and locations and configurations of sears and sear surfaces on the rotating trigger member 104 may of course be used. It bears noting that the vertically elongated extension of the upper portion 120 of trigger member 104 to form sear 131 may of course be provided in any of the trigger mechanisms 100 shown in FIGS. 6, 7, 13, and 14.

The terminal end portion of upper portion 110 of yoke 102 and terminal end portion of the upper portion 120 of rotating trigger member 104 are movable together and apart via the pivoting action of the rotating trigger member 104 relative to the stationary yoke 102. Accordingly, an openable and closeable air space or gap A is formed at the interface between the yoke 102 and rotating trigger member 104. The rotating trigger member 104 is pivotably and manually movable between two actuation states or positions by a user. Rotating trigger member 104 is movable between a first unactuated or rest position physically engaged with the yoke 102 when the trigger is not pulled, and a second actuated or fire position disengaged from the yoke 102 when the trigger is pulled to discharge the firearm. In the actuated position, air gap A is opened whereas the gap is closed in the unactuated position. Also in the actuated position, the axis of tilt TA of the rotating trigger member 104 is obliquely oriented and angled to the stationary axis SA defined by yoke 102, whereas the axis of tilt TA is parallel to axis SA when the rotating trigger member is in the upright unactuated position.

With continuing reference to FIGS. 6 and 7, the electromagnet coil 103 of the trigger mechanism 100 is electrically coupled to and energized by an electric power source 122 (see, e.g. FIG. 1) of suitable voltage and current to control operation of the trigger mechanism for adjusting the trigger pull force and profile. The power source 122 is preferably mounted to the firearm and may comprise a single use or rechargeable replaceable battery in some embodiments. In one embodiment, an electric coil 106 wound primarily around and supported by the upright or vertical intermediate portion 114 of the stationary yoke 102 may be provided as shown which collectively forms an electromagnet. Operation of the trigger mechanism 100 such as for controlling the firing mechanism of a firearm or other applications is further described herein. In one embodiment, a protective casing such as an electrical resin encapsulate or potting compound may be provided to at least partially enclose and protect the coil 106.

The stationary yoke 102 and rotating trigger member 104 may be formed of any suitable soft magnetic metal capable of being magnetized, such as without limitation iron, low-carbon steel, nickel-iron, cobalt-iron, etc.

The trigger mechanism 100 in one embodiment includes a preferably strong permanent magnet 108 which creates a relatively high threshold static magnetic attractive or holding force between the yoke 102 and rotating trigger member 104 which acts to draw these two components into mutual engagement. This static and primary resistance force created by the magnetic field between yoke and trigger member acts to inhibit movement of the rotating trigger member 104 about its pivot axis PA between its two actuation positions when trigger 121 is pulled by a user. The magnetically-induced static resistance corresponds to a trigger pull force required to be exerted and surpassed by the user in order to rotate the trigger member sufficiently to discharge the firearm. The magnet 108 may have a flat rectilinear plate-like shape in one embodiment; however, other shapes may be used. Magnet 108 biases the rotating trigger member 104 into the first unactuated position engaged with the upper portion 110 of yoke 102 at magnet 108.

Permanent magnet 108 may be disposed anywhere within the magnetic loop formed by the yoke 102 and the movable upper portion 120 of rotating trigger member 104. In one embodiment, the magnet 108 may be mounted on the front terminal end of the upper portion 110 of the yoke. Alternatively, the magnet 108 may be disposed on the rear surface of the rotating trigger member 104 and positioned to engage upper portion 110 of the yoke 102. The magnet 108 may therefore be interposed directly between the movable upper portion 120 of the rotating trigger member 104 and stationary yoke 102 to maximize the magnetic attraction of the rotating trigger member to the magnet 108. Other less preferred but still satisfactory locations for mounting the magnet 108 on yoke 102 may alternatively be used. Magnet 108 preferably may be dimensioned and has a cross-sectional area approximately commensurate with and similar to the dimensions and cross-sectional area of the yoke 102 or rotating trigger member in or on which the magnet is arranged.

The present invention further provides a user-selectable and dynamically variable secondary electromagnetic field generated when the electromagnetic actuator 123 is energized. This secondary electromagnetic field interacts with the primary static magnetic field produced by the permanent magnet 108. By electrically and preferentially biasing the magnet flux in the closed loop of the actuator 123 to add or detract from the static magnetic field using the actuator's electromagnet, a dynamically variable trigger pull force or resistance and profile is created which can be selected by the user to meet personal preferences. When coil 106 of the trigger mechanism snap actuator 123 is not energized, a trigger pull force sufficient to only overcome the primary fixed or static magnetic field force of the permanent magnet 108 on the rotating trigger member 104 would be needed to initiate and displace the trigger through a trigger pull event. This allows the trigger member to be actuated in the event power is lost to the actuator 123 (e.g. depleted battery charge).

Electrical energy supplied to the actuator coil 103 and its concomitant dynamically changeable electromagnetic field created when the coil is energized can be made additive or subtractive to the static magnetic field flux generated by the permanent magnet 108 such as by changing the polarity of the electric power. For example, if the user wishes to increase the pull force required over a portion of the travel or displacement of the trigger, the microcontroller 200 may be programmed to change polarity of power source 122 to make the electromagnetic field of the snap actuator additive. In such a setup, the electromagnetic lines of flux of the actuator when energized circulate and act in the same direction in the single closed flux loop as the static magnetic flux generated in the trigger mechanism 100 by the permanent magnet 108. The flux density increases at the air gap A. This increases the magnetic attraction between the yoke 102 and rotating trigger member 104, thereby concomitantly increasing the resistance to rotation of the trigger member by the user making it harder to further pull the trigger (i.e. heavier trigger pull).

Conversely, if the user wishes to decrease the pull force over the travel of the trigger, the microcontroller may be programmed to change polarity of power source 122 to make the electromagnetic field of the snap actuator subtractive. In such a setup, the electromagnetic lines of flux of the actuator when energized circulate and act in the opposite direction in the closed flux loop as the static magnetic flux generated in the trigger mechanism 100 by the permanent magnet 108. The flux density decreases at the air gap A. This decreases the magnetic attraction between the yoke 102 and rotating trigger member 104, thereby concomitantly decreasing the resistance to rotation of the trigger member by the user making it easier to further pull the trigger (i.e. light trigger pull).

The magnitude of the peak trigger pull force required to fully actuate the electromagnetic trigger mechanism 100 may also be altered by the user. This may be achieved in one embodiment by configuring the actuation control circuit 202 associated with microcontroller 200 to increase or decrease the output voltage to the electromagnet coil 106 of snap actuator 123 from power source 122 which passes through and is controlled by the actuation control circuit 202 (reference FIG. 9). This results in either a decrease or increase in the peak trigger pull force required to be exerted on the rotating trigger member 104 by the user to pull and fully actuate the trigger mechanism 100. This parameter may be configured in conjunction with preprogramming the actuator 123 to operate the secondary electromagnetic field in either the additive or subtractive mode described above, thereby advantageously creating a highly customized the trigger pull force-displacement profile or curve in accord with user preferences.

It bears noting that inclusion of the permanent magnet 108 also advantageously conserves energy by reducing power consumption. The static magnetic field of the permanent magnet 108 automatically maintains the rotating trigger member 104 of electromagnetic trigger mechanism in the unactuated state or position at rest. Accordingly, the magnetic field generated when the coil 106 of the trigger mechanism snap actuator 123 is energized is not required at all times such as when the trigger 121 is not pulled to simply hold the rotating trigger member 104 in the vertical unactuated state or position. To minimize power consumption, the trigger mechanism actuator therefore only needs to be energized once the trigger (i.e. rotating trigger member 104) is pulled, which is sensed by trigger sensor 159 and the control system. After the trigger pull is completed and the firearm is discharged, the actuator coil may be de-energized until the next trigger pull cycle. This arrangement and mode of operation advantageously extends battery life of the power source 122. Accordingly, the permanent magnet 108 provides energy conservation benefits in addition to creating the initial trigger pull force and primary resistance to movement of the electromagnetic trigger mechanism 100.

As shown in FIG. 7, the stationary yoke 102 and rotating trigger member 104 of the snap actuator 123 are configured to create a magnetic circuit having a single closed flux loop or path. By orienting the north pole N and south pole S of permanent magnet 108 in any direction, a magnetic static holding force is created which draws the rotating member 104 to the stationary yoke 102. As one non-limiting example, assuming the north pole N were facing towards the rotating trigger member 104 as illustrated, the static magnetic flux circulates or flows through the flux circuit between the north and south magnetic poles in the clockwise direction indicated by solid static magnetic flux field arrows Ms. This draws the rotating member 104 and yoke 102 together at permanent magnet 108 to hold the trigger mechanism in the unactuated ready-to-fire position shown. When the power source 122 is configured via microcontroller 200 to operate in the "additive" mode as previously described (based on the polarity of the electric pulse sent to the actuator), the dynamic or active magnetic flux circulates or flows through the flux circuit when energized in the same clockwise direction indicated by dashed dynamic magnetic flux arrows "Md+". This intensifies and increases the magnetic field and attraction between the yoke 102 and rotating member 104 which equates to a greater trigger pull force requirement to fully actuate the trigger mechanism. Conversely, when the power source 122 is configured by microcontroller 200 to operate in the "subtractive" mode as previously described (based on a reverse polarity of the electric pulse sent to the actuator), the dynamic or active magnetic flux circulates or flows through the flux circuit when energized in the opposite counterclockwise direction indicated by dashed dynamic magnetic flux arrows "Md-". This lessens or decreases the magnetic field and attraction between the yoke 102 and rotating member 104, which equates to a lesser trigger pull force (i.e. resistance) required by the user to fully actuate the trigger mechanism. In some embodiments, the active magazine flux field can complete the trigger pull for the user upon detection of a trigger pull event. It bears noting that the actuator 123 would still operate in a similar manner if the north N and south S poles of permanent magnet 108 were reversed from the illustrated position which still creates a magnetic attractive force pulling the rotating member 104 to the yoke 102.

Figure 9:
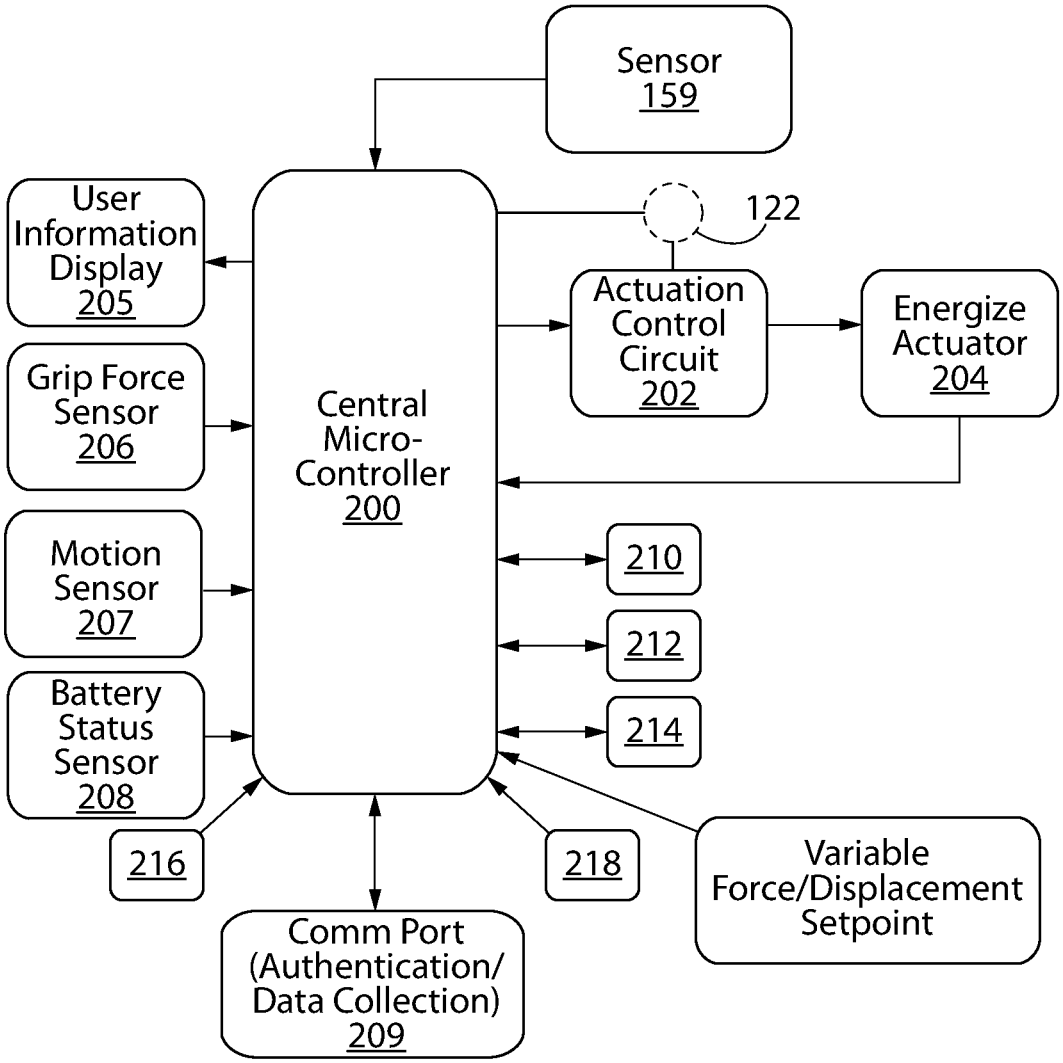
FIG. 9 is a system block diagram of the programmable microcontroller based control system for monitoring and operating the electromagnetic trigger mechanism.

FIG. 9 shows one non-limiting embodiment of a control system which enables user selectable, programmable, and precisely timed adjustment of the trigger pull force/displacement profile during a trigger pull event via application of electric control current to the electromagnetic actuator 123 of the trigger mechanism 100. The control system includes programmable microcontroller 200 for monitoring and controlling operation of the electromagnetic trigger mechanism snap actuator and other aspect of the firearm operation in general. An actuation control circuit 202 operably coupled to power source 122 forms a control interface between the microcontroller 200 and electromagnetic actuator 123. In some configurations, the microcontroller 200 may actually from an integral part of the actuation control circuit 202 which is mounted on the same circuit board as opposed to being a separate component electrically coupled to the control circuit. This creates a "smart" control circuit 202.

Microcontroller 200 includes a programmable processor 210, a volatile memory 212, and non-volatile memory 214. The non-volatile memory 214 may be any type of non-removable or removable semi-conductor non-transient computer readable memory or media. Both the volatile memory 212 and the non-volatile memory 214 may be used for saving sensor data received by the microcontroller 200, for storing program instructions (e.g. control logic or software), and storing operating parameters (e.g. baseline parameters or setpoints) associated with operation of the actuator control system. The programmable microcontroller 200 may be communicably and operably coupled to a user display 205, a geolocation module 216 (GPS), grip force sensor 206, motion sensor 207, battery status sensor 208, audio module 218 to generate sound, and a communication module 209 configured for wired and/or wireless communications with other off-firearm external electronic devices configured to interface with the microcontroller. The geolocation module 161 generates a geolocation signal, which identifies the geolocation of the firearm (to which the programmable controller is attached), and communicates the geolocation signal to the programmable microcontroller 200, which in turn may communicate its location to a remote access device. The audio module 218 may be configured to generate suitable audible alert sounds or signals to the user such as confirming activation of the actuator system, successful or failed system access attempts, component failure attention alerts, or other useful status information.

The communication module 209 comprises a communication port providing an input/output interface which is configured to enable two-way communications with the microcontroller and system. The communication module 163 further enables the programmable microcontroller 200 to communicate wirelessly or wired with other external electronic devices directly and/or over a wide area network (e.g. local area network, internet, etc.). Such remote devices may include for example cellular phones, wearable devices (e.g. watches wrist bands, etc.), key fobs, tablets, notebooks, computers, servers, or the like.

The display 205 may be a static or touch sensitive display in some embodiments of any suitable type for facilitating interaction with an operator. In other embodiments, the display may simply comprise status/action LEDs, lights, and/or indicators. In certain embodiments, the display 205 may be omitted and the programmable microcontroller 200 may communicate with a remote programmable user device via a wired or wireless connection using the wireless communication module 209 and use a display included with that remote unit for displaying information about the actuator system and firearm status.

Besides a battery sensor 208 and trigger sensor(s) 159, the additional sensors noted above which are operably and communicably connected to microcontroller 200 may be used to enhance operation in some embodiments. In one example, a grip force sensor 206 may be used to wake up the microcontroller 200 (e.g. usable in Step 502 of control logic process 500 in FIG. 8).

An intentional trigger pull to discharge the firearm may be sensed or detected in one embodiment via one or more trigger sensors 159. At least one trigger sensor is provided. Sensor 159 is positioned proximate to rotating trigger member 104 and operable to detect movement of the trigger such as by direct engagement or proximity detection. In some embodiments, the trigger sensor 159 may be a displacement type sensor configured to sensing movement and displacement position of the trigger during its travel. Sensor 159 may alternatively be a force sensing type sensor operable to sense and measure the trigger pull force F exerted on the trigger by the user. A force sensing resistor may used in some embodiments. Trigger sensor 159 is operably and communicably connected to the microcontroller 200 via wired and/or wireless communication links 201 (represented by the directional arrowed lines shown in FIG. 9).

Another example of potentially desirable sensors is an accelerometer or other motion sensing device such as motion sensor 207 if the firearm is moved the user indicating potential onset of a intentional firing event. By monitoring the acceleration or motion of the firearm, the sensor 207 may be used may be used in addition to or instead of grip force sensor 206 to wake up the microcontroller 200 (e.g. usable in Step 502 of control logic process 500 in FIG. 8).

One possible enhancement to the firearm control would be to sense the movement of the trigger using sensors 159 and actuate the firing event prior to the operator feeling the end of travel of a mechanical trigger when using the actuator in a firing mechanism release role as further described herein. This would enhance trigger follow-through and greatly reduce the operator effects of flinching as the firing event approaches. Additionally, since precise trigger event timing can be provided independent of the firing actuation event, the same firing actuator can be used with many different trigger force and displacement profiles.

Figure 10A:
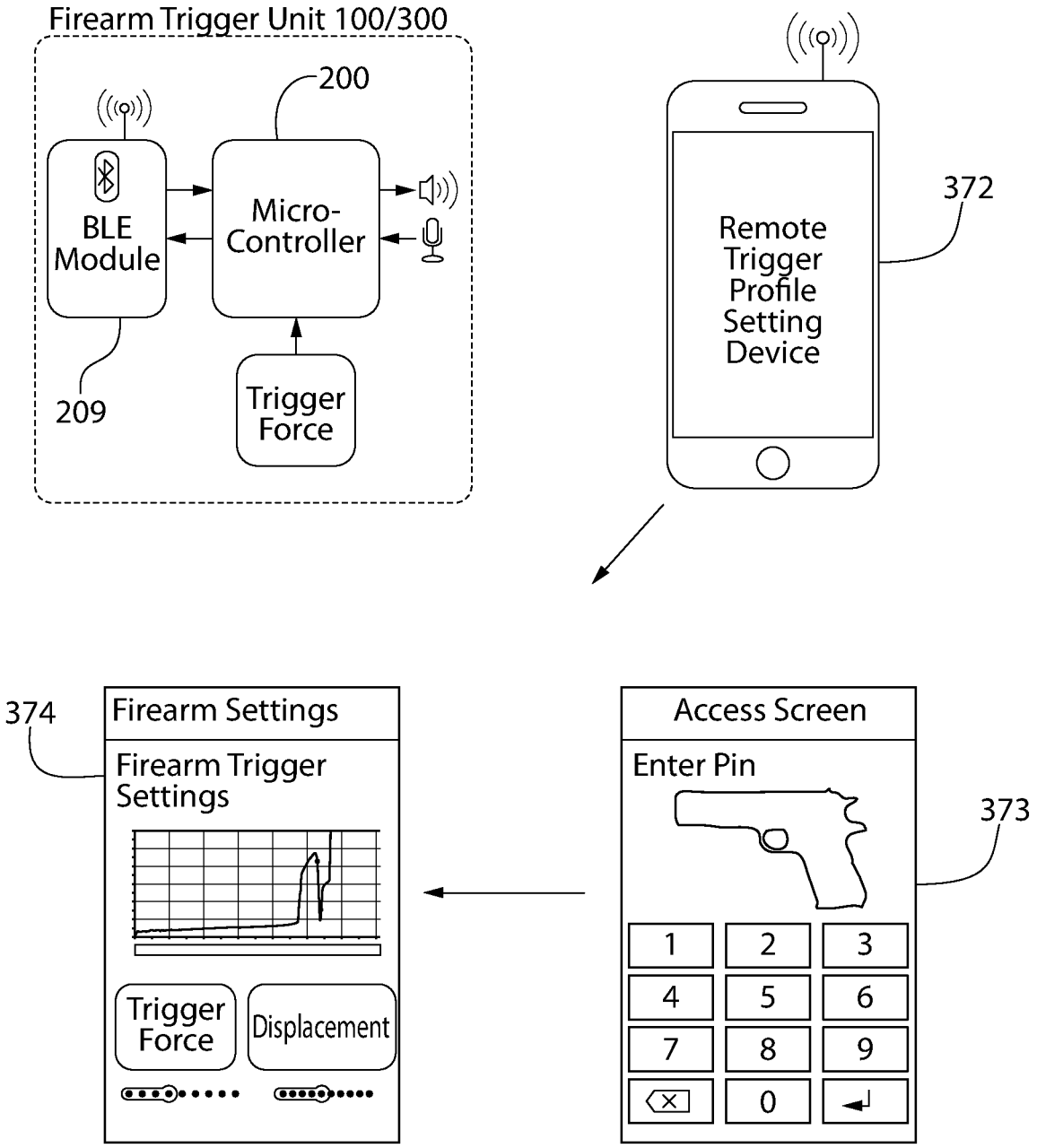
FIG. 10A is a diagram showing a wireless communication and control system interfacing with the microcontroller for use with the electromagnetic trigger mechanism which is programmable via an external/remote electronic device.
Figure 11:
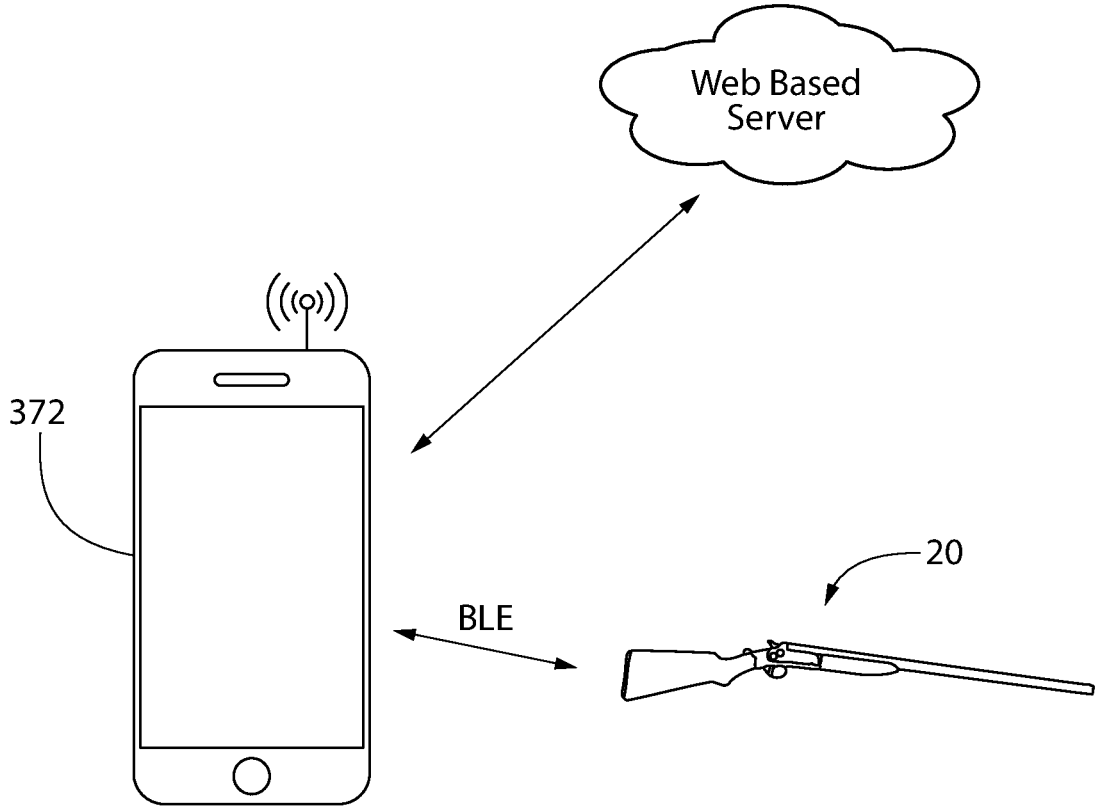
FIG. 11 is a diagram showing a variable force trigger wireless data collection and communication smart application.

One enhancement to the control system disclosed herein is the inclusion of one or more wireless communications options in some embodiments such as Bluetooth® (BLE), Near-Field Communication (NFC), LoRa, Wifi, etc. implemented via communications module 209 (see, e.g. FIGS. 9 and 10A). This would allow the collection of data such as rounds fired, attempted fires, acceleration forces, performance data, maintenance data, and timing and authorization events. This data could be wirelessly shared with a cellphone or other external electronic data processing/communication device, or even directly through a WiFi hub as shown in FIG. 11. In addition, operation of the electromagnetic actuator system including programming of the trigger pull force and displacement profile in the microcontroller 200 on the firearm may be programmed and controlled via the remote device.

Referring now to FIG. 7, further energy conservation and repeatability enhancements can be achieved by adding a spring 125 or other resiliently flexible member to the system, and the addition of a trigger displacement sensor 159. Spring 125 may be configured and arranged to bias the lower portion 118 (i.e. trigger 121) upper portion 120 of the rotating trigger member 104 forward to the ready-to-fire (unactuated) position relative to the upper portion 120. The static magnetic field generated by the permanent magnet 108 conversely holds the separately pivotable upper portion 120 of rotating trigger member 104 rearward towards the yoke 102 in the unactuated position. In various embodiments, the spring 125 may be a linear spring having a linear relationship between force and displacement, or a non-linear spring which changes spring force during trigger travel as further described herein elsewhere with respect to alternate spring 126. The spring 125 acts as a "buffer" for the magnetically-applied force on the upper member. The spring also provides the uniform feel of the trigger pull. Spring 125 may be a linear torsion spring in one embodiment as illustrated. The force "F" needed to extend or compress the spring 125, or other flexible member, by a distance "X" is proportional to that distance multiplied by the spring constant "k" (per Hooke's Law) and provides an additional force opposed to the permanent magnet 108 static holding force. In operation, as the trigger 121 (i.e. lower portion 118) is pulled and displaced against the biasing force of spring 125 with the separately pivotable upper portion 120 remaining stationary and engaged with permanent magnet 108, a displacement sensor 159 determines the threshold position during trigger travel (i.e. displacement distance) for energizing the electromagnet coil 106 of the snap actuator 123. At this point, the electromagnet coil is electrically energized to cancel out the static holding force or primary resistance created by permanent magnet 108 and creates a crisp snap-like final movement of the trigger linkage. As described elsewhere herein, permanent magnet 108 provides the primary or static magnetic field that directly constrains the movement of the trigger linkage at the beginning of the trigger travel. In this present embodiment, the final trip force is selectable by sensing the desired displacement/force point to electrically break-over the electromagnetic snap actuator 123 prior to reaching the magnetic flux open-loop break-over point of the permanent magnet.

As the trigger 121 moves rearward and is displaced against the mechanical Hooke's law force of the spring 125, the trigger 121 (defined by rotating trigger member 104) can be released at any point during its travel by energizing the electromagnetic trigger mechanism 100 through the use of feedback to the microcontroller 200 provided by a trigger displacement sensor 159 operably and communicably coupled to the microcontroller. As the desired preprogrammed set-point is reached which is sensed by displacement sensor 159 and received by microcontroller 200, the trigger 121 is released via the microcontroller energizing the electro magnetic coil 106 in a fast snap-like action that initiates the trigger movement transfer means to activate the firing mechanism such as by releasing the striking member 130 directly engaged by the trigger mechanism 100 (see, e.g. FIG. 15), or an intermediate sear operably linked between the trigger mechanism 100 and striking member which holds the striking member in the rearward cocked position (see, e.g. FIG. 30).

It should be noted that spring 125 if provided affects and establishes a mechanically-based component of the force/displacement profile for the trigger 121. Permanent magnet 108 may be considered to establish a magnetically-based component of the force/displacement profile. In one embodiment, spring 125 acts in a biasing direction counter to the holding force created by permanent magnet 108. Spring 125 therefore acts in such an arrangement to assist the user in pulling the trigger against the static magnet holding field of the magnet 108. Permanent magnet 108 acts to reset the rotating trigger member to the vertical unactuated position after a trigger pull event even in embodiments without a spring which may be sufficiently fast acting to support multiple trigger pulls in rapid succession. As a corollary, it bears noting that the trigger 121 of the snap actuator trigger mechanism 100 is not returned to the unactuated position by the microcontroller 200 and power source 122. Instead, the magnet 108 and/or other mechanical means (e.g. springs) that might be provided are used to reset the trigger. This allows the actuator coil 106 to be de-energized at the end of the full trigger travel or displacement until needed during the next trigger pull event, which conserves battery power.

Additional enhancements can be combined to alter and/or improve the trigger feel. In one embodiment, a segmented trigger design shown in FIGS. 13A-B may be used to create a non-linear trigger force displacement curve using a non-linear spring 126 or other resiliently flexible member and the electromagnetic snap actuator 123 of trigger mechanism. In this embodiment, the upper segment or portion 120 of the rotating trigger member 104 is pivotably coupled to and independently movable relative to the lower segment or portion 118. Spring 126 has a fixed end rigidly attached to or formed integral with the lower portion 118 of trigger member 104 and a free end engaged with the upper portion 120 of the trigger member. Spring 126 engages the rear surfaces of the upper and lower portions 120, 118 which acts to bias the trigger forward to the ready-to-fire vertical position.

In operation, as the trigger (i.e. lower portion 118) is displaced against the biasing force of spring 126 with the separately pivotable upper portion 120 remaining stationary and engaged with permanent magnet 108, a displacement sensor 159 determines the threshold position during trigger travel (i.e. displacement distance) for energizing the electromagnet coil 106 in the snap actuator. At this point, the electromagnet coil is electrically energized to cancel out the permanent magnet 108 generated static holding force or primary resistance and creates a crisp snap-like final movement of the trigger linkage. The final trip force is selectable by sensing the desired displacement/force point to electrically break-over the electromagnetic snap actuator prior to reaching the magnetic flux open-loop break-over point of the permanent magnet.

Figure 12:
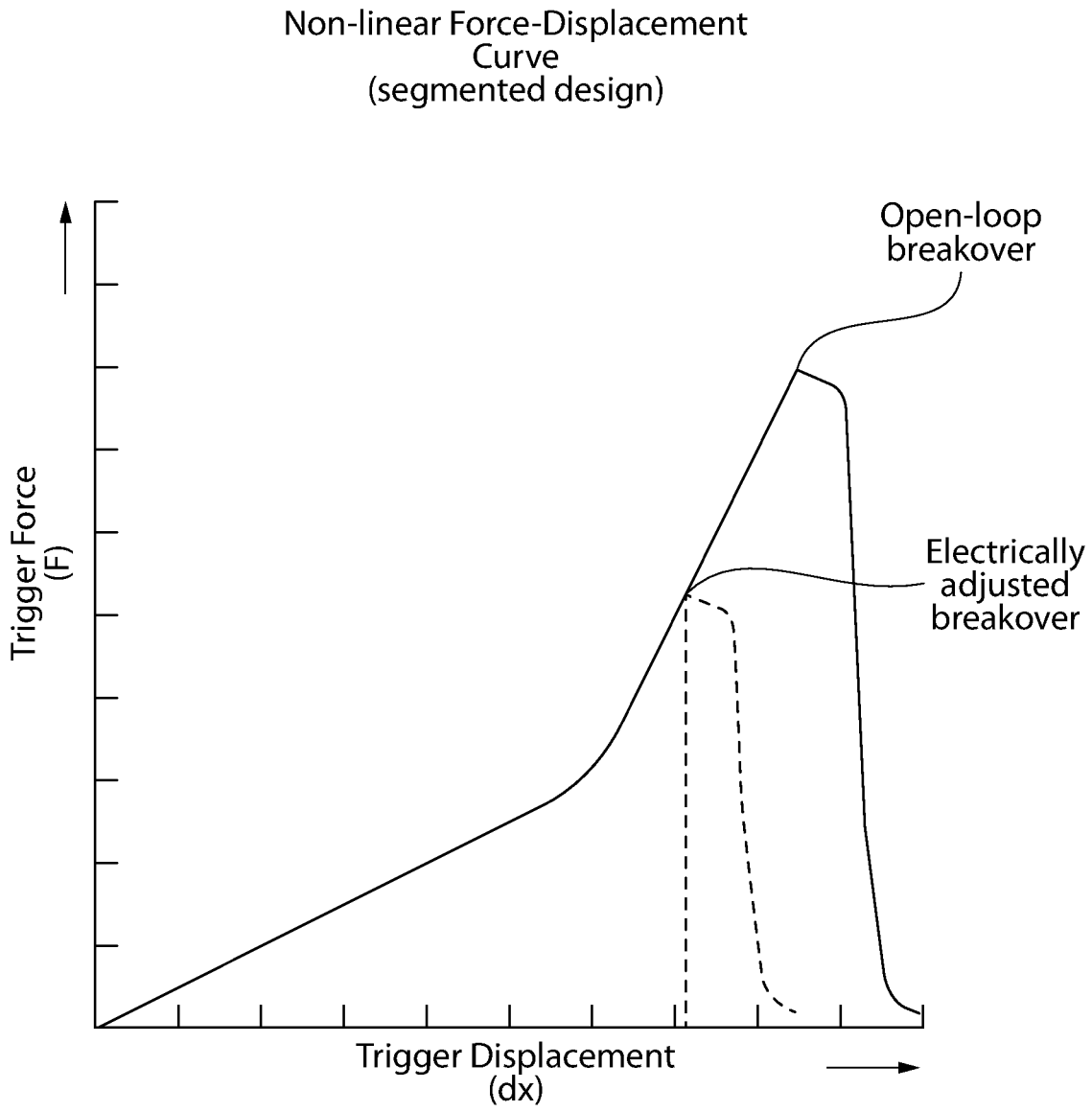
FIG. 12 is a graph of trigger pull force versus displacement (travel or distance) of a non-linear force displacement curve for a segmented trigger design.
Figure 13A:
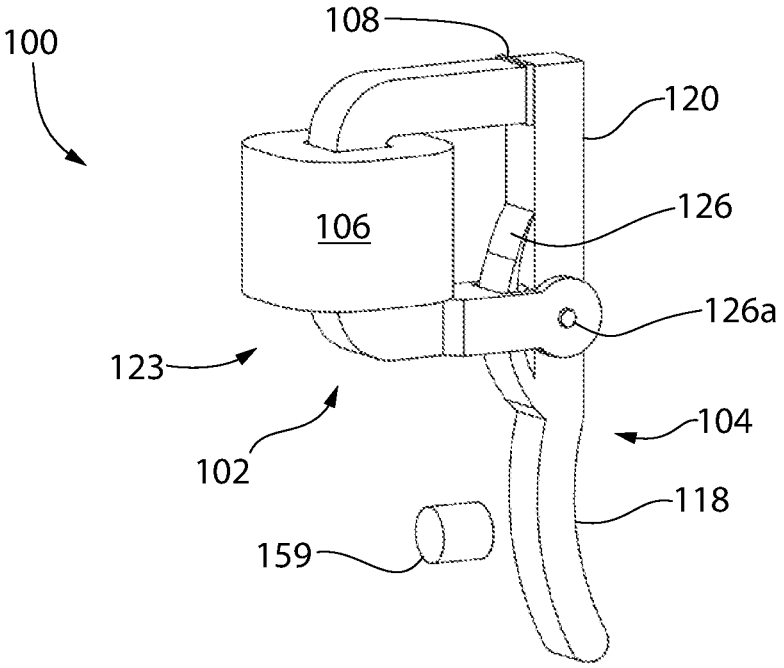
FIG. 13A is a perspective view of an electrically variable and adjustable electromagnetic trigger mechanism comprising an electromagnetic control device and including a non-linear leaf spring.
Figure 13B:
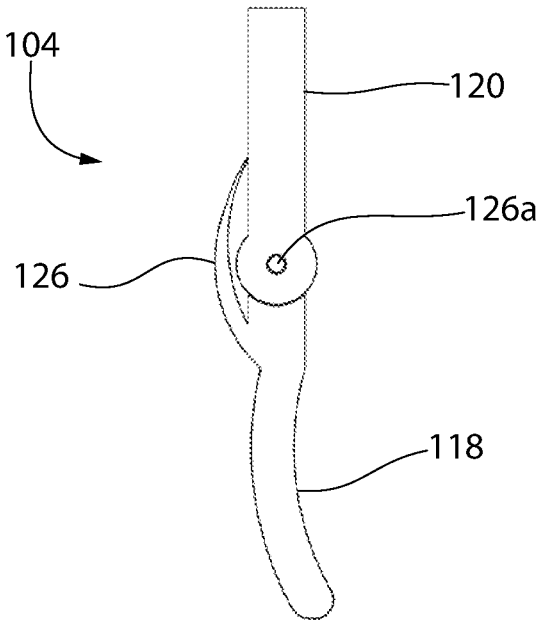
FIG. 13B is a side view of the trigger member thereof in isolation.

FIG. 12 shows a representative non-linear force-displacement curve for the proposed segmented trigger design of FIGS. 13A-B. A non-linear means or mechanism such as a combination of springs, flexible members and linkages is used to create the trigger displacement profile shown and the displacement sensor 159 is used to adjust the point at which the electrical trigger's break-over point in tripped. In the event of a failure of the electrical system, the default open-loop break-over point will provide a higher force trip point as a default operating point for the trigger. Many variations of the force-displacement curve could be possible using different springs, flexible members, and linkages.

In FIGS. 13A-B, the non-linear displacement force curve characteristics are achieved using a non-linear leaf spring 126. The first portion of the segmented trigger force-displacement curve is defined by the characteristics of the deformation of the non-linear leaf spring. When the trigger travel or displacement reaches and crosses the desired set-point, as measured using the trigger displacement trigger sensor 159 and relayed to the microcontroller 200, an electrical signal to the actuator triggered by the microcontroller snaps the upper segment of the trigger forward to interact with a traditional trigger bar linkage, sear, or alternative firing means. Although a leaf spring 126 is disclosed herein as an example of a spring exhibiting a non-linear relationship between force and displacement, other types of non-linear springs may be used such as for example without limitation a non-linear dual pitch helical coil springs, conical/tapered springs, barrel compression springs, etc.

Figure 14A:
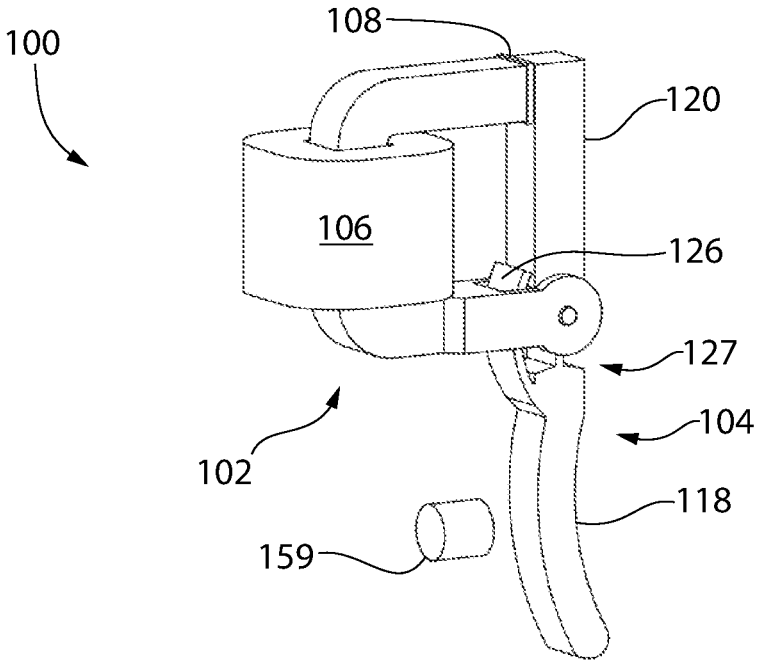
FIG. 14A is a perspective view thereof including a secondary spring flexing member joining an upper rotating member of the trigger mechanism with a lower trigger member.
Figure 14B:
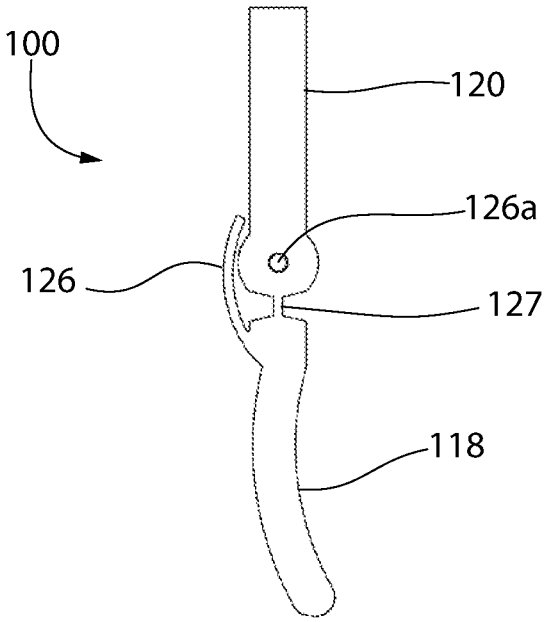
FIG. 14B is a side view of the trigger member thereof in isolation.

FIGS. 14A-B shows another possible embodiment of the invention where the non-linear displacement force curve characteristics are achieved using a flexing member 127 combined with a secondary non-linear leaf spring 126. In this construction, the upper segment or portion 120 of rotating trigger member 104 is hingedly connected to the lower segment or portion 118 by a structurally integral portion of the trigger member body have a reduced transverse cross section in comparison to the upper and lower portions. The cross-sectional shape may be rectilinear in one embodiment. This creates a resiliently flexible and spring-like connection between the upper and lower portions of the rotating trigger member 104. Flexing member 127 acts as a elastically deformable living hinge. Other optional means for creating different force-displacement trigger profiles, before the magnetic break-over trip point, can be easily integrated with the magnetic snap actuation of the trigger mechanism 100 to those skilled in firearm trigger design. This could include the novel application of the magnetic snap actuation combined with mechanical trigger means used in traditional non-adjustable trigger designs. An apparent extension of the embodiment would include the application of the magnetic snap actuation combined with adjustable traditional mechanical trigger designs in a hybrid trigger design.

FIG. 15 shows the non-linear segmented trigger mechanism 100 with snap action magnetic break-over design used as a low-force sear surface and integrated into the release of a firearm striking member 130 in the form of a pivotable hammer, already described in detail above. This represents one non-limiting example of how the variable force trigger actuator could interface with existing firearm firing mechanism designs. Those skilled in firearm design can easily adapt this modular design to interface with other firing mechanisms as a direct replacement for the trigger mechanism.

The trigger member 104 in FIGS. 7 and 13-15 commonly share the design feature that the upper portion 120 of the trigger member is moveable independently of the lower portion 118 below the pivot 101 which is configured for a user's finger grip. Accordingly, in such a case, the upper portion 120 may alternatively be considered as simply a rotating member of the electromagnetic actuator 123 which is coupled to the trigger formed by the lower portion 118.

Referring to any of the foregoing embodiments of FIGS. 6, 7, and 13-15, an overview of basic theory of operation for the trigger mechanism 100 will now be described. The permanent magnet 108 contained within a closed loop magnetic yoke arrangement provides the fixed or static holding force for resisting movement of the trigger and associated sear 131. The holding force acts on the movable upper portion 120 of rotating trigger member 104. The magnetic yoke cross-sectional area and soft magnetic properties are chosen to maximize the efficiency of conducting the magnetic flux lines and provide inherent immunity to external magnetic field interference. The magnetic coil 106 can be energized, in either polarity, to add to or subtract from the fixed holding force of the permanent magnet which will result in changing the release force necessary to move the trigger and release the sear formed thereon.

In the un-energized state of the actuator 123, an operator can apply pressure to the rotating trigger member 104 until it exceeds the fixed holding force of the permanent magnet 108 at which time the trigger and its integral sear 131 will move, thereby releasing the striking member 130 (e.g. hammer or striker) to strike a chambered round and discharge the firearm. Ideally, the fixed un-energized holding force provided by the permanent magnet 108 may be chosen to product a heavy trigger pull force that would be acceptable as a manual default should battery power or a failure of the magnetic coil or control logic result in a failure to operate properly electronically. An example of this open-loop breakover trigger force profile is shown in FIG. 12.

In normal operation, a range of trigger release forces can be chosen by applying electricity to the magnetic coil via microcontroller 200 to add to or subtract from the fixed holding force of the permanent magnet. An example of this new electrically adjusted breakover trigger force profile is also shown in FIG. 12 (dashed line curve). Because it is impractical to have the magnetic coil 106 energized at all times to extend battery life, the preprogrammed control logic executed by microcontroller 200 is used to determine the exact timing when to energize the magnetic coil, by how much (i.e. magnitude of electric voltage applied), and in what polarity (i.e. additive or subtractive).

A simple mechanical switch could be used for trigger sensor 159 in its most basic form to sense the movement of the trigger initiated by the user or shooter. Other means such as a displacement and/or force sensor can be used instead of or in combination with a mechanical switch as previously described herein to determine that an operator has taken a positive action to pull and actuate the trigger.

Figure 33:
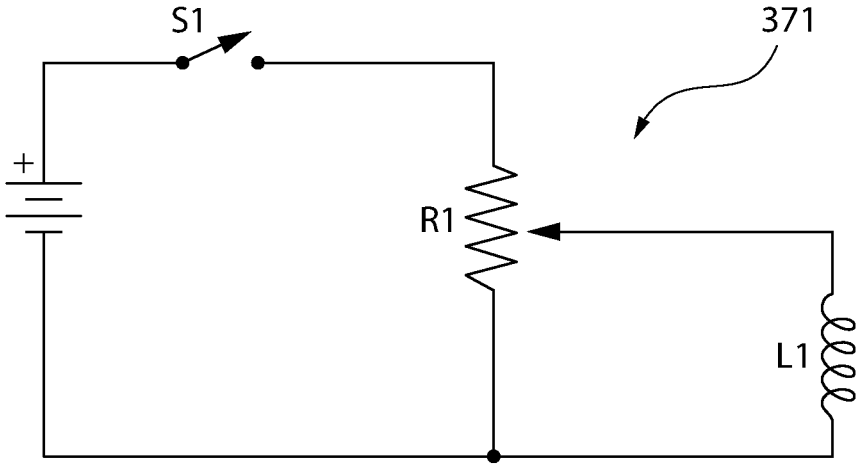
FIG. 33 is a schematic diagram of a manually adjustable analog potentiometer circuit which may be used to control operation of the electromagnetic actuator.

In its simplest form, a potentiometer 371 as shown in FIG. 33 and electrically coupled between the power source 122 and snap actuator 123 could be used as the electronic control system to mechanically adjust and select a desired amount of voltage from a battery source to be applied to the magnetic coil 106. Potentiometer 371 provides a manually adjustable output voltage which is directed to the actuator 123 to either add to or subtract from the permanent magnetic holding force applied by permanent magnet 108. This allows the user to select the desired static magnetic holding force and concomitantly trigger force necessary to actuate the trigger mechanism. Potentiometer includes a manually rotatable or linearly movable slider or wiper allowing the user to adjust the output voltage. Potentiometers are commercially available.

Figure 8:
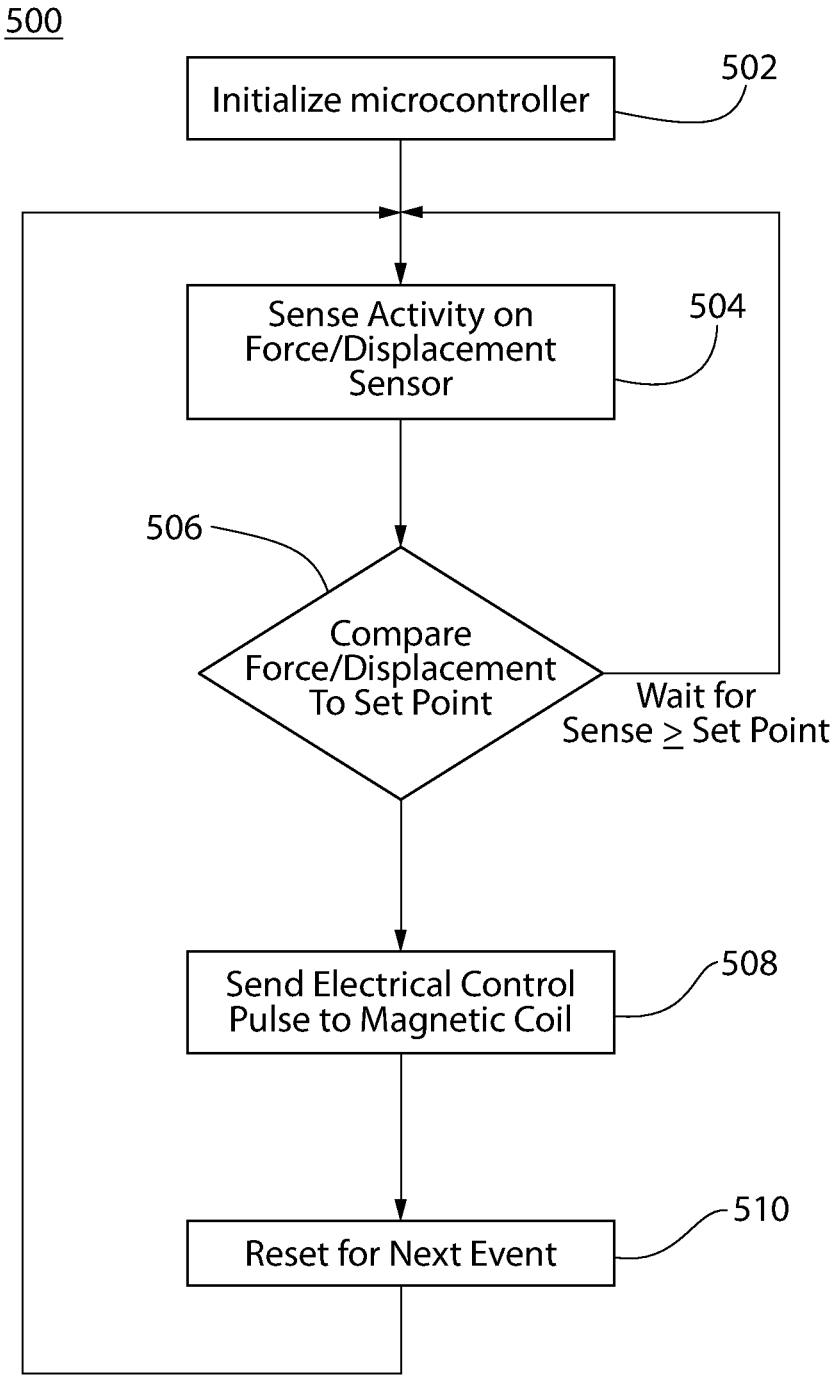
FIG. 8 is a control logic diagram of a process implemented by a programmable microprocessor-based microcontroller for controlling operation of the electromagnetic trigger mechanism.

Alternatively, a simple basic electronic logic circuit or instructions implemented by microcontroller 200 and associated circuitry could be used to control precisely the polarity, the amount of voltage, and timing of the electrical energy pulse sent to the magnetic coil 106 by the microcontroller for energizing the actuator 123 of trigger mechanism 100. This allows the user to highly customize the trigger pull force-displacement profile. Actuation control circuit 202 (see, e.g. FIG. 9) may be configured to include a digital potentiometer which is well known in the art. This provides adjustment of the magnitude of output voltage provided to actuator 123, thereby concomitantly allowing the magnitude of the required peak trigger pull force to be selected in addition to the other parameters such as polarity and timing of the electric signal pulse. FIG. 8 depicts one embodiment of a core or basic control logic which may be preprogrammed into microcontroller 200 to configure operation of the microcontroller and control snap actuator 123 of trigger mechanism 100. This control logic process may be used alone, or as the core for a more complex and detailed logic process used to control operation of the electromagnetic actuator 123 of trigger mechanism 100.

Referring now to FIG. 8, the control logic process 500 used to operate trigger mechanism 100 in one embodiment may start with activating and initializing the microcontroller 200 in Step 502. This may be initiated automatically in one embodiment via a wakeup signal from the grip force sensor 206 (see, e.g. FIG. 9) or other means. In Step 504, user activity on the trigger is sensed and measured by the trigger sensor 159 (e.g. a trigger pull) and a corresponding real-time data signal is transmitted to microcontroller 200. The sensor 159 may be a force or displacement type sensor in some embodiments, and the real-time data relayed to microcontroller 200 contains a respective type of information associated with the type of sensor being used (e.g. applied actual trigger pull force F or actual displacement distance of the trigger during its rearward travel). In one implementation, the displacement type sensor may be configured in its simplest form to merely measure movement of the trigger. The trigger activity real-time data may change over time during the trigger pull as the user further applies force or pressure on the trigger which is displaced by an increasingly greater distance. In Step 506, a test is performed by the microcontroller 200 which compares the real-time trigger activity data to a force or displacement setpoint preprogrammed into the microcontroller 200 by the user. If the microcontroller determines the measured real-time actual trigger force or displacement is less than the setpoint, control passes back to Step 504 to be repeat Steps 504 and 506. If the microcontroller determines that the measured real-time actual trigger force or displacement is greater than or equal to the preprogrammed setpoint, control passes forward to Step 508 in which the microcontroller sends an electric control pulse to actuator electromagnet coil 106. The actuator 123 becomes energized to implement the trigger force and release profile or curve having the characteristics preset by the user in the microcontroller 200. In Step 510, the process circuitry is reset in anticipation of the next trigger pull event.

To achieve a crisp fast acting trigger release feel with a reliable means for varying the trigger force, one embodiment may include force or displacement type sensor 159 monitored by microcontroller 200 that determines, in real time, when the desired degree of actual trigger force or displacement is applied to the trigger by the user during a trigger pull event. At this point, a pulse of electrical energy is applied to the magnetic coil 106 by the microcontroller to quickly lower the static magnetic holding force breakover point for actuating the trigger mechanism 100 and releasing its integral sear 131 to discharge the firearm.

Control and adjustment of the dynamically variable force electromagnetic actuator trigger mechanism would ideally be through the use of microcontroller 200. Such a control system could easily be configured with a wireless communication capability such as Bluetooth BLE, NFC, LoRa, WiFi or other commercial or custom communications means (see, e.g. FIG. 10A). Additionally, wireless communications, applications using an external electronic device 372 such as smartphone, tablets, personal wearable devices, or other custom external devices could be used to control the variability of the trigger feel. Additionally, the direct sensing of the trigger means provides a rich area for the implementation of data collection on the performance and operation of the device. Shot counting, shot timing, pre-fire trigger analysis, and post firing performance analysis can be tied to internal sensing of the trigger event and electrically interfaced to the user through wired or wireless connections to the external electronic device (see, e.g. FIG. 11).

Dual Closed Magnetic Flux Loop Path Embodiment

FIGS. 16-30 depict an electromagnetically adjustable firing system of a firearm having an alternative non-limiting embodiment of an electromagnetic trigger mechanism 300 using a second magnetic flux loop. The second magnetic flux loop or path provides additional design features that provide faster snap action at the trigger breakover point and the ability to actively pull the trigger through its full range of travel on its own under magnetic power without additional external force or displacement from the operator's finger on the trigger. This advantageously provides essentially a powered follow through motion of the trigger and elimination of the operator feeling any of the remaining resistance of movement of the sear release linkages and parts. A principle advantage of the dual loop design is that it makes the operation of the trigger less susceptible to tolerance variations in the magnetic circuits. Trying to "buck" the magnetic holding force to exactly zero in a single loop design is generally not practical.

Trigger mechanism 300 includes an electromagnetic snap actuator 350 configured to form the dual closed magnetic flux loop or paths. Actuator 350 may be a non-bistable release type electromagnetic actuator in which the actuator is not energized to change position for either initiating movement or to reset the actuator similar to trigger mechanism snap actuator 123 previously described herein. Instead, similarly to actuator 123 previously described herein, microcontroller 200 may be programmed and configured to energize the present actuator 350 of the dual flux loop design only in response to a manual trigger pull. This generates the secondary dynamic or active magnetic field which interacts with the primary fixed or static magnetic field generated by the permanent magnet 308 in either an additive or subtractive operating mode depending on the polarity of the power source 122 established via the microcontroller. The present actuator 350 is configurable by the user or shooter via the microcontroller 200 to change the trigger pull force and displacement profile in the same manner described above for single flux loop electromagnetic actuator 123.

Referring to FIGS. 16-29, trigger mechanism 300 generally comprises electromagnetic snap actuator 350 and a trigger member 320 which may be pivotably coupled to the actuator in one embodiment. Viewed from the perspective of being mounted in a firearm held by a user or shooter (see, e.g. FIG. 30), actuator 350 includes a front side 310, rear side 311, right and left lateral sides 312, 313, bottom 314, and top 315. Actuator 350 comprises a stationary magnetic yoke 302, movable central rotating member 304, and electromagnet coil 306 which is operably connected to an electric source of power such as power source 122 onboard the firearm, as previously described herein. Yoke 302 defines mechanically robust main body or housing of the actuator, which is configured for removable mounting to a chassis or frame 22 of the firearm (see, e.g. FIG. 30) by any suitable mechanical coupling means, such as for example without limitation fasteners, interference or press fit, mechanically interlocked surfaces, combinations thereof, or other. The yoke 302 is amenable for use in any type of small arms or light weapons using a trigger mechanism, including for example handguns (pistols and revolvers), rifles, carbines, shotguns, grenade launchers, etc.

Yoke 302 includes an outer yoke portion 305 and a central inner yoke portion 307. The outer yoke portion 305 has a circular annular and circumferentially extending body which may be considered generally O-shaped in configuration. Outer yoke portion 305 circumscribes a central space 303. Inner yoke portion 307 is nested inside the outer yoke 305 in the central space 603. Outer yoke portion 305 generally comprises a common horizontal bottom section 305A, upwardly extending rear and front vertical sections 305B, 305C spaced laterally apart, and a pair of inwardly-turned top sections 305D, 305E having a horizontal orientation. Each top section 305D, 305E is removably attached directly to a respective one of the vertical sections 305B and 305C to facilitate assembly of the actuator 350. In one embodiment, each top section 305D, 305E may be attached to a vertical section by a pair of laterally spaced apart longitudinal fasteners such as cap screws 316 which extend through axial bores 318 in vertical sections 305B, 305C and engage corresponding threaded sockets 319 formed in the top sections. The top sections 305D, 305E when mounted to each of the vertical sections 305B, 305C are horizontally and longitudinally spaced apart to define a top gap or opening 309 therebetween which communicates with the central space 303 of the outer yoke. A working end portion 304A of the rotating member 304 is received between the top sections 305D, 305E in opening 309 and movable therein when the actuator 350 is actuated, as further described herein.

The inner yoke portion 307 is generally straight and vertically elongated forming a substantially hollow structure defining an internal upper cavity 330 which movably and pivotably receives rotating member 304 therein. Inner yoke portion 307 may be formed as integral unitary structural part of the outer yoke portion 305 as shown in the figures and extends upwards from the horizontal bottom section 305A thereof into central space 303. Inner yoke portion 307 is cantilevered from the outer yoke portion 305 in this construction. In other embodiments, inner yoke portion 307 may be formed as a separate component attached to bottom section 305A of outer yoke portion 305 such as via fasteners, adhesives, welding, soldering, etc. Inner yoke portion 307 is orientated parallel to the rear and front vertical sections 305B, 305C of the outer yoke portion 305. The inner yoke portion 307 may be spaced approximately equidistant between the rear and front vertical sections 305B, 305C to facilitate winding coil 306 around the inner yoke portion in the central space 303 of actuator 350.

Figure 28:
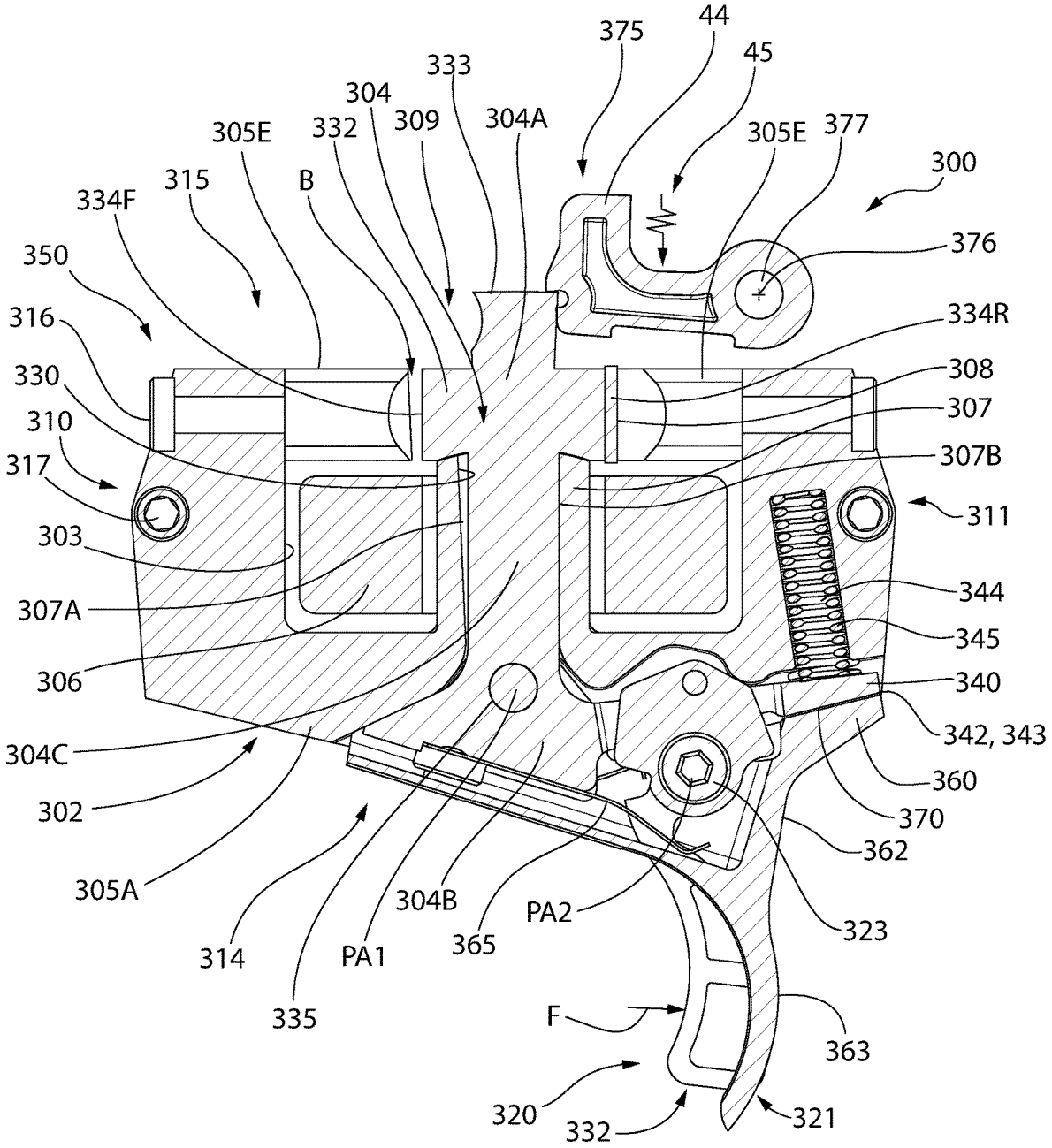
FIG. 28 is a second left side cross-sectional view thereof showing the same.
Figure 29:
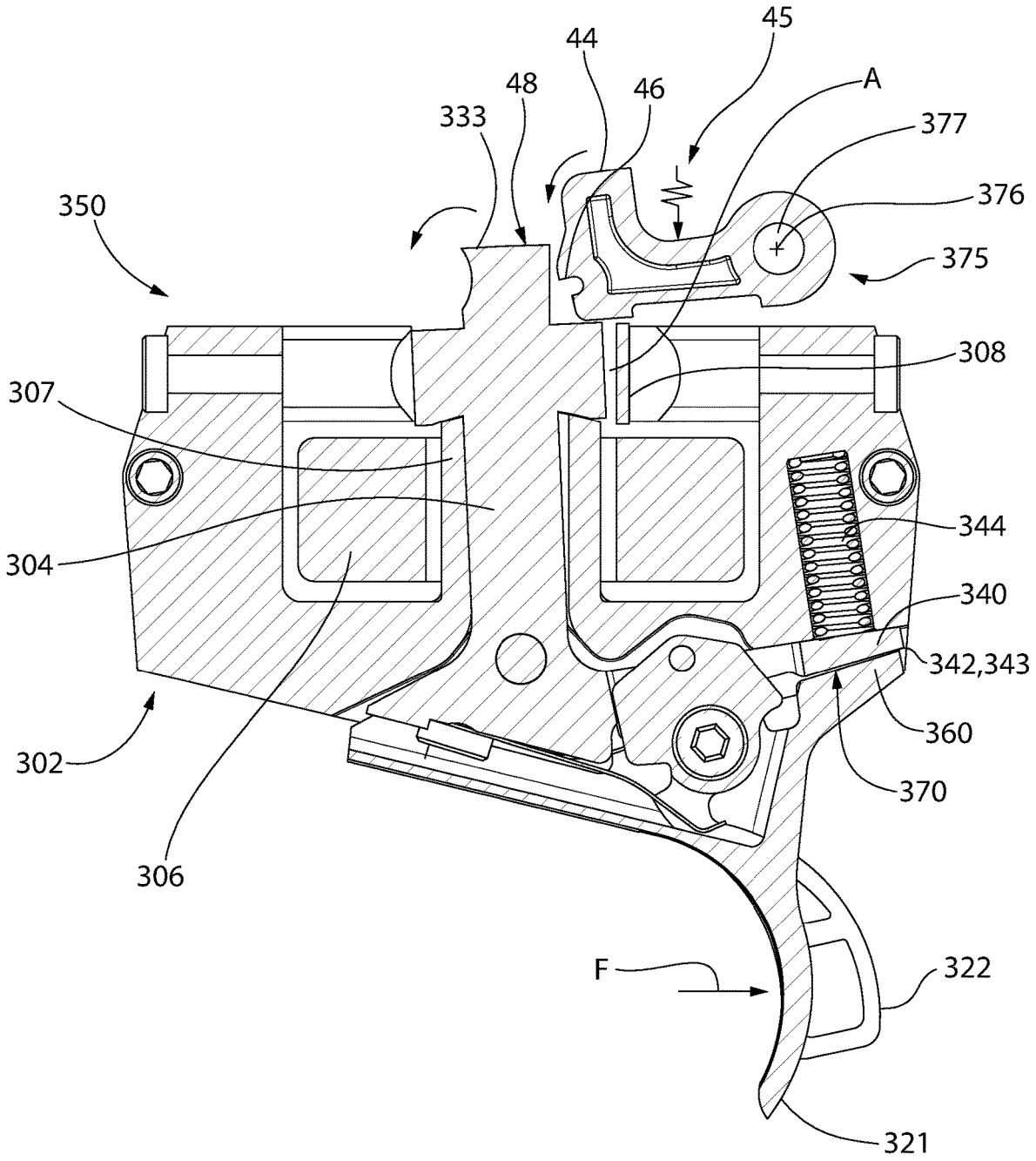
FIG. 29 is a view thereof showing the electromagnetic actuator trigger mechanism in an actuated fire position or state.

Because the rotating member 304 is sheathed or shrouded by inner yoke portion 304 for a majority of its length in one embodiment as best shown in FIGS. 28 and 29, possible physical interference between the coil 306 windings on the actuator and the rotating member is avoided. This arrangement therefore advantageously prevents impeded movement and response time or speed of the rotating member when actuated which might create undue pull resistance on the trigger member 320.

In one embodiment, yoke 302 comprising the outer yoke portion 305 and integral inner yoke portion 307 may be split longitudinally (i.e. lengthwise) front a right half-section 305RH and left half-section 305LH. This split casing arrangement facilitates assembly of the rotating member 304 inside the inner and outer yoke portions. The half-sections 305RH and 305LH may be mechanically coupled tougher by any suitable means, including for example without limitation fasteners including screws and rivets, adhesives, welding, soldering, etc. In one embodiment, threaded fasteners such as transverse cap screws 317 may be used.

Each half-section 305RH, 305LH defines a portion of the vertically elongated upper cavity 330 in inner yoke portion 307 which pivotably receives rotating member 304 partially therein. The cavity 330 communicates with a downwardly and rearwardly open internal lower cavity 331 of the actuator 350 formed in outer yoke portion 305. Lower cavity 331 pivotably receives bottom actuating section 304B of rotating member 304 therein. Lower cavity extends rearward from the central pivot region of the outer yoke portion 305 (containing pivot pin 335) to the rear side of the actuator 350 and bottom section 305A of the outer yoke potion. Upper cavity 330 extends vertically from the lower cavity 331 and penetrates the top and bottom ends of the central inner yoke portion 307.

Referring particularly to FIG. 28, upper cavity 330 in inner yoke portion 307 of yoke 302 defines a pair of opposing front and rear inner wall surfaces 307A, 307B on the front and rear of the cavity. Cavity 330 is configured to allow full pivotable actuation movement or action of the rotating member 304 about its pivot axis PA1. To achieve this functionality, the inner wall surfaces 307A-B have a non-parallel converging-diverging relationship in so far that these wall surfaces converge moving downwards in cavity 330 towards the pivot axis PA1 of the rotating member 304 and diverge moving upwards towards the top open end of the inner yoke portion 307. The front inner wall surface 307A is obliquely angled to the rear inner wall surface 307B such that upper cavity 330 of inner yoke portion 307 is wider at the top and narrower at the bottom from front to rear. In one embodiment, the front inner wall surface 307A may be obliquely angled to the vertical central axis CA of actuator 350 and rear inner wall surface 307B may be parallel to central axis CA. The foregoing arrangement permits pivotable motion of the rotating member 304 forward and rearward in the upper cavity 330.

Rotating member 304 has a vertically elongated body including a top or upper operating end section 304A, bottom or lower actuating end section 304B, and intermediate section 304C extending therebetween. Both top operating end section 304A and bottom actuating end section 304B may be enlarged and longitudinally/horizontally elongated in the front to rear direction relative to intermediate section 304C in one embodiment as shown to achieve their intended functionality. In one embodiment, intermediate section 304C may have parallel sides and be generally rectilinear in configuration and cross-sectional shape. Operating end section 304A is configured to operably interface with the both the outer yoke portion 305 of yoke 302 and the firing mechanism of the firearm as further described herein. When the electromagnetic actuator 350 is fully assembled, the operating end section 304A protrudes upwards beyond the inner yoke portion 307 of yoke 302 and is exposed to engage both the outer yoke portion 305 and a firing mechanism component or mechanical linkage.

The top operating end section 304A of rotating member 304 may be generally cruciform-shaped in one embodiment defining horizontally/longitudinally protruding front and rear extensions 332. This portion of operating end section 304A may be considered to generally resemble double-faced hammer in configuration and defines two opposite and outwardly facing front and rear actuation surfaces 334F, 334R (see, e.g. FIG. 28). When the actuator 350 is cycled between its two actuation positions by a user via a trigger pull, the actuation surfaces 334F, 334R are arranged to alternatingly engage the top sections 305D, 305E of the outer yoke portion 305. In one embodiment, rear actuation surface 334R engages permanent magnet 308 affixed to the rear top section 305D of outer yoke portion 305.

Actuator 350 may further include an engagement feature strategically located on the upper portion of central rotating member 304 and configured to interface with a component of the firearm's firing mechanism in release-type operational role. In various embodiments, the engagement feature may be an operating extension or protrusion 333 of the rotating member 304 as illustrated in FIGS. 16-29, a socket or recess formed in the rotating member (not shown), or other element of other type and/or configuration (not shown) capable of mechanically interfacing with the firing mechanism. Although the engagement feature may be described herein for convenience of description and not limitation as an operating protrusion 333, any other form of engagement feature may be provided so long as the feature is capable of mechanically interfacing with a portion of the firing mechanism.

Operating protrusion 333 extends upwards from between the front and rear extensions 332 at the top of the rotating member 304. Operating protrusion 333 may be approximately centered between actuation surfaces 334F, 334R in one embodiment; however, other positions of the operating protrusion may be used depending on the interface required with the firing mechanism component acted upon by the operating protrusion 333. The operating protrusion 333 may be configured to releasably engage a firing mechanism component or linkage in a direct release role or an indirect release role. Accordingly, operating protrusion 333 may be configured and operable to act directly on the energy storage device such as the spring-biased striking member 130 shown in FIG. 15, or indirectly by acting on a separately mounted pivotable sear 375 which in turn is releasably engaged with the striking member (see, e.g. FIGS. 16-30).

Permanent magnet 308 may be fixedly attached to rear top section 305D of outer yoke portion 305 in a position between the top section 305D and the rotating member 304. Rear top section 305D may include a flat forward facing surface 308*a* for mounting the permanent magnet 308. This arrangement advantageously magnetically attracts and engages rotating member 304 to create a static holding force on the rotating member. Rotating member 304 is magnetically biased rearwards towards its rearward unactuated position associated with a corresponding unactuated forward position of the trigger member 320 when not pulled by the user. Any suitable mechanical coupling means may be used to affix magnet 308 to the outer yoke portion 304, including for example without limitation adhesives, fasteners, welding, soldering, etc.

The enlarged bottom actuating end section 304B of the rotating member 304 may be completely disposed in lower cavity 331 of outer yoke portion 305 in one configuration and enclosed therein by the yoke 302. Actuating end section 304B includes a horizontally/longitudinally elongated cantilevered rear actuating arm or extension 340 used to manually actuate the rotating member 304 via a trigger pull by the user. This may be considered to give the rotating member 304 a generally L-shaped body configuration. Actuating extension 340 extends rearward from the central pivot region of the bottom actuating end section 304B towards the rear side 311 of the actuator 350. In one embodiment, the actuating extension 340 may be formed integrally with the rotating member body as a unitary monolithic structural part thereof. Actuating extension 340 may be obliquely angled to the vertical central axis CA of actuator 350 and may extend completely to the rear side 311 of the actuator such that the free terminal rear end of the actuating extension is exposed for attachment of monitoring or sensing devices, as further described herein.

The rear actuating extension 340 includes an upwardly facing spring seating surface 341 and downwardly facing actuation surface 342. Each surface may be substantially flat or planar in one configuration. Surfaces 341 and 342 may be formed on a laterally widened paddle-shaped portion of actuating extension 340 at the terminal rear end of the extension as shown (best seen in FIGS. 20 and 21). This increases the surface area of the seating and actuation surfaces 341, 342 in contrast to portions of the actuating extension 340 extending forward from the paddle-shaped region.

Spring seating surface 341 of the rear actuating extension 340 is engaged by one end of an operating or trigger return spring 344 disposed in vertical spring socket 345 formed in yoke 302. In one embodiment, spring socket 345 may be formed in rear vertical section 305B of the outer yoke portion 305 as shown. Spring 344 may be a helical coil compression spring in one embodiment; however, other type springs may be used. Spring 344 acts to bias the rear actuating extension 340 downward, which in turn rotates the rotating member 304 about pivot pin 335 to bias the top operating end section 304A into engagement with the permanent magnet 308 when the trigger member is not pulled and actuated (e.g. ready-to-fire position).

Rotating member 304 may be pivotably mounted to yoke 302 via a pivot protuberance such as pivot pin 335 which defines a pivot axis PA1. Rotating member 304 is movable between a rearward unactuated position magnetically engaged with permanent magnet 308 (or yoke 302 in other embodiments depending on placement of the magnet), and a forward actuated position disengaged from the permanent magnet. It bears noting that the rotating member 304 may be moved between the two positions by sensing user action on the trigger member 320 which then energizes the actuator 350. Movement of the rotating member 304 then comes under the influence of the secondary electromagnetic field generated by the electromagnetic actuator 350 when energized by the microcontroller 200, which can either assist with completing the trigger pull for the user, or retard trigger travel/displacement by creating a resistance force on the trigger as previously described herein.

In one embodiment pivot axis PA1 may define a common pivot axis for mounting both the rotating member and trigger member 320 to yoke 302 of snap actuator 350 in one embodiment. Pivot pin 335 therefore defines a common center of rotation about which both the rotating member 304 and trigger member 320 each pivot or rotate independently of each other Common pivot axis PA1 is aligned with central axis CA of the actuator 350 which passes through this pivot axis. In one embodiment, pivot pin 335 is disposed inside lower cavity 331 of the outer yoke portion 305 which serves as the mounting point for the rotating member and trigger member. Rotating member 304 and trigger member 320 each include laterally open pivot holes 336 and 337 respectively for inserting pivot pin 335 therethrough. Holes 336 and 337 are concentrically aligned when the trigger mechanism 300 is fully assembled.

In one construction, as shown, pivot pin 335 may comprise two right and left half-pin sections 335R, 335L each fixedly disposed on a respective right and left yoke half section 305RH, 305LH. In one embodiment, half-pin sections may be integrally formed with the right and left yoke half sections. Each half-pin section collectively forms a complete pin extending from the right to left yoke half-section when assembled together to capture both the rotating member 304 and trigger member 320 thereon and therebetween the yoke half sections. In an alternative embodiment, a single one-piece pivot pin may instead be used which extends completely through lower cavity 331 of outer yoke portion 305 from right to left. In one embodiment, pivot pin 335 is preferably circular in cross section.

Figure 20:
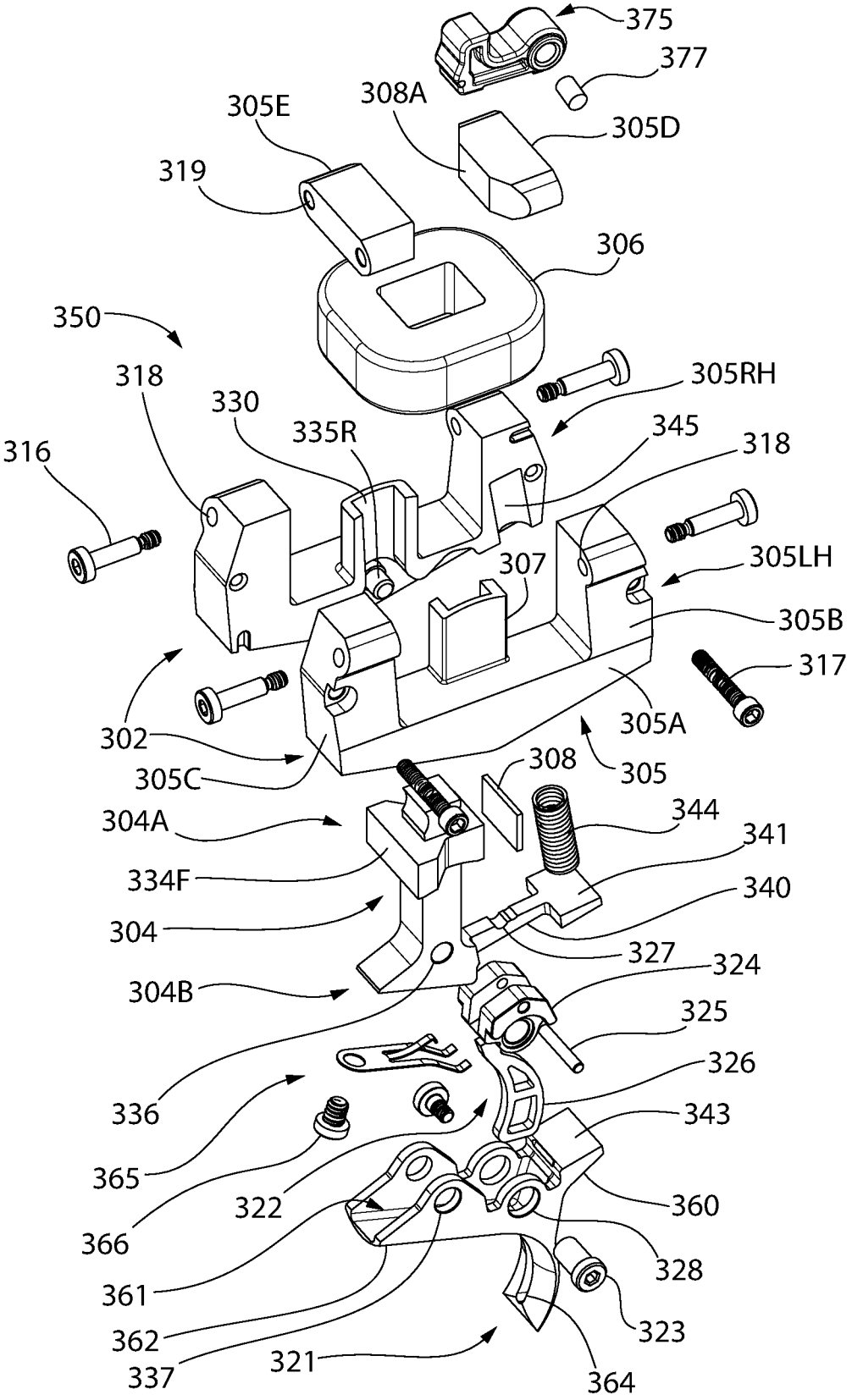
FIGS. 20 and 21 are exploded top and bottom perspective views respectively thereof.
Figure 21:
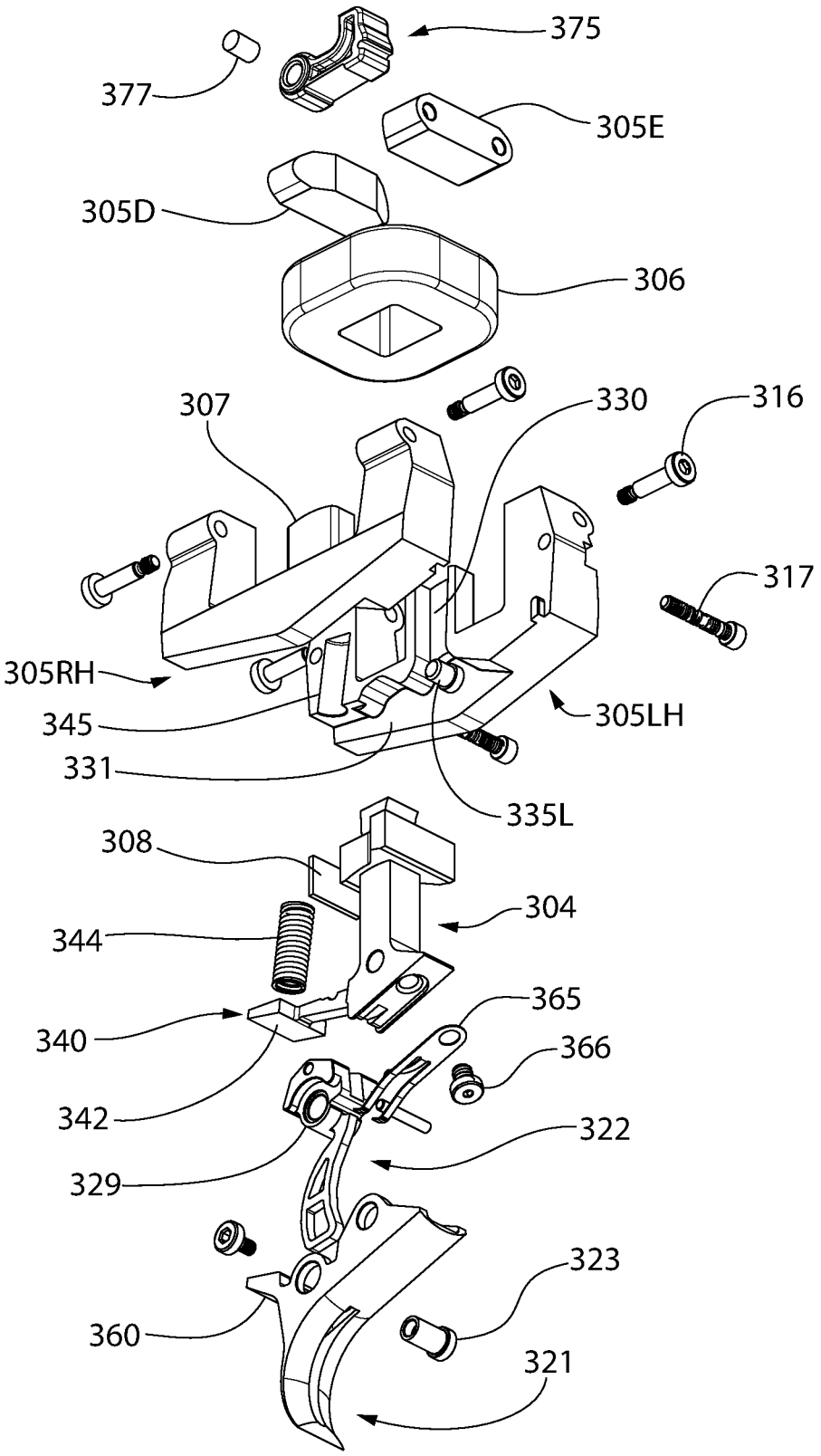
Figure 22:
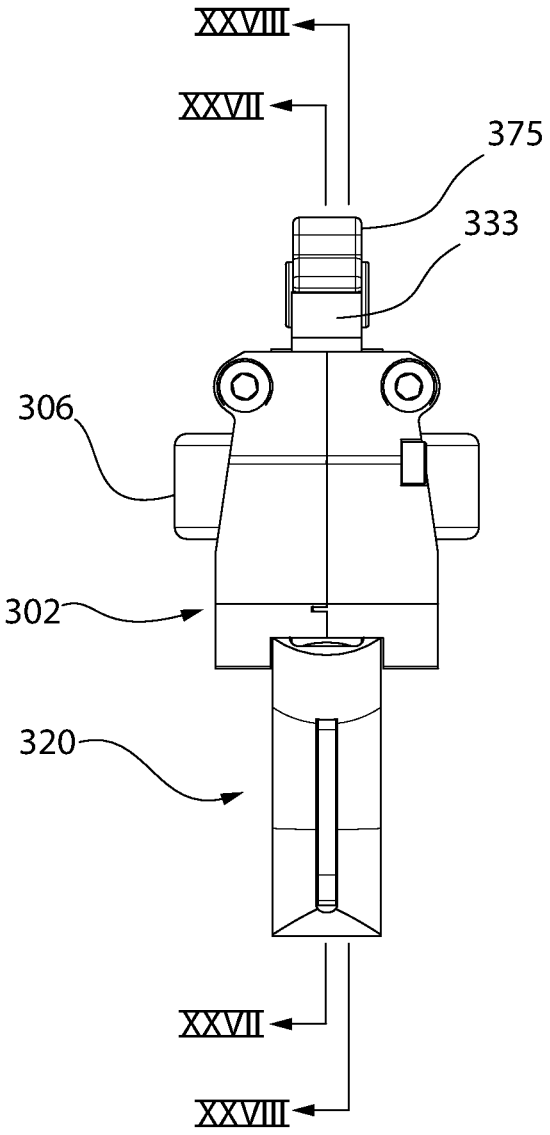
FIGS. 22 and 23 are front and rear end views respectively thereof.
Figure 23:
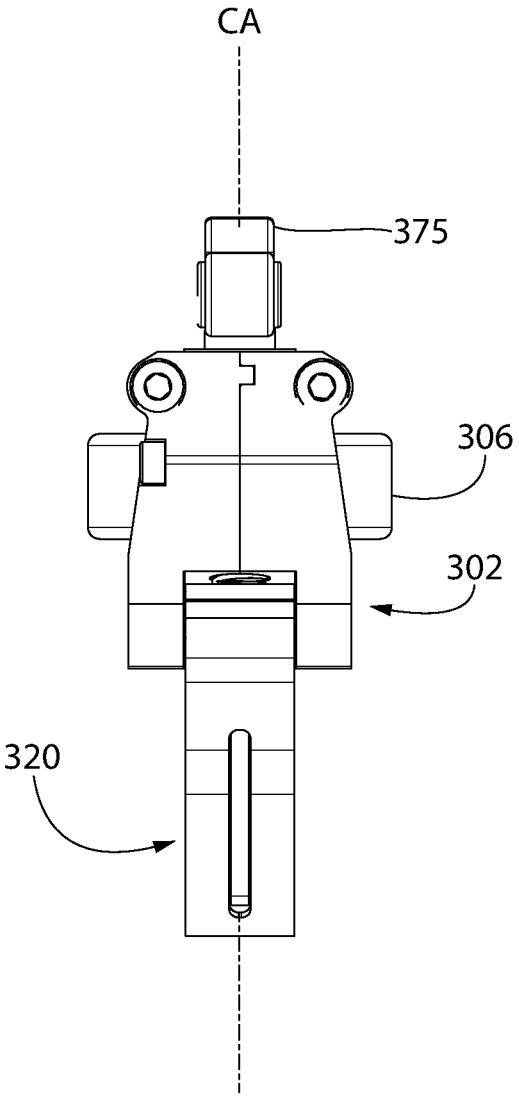
Figure 24:
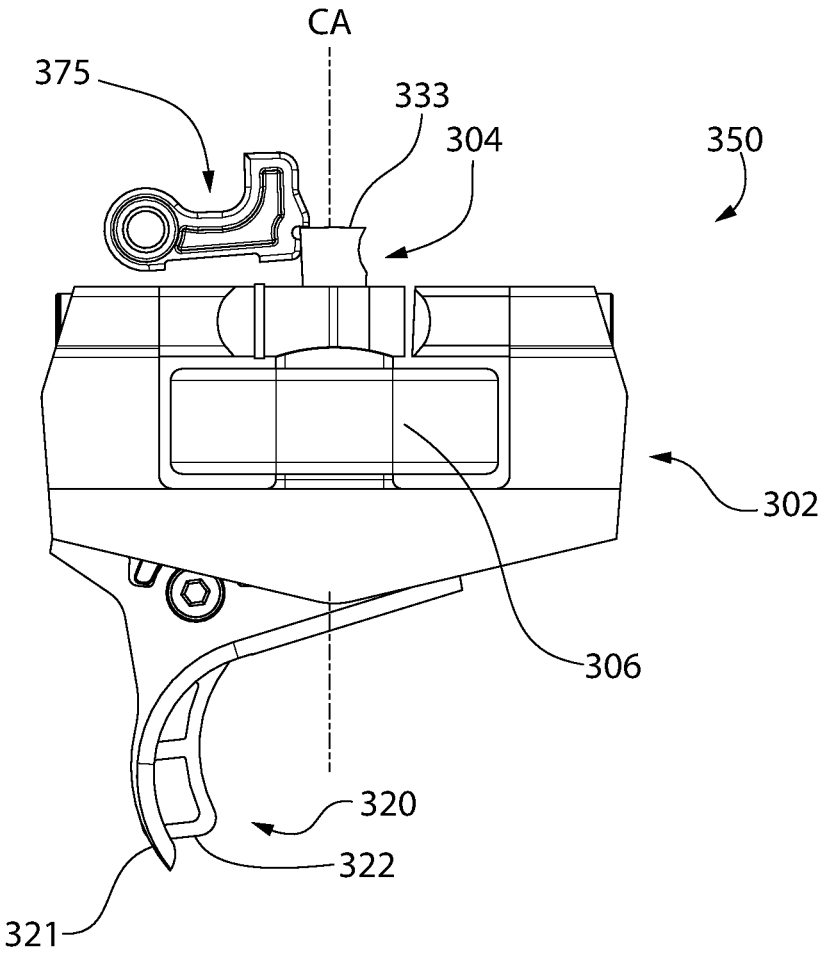
FIG. 24 is a right side view thereof.
Figure 25:
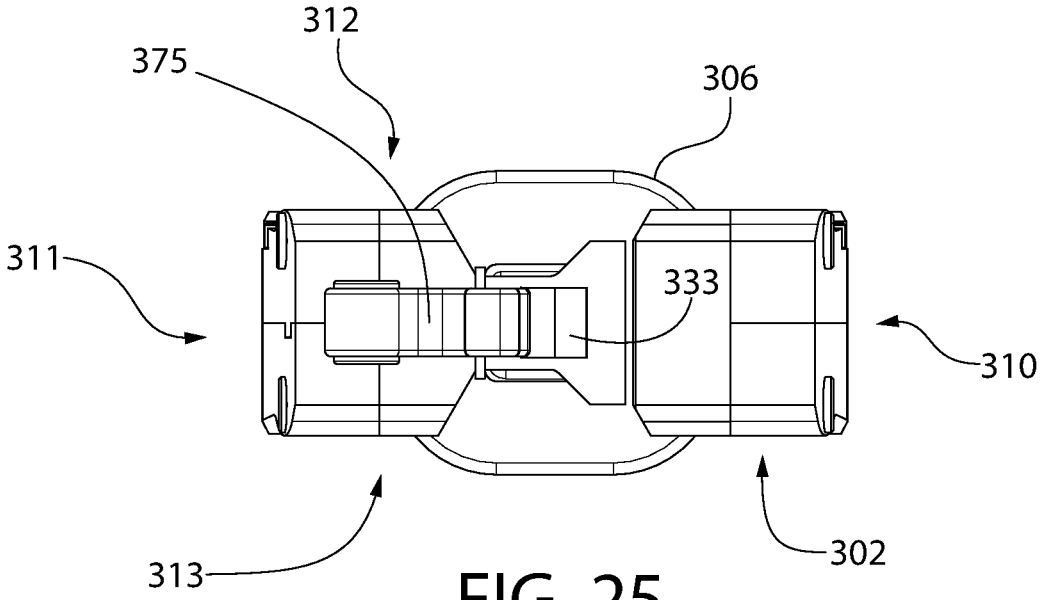
FIGS. 25 and 26 are top and bottom views respectively thereof.
Figure 26:
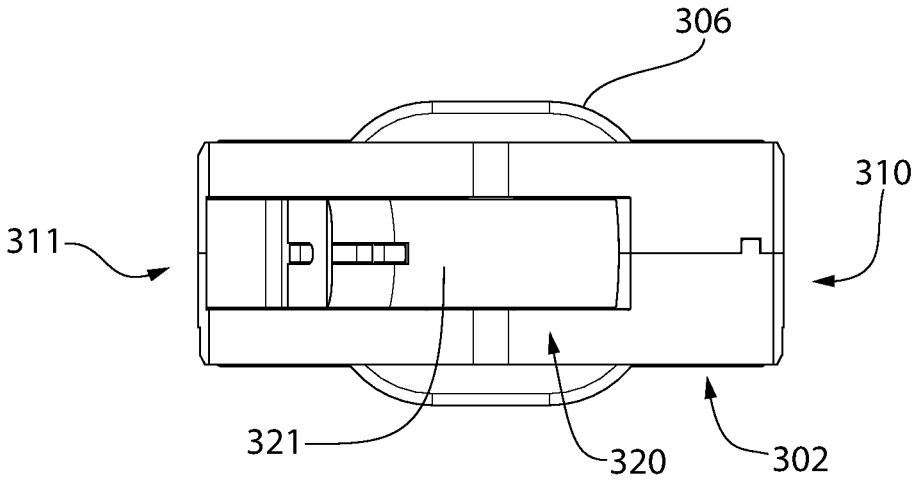

Referring to the exploded views of electromagnetic actuator 350 in FIGS. 20 and 21, the foregoing split construction of yoke 302 facilitates preassembly of the rotating member 304, electromagnet coil 306, and the trigger assembly or member 320 to the yoke to form a self-supporting electromagnetic trigger unit which is configured for mounting to the firearm via any suitable mechanical manner. Because the rotating member 304 and trigger member 320 (i.e. outer trigger 321) are pivotably mounted on pin 335 inside cavity 330 of the central section or portion 307 of yoke 302, these components require mounting before the right and left half-sections 305RH, 305LH of the yoke are assembled and fastened together. A general method for assembling actuator 350 in one non-limiting scenario may therefore comprise the sequential steps of: inserting trigger spring 344 into the downwardly open spring socket 345 of the yoke 302; inserting the inner trigger 322 into the outer trigger 321; inserting the pivot pin 323 transversely through the outer and inner triggers to complete assembly of these components; inserting the bottom actuating section 304B of rotating member 304 into the U-shaped channel 361 of the outer trigger 321 (inner trigger spring 365 being pre-mounted to the underside of bottom actuating section 304B using fastener 366); pivotably mounted the rotating member 304 and trigger member 320 on pivot pins 335R or 335L on the yoke 302 inside cavity 330; assembling or joining the right and left half-sections 305RH and 305LH of yoke 302 together using fasteners 317; winding the electromagnet coil 306 around central inner yoke portion 307; and attaching and mounting each rear and front top section 305D, 305E to its respective one of the vertical sections 305B and 305C of the outer yoke portion 305 using fasteners 316 (the permanent magnet 308 being pre-mounted on the rear top section 305D). Variations of the assembly sequence are possible and not limiting of the invention. In one embodiment, the assembled electromagnetic actuator trigger unit may be dropped into an upwardly open receptacle of the firearm frame 22 (see, e.g. FIG. 30) for securing the unit to the firearm. The electromagnetic trigger unit may alternatively be mounted to the firearm frame via fasteners or other methods.

The trigger member 320 will now be described in further detail. With continuing reference to FIGS. 16-29, trigger member 320 may include an outer trigger 321 and inner safety trigger 322 movable relative to the outer trigger. Inner safety trigger 322 includes an enlarged upper mounting portion 324 and lower blade portion 326 depending downwards therefrom for actuation by a shooter or user. The blade portion 326 may have an open framework construction including an arcuately concave front surface configured to facilitate engagement by the shooter or user's finger. The mounting portion 324 is pivotably mounted to outer trigger 321 via a second pivot pin 323 which defines a transverse second pivot axis PA2. Pivot pin 323 extends transversely through laterally open mounting holes 329 and 328 formed in the mounting portion 324 and outer trigger 321 respectively. Safety trigger 322 is pivotable independently of both the outer trigger 321 and rotating member 304 between forward and rearward positions. Pivot axis PA2 may be parallel to transverse pivot axis PA1 about which the trigger member 320 and rotating member 304 rotate. Pivot axis PA2 may be below pivot axis PA1 and is offset rearwards from the vertical central axis CA of the actuator. A transversely oriented safety bar 325 is carried by the upper mounting portion 324 and is arranged to selectively engage or disengage an upwardly open safety notch 327 formed in the cantilevered rear actuating extension 340 of the rotating member 304. In one embodiment, actuating extension 340 runs through a an upwardly open longitudinal slot formed in the upper mounting portion 324 of safety trigger 322 and is captured beneath the safety bar 325, but movable up/down when the rotating member 304 is actuated.

The outer trigger 321 includes an upper mounting portion 362 and a lower blade portion 363 depending downwards therefrom. The blade portion includes a vertical slot 364 for movably receiving the inner safety trigger 322 therethrough when actuated by the user. Blade portion 363 may have an arcuately concave front surface configured for engagement by the user's finger. The mounting portion 362 of outer trigger 321 may have a U-shaped body in one embodiment defining a forwardly and upwardly open channel 361 which movably receives the lower actuating section 304B of rotating member 304 therein. The rear actuating extension 340 of rotating member 304 also extends through channel 361. The actuating section 304B of the rotating member is therefore nested inside the mounting portion 362 of the outer trigger 321.

Outer trigger 321 further includes a cantilevered rear operating arm or extension 360 arranged to engage the rear actuating extension 340 of the rotating member 304. In one embodiment, operating extension 360 protrudes rearwardly from the mounting portion 362 of outer trigger 321. Operating extension 360 defines a flat or planar upwardly facing operating surface 343 configured and arranged to abuttingly engage downwardly facing actuation surface 342 of rotating member 304. The interface between the operating surface 343 and actuation surface 342 is one of a flat-to-flat interface in one embodiment as shown (see, e.g. FIGS. 27-29). Operating extension 360 of outer trigger 321 is biased downward by trigger return spring 344 via rear actuating extension 340 of the rotating member (which acts on the operating extension). This in turn biases outer trigger 321 forward towards the ready-to-fire position. The spring 34 maintains continuous mutual engagement between the outer trigger 321 and the rotating member 304. Outer trigger 321 is manually movable by the shooter or user between the substantially vertical forward ready-to-fire position and pulled rearward fire position.

In one embodiment, a force/displacement sensor such as a thin film force sensing resistor 370 may be interposed at the interface between the operating surface 343 of the operating extension 360 of outer trigger 321 and actuation surface 342 of the rear actuating extension 340 of rotating member 304. Force sensing resistors measure an applied pressure or force between two mating surfaces and are commercially available from numerous suppliers. Force sensing resistor 370 is operably and communicably coupled to microcontroller 200. Force sensing resistor 370 is configured to detect and measure a trigger force F exerted by the user on the outer trigger 321 when pulled to fire the firearm 20. When paired with trigger force setpoint preprogrammed into microcontroller 200, this serves as a basis for intermittently energizing the electromagnetic snap actuator 350 based on trigger force, as further described herein.

Inner trigger 322 is biased toward its substantially vertical forward position (see, e.g. FIGS. 27 and 28) by a spring 365. In one embodiment, spring 365 may be in the form of a spring clip having a flat thin body with an upwardly angled central arm which engages a bottom surface of the inner trigger mounting portion 324 and a pair of downwardly angled legs which engage the lower trigger within channel 361. The central arm acts on the mounting portion 324 to bias the blade portion 326 of inner trigger 322 forward. The spring clip may be mounted to the underside of rotating member 304 in one embodiment by a threaded fastener 366 received in a threaded socket in the bottom actuating section 304B of rotating member 304. The bottom of rotating member 304 may comprise a recess configured to receive the spring clip. In the forward position, the blade portion 326 of inner trigger 322 protrudes forward from the outer trigger 321 (see, e.g. FIGS. 27 and 28). In the rearward position, the blade portion protrudes rearward from the outer trigger when the inner trigger is fully depressed by the user (see, e.g. FIG. 29).

Figure 27:
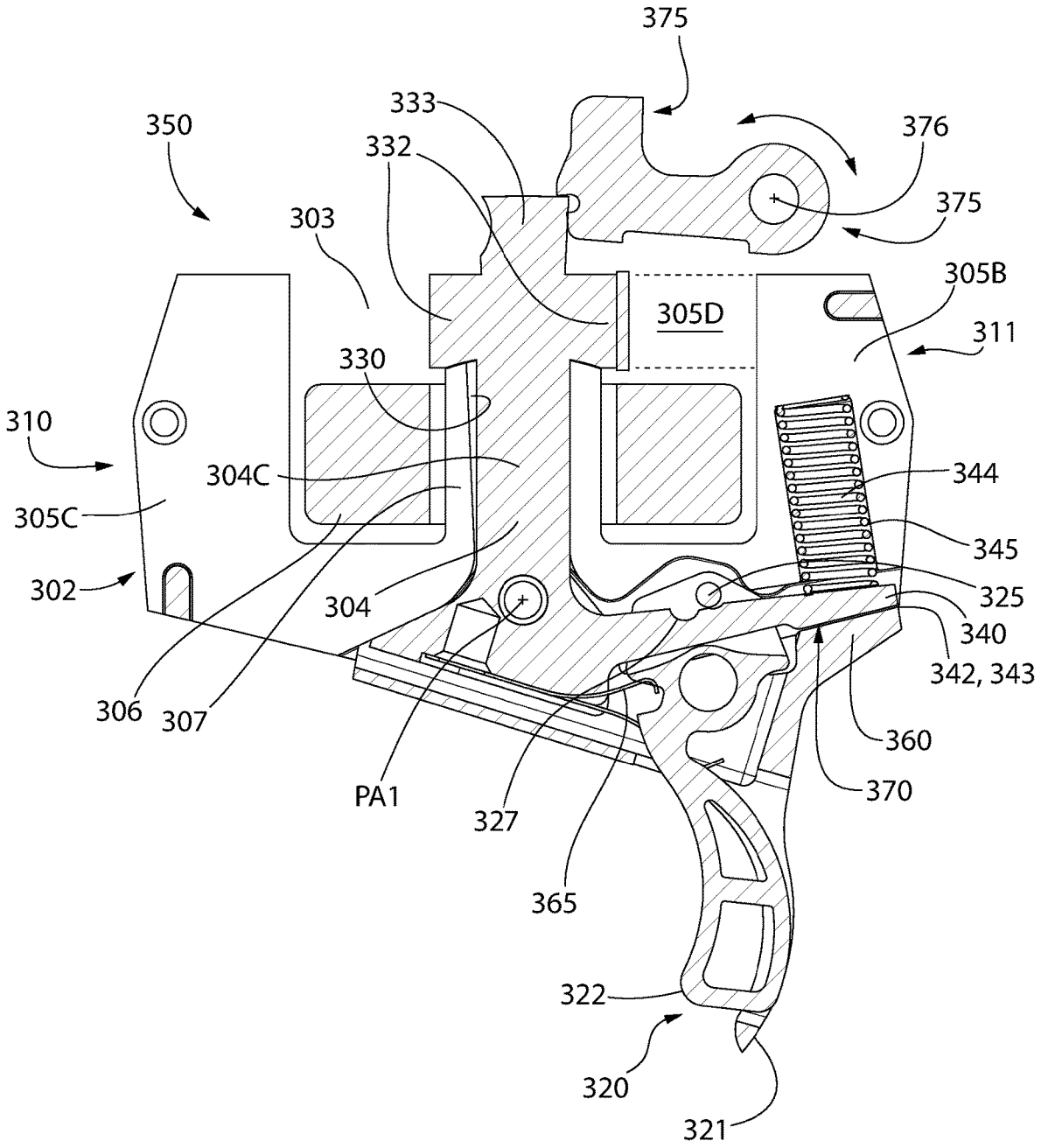
FIG. 27 is a first left side cross-sectional view thereof showing the electromagnetic actuator trigger mechanism in an unactuated ready-to-fire position or state.

In operation, the trigger mechanism 300 will be in the ready-to-fire condition shown in FIGS. 27 and 28. Both the inner safety and outer triggers 322, 321 are in their vertical forward ready-to-fire positions via the biasing action of springs 365 and 344, respectively. In this position, the safety bar 325 on the inner trigger is engaged with the rear actuating extension 340 of the rotating member 304, thereby blocking its upward movement and preventing the firearm from being fired (best shown in FIG. 27). To discharge the firearm, the shooter or user initially applies a trigger pull force F on first the safety trigger 322 which rotates rearward to its rearward position shown in FIG. 29. The safety bar 325 seen in FIG. 27 rotates forward from the position shown and becomes vertically aligned with safety notch 327 in the rear actuating extension 340 of rotating member 304. The user's trigger finger may then fully engage and rotate the trigger member 320 (i.e. collectively outer trigger 321 with inner trigger 322) rearward to the rearward fire position. This fully actuates the trigger mechanism 300 to discharge the firearm, as further described herein. Because the safety bar 325 is aligned with safety notch 327, upward movement of rear actuating extension 340 of the rotating member 304 is no longer blocked, thereby allowing the firearm to be discharged either manually or when the snap actuator 350 is energized via normal operation.

The stationary yoke 302 and the rotating member 304 may be formed of any suitable magnetic metal capable of being magnetized, such as without limitation iron, low-carbon steel, nickel-iron, cobalt-iron, etc. Suitable fabrication methods include for example without limitation metal injection molding, casting, forging, machining, extrusion, laminated stamping, and combinations of these or other methods. The method is not limiting of the invention.

Figure 31:
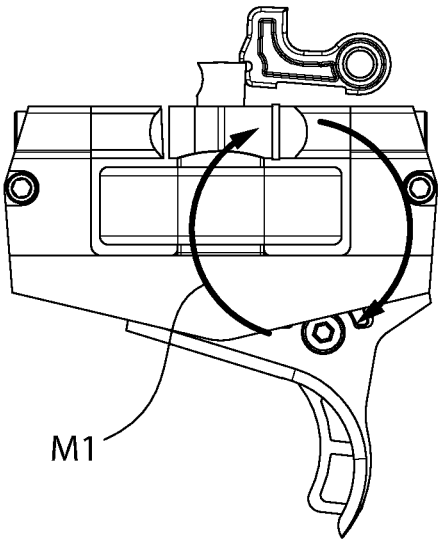
FIGS. 31 and 32 show magnetic flux paths in the electromagnetic actuator trigger mechanism in a de-energized state (FIG. 31) and energized state (FIG. 32)

The operating theory of the electromagnetic trigger mechanism 300 with snap actuator 350 is as follows. The central rotating trigger armature or rotating member 304 is surrounded by the magnetically conductive yoke 302 configured to form two possible flux loop paths. A primary fixed or static magnetic flux and associated holding force is established using the permanent magnet 308 in the right hand flux loop or path to hold the central rotating member 304 firmly to the right side of its pivotal range of motion within the yoke 302. The primary magnetic flux path generated by the permanent magnet 308 is shown in FIG. 31 (see flux arrows representing the primary static flux M1). The rotating member 304 is held firmly against and abuttingly engages the permanent magnet 308 as shown in FIGS. 27 and 28. The air gap B on the left side of the top of the rotating member 304 ensures that the left hand magnetic flux path is sufficiently high in magnetic reluctance that essentially all of the magnetic flux from the permanent magnet 308 is contained within the right hand loop (see, e.g. FIG. 28). A magnetic coil 306 surrounds the rotating member and when energized, the coil will generate and provide a secondary dynamically variable magnetic flux that adds to, or subtracts from, the primary fixed or static magnetic flux generated by permanent magnet 308 depending on the polarity of the electricity provided to the coil.

Figure 10B:
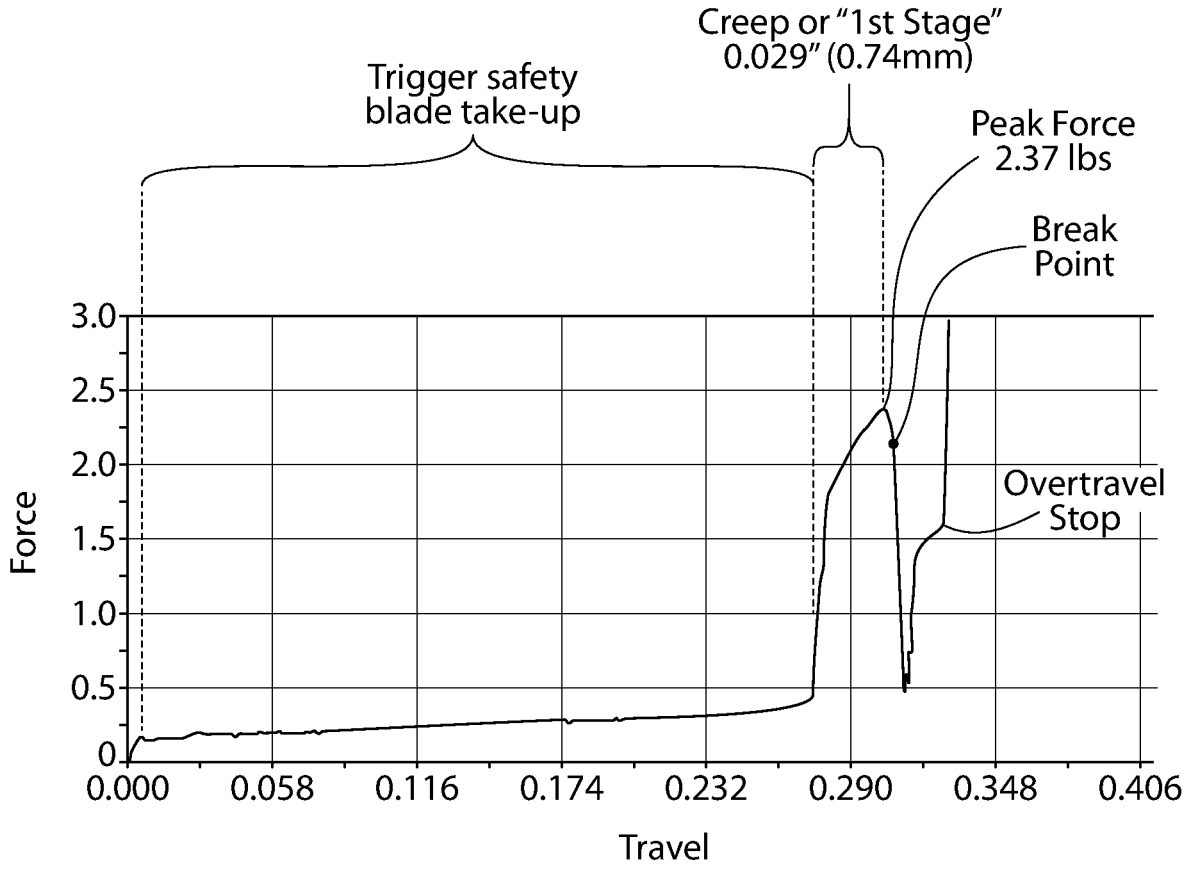
FIG. 10B is a graph of an example trigger pull force versus displacement (travel) curve showing various stages trigger force during a trigger pull sequence and an illustrating a breakpoint in the trigger release profile.

Under normal operation to discharge the firearm, the operator or user pulls the outer trigger 321 which applies a trigger pull force F thereon that acts in an opposite direction counter to the primary fixed or static magnetic field flux and holding force generated by the permanent magnet 308. This creates pressure on and pivotably displaces the outer trigger 321 rearwards. This applied pressure and trigger displacement provides the means for sensing physical activity with the trigger sensor 370 as input for Step 504 in the control logic process of FIG. 31. In various embodiments, the trigger sensor(s) may be a force type sensor that measures applied force in real-time, a displacement type sensor that measures displacement distance in real-time, or a combination of force and displacement sensors may be used to provide both force and displacement information relayed to the microcontroller 200 for use in activating the snap actuator 350 in accordance with the preprogrammed trigger release profile created by the user. The force type sensor senses and provides information to the microcontroller relevant to actual trigger pull force F being applied on the trigger by the user. This serves as a basis for comparison to the preprogrammed breakpoint or setpoint trigger pull force used to time energizing the electromagnetic actuator 350 to alter the trigger pull force-displacement profile (see, e.g. FIG. 10B). The displacement type sensor senses and provides information relevant to the displacement distance of the trigger which may be used as the basis by the microcontroller for energizing the actuator 350 when a displacement setpoint is preprogrammed into the control system.

In one embodiment, the sensor 370 may be a thin film force sensing resistor 370 as previously described herein which measures the magnitude of the trigger pull force F. Alternative approaches for force sensors include load cells, piezo-electric force sensors, and others. Alternatives to force sensors are displacement sensors such as Hall Effect sensors, magnetoresistive sensors such as without limitation GMR (giant magnetoresistance sensors), TMR (tunnel magnetoresistance sensors), or AMR (anisotropic magnetoresistance sensors, and optical or mechanical switches or sensors could also be used. When the force (or displacement) reaches a preset desired threshold trigger trip or setpoint preprogrammed into the actuation control circuit 202 or microcontroller 200 for the variable force trigger, the control system applies electrical energy to the magnetic coil 306.

Figure 32:
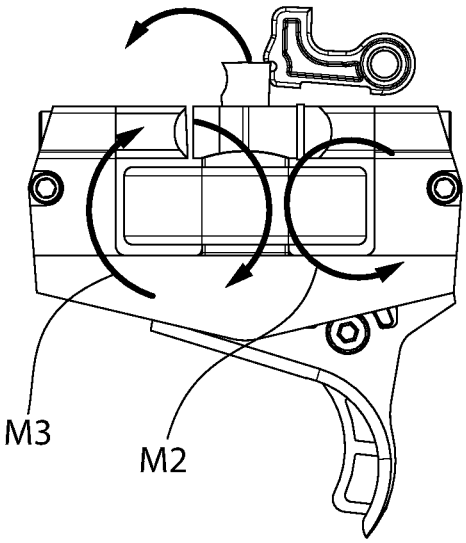

At the preset desired force or displacement trip or setpoint, the pulse of electrical energy applied to the electromagnet coil 306 by microcontroller 200 generates user-selectable and adjustable dynamic secondary dual magnetic field fluxes. The two flux loop or paths for the right-hand side and left-hand side magnetic fluxes M2 and M3 are shown in FIG. 32 and represented by the flux line arrows indicated. In one implementation, as depicted, the secondary flux M2 opposes the static magnetic flux M1 generated by the permanent magnet 308 in the right-hand side circuit when the electric pulse from power source 122 has a first polarity as controlled by microcontroller 200. Note that the dynamic secondary right-hand side flux M2 generated by energizing the coil is shown to circulate in a counterclockwise direction opposite to the static clockwise flux M1 generated by permanent magnet 308 shown in FIG. 31. The right-hand side secondary flux M2 created by the electromagnet coil 306 is therefore considered "subtractive" and decreases the clockwise static magnetic flux M1 in the right-hand side of the flux circuit. The energized coil 306 also simultaneously creates the additional clockwise flux M3 in the left-hand side of the circuit. If the current in the magnetic coil 306 is sufficiently large as in the present embodiment, then the force resulting from the magnetic flux M3 in the left-hand circuit air gap B will be greater than the force in the right-hand circuit, and the central rotating member 304 will snap to the left very quickly under magnetic force without any additional pull force F applied to the trigger by the operator or user. As the size of the air gap B on the left-hand side flux loop closes, an air gap A opens on the opposite right-hand side flux loop between the top of the rotating member 304 and permanent magnet 308 at right (see, e.g. FIG. 29). The magnetic reluctance of the left-hand side flux loop decreases and the magnetic reluctance of the right-hand side flux loop increases causing a rapidly increasing magnetic force of attraction pulling the central rotating member 304 to the left-most position allowed by the yoke 302 shown in FIG. 29.

When electrical energy is removed from the magnetic coil by microcontroller 200, the left-hand flux path collapses and the static permanent magnet 308 attractive force takes back over and pulls the rotating member 304 back to the right-hand side of the yoke 302 as shown in FIG. 28. The trigger return spring 344 provides a preferably light biasing force ensuring the positive return of the rotating member 304 to the right-side starting or ready-to-fire position in the event the permanent magnet 308 fails to positively reset the actuator 350 or another unanticipated failure of the trigger mechanism occurs. The trigger spring, however, is not an essential component in the design in all embodiments but does provide a backup system for operating the trigger mechanism 300 completely by manual means particularly in exigent circumstances if the battery charge is lost or the microcontroller 200 malfunctions.

Under conditions when the electromagnet coil 306 is not energized, either by intentional design or failure of components or weak batteries, the operator can still cycle the firearm by applying force/displacement to the outer trigger 302 that exceeds the fixed or static holding force of the permanent magnet 308.

An alternate embodiment and application can be envisioned where the static holding force of the permanent magnet 308 is increased by applying electrical energy to the magnetic coil 306 in an "additive" manner instead that reinforces the permanent magnet's holding force. In this instance, the microcontroller 200 is configured to apply the electric pulse to electromagnet coil 306 with an opposite second polarity. The secondary dynamic right-side flux M2 would therefore act in the same clockwise direction as the static flux M1 seen in FIG. 31. This could be used to greatly increase the adjustable range of the trigger setpoint. This could also be used as a safety measure to increase the trigger holding force significantly in the event of some outside influence where it would be desirable to require a much higher trigger pull such as under high acceleration, drops, or shocks applications. This may be done with certain firearm configurations to ensure compliance with gun safety drop tests which is a well known test procedure in the art to confirm a firearm does not fire when accidentally dropped.

One key feature of the present variable force trigger mechanisms 100 or 300 disclosed herein is the ability to select a desired trigger pull force-based release breakpoint or breakover setpoint for the trigger that is optimal for the user's experience and shooting situation. In one embodiment, the setpoint may be preprogrammed into microcontroller 200 for use in the control logic shown in FIG. 8. In other embodiments, the selection of the setpoint can be as simple as a manual adjustment screw or knob of the potentiometer shown in FIG. 33 that interfaces with the microcontroller 200 and its basic control logic shown in FIG. 8. Or it can be any range of options from pre-programmed to provide preset features, or totally programmable using controls mounted on the firearm, computer, or an external electronic device such as even a cellphone application that interface with the control logic unit or microcontroller 200. Examples of implementations that can be used include: (1) a Trigger Setpoint that is selected by manually adjusting a screw, knob, or switches of a potentiometer 371 to select either a continuous range of trigger release forces or a preset number of fixed release levels; (2) a user interface using switches, knobs, buttons, touch screen or other control interface on the firearm to set the trigger setpoint parameters and communicate them to the logic control unit or microprocessor 200 shown in FIG. 9; and (3) a wired or wireless programming device that communications to the firearm control logic via either a cable such as a USB cable, or wireless network connection such as Bluetooth, Wi-Fi, NFC, etc. The programming device could be a simple discrete remote control device or key fob, a computer, laptop, tablet, or cellphone running a software application which communicably interfaces with microcontroller 200 and its control logic or program instructions.

FIG. 10A graphically shows how an external electronic device 372 such as a cellphone for example could be used to select and program microcontroller 200 located onboard the firearm 20 with a trigger release profile via wireless Bluetooth communications. The wireless communications is enabled via the communication interface or module 209 in the microcontroller 200 (see, e.g. FIG. 9). The trigger profile parameters which may be accessed and selectively adjusted by the user in this non-limiting example may include both a trigger force breakpoint or setpoint (i.e. magnitude or value of holding or breakover trigger force F necessary to release the trigger) and timing of which point during the travel or displacement of the trigger that the trigger mechanism actuator 123 or 350 will be energized by the microcontroller 200. An example of the breakpoint or setpoint is shown in the trigger release profile of FIG. 10B.

The cellphone microprocessor runs a local software application or "app" comprising program instructions or control logic that allows adjustment of the trigger release profile. Two application screens which may be presented to the user on the cellphone visual touchscreen are shown in FIG. 10A as examples. When the trigger profile setting software application is launched, a first security access screen 373 may be presented which prompts the user to enter a preselected personal identification number (PIN) in a similar manner to the security PIN required by the cellphone to change some of its core user settings. The user is then presented with a second trigger settings screen 374 containing input fields such as active icons, adjustment sliders, or other type input fields. This the user to select/enter the desired trigger breakpoint or breakover setpoint force ("Trigger Force" icon) for energizing the actuator 350 and/or timing for energizing the actuator based instead on trigger displacement ("Displacement" icon) depending on which type sensor is used. Alternatively, both type sensors may be used in some embodiments. These input fields provide the user interface which allow adjustment of the trigger force-displacement curve (FIG. 10B) to suit the user's preferences. In one embodiment, an active trigger release profile may be displayed in screen 374 which changes in real-time to reflect the corresponding settings for the setpoint and timing being input by the user. The external electronic device 372 then wirelessly communicates the selected changed trigger settings to the microcontroller 200 which becomes programmed with the trigger parameters entered in the cellphone trigger software application. Once the setting are complete, the user may close the trigger software application on the cellphone.

It will be appreciated that numerous variations in the configuration of the trigger profile software application are possible. The trigger profile software may also be implemented in other external electronic devices, such as a laptop, notebook, electronic pad, desktop computer, or other processor-based devices capable of communication with the onboard microcontroller 200 of the firearm.

It bears noting that particularly the electromagnetic trigger mechanism 300 is substantially immune to external magnetic field which could interfere with proper operation of the trigger mechanism electromagnetic actuator 350. The permanent magnet 308 in the embodiment presented herein provides a fixed or static holding force for a trigger-sear release system in a closed flux loop that limits susceptibility to external magnetic fields. With the exception of the small air gap created between the rotating member 304 and stationary yoke 302, that allows for the motion of the rotating central trigger/armature (rotating member 304), the magnetic yoke cross sectional area, and soft magnetic material properties of the yoke and rotating member to provide a low reluctance path that captures almost all of the magnetic flux generated by energizing the magnetic coil and from the permanent magnet.

Since magnetic force within the air gap increases with magnetic cross-sectional area and decreases with the square of the air gap length or width, practical designs which are optimized for force and speed tend to minimize the length or width relative to the cross-sectional area of the yoke. A consequence of this is that variable force trigger designs based on these design principles are inherently immune to external magnetic field interference. In practice, it is virtually impossible to change the state of the variable force trigger using an external magnet (and optional soft magnetic material yoke) provided the rotating member is physically isolated from the external magnet by at least one air gap distance. This will virtually always be the case in practical firearm embodiments.

Figure 30:
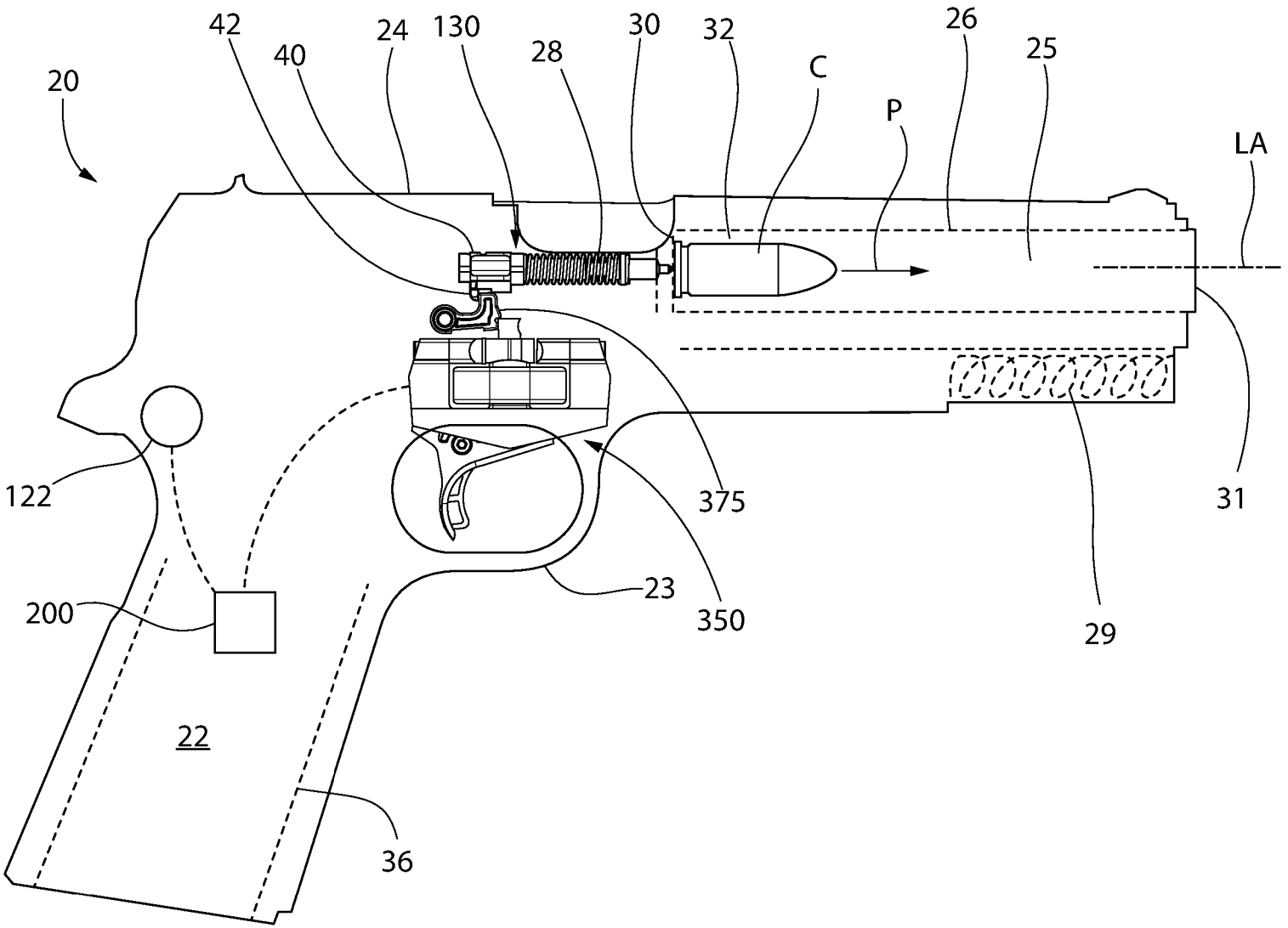
FIG. 30 is a right side view of a firearm in the form of a pistol incorporating the electromagnetic actuator trigger mechanism.

FIG. 30 shows one embodiment of a firearm 20 incorporating the electromagnetic trigger mechanism 300 with dual flux loop electromagnetic snap actuator 350 shown in FIGS. 16-29. It bears repeating that actuator 350 does not act like a non-bistable actuator characterized by the presence of a single permanent magnet 308 in the dual flux loops. Instead, the present trigger mechanism 300 and controller in this embodiment are mutually configured and operable to use a sensed externally applied force F on the trigger member as the impetus to energize the coil of the actuator 350. Energizing actuator 350 alters the force F required to be applied by the user to pull the trigger in accordance with the trigger release profile preprogrammed into microcontroller 200 (e.g. trigger breakpoint or breakover point previously described herein). In some configurations, the actuator 350 may actually complete the full trigger pull or travel without application of additional force by the user.

In the present firearm embodiment, electromagnetic snap actuator 350 operably interacts with and releases the energy storage device such as movable striking member 130 in an indirect manner via an intermediate firing mechanism component. The central rotating member 304 of the electromagnetic snap actuator 350 in this case operably interacts with a sear 375 operably interposed in the firing linkage between actuator 350 and striking member 130 (see also FIGS. 27-29).

In one embodiment, the firearm 20 may be a semi-automatic pistol recognizing that the trigger mechanism 300 with electromagnetic actuator 350 may be used in any type firearm having a pivotably or linearly movable striking member 130 and optionally a sear 375 or other intermediate component in some designs which operate to hold and selectively release the energy storage device (e.g. hammer or striker). Accordingly, the trigger mechanism 300 may be variously embodied in firearms including for example without limitation rifles, carbines, shotguns, revolvers, or other small arms.

Firearm 20 generally includes a frame 22, trigger guard 23 formed as a unitary structural part of the frame or a discrete guard separately attached thereto, reciprocating slide 24, barrel 26 mounted to the frame and/or slide 24, and a movable energy storage device such as striking member 130. Slide 24 is slideably mounted on frame 22 for movement in a known axially reciprocating manner between rearward open breech and forward closed breech positions under recoil after the pistol is fired. A recoil spring 29 compressed by rearward movement of the slide acts to automatically return the slide forward to reclose the breech after firing. Slide 24 may be also considered to define an axially movable receiver, in contrast to a fixed receiver mounted rigidly to the frame or chassis of a long gun such as for example a rifle, carbine, or shotgun (see, e.g. FIG. 70).

Barrel 26 is axially elongated and includes rear breech end 30, front muzzle end 31, and an axially extending bore 25 extending therebetween. Bore 25 defines a projectile pathway and a longitudinal axis LA of the firearm which defines an axial direction; a transverse direction being defined angularly with respect to the longitudinal axis. The breech end 30 defines a chamber 32 configured for holding an ammunition cartridge C. The slide 24 defines a vertical breech face 34 movable with the slide and arranged to abuttingly engage the rear breech end 30 of barrel 26 to form the openable/closeable breech in a well known manner. The vertically elongated rear grip portion of frame 22 comprises a downwardly open magazine well which receives a removable ammunition magazine 136 therein for uploading cartridges automatically into breech area after the firearm is discharged which are chambered into the barrel via operation of the slide 24. All of the foregoing components and operation of semi-automatic pistols are well known in the art without requiring further elaboration.

With continuing reference to FIGS. 27-30, firearm 20 in the present embodiment includes a striking member 130 in the form of a spring-biased and linearly movable striker 40. Striker 40 is movable in a forward linear path P for striking a chambered cartridge C. Spring 28 biases the striker 40 forwards such that when the striker is released from a rearward cocked position, the spring drives the striker forward to strike and detonate the charge in the cartridge C. Striker 40 has a horizontally-axially elongated body including a downwardly depending catch protrusion 42 which is engageable with an upstanding sear protrusion 44 of the sear 375 to hold the striker in the rearward cocked position. Sear 375 is pivotably mounted to the firearm frame 22 about a separate transverse sear pivot axis 376. Sear protrusion 44 may be formed on one forward end of sear 375 opposite a rear end having a transverse opening which receives a cross pin 377 that defines pivot axis 376. In one embodiment, a rear facing vertical surface on sear protrusion 44 engages a mating front facing surface of catch protrusion 42 on striker 40 to hold the striker in the rearward cocked position. Striker 44 is movable in forward path P via a trigger pull between a rearward cocked position and a forwarding firing position contacting and detonating a chambered cartridge C to discharge the firearm.

Sear 375 is pivotably movable between an upward standby position in which sear protrusion 44 engages catch protrusion 42 of striker 40, and a downward fire position in which the sear protrusion disengages the catch protrusion to release the striker for firing the firearm 20. Sear 375 is held in the upward position by engagement with upstanding operating protrusion 333 on the central rotating member 304 of electromagnetic actuator 350 of the trigger mechanism 300 (see, e.g. FIGS. 27-28). In one embodiment, the front end of sear 375 may include a downward facing engagement surface 46 formed on a forwardly extending ledge-like protrusion of the sear which is selectively engageable with an upward facing engagement surface 48 formed on operating protrusion 333 of rotating member 304. Mutual engagement between surfaces 46 and 48 maintains the sear 375 in the upward position. Sear 375 may be biased towards the downward fire position by a spring 45 (shown schematically in FIGS. 28 and 29).

In operation, the firing mechanism is initially in the ready-to-fire condition or state shown in FIGS. 24, 27, 28, and 30. The striker 40 is held in the rearward cocked position by sear 375 which is in the upward standby position. Engagement surface 46 of the sear is engaged with engagement surface 48 of the actuator 350 (i.e. central rotating member 304). The trigger member 320 is not yet pulled. The microcontroller 200 is programmed with the control logic shown in FIG. 8 and may be initialized and active (Step 502), such as via the microcontroller detecting user activity on the firearm, such as the user's positive grip on the frame 22 sensed by grip force sensor 206 mounted to the frame, and/or motion of the firearm sensed by motion sensor 207 (see also FIG. 9). The rotating member is in the rearward unactuated position magnetically engaged with permanent magnet 308.

To fire the firearm 20, the operator or user pulls the trigger member 320 thereby applying a trigger pull force F which is sensed and measured by the trigger sensor such as thin film force sensing resistor 370. The electromagnet coil 306 is then energized by microcontroller 200 in accordance with the control logic of FIG. 8 in the manner previously described herein. The preprogrammed trigger force and displacement profile (e.g. breakpoint or breakover setpoint) is implemented in which the microcontroller energizes the electromagnetic actuator 350 and automatically adjusts the trigger activation force according to the preprogrammed profile created by the user. The user continues to pull the trigger until the central rotating member 304 of the actuator pivots forwards to the actuated position and breaks engagement with the sear 375 as shown in FIG. 29. Sear 375 then in turn drops and pivots downward thereby releasing the striker 40 which moves along path P to strike the chambered cartridge C and discharge the firearm 20. After firing, actuator 350 is de-energized by the microcontroller 200 as the user completely or partially releases the trigger which resets to the ready-to-fire position for the next firing cycle. In some embodiments, the microcontroller via actuation control circuit 202 transmits merely a short momentary pulse of electric current to the coil 306 which is sufficient to change state of the electromagnetic actuator 350 for implementing the trigger release profile and alter the primary resistance force generated by the permanent magnet 308 in the flux loop. The control circuit therefore performs a quick on/off switching of the power supply to the actuator. Accordingly, no feedback control is required for the microcontroller 200 to terminate electric power to the actuator 350.

Fire-by-Wire Dynamic Variable Force and Displacement Trigger Embodiment

Expanding on the variable force trigger concept disclosed herein, it may be ideal if both the trigger force and trigger displacement could be dynamically changed during the trigger pull and firing sequence. One way to accomplish this would be to completely separate the trigger function from the firing event. The trigger event would generate an electrical signal that would be sent by wire to a separate electromechanical actuator to fire the firearm. In this embodiment, the trigger force could be dynamically adjusted as before; but the displacement could also be dynamically adjusted. This can be accomplished by a predefined effect or with feedback using a displacement sensor 159 of a flux measurement type such as a hall-effect or alternatively a magnetoresistive sensor (e.g. GMR, TMR, AMR) sensor operably incorporated with the trigger mechanisms 100 (with single flux loop actuator 123) or 300 (with double flux loop actuator 350). Such a sensor could be placed near the air gap A (see, e.g. FIG. 7 or 29) to measure leakage flux at the air gap as the rotating trigger member 104/304 are moved. This measurement could be relayed to the microcontroller 200 and used to deduce the state of the electromagnetic actuator. The flux measurement displacement sensor would allow for the dynamic variation of trigger pull force based on travel or displacement and the trigger decision event could be defined as a specific displacement threshold. The possible force profiles to be defined, selected, and implemented under electrical control could be expanded to include any number of force/displacement curves with the displacement to firing being a new dynamic variable. A long easy trigger pull, verses a short heavy pull, or a long heavy pull, or even a short light hair trigger could be created by appropriately programming the microcontroller 200. The force and displacement could conceptually be fully programmable over a plurality of all possible ranges using the control system shown in FIG. 9.

Force feedback could be combined with the dynamic adjustment of displacement and force in trigger feel to indicate the firing point. At the point of firing, the trigger force could be dynamically changed to give the operator haptic or kinesthetic feedback of the fire decision being reached. Optionally, the kinesthetic feedback could be supplied slightly after the actual firing event to minimize the possibility of the user staging or anticipating the firing event and minimizing flinching which could adversely affect point of aim.

The fire-by-wire concept has one potential weak spot in that a single fire signal could result in a single point of failure. A false positive or negative signal resulting from a short, open, or other failure could result in a failure to function or unintended trigger event. One of several concepts that would mitigate this is to have the trigger event generate two redundant triggering signals, an armed and a fire event signal. Using the displacement sensor 159, a minimum displacement of the trigger could be used as a signal to arm the firing system. The final fire decision could be an electrical contact or optical switch. Using two or more sensors, with different failure mechanisms, should ensure no single failure point. By adding intelligence to the relationship of the two signals, the reliability can be enhanced further. For example, it should not be possible to arm the firing sequence unless the trigger displacement has recovered to a predetermined position and the electro-mechanical switch is in an open state. The displacement sensor could be used to arm the firing signal as displacement is increased but before the mechanical switch closes. The actual closing of the mechanical switch would need to happen within a predefined time window or the arm signal would time out. This would ensure that the trigger pull event is representative of an actual firing event and would not be duplicable as a random failure of several components at the same time.

It can be envisioned that by incorporating the additional system sensors shown in FIG. 9 beyond a trigger sensor(s), a series of operating conditions could be incorporated into the control logic used to enhance operation of an electronic fire-by-wire firing mechanism. Referring to FIG. 9, some possibilities could include grip force sensors 206 to ensure a ready-to-fire secure grip of the firearm by the user preceding the firing event, to inertia or motion sensors 207 that would preclude the firearm to function under dropping or accidental movement due to a fall, trip, or other similar incident, to the incorporation of other sensors operable to confirm suitable firing conditions based on the user, location, time of day, or environment.

The fire-by-wire electronic firing system may still incorporate a modified version of either trigger mechanisms 100 or 300. In such an application, electromagnetic actuators 123 or 350 of trigger mechanism 100 or 300 respectively would not physically engage/disengage a component of the firing mechanism as previously described herein. Instead, the actuators would simply be used to adjust the trigger release profile and breakpoint of the trigger member 104 or 320 in the manner previously described herein in accordance with the control logic of FIG. 8.

Figure 34A:
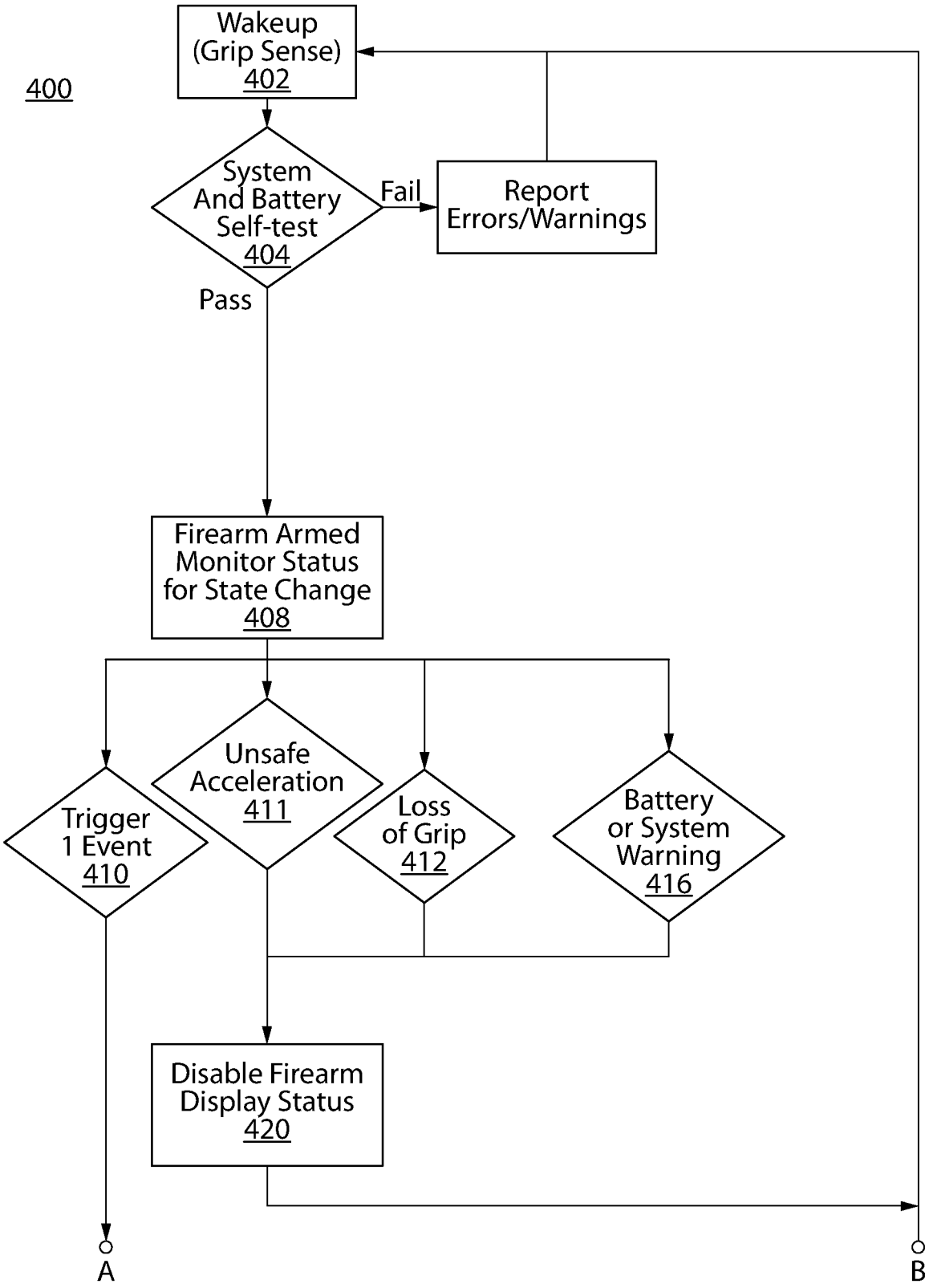
FIGS. 34A and 34B are first and second parts of a control logic diagram of a fire-by-wire electric firing system for a firearm implemented by the microcontroller.
Figure 34B:
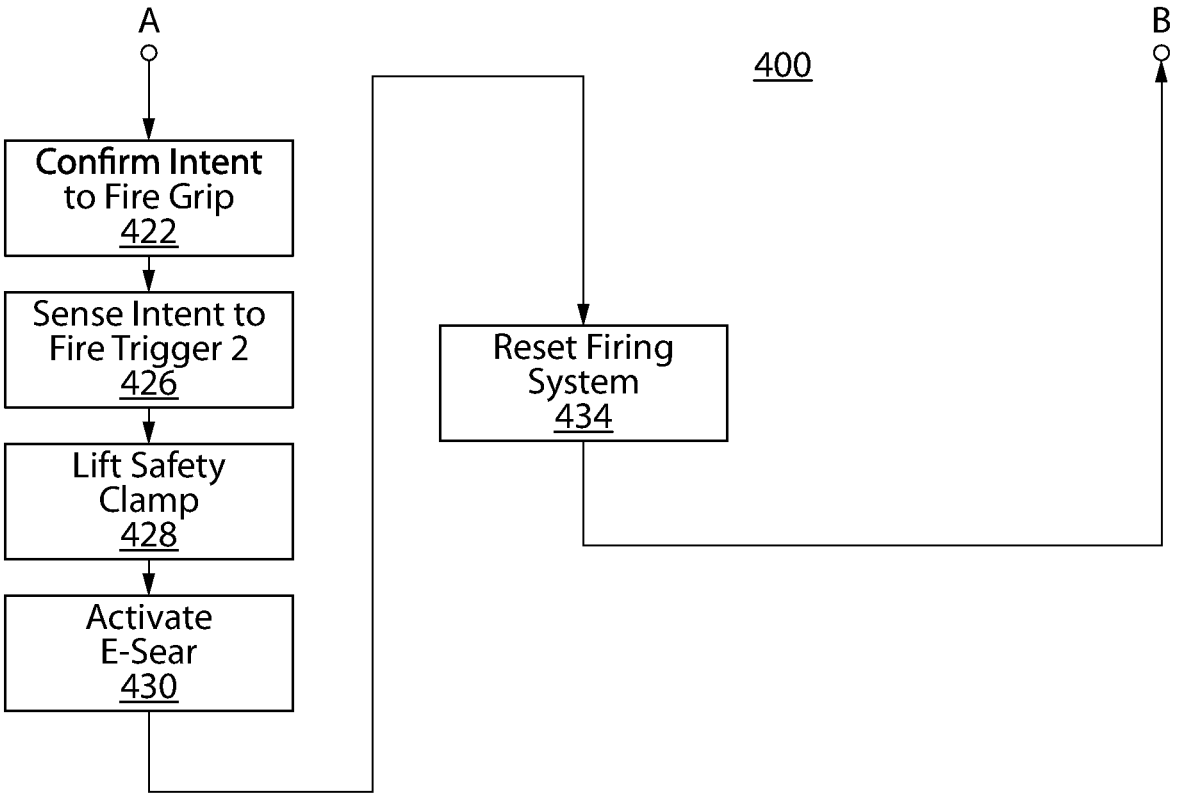
Figure 35:
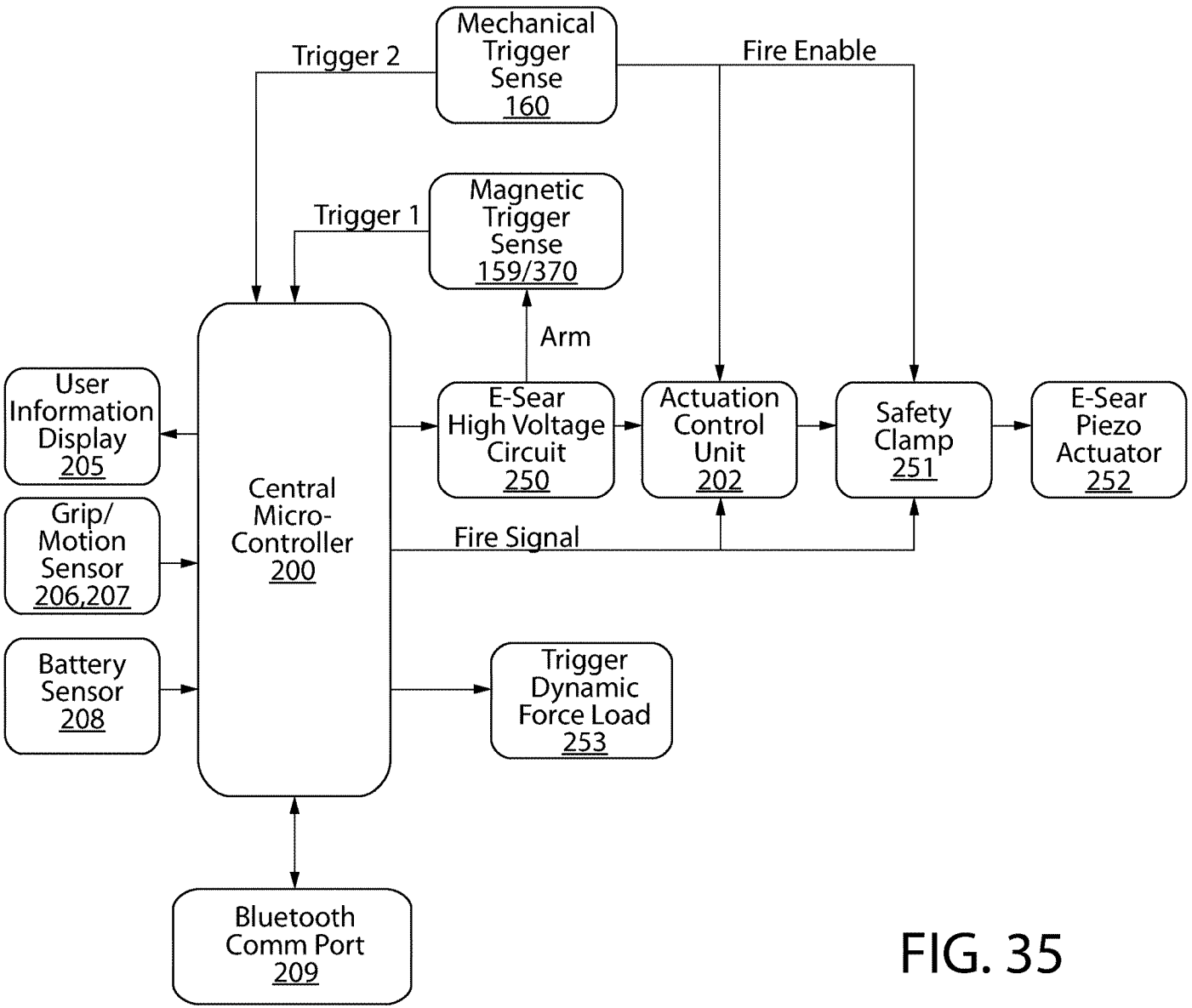
FIG. 35 is a system block diagram of the programmable microcontroller based control system for monitoring and operating the fire-by-wire firing system.

FIG. 34 shows an exemplary control logic process 400 which may be implemented by microcontroller 200 to control a fire-by-wire trigger mechanism having an electronic sear (E-sear) such as a piezo-electric actuator to detonate the cartridge. Such a system may be incorporated into any type of firearm, such as the pistol shown in FIG. 30 as one non-limiting example. FIG. 35 shows a modified control system amenable for use with such an electronic E-sear trigger mechanism. The trigger mechanism 400 may include a second mechanical trigger sensor 160 such as a mechanical switch in conjunction with a force or displacement trigger sensor 159/370 associated with the electromagnetic actuators 123/350 of firing mechanisms 100/300 depending on which firing mechanism is used with the fire-by-wire system.

Referring to FIGS. 34 and 35, the microcontroller 200 would awaken when it detects a wake-up signal generated from gripping the gun which is sensed by grip sensor 206 and communicated to microcontroller 200 (Step 402). Alternatively, this could be a motion detection wake-up signal sensed by motion sensor 207 instead of a grip sensor. On wake-up, a quick check that sufficient battery power is available and that the system is functioning is performed in the form of a self-test (Step 404). A failure of this self-test or battery check would result in aborting the start-up sequence and informing the operator of the error/warning so that corrective action can be taken.

If however the Step 404 test is positive, the microcontroller 200 will arm the firearm and continuously monitor for a trigger event and a number of other possible state change events in Step 408; some examples of which are indicated in FIG. 34. Alternatively, these state change events could be polled periodically on a reasonable preprogrammed time schedule to ensure reliable and timely detection.

An example of one state change event that would effect authorization is the detection of loss of intent-to-fire grip that would indicate the user no longer has control of the firearm (Step 412). Another example would be the detection of an unsafe acceleration force detected by motion sensor 207 (Step 411), which is associated with falling or being bumped or jarred while holding the firearm. In the presence of a high acceleration force, the system disables the firing due to unsafe conditions. Another example of state-change events would be the detection of a system error or the detection that the battery might not have sufficient remaining power to reliably actuate the magnetic actuator (Step 416). These types of faults and warning would also drop the firearm out of the arm state and indicate a warning to the user.

An actuation event cycle also starts if a trigger event is detected by trigger sensors in Step 410, and the firearm is in an armed state and no state change event (Steps 411, 412, or 416) has occurred to disarm the firing mechanism as indicated above. Steps 422 through 430 represent a firing sequence for the firearm implemented by microcontroller 200. For added safety, two independent trigger events, "Trigger Event 1" based a signal from mechanical trigger sensor 160 and "Trigger Event 2" based on a signal from the electronic sensor 159 or 370 may be used to initiate a valid trigger event. However, a single trigger sensor and event may be used in other embodiments. After the system detects Trigger Event 1 has occurred, the system then confirms that the firearm is still under the users physical control with an intent-to-fire grip (Step 422). Next, the system detects whether an intent-to-fire Trigger Event 2 is activated. This provides the double layer of firing security. Assuming Steps 422 and 426 are positive, the electronic safety shorting clamp 251 is lifted (Step 428) to enable the firing mechanism. A high voltage electric pulse or signal from circuit 250 is sent by the microcontroller 200 via actuation control circuit 202 to the E-sear piezo actuator 252 which discharges the firearm (Step 430). The firing system is then reset for the next firing event.

During the preceding firing sequence of the fire-by-wire firing mechanism, it bears noting that the control logic of FIG. 8 is simultaneously performed and implemented by the microcontroller 200 to adjust the trigger release profile according to the preprogrammed trigger breakpoint/breakover setpoint or displacement in the manner previously described herein. The trigger release settings and electric pulse sent to actuator 123 or 350 to activate the same (depending on whether the single or double loop actuator firing mechanism is used) is represented by block 253 in FIG. 35.

Magnetically Variable Trigger Mechanisms

The following disclosure describes non-electrically operated trigger mechanisms which are magnetically variable by manually adjusting the static magnetic field of the mechanism. These trigger mechanisms function without an electric power source or electromagnet to release a spring-loaded striking member for striking a chambered round of ammunition, but embody some of the same general magnetic operating principles of the electromagnetically operated trigger mechanisms described heretofore.

Traditional triggers for firearms provide a decisive intent-to-fire signal through mechanical motion that utilizes a displacement and force profile developed by using mechanical linkages, springs and the release of energy stored in a spring-biased hammer, striker, or sear. The trigger force and displacement curve or profile is normally fixed by these mechanical linkages and springs. A number of designs exist that provide adjustable characteristics for the force and displacement of the trigger using set screws, additional springs and other parts, or by completely changing components in order to customize the force-displacement profile of firearm triggers. Such adjustment techniques, however, modify the trigger pull force resistance in a purely mechanical manner which is limited by the physical interaction of trigger parts and associated linkages alone. To provide adjustment of the trigger pull force, these trigger mechanical linkages may therefore become quite complex, require multiple individual mechanical components, and hence are susceptible to wear and failure.

Exemplary embodiments of the present invention provide a trigger mechanism for a firing system of a firearm which is magnetically adjustable and variable, thereby providing quick and easy user-adjustment of the trigger pull force. Both closed and open magnetic flux loop designs are provided. In one implementation, the combination of a closed magnetic flux loop design and a manually translatable magnetic control device or insert configured and constructed to adjustably vary the magnetic field in the trigger mechanism produced by a permanent magnet disposed in the loop overcomes the deficiencies of purely mechanical and often complex adjustable trigger designs comprising multiple parts, springs, and linkages. The control device may comprise a "soft" magnetic material—a material preferably having a large relative magnetic permeability (i.e. the ability to support formation of a magnetic field in the material). As used in the art, "soft" magnetic materials refer to materials which are easily magnetized and demagnetized. Non-limiting examples include iron, low-carbon steel, nickel-iron, cobalt-iron, etc. The control device or insert in some embodiments is selectively and variably insertable into and retractable from a control recess or air gap (B) formed in the magnetic flux loop by varying degrees to adjust the trigger force. The control air gap B, formed by removing material from the stationary yoke, attenuates (i.e. decreases or diminishes) the maximum magnetic flux available in the loop at a working air gap (A) between the yoke and a movable trigger member which retains the trigger member magnetically to the yoke until the trigger member is pulled. Inserting the control device or insert into the control air gap B increases the magnetic flux in the closed loop at air gap A. Conversely, retracting the control device or insert from the control air gap B decreases the magnetic flux in the loop at air gap A. In some embodiments, the control device or insert may comprise the permanent magnet for the closed magnetic loop and inserting/retracting, or rotating the insert relative to the control air gap B changes the magnetic flux in the loop at air gap A. In another implementation, the combination of an open flux loop design and a manually translatable magnet configured to adjustably vary the proximity of a magnet to the trigger body provides adjustment of the trigger pull force. Each trigger mechanism design is further described herein.

In one aspect, embodiments of the magnetic trigger mechanism disclosed herein represent adjustable variable force magnetic air gap trigger designs. A permanent magnet in the closed flux loop generates a primary static magnetic field producing a fixed or static holding force for a trigger-sear release system which limits susceptibility to external magnetic fields that might affect the trigger force. By adjusting the control air gap in the closed magnetic flux loop via the magnetic control device, the fixed or static holding force can be increased or decreased to provide a variable range of trigger force breakpoints or setpoints that provide a crisp feel as the trigger pull force applied by the user to the trigger meets or crosses the fixed magnetic holding force set point during a trigger pull event. The fixed or static magnetic field generated by the permanent magnet in the closed flux loop creates a primary resistance force opposing movement of the trigger when pulled by the user. The trigger mechanism operates to release the movable sear of the firing system, which in turn releases a cocked energy storage device to discharge the firearm. The energy storage device may be a spring-biased striking member such as a pivotable hammer or linearly movable striker configured to strike and detonate a chambered ammunition cartridge; each of which is described herein.

FIGS. 36-49 depict several non-limiting example design embodiments and respective operating characteristics of closed loop non-electric magnetic only trigger mechanism having a user adjustable trigger force. Each design embodiment was evaluated using computer-aided finite element analysis (FEA) to determine the projected magnetic flux characteristics and trigger pull force profile of each design for comparison. The figures include illustrations which summarize the detailed finite element magnetic analysis of the performance of the different design embodiments and respective trigger pull force versus displacement profile graphs, thereby illustrating the characteristics and trade-offs between designs. An open magnetic loop design shown in FIGS. 50 and 51 was also computer modeled and analyzed for comparison to the closed magnetic loops designs.

The different examples of trigger mechanisms presented hereafter illustrate the relative features of the design strategies used in each design embodiment. The full analysis is not included; however, important summary performance is presented. It will be clear to those in the field that these examples are not exhaustive, but merely a sample of differing design strategies which can be implemented. It should also be clear that desirable design features of a trigger mechanism include a wide range of adjustable trigger pull force, an adjustment means that is relatively linear in response, and an adjustment means being relatively insensitive to normal mechanical tolerances.

Closed Magnetic Loop Designs

Figure 36:
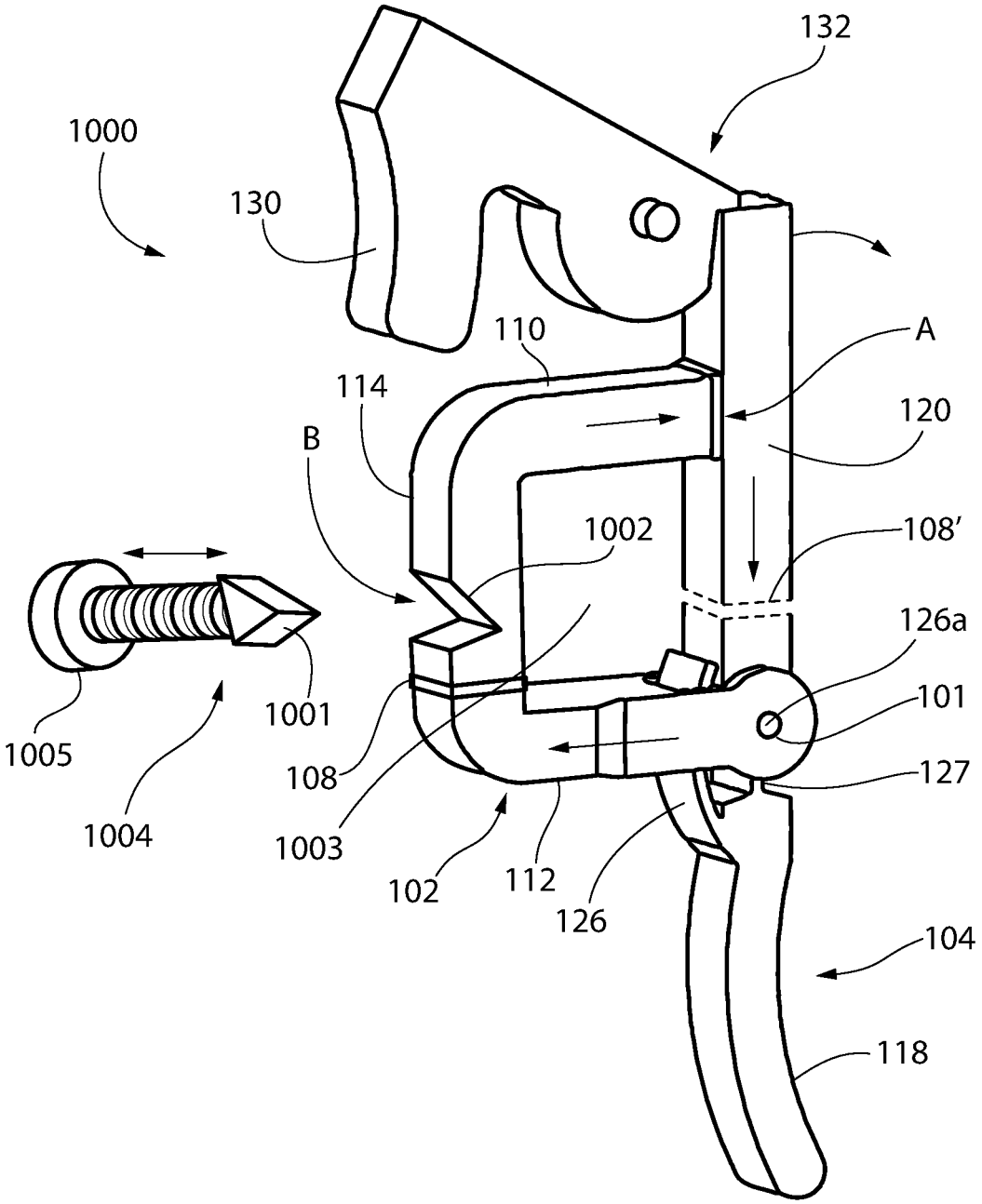
FIG. 36 is a side view of a first non-electric embodiment of a closed magnetic loop trigger mechanism comprising a sliding soft magnetic material wedge with trigger mechanism in a ready-to-fire position.
Figure 37:
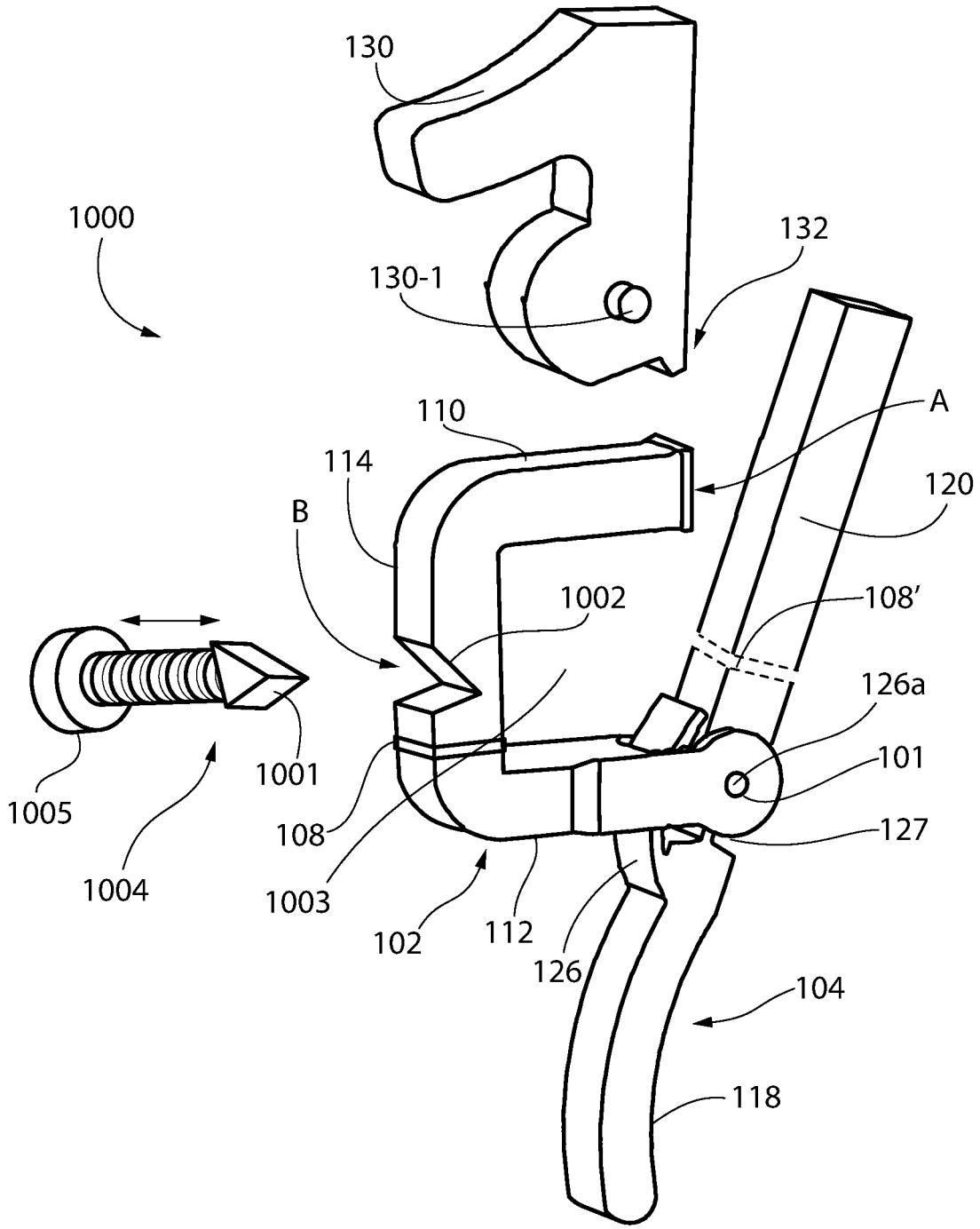
FIG. 37 is a side view thereof showing the trigger mechanism in the pulled firing position.

FIGS. 36 and 37 depict a first embodiment of a variable magnetically adjustable trigger mechanism 1000 configured for manually controlling the trigger force of a firearm trigger by using magnetic fields to directly constrain the movement of the trigger linkage or mechanism until a user preselected trigger release force (i.e. trigger force breakpoint or setpoint) is applied to the trigger and reached. The trigger mechanism shown in FIG. 36 is based on the electromagnetic trigger mechanism shown in FIG. 15 with non-linear leaf spring 126 and similar in construct with some revisions. Those features in common will not be discussed in detail for the sake of brevity. The electromagnetic coil 106 is notably omitted and replaced with an outwardly open control recess 1002 forming a magnetically adjustable control air gap B in yoke 102, as further described herein.

It bears noting that the magnet only trigger mechanisms described in this section of the application may also be used with any of the trigger assemblies shown in FIG. 6, 7, 13A, or 14A, and are therefore not limited in their applicability to the trigger assembly shown in FIG. 15 selected for convenience as representing represents one non-limiting embodiment.

Referring to FIGS. 36 and 37, the magnetic trigger mechanism 1000 generally includes a magnetic stationary yoke 102 and rotating trigger member 104. The yoke 102 may thus be fixedly but removably mounted to the frame 22 of the firearm, the receiver 39, or in an open receptacle of a trigger housing 1220 (see, e.g. FIG. 70) in turn attached to the frame or receiver. Any suitable mounting means may be used to fixedly mount the yoke 102 to the frame, receiver, or trigger unit housing such as for example without limitation fasteners, couplers, pins, interlocking features, etc. The mode of attachment is not limiting of the invention. Yoke 102 may be generally C-shaped in one configuration.

Rotating trigger member 104 of the trigger mechanism 1000 includes vertically elongated upper working extension or portion 120 and lower trigger portion 118 each mounted about pivot 101, as previously described herein with respect to FIG. 15. Upper working portion 120 of trigger member 104 preferably has a width commensurate with the width of the yoke 102 (i.e. yoke horizontal upper portion 110) where the working portion abuttingly but removably engages the end of the yoke at the air gap A.

The permanent magnet 108 may be disposed and arranged on or within the yoke 102 (see, e.g. FIG. 36), or alternatively on or in the upper portion 120 of the trigger member 104 at a suitable location (see, e.g. magnet 108' shown in dashed lines). In FIG. 36, the magnet 108 is embedded within the yoke 102 at a suitable location of its cross section. The magnet 108 alternatively may also be mounted on the free terminal end of the yoke 102 (e.g. horizontal upper portion 110) at the air gap A where it may engage the upper working portion 120 of trigger member 104 as one alternative non-limiting option. The permanent magnet 108 will produce the desired static magnetic field in trigger mechanism so long as the magnet is located somewhere within the closed magnetic loop formed by yoke 102 and rotating trigger member 104. Accordingly, the location of the permanent magnet 108 within the closed magnetic loop does not limit the invention.

Permanent magnet 108 preferably has dimensions and a cross-sectional area commensurate in dimensions and cross-sectional area to the cross section of the yoke 102, as shown (or alternatively the upper working portion 120 of trigger member 104 if mounted thereto as shown for example by magnet 108'. Optimal coupling of the flux lines of the magnet to the closed loop of magnetic material is achieved by such an arrangement and dimensions. If the magnet is smaller than the yoke in cross section, then flux lines will short across the gap B formed between the two yoke separated pieces in which there is no magnet, reducing the closed-loop flux in the circuit.

The yoke 102 and rotating member 104 are configured to collectively form an annular-shaped closed flux loop resistant to external magnetic fields. Yoke 102 and trigger member 104 define an enclosed open central space 1003 therebetween (see, e.g. FIG. 36). The permanent magnet 108 generates a static magnetic field or flux (see directional flux arrows) creating a fixed holding force on the rotating member 104. This creates a primary fixed or static resistance force opposing movement of the trigger mechanism when actuated by the user.

A completely openable/closeable air gap A is formed between the yoke and rotating member. The air gap A may be vertically oriented and normally held closed by the static holding force created by the permanent magnet 108, and opened when the trigger is pulled by the user to overcome the static holding force and discharge the firearm.

The preferably strong permanent magnet 108 arranged in the closed magnetic flux loop maintains a high static holding force threshold inhibiting the movement of the trigger portion 104 (e.g. "trigger" alternatively) around the pivot point 101.

The magnetic control device used to alter the static magnetic field and establish a trigger force breakpoint or setpoint comprises the adjustably translatable soft magnetic material control insert 1001. In one embodiment, the control insert 1001 may be in the form of a triangular or V-shaped wedge formed of a magnetically conductive material such as without limitation a suitable soft magnetic metal capable of being magnetized by a magnet, such as without limitation iron, low-carbon steel, nickel-iron, cobalt-iron, etc. This same material may be used for the yoke 102 and rotating trigger member 104. The control insert 1001 is linearly translatable to project into or retract from a secondary control air gap B formed in the yoke 102 to change the reluctance. Air gap B may comprise an outwardly open and angled wedge-shaped (e.g. triangular) control recess 1002 in one embodiment as shown which may be formed in the yoke 102 by partially removing some material such that the recess does not completely sever the cross section of the yoke (see, e.g. FIGS. 36-38). Control recess 1002 in the present wedge embodiment only partially severs the cross section of the yoke 102. In other embodiments as shown in FIG. 39, however, the recess 1002 may completely sever the cross section of the yoke 102. Both the partially closed and fully open embodiments of control recess 1002 form a wedge-shaped negative space which is filled to varying degrees by the magnetically conductive wedge-shaped control insert 1001 to change and adjust the primary static magnetic field or flux. One characteristic of the partially connected design is that it would have a well defined low end holding force that is independent of the control air gap wedge insert.

To linearly translate or move the soft magnetic material control insert, a manually operable actuator 1004 may be operably coupled to the wedge-shaped control insert 1001. The actuator 1004 may be movably mounted to the firearm frame 22, receiver 39, or alternatively a trigger housing 1220 (see, e.g. FIG. 70). In either of the foregoing mounting arrangements, the actuator is ultimately supported directly or indirectly by the frame 22 to which the receiver and/or trigger housing are attached.

The actuator 1004 in one non-limiting example may be comprise an insert adjustment screw 1005 which acts on the wedge-shaped control insert 1001 as shown in FIGS. 36 and 37. The adjustment screw 1005 converts rotary motion applied by the user to turn the screw into a linear translation of the control insert 1001 relative to control air gap B. In some possible embodiments, the control insert 1001 may be mounted directly to an end of the screw 1005 as shown. Rotating the screw in opposing directions therefore linearly projects the control insert wedge into or retracts the control insert wedge from the control air gap B created by control recess 1002 to varying degrees for adjusting the trigger pull force according to the user's preferences.

The position of the wedge-shaped control insert 1001 relative to the angled control air gap B and concomitantly the yoke 102 increases or decreases the static holding force in the closed magnetic loop of the trigger mechanism, which holds the upper working portion 120 of trigger member 104 against the yoke 102. This in turn creates the user-adjustable trigger pull force which must be overcome by the user in order to pivot the trigger member about pivot 101 and open the air gap A for releasing the striking member, such as for example without limitation the spring-biased hammer 130 shown in FIG. 37.

In sum, rotating and linearly moving actuator 1004 accordingly moves the control insert 1001 between a first position relative to the control air gap B producing a first magnetic static holding force in the closed magnetic loop, and a second position relative to the control air gap B producing a second magnetic static holding force different than the first force (e.g. more or less).

FIG. 36 shows trigger mechanism 1000 in the ready-to-fire position. Air gap A is fully closed (i.e. upper working portion 120 of trigger member 104 is abuttingly engaged with the yoke 102). The spring-biased hammer 130 (spring not shown) is held in the rearward cocked position via engagement with a sear surface 132 formed by the trigger member working portion 120, which defines a vertically elongated sear as described previously herein with respect to FIG. 15. After the trigger is pulled, the trigger member working portion 120 rotates forward to break engagement between sear surface 132 and the hammer 130, thereby releasing the hammer to strike the firing pin and discharge the firearm. Air gap A is fully open at this point as shown in FIG. 37 showing the firing position of the trigger mechanism 1000.

Figure 39:
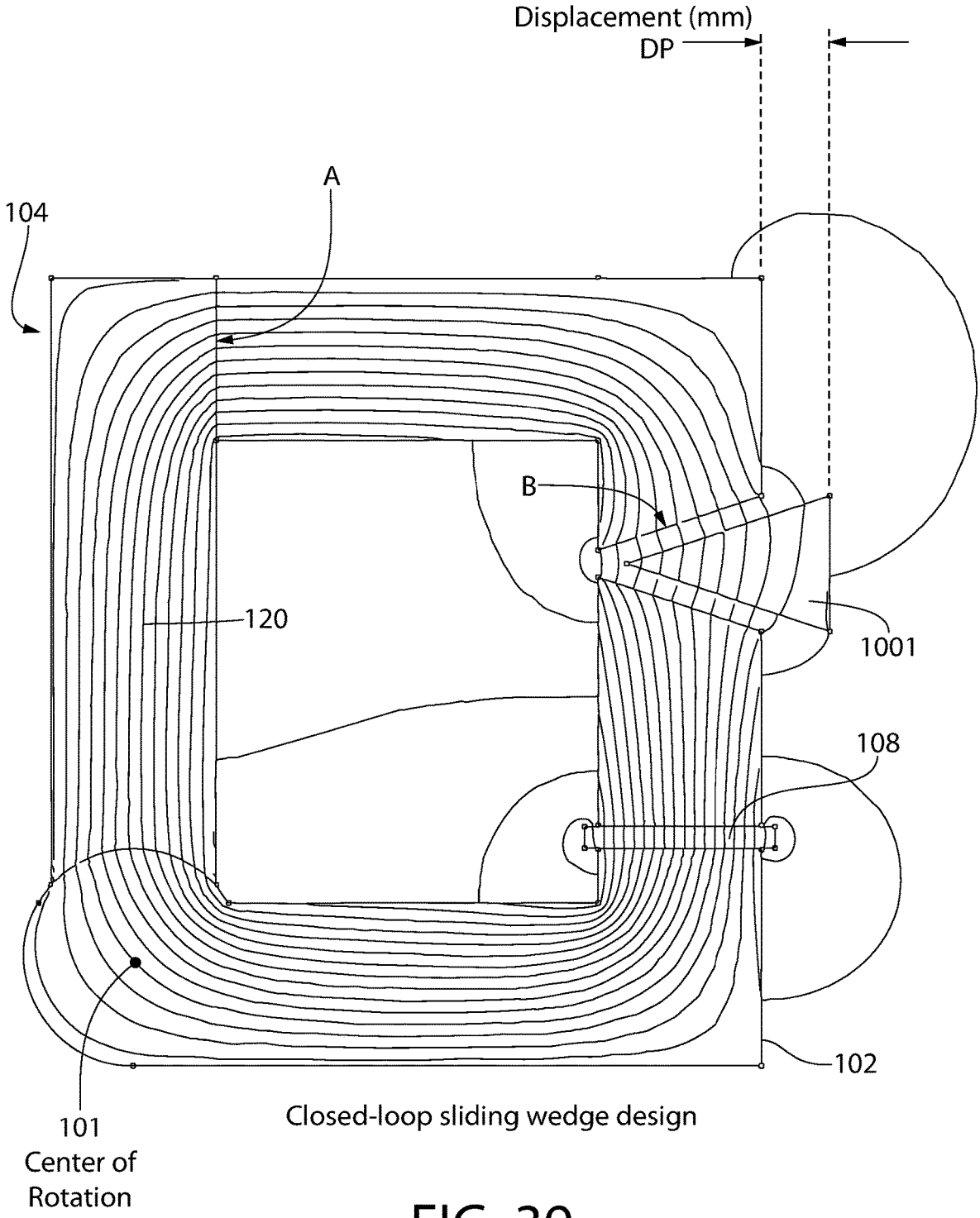
FIG. 39 shows computer-modeled magnetic flux lines generated by the trigger mechanism of FIGS. 36 and 38.
Figure 40:
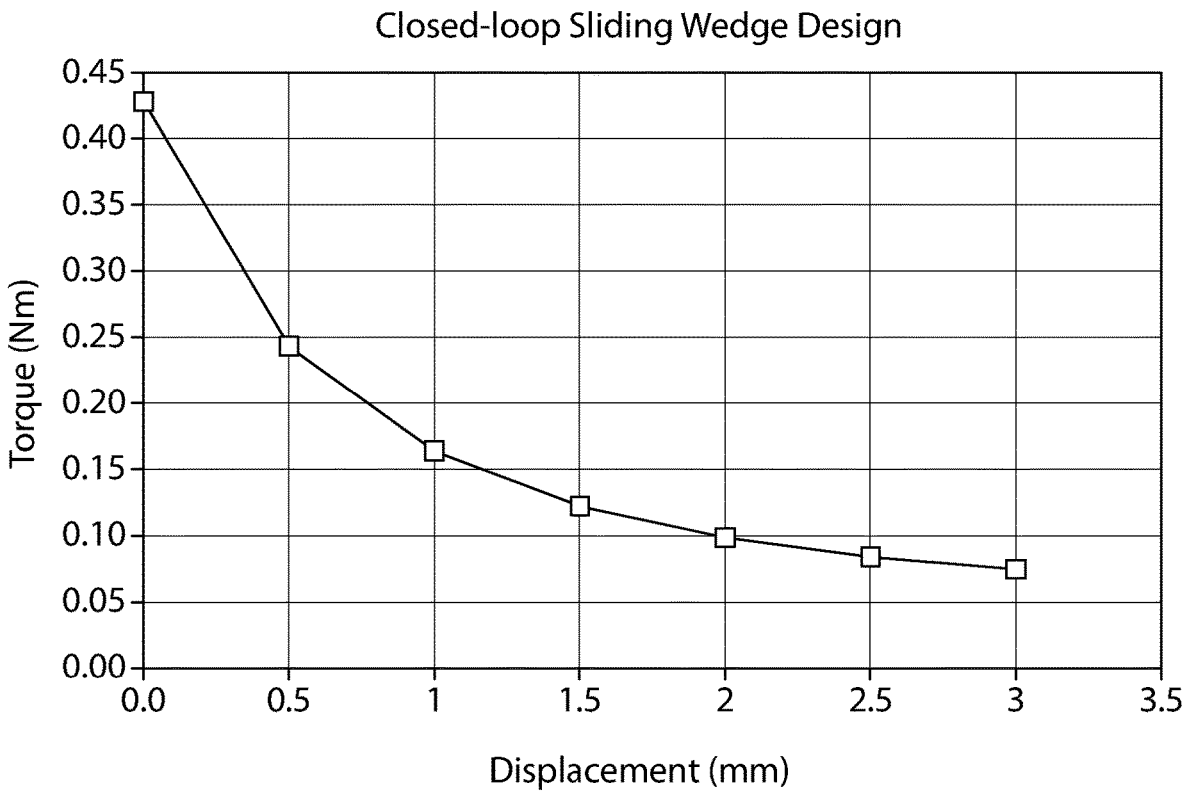
FIG. 40 shows the results of finite element analysis (FEA) of trigger mechanism of FIGS. 36 and 38 in a trigger pull force (Torque) versus displacement (Dp) profile graph.

FIG. 39 shows a side view of the closed-loop sliding wedge design of trigger mechanism 1000 with computer-modeled magnetic flux lines illustrated. In this case, a steel wedge (soft magnetic material) is slid in and out of similarly angled control air gap B in the magnetized stationary yoke via operation of the actuator 1004, thereby providing a variable reluctance at air gap A based on the horizontal displacement or position of the wedge control insert 1001 relative to control air gap B. It should be noted that the analysis of FIG. 39 and FIG. 40 is performed on the alternative embodiment of FIGS. 36 and 37 in which the control recess 1002 fully severs the cross section of the yoke 102. FIG. 40 shows the results of finite element analysis (FEA) of this design in a trigger pull force (Torque) versus displacement (Dp) profile graph. This figure shows that the torque on the trigger member 104 varies from almost 0.08 to 0.42 Nm over a trigger displacement range of about 3 mm. The variation is fairly non-linear and is more susceptible to mechanical tolerance variations than the sliding magnet or rotating magnet designs further described elsewhere herein by comparison, but nonetheless may be acceptable. Notably, the graph in FIG. 40 shows this trigger mechanism exhibits a high initial trigger pull force requirement which then relatively rapidly decreases over the remainder of the trigger displacement range to the point of discharging the firearm.

Figure 38:
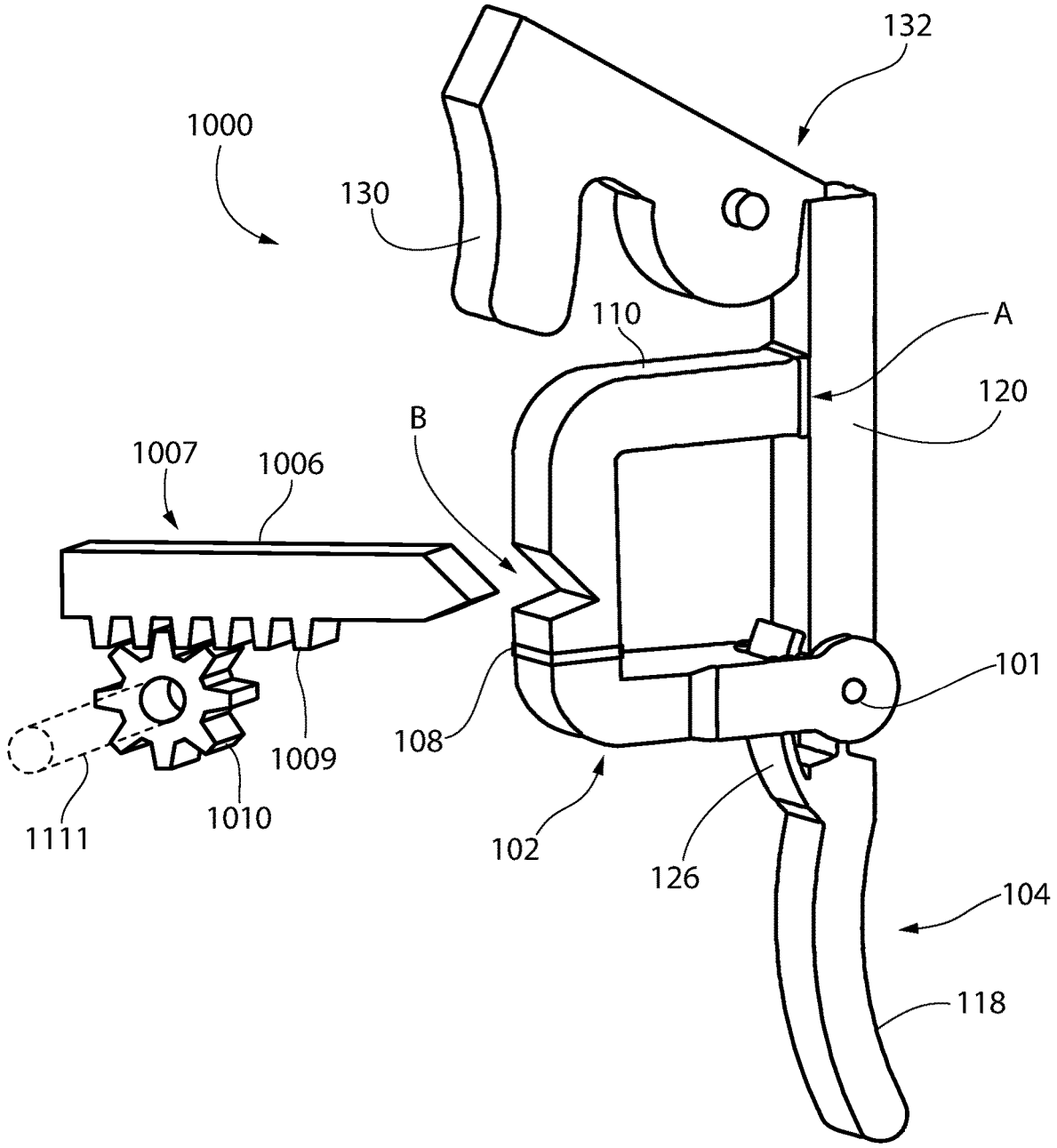
FIG. 38 is a side view a second non-electric embodiment of a closed magnetic loop trigger mechanism comprising a sliding soft magnetic material wedge but with an alternative actuator mechanism for translating the sliding wedge.

An alternate actuator 1007 for linearly translating the wedge-shaped control insert 1001 of trigger mechanism 1000 is shown in FIG. 38. This actuator may include a gear mechanism comprising a toothed linear gear rack 1009 disposed on a linearly elongated wedge 1006 and a manually adjustable and rotatable toothed gear pinion 1010 engaged with the rack. Pinion 1010 may be mounted via a crosswise control shaft 1111 arranged transversely to the wedge and mounted in the frame, receiver, or trigger housing. The end of the control shaft 1111 may be exposed and accessible from outside the firearm frame to the user for making adjustments to the trigger pull force. The end of shaft 1111 may include a knob, or be configured with a tooling interface (e.g. hex key interface recess, Philips or slotted screwdriver interface recess, etc.) to facilitate rotating the shaft by the user. Rotating the pinion 1010 in opposing directions similarly projects or retracts the wedge into/from control air gap B in a linear manner similar to screw actuator 1004. The magnetic flux lines and FEA trigger pull force graph are the same as in FIGS. 39 and 40.

By adjusting the displacement and position of a wedge control insert 1001 of magnetically conductive material relative to control air gap 1002, the effective length of the control air gap 1002 (the distance magnetic flux lines have to travel in air) can be varied. As the effective length is shortened, the total magnetic flux in the closed loop magnetic circuit increases, and hence the flux density in the air gap A is increased resulting in greater trigger holding force (torque). An increase in the effective length of control air gap 1002 has the opposite effect. Adjusting the displacement and position of control insert 1001 therefore adjusts and changes the resulting strength of the trigger static magnetic field and holding force that creates a primary resistance force opposing movement of the trigger member when pulled by the user that must be overcome. Inserting the wedge control insert 1001 farther into control air gap B increases the static magnetic holding force to increase the required trigger pull force. Conversely, withdrawing control insert 1001 from the control air gap B decreases the static magnetic holding force to lessen the required trigger pull force.

Figure 41:
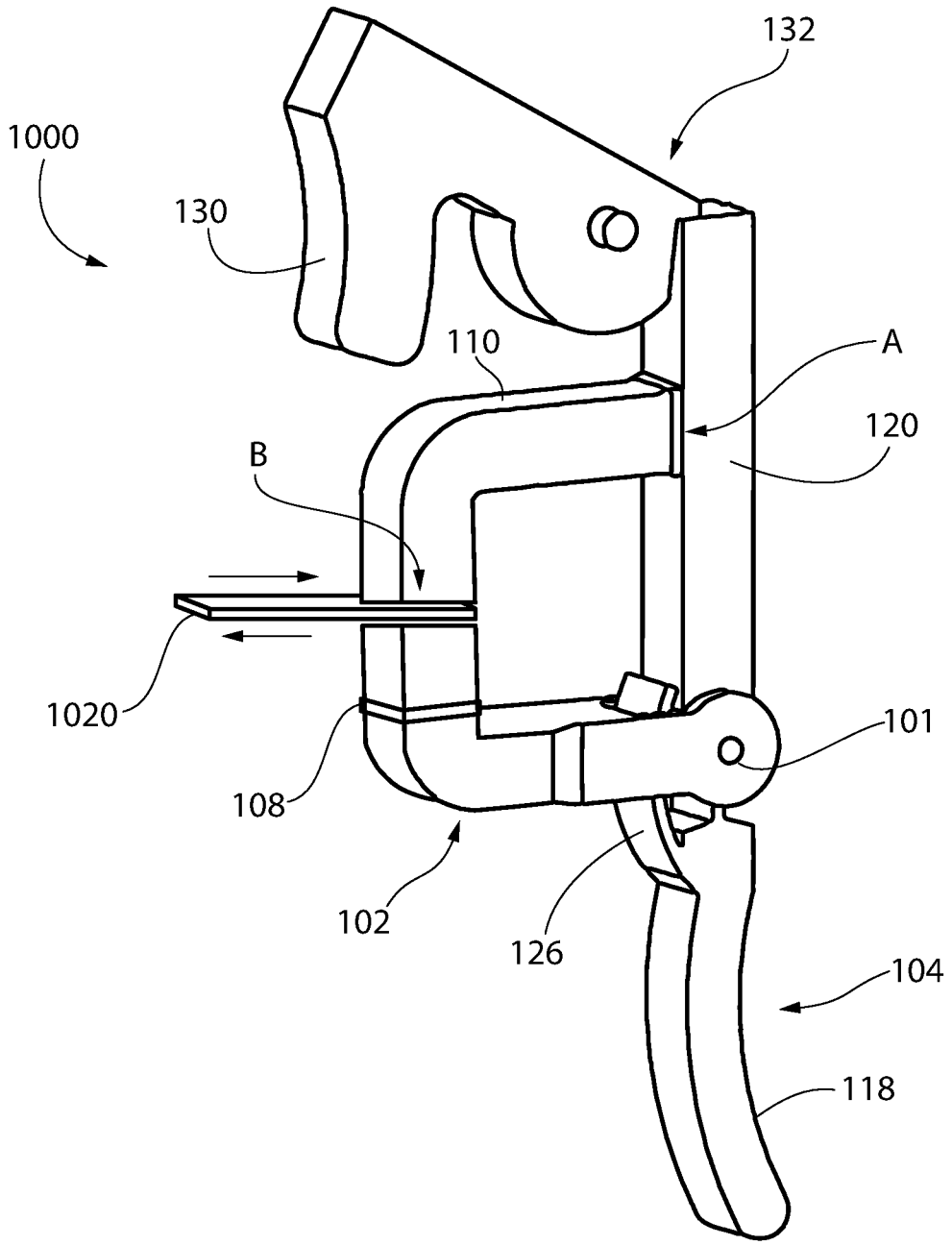
FIG. 41 is a side view of a third non-electric embodiment of a closed magnetic loop trigger mechanism comprising a sliding soft magnetic material plate.

In alternative embodiment shown in FIG. 41, a variable control air gap B is controlled by moving a control insert 1020 in the form of a substantially planar rectangular block or plate of soft magnetic material into or out of the flux path in the trigger mechanism 1000 to varying degrees to change the reluctance and trigger pull force. Other suitable shapes may be used. The control air gap B in this embodiment completely severs the cross section of the yoke 102 at air gap B (i.e. intermediate portion 114 of the yoke). The horizontal upper and lower portions 110, 112 and adjoining parts of the vertical intermediate portion 114 above and below the control air gap B in this case may be separately mounted to the support structure (e.g. frame, receiver, or trigger housing) via any suitable methods (e.g. fasteners, etc.). In the non-limiting illustrated embodiment, the plate-like control insert 1020 has a length and width greater than the vertical thickness of the plate. The adjustably translatable soft magnetic material control insert 1020 may similarly be formed of a magnetically conductive material such as without limitation a suitable soft magnetic metal capable of being magnetized by a magnet, such as without limitation iron, low-carbon steel, nickel-iron, cobalt-iron, etc. Any suitable manually operable actuator such as actuators 1004 and actuator 1007 previously described herein, or another type actuator may be used to adjust the position of the plate-like control insert relative to control air gap B.

The present closed-loop sliding plate design is based on a principle which allows the magnetic flux to be choked off by introducing a restriction in the magnetic loop. By contrast, it bears mention here that both the sliding magnet design and the rotating magnet design as further described below are based on varying the amount of total flux coupled from the magnet 108 into the magnetic yoke 102.

Figure 42:
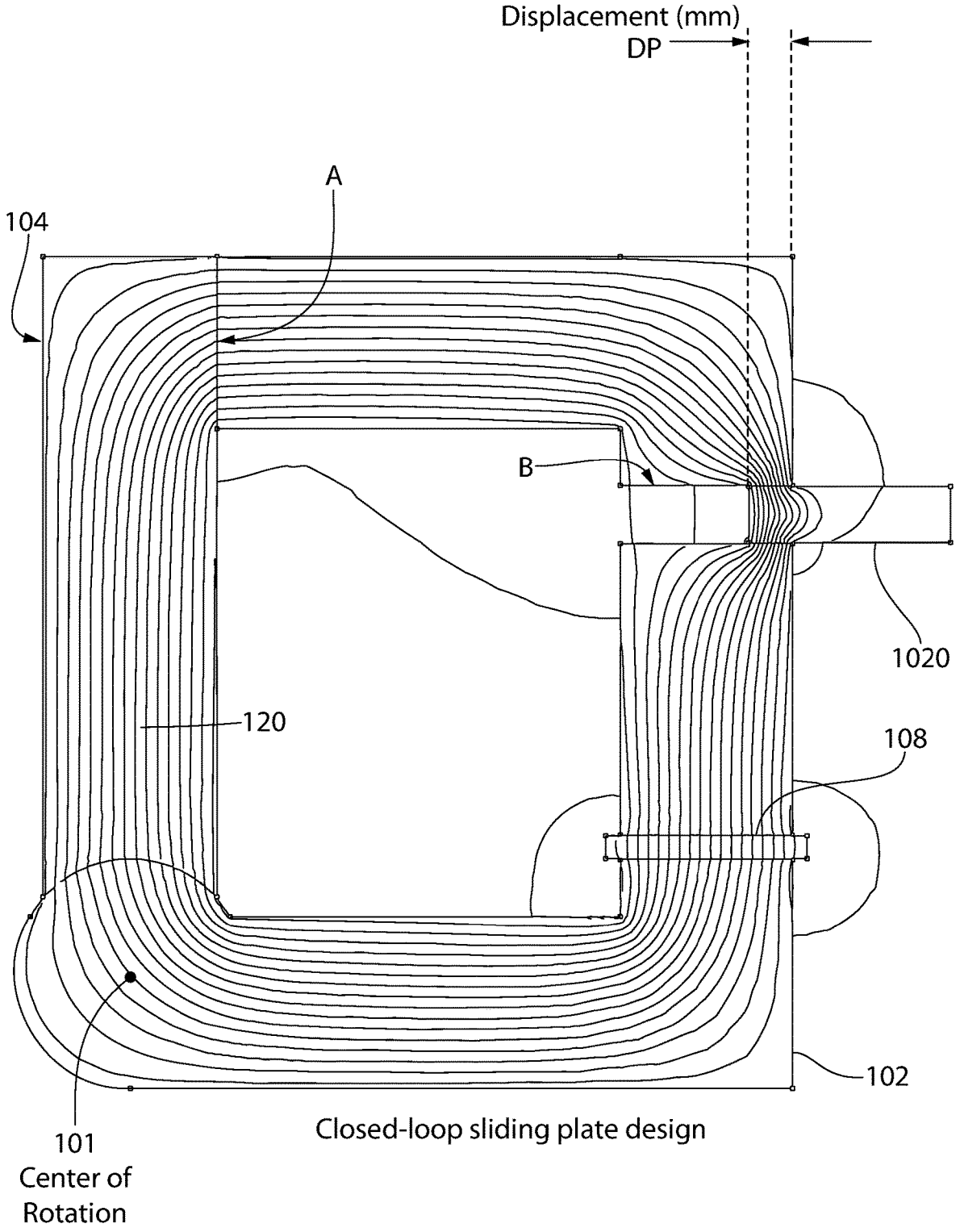
FIG. 42 shows computer-modeled magnetic flux lines generated by the trigger mechanism of FIG. 41.
Figure 43:
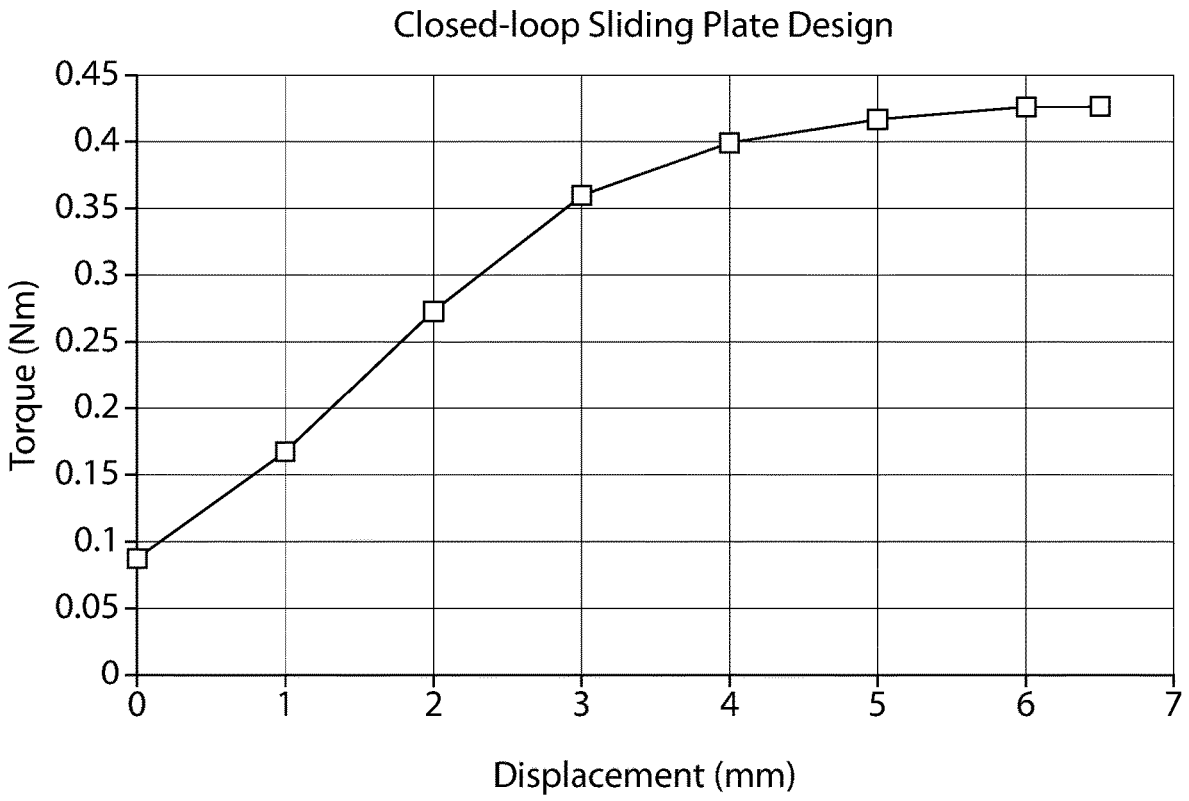
FIG. 43 shows the results of finite element analysis (FEA) of trigger mechanism of FIG. 41 in a trigger pull force (Torque) versus displacement (Dp) profile graph.

FIG. 42 shows a side view of the closed-loop sliding plate control insert 1020 design of trigger mechanism 1000 with computer-modeled magnetic flux lines illustrated. In this case, a steel plate (soft magnetic material) is slid in and out of the control air gap B of magnetic yoke 102 providing a restriction in the magnetic loop. FIG. 43 shows the results of finite element analysis (FEA) of this design in a trigger pull force (Torque) versus displacement (Dp) profile graph. FIG. 43 shows that the torque on the trigger member 104 varies from almost 0.08 to 0.42 Nm over a range of about 5 mm. In contrast to the sliding wedge design described herein, the graph in FIG. 43 shows the sliding plate design exhibits a low initial trigger pull force requirement which then increases over the control displacement range. The performance of the sliding plate design however is not quite as good as the sliding magnet design described elsewhere herein, but nonetheless acceptable. Contrasting FIG. 43 (sliding plate) and 46 (sliding magnet), the range of torque is larger and the variation of displacement is more linear for the sliding magnet design. A major advantage of sliding the magnet in and out of control air gap B versus just adjusting the width of the airgap via the sliding soft magnetic material plate is that adjustment of the airgap width is a precision movement over a very small range to make a large change in torque. This will take a precision adjustment to control the small changes in width of the airgap. With the sliding magnet, the effective change in torque is distributed over a longer movement from totally open to completely centered in the yoke. It is a much less sensitive adjustment that does not require the same degree of precision adjustment tolerance. The sliding plate design relies on the principle of saturating the soft-magnetic material which is a less precise physical parameter than the physical coupling of flux lines from a permanent magnet into the yoke by varying the magnet position relative to the yoke.

Figure 44:
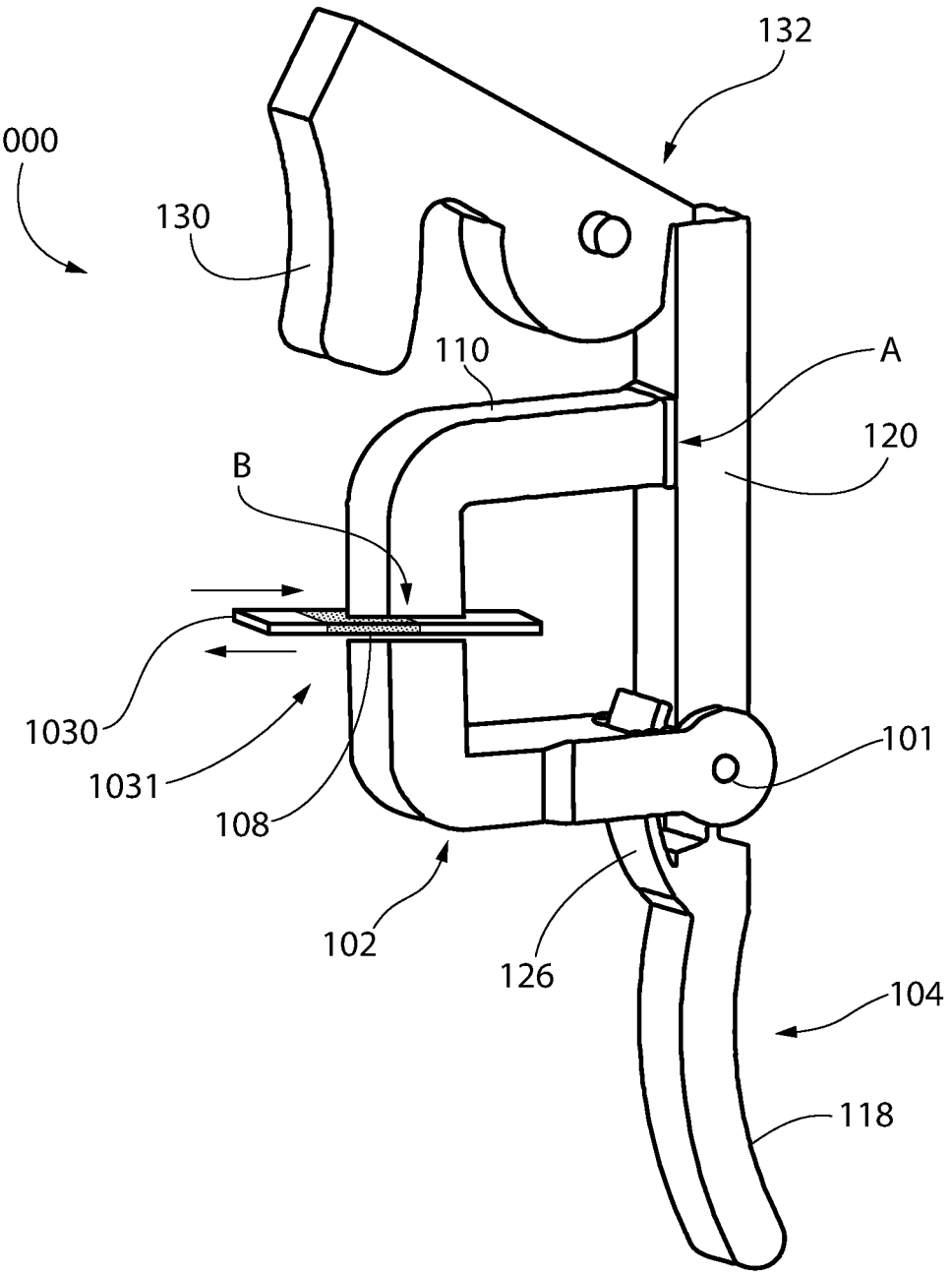
FIG. 44 is a side view of a fourth non-electric embodiment of a closed magnetic loop trigger mechanism comprising a sliding magnet.

FIG. 44 depicts another alternative approach and embodiment of trigger mechanism 1000 which provides a movable control insert 1031 incorporating magnet 108 in lieu of the movable soft magnetic material wedge or plate designs described above. In the moving magnet design, the permanent magnet is not mounted to the stationary yoke 102 or rotating trigger member 104 as in the moving soft magnetic material embodiments. Instead, the permanent magnet 108 may be mounted on or encapsulated in a thin wall carrier 1030 which preferably is formed a non-magnetic material such as for example without limitation nylon or other suitable polymers. Carrier 1030 may have a plate-like body in one embodiment having a width and length greater than its vertical thickness as shown. The polymeric carrier 1030 would act as both a protective cover to the magnet as well as a means and/or bearing surface for guiding the magnetic into or out of the flux path at control air gap B coupling to the trigger release surface at the interface between the yoke 102 and trigger member 104 at air gap A. The carrier 1030 with magnet 108 may be translated by a suitable actuator such as those described herein which are operably coupled to the carrier. It bears noting that control air gap B is formed by a completed severed section of the yoke 102 similarly to the sliding plate design shown in FIG. 41 and previously described herein.

Figure 45:
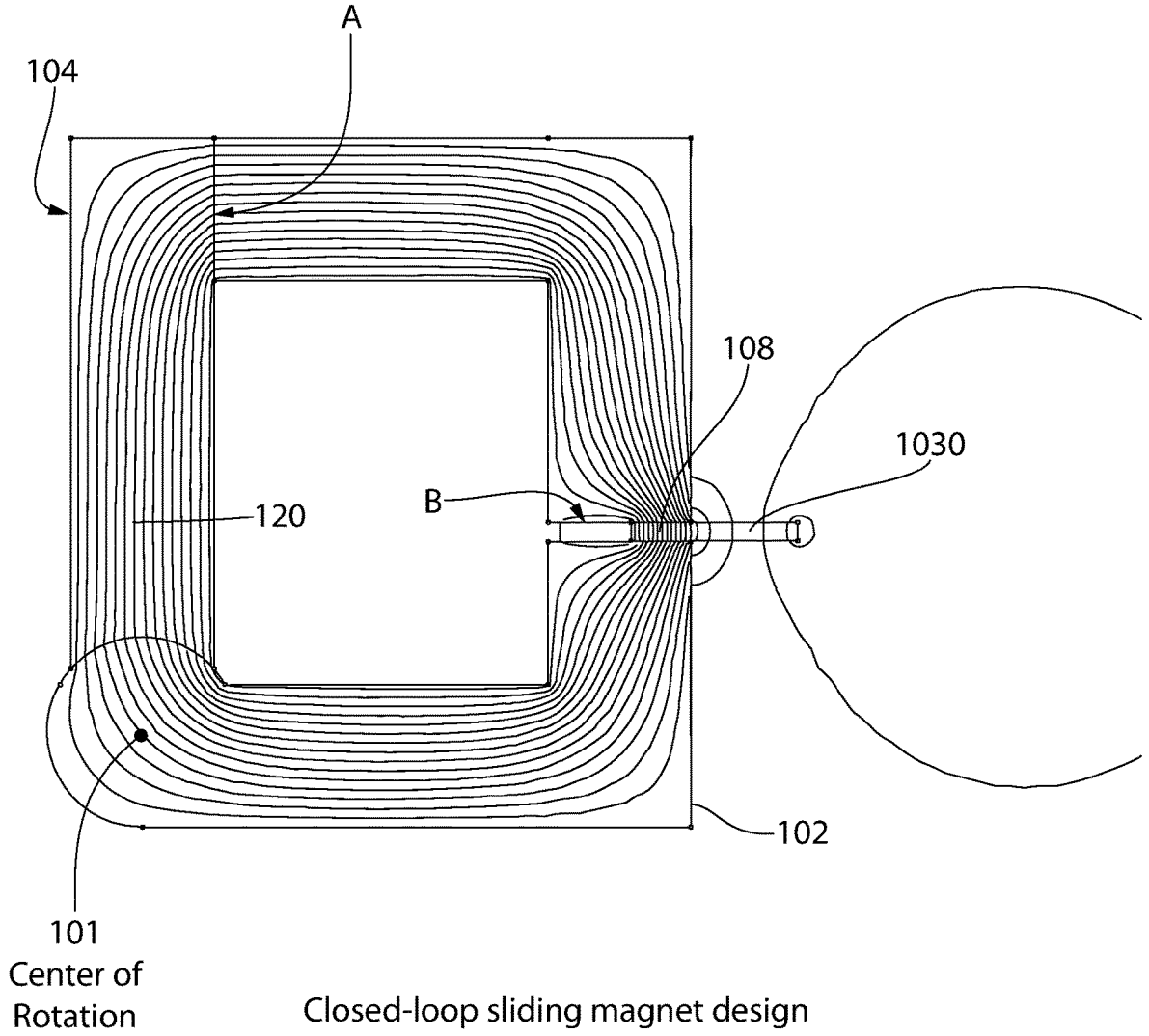
FIG. 45 shows computer-modeled magnetic flux lines generated by the trigger mechanism of FIG. 44.
Figure 46:
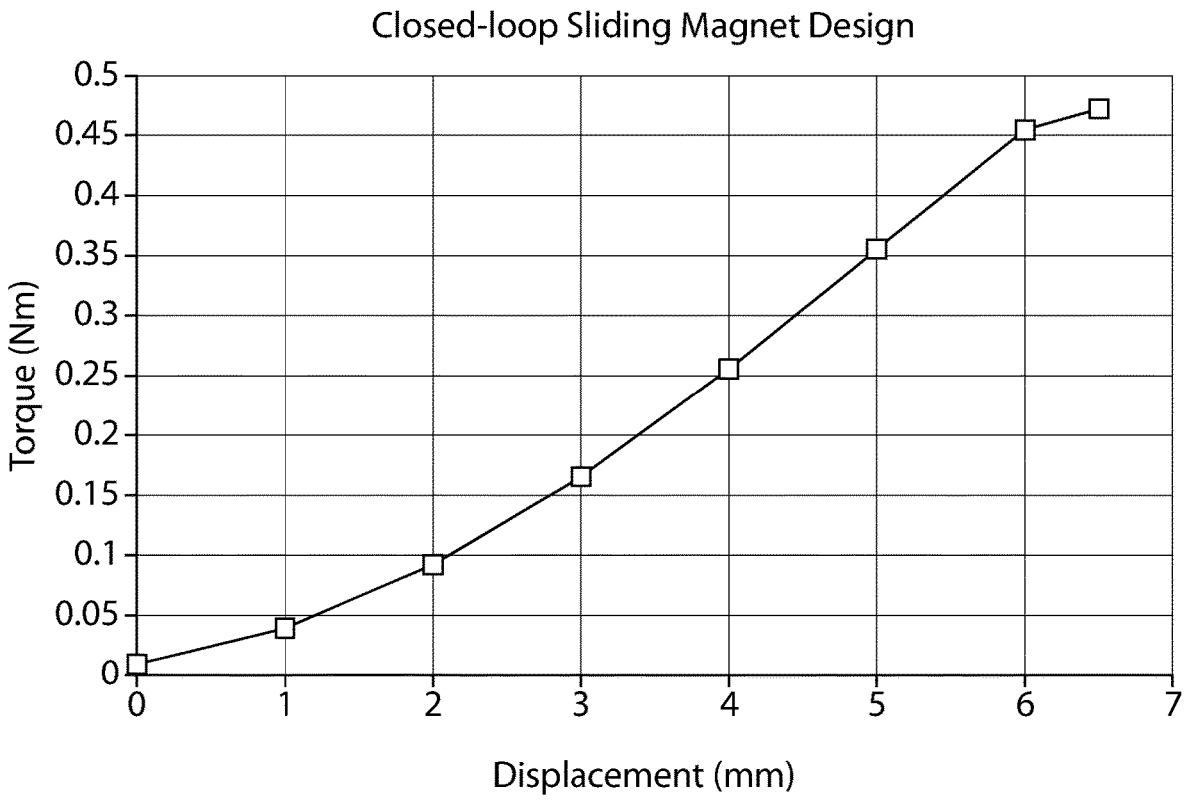
FIG. 46 shows the results of finite element analysis (FEA) of trigger mechanism of FIG. 44 in a trigger pull force (Torque) versus displacement (Dp) profile graph.

FIG. 45 shows a side view of the closed-loop sliding magnet control insert 1031 design of trigger mechanism 1000 with computer-modeled magnetic flux lines illustrated. In this case, the magnet 108 mounted to the non-magnetic carrier 1030 is slid in and out of the control air gap B of magnetic yoke 102. FIG. 46 shows the results of finite element analysis (FEA) of this design in a trigger pull force (Torque) versus displacement (Dp) profile graph. FIG. 46 shows that the torque on the trigger member 104 varies from almost 0 to 0.47 Nm over a range of about 6.5 mm. In general, this option beneficially offers wide ranges of user-adjustable holding torque with less sensitivity to mechanical displacement errors. The holding force as a function of displacement is non-linear in this closed magnetic loop design, but it is still closer to linear which is desirable than in the open loop design case. Generally, it is desirable to have a large range of torque adjustment, and that the range of adjustment is close to linear. A uniform relationship between the amount of displacement to the change in torque over the usable range of the trigger is ideal. For example: one mm of displacement represents one unit of torque change along the whole range of possible torque settings. By contrast in FIG. 40, it is evident that torque changes much more with the same displacement change at the higher torque range that at the lower torque range. In FIG. 46, however, it can be observed that the change in torque with displacement is similar anywhere along the range except for the extreme endpoints, thereby representing a more ideal trigger setup.

Figure 47:
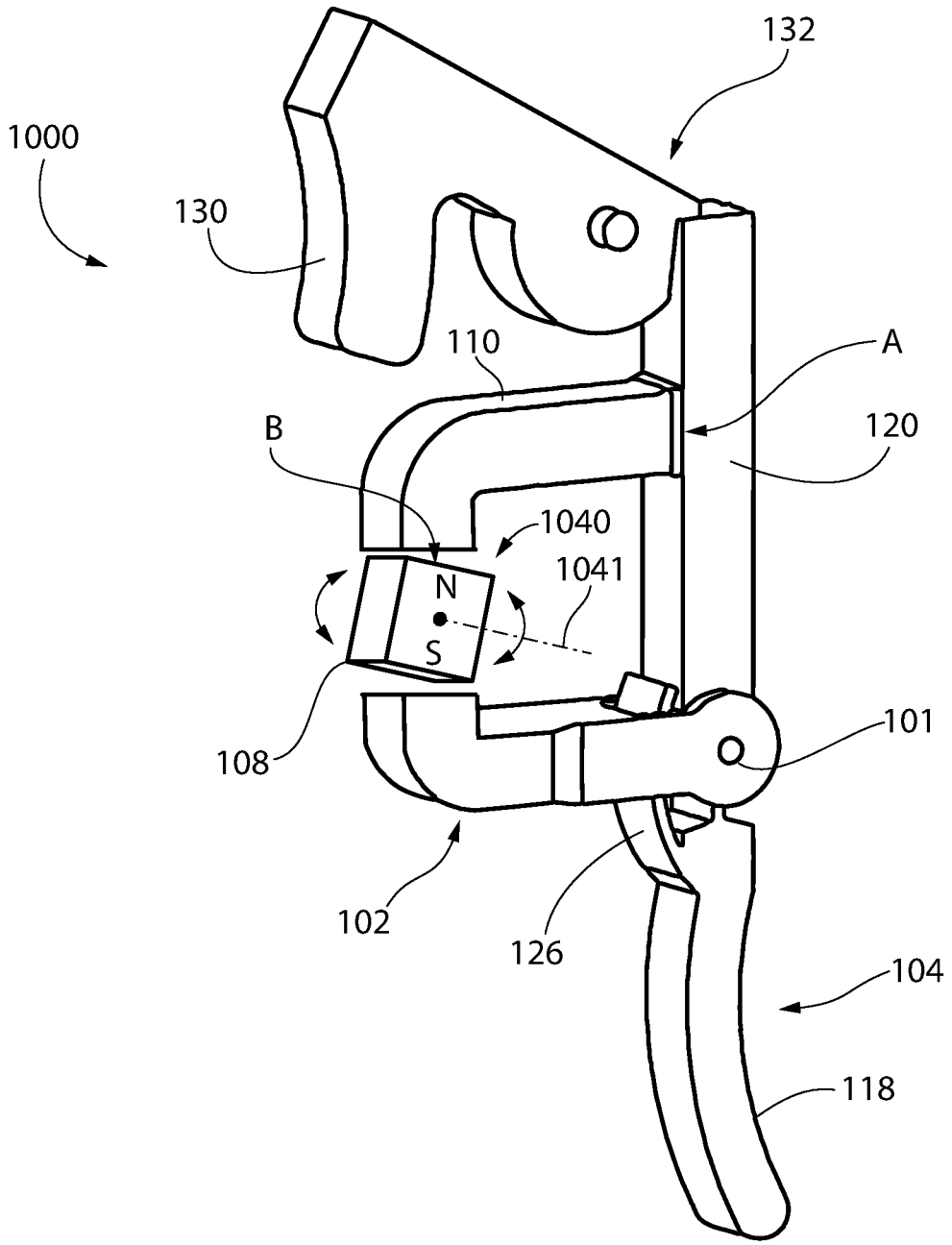
FIG. 47 is a side view of a fifth non-electric embodiment of a closed magnetic loop trigger mechanism comprising a rotating magnet.
Figure 48:
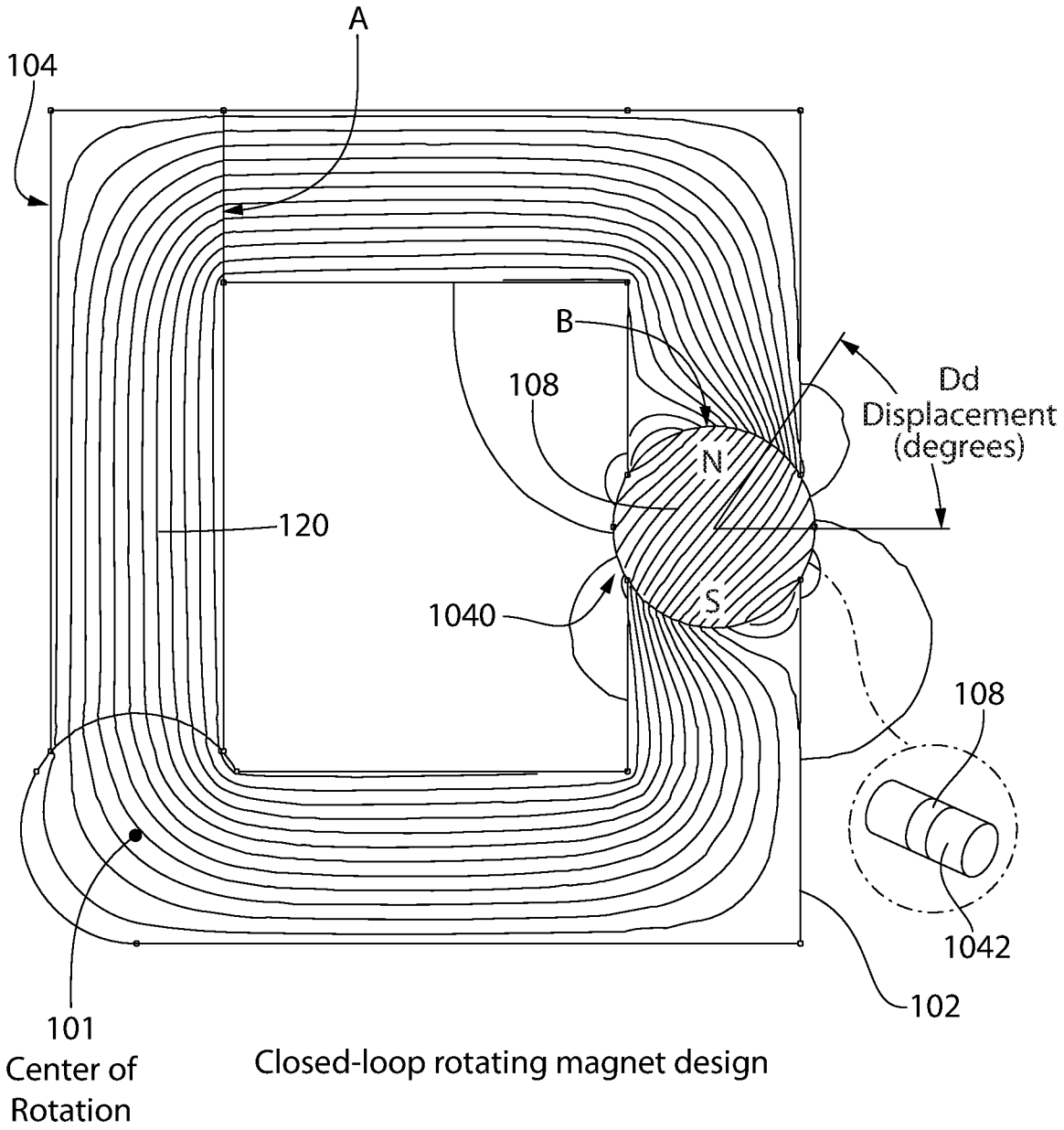
FIG. 48 shows computer-modeled magnetic flux lines generated by the trigger mechanism of FIG. 47.

Another alternative embodiment to achieve the variable coupling of the magnetic flux comprising a closed loop rotating permanent magnet control insert 1040 whose rotational position is adjustable by the user is shown in FIG. 47. The control insert 1040 may comprise the magnet 108 rotating alone (see, e.g. FIG. 47) or with support of a non-magnetic carrier 1042 (e.g. polymer) as shown in FIG. 48. When the magnet 108 is rotationally misaligned with the yoke 102 at the control air gap B with respect to its north (N) and south (S) poles, this will attenuate the flux coupling of the magnet into the closed magnetic loop. Magnet 1040 is manually and adjustably rotatable by the user about a transversely oriented rotational axis 1041 defined by the magnet itself, non-magnetic carrier 1042, or a pin/shaft coupled to the magnet. Rotary magnet 1040 may have any suitable cross-sectional shape, including as non-limiting examples rectilinear as shown (e.g. rectangular or square), polygonal (e.g. hex shaped, etc.), or non-polygonal (e.g. circular as shown in FIG. 48 or other). Control air gap B may be complementary configured to the cross-sectional shape of the magnet 1040 as shown in FIG. 48. The magnet 1040 includes opposing north (N) and south (S) poles whose orientation is changeable via rotating the magnet, thereby altering the magnetic flux field and trigger pull force. A displacement angle Dd relative to a horizontal reference line passing through the rotational axis 1041 of the magnet 1040 is therefore manually adjustable by the user to change and achieve the desired trigger pull force of the trigger mechanism 1000.

Figure 49:
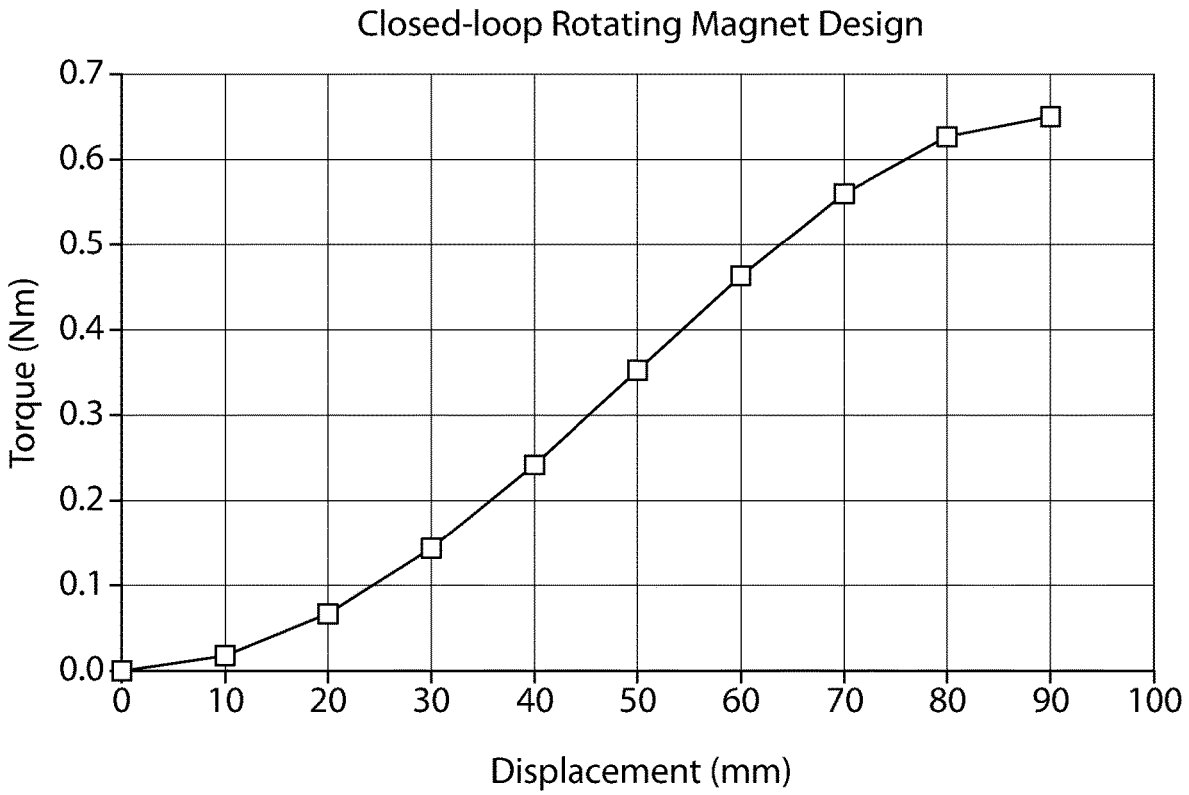
FIG. 49 shows the results of finite element analysis (FEA) of trigger mechanism of FIG. 47 in a trigger pull force (Torque) versus displacement (Dp) profile graph.

FIG. 48 shows a side view of the closed-loop rotary magnet control insert 1040 design of trigger mechanism 1000 with computer-modeled magnetic flux lines illustrated. The magnet 108 mounted to the non-magnetic carrier 1042 is rotated with respect to orientation of its north and south poles relative to the control air gap B of magnetic yoke 102. In this case, a cylindrical magnet 108 is magnetized perpendicular to its rotational axis 1041. When the magnet 108 is rotated through a displacement angle Dd, the coupled magnetic flux varies as the sine of the displacement angle with 0 being no flux coupling and 90 degrees being full flux coupling. FIG. 49 shows the results of finite element analysis (FEA) of this design in a trigger pull force (Torque) versus displacement (Dp) profile graph. FIG. 46 shows that the torque on the trigger member 104 varies from almost 0 to 0.65 Nm over an angular range of 90 degrees. Like the closed-loop sliding magnet design previously described herein, this beneficially provides a wide range of holding torques and a wide range of angular displacement with a non-linear, but well-behaved response.

It bears noting that since magnetic force within the air gap increases with magnetic cross-sectional area and decreases with the square of the air gap length, practical designs which are optimized for force and speed tend to minimize the length relative to the cross-sectional area. A consequence of this is that actuator designs based on these design principles are advantageously inherently immune to external magnetic field interference. In practice, it is impossible to change the state of the actuator using an external magnet (and optional soft magnetic material yoke) provided the rotating trigger member 104 is physically isolated from the external magnet by at least one air gap distance. This preferably should always be the case in practical firearm embodiments utilizing the trigger mechanisms disclosed herein.

The trigger pull force in all design magnetic embodiments is adjusted by varying the magnetic flux density in the control air gap B acting on the rotating trigger bar or member 104. Ultimately the breakpoint of the trigger is determined by the magnetic flux density in the air-gap A controlled by manipulation of control air gap B via the various control inserts described herein. Even though A is very small, the holding force is determined by the flux density in this space. In general, the flux density at air gap A is varied by either changing the flux density at control air gap B, or by changing the effective coupling of flux from the magnet into the yoke. These two principles are used independently or together in each of the designs. In the case of FIGS. 36-40, the magnetic flux coupled across the gap B is varied (flux reluctance of the closed loop). In the case of FIGS. 41-49, the amount of flux injected into the closed loop is varied by either movement of the magnet into the gap B or rotating the magnet in gap B. In magnetic closed-loop designs, the flux density occupies the space between the magnetic yoke 102 and the rotating trigger member 104. In open-loop designs, the flux density is directed between the rotating trigger member 104 and the permanent magnet 108.

For open-loop designs, the flux density is dependent on the magnetic properties of the permanent magnet 108, the physical geometry of the magnet, and the displacement between the magnet and the rotating trigger member 104. For closed-loop designs, the flux density is dependent on the magnetic properties of the permanent magnet 108, the geometry of the magnet, the physical placement of the magnet within the magnetic yoke 102 and the geometry of the control air gap B. In general, the breakpoint force of the trigger mechanism is determined by the flux density at air gap A, but this flux density is varied only by (1) changing the flux using the properties of control air gap B, or (2) changing the coupled flux into the yoke by varying the position or angle of the magnet relative to the yoke at control air gap B.

In general, the magnetic flux density in closed-loop designs can be changed by a combination of changing the reluctance in the magnetic circuit and changing the described below coupling of the permanent magnet 108 into the yoke 102. In open-loop designs discussed below, the magnetic flux density is adjusted by changing the displacement of the magnet 108 relative to the rotating trigger member 104.

Open-Loop Magnetic Design

Figure 50:
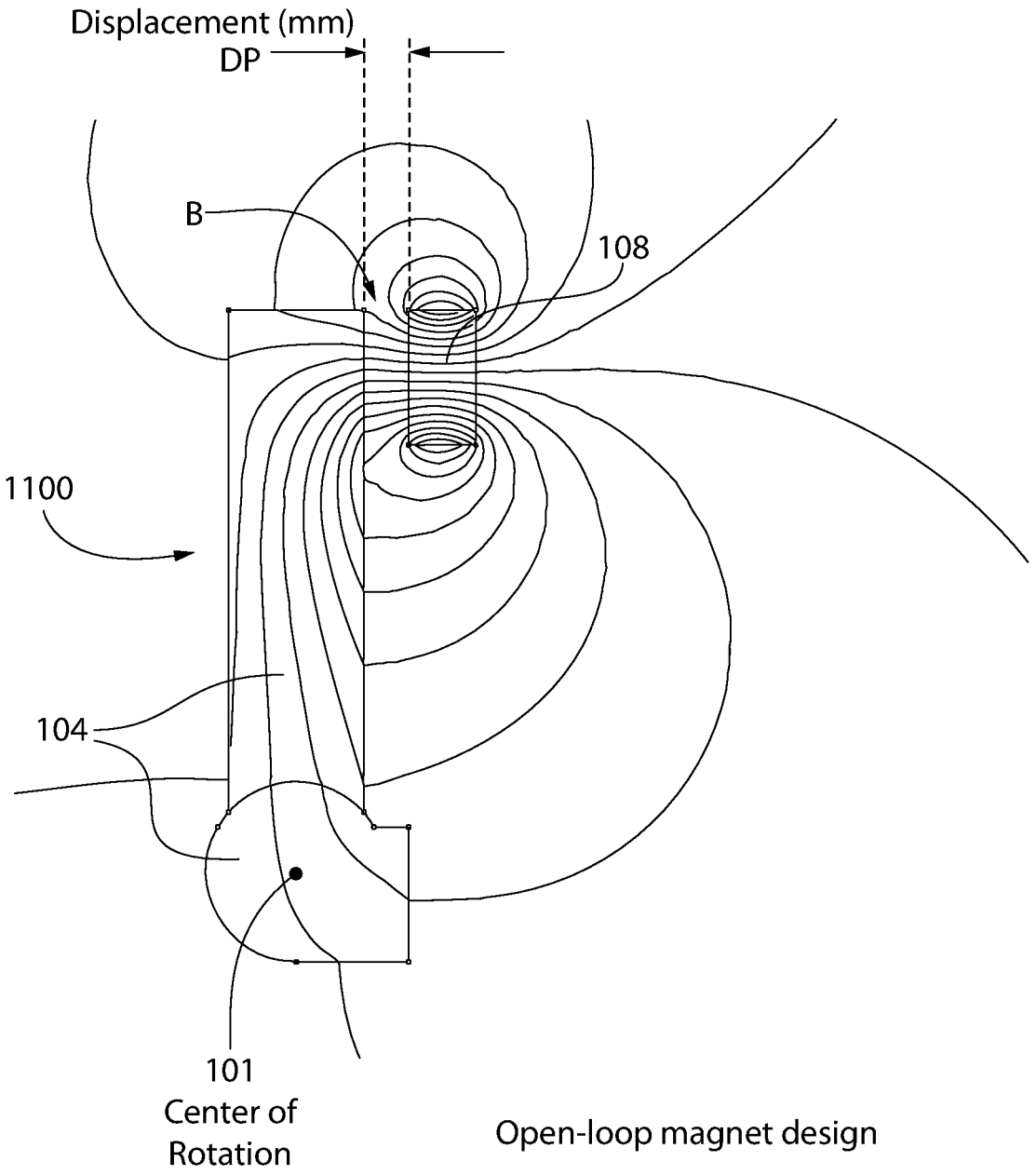
FIG. 50 is a side view of a non-electric embodiment of an open magnetic loop trigger mechanism comprising a moving magnet and showing the computer-modeled magnetic flux lines generated.

FIG. 50 shows a side view of a simple conceptual open-loop magnetic design of trigger mechanism 1100 with computer-modeled magnetic flux lines illustrated. A detailed embodiment which exemplifies this open magnetic loop design is shown in FIGS. 61-69 and further described herein. The magnet 108 is movably displaceable in position relative to the rotating trigger member 104, thereby providing a means for adjusting the control air gap B between the magnet and upper working portion 120 (e.g. sear) of the trigger member 104. Flux lines from the permanent magnet couple into the rotating trigger bar via control air gap B formed between the upper working portion 120 of trigger member 104 and the permanent magnet 108. These flux lines form an attractive force which results in a torque on the trigger bar or member 104 about its center of rotation defined by pivot 101. The horizontal displacement of the magnet 108 towards or away from the trigger bar or member determines the static holding torque on the trigger bar which must be overcome by the user to discharge the firearm.

Figure 51:
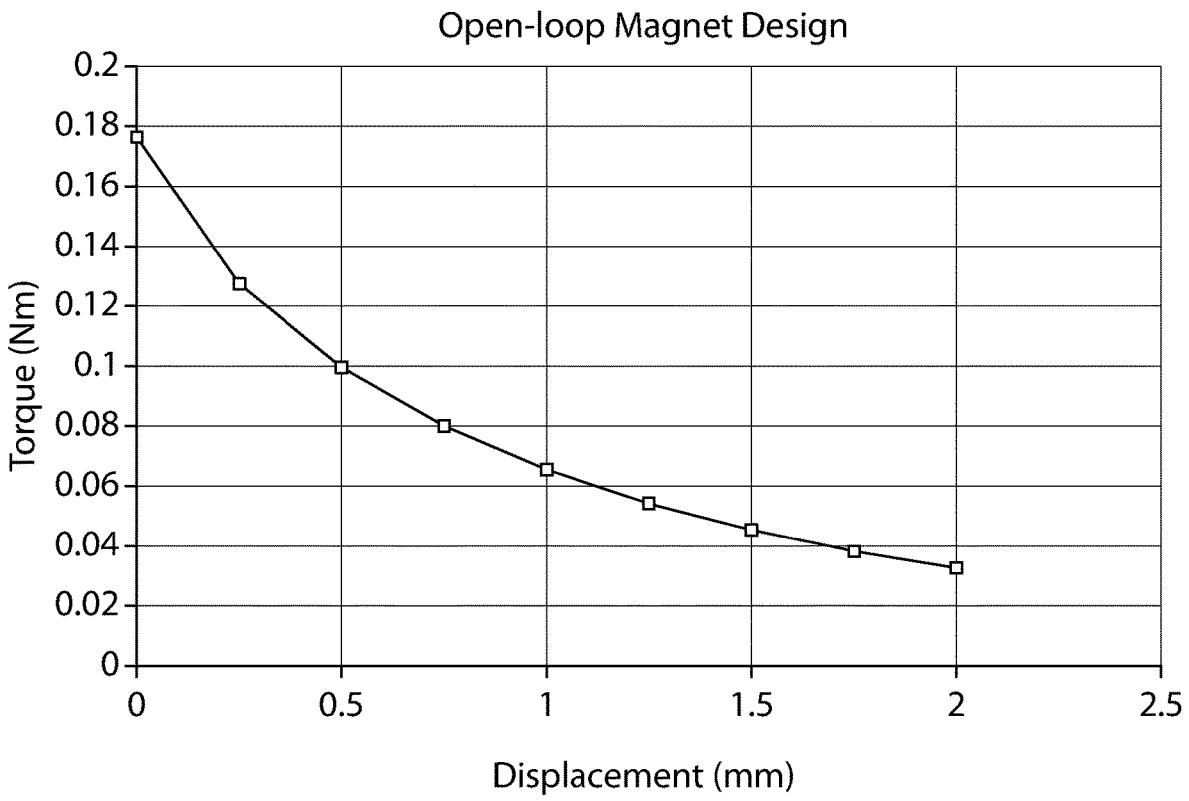
FIG. 51 shows the results of finite element analysis (FEA) of trigger mechanism of FIG. 50 in a trigger pull force (Torque) versus displacement (Dp) profile graph.

FIG. 51 shows the results of finite element analysis (FEA) of this design in a trigger pull force (Torque) versus displacement (Dp) profile graph. FIG. 46 shows that the torque on the trigger member 104 varies from almost 0.18 Nm to 0.03 Nm over a displacement range of 2 mm. The trigger force profile resembles that of the foregoing sliding wedge closed magnetic loop design in so far that the pull force is also characterized by a high initial pull force which then rapidly diminishes over the remainder of the trigger displacement range. This contrasts to the other closed loop designs having the opposite trigger force profile as described above. It is important to note that in this case of the open loop and in the foregoing closed magnetic loop examples, these values are for comparative use only and not intended to indicate specific design targets for an actual trigger mechanism.

Summary of Closed and Open Loop Design Comparison Results

Based on the comparative results of the design and performance analysis for each magnetic only trigger mechanism describe above, a few summary conclusions can be offered. Each design disclosed herein is capable of achieving the design goals for a magnetically adjustable trigger mechanism, which are a wide range of adjustable trigger pull force, an adjustment means that is relatively linear, and an adjustment means that is relatively insensitive to normal mechanical tolerances.

The rotating magnet and sliding magnet have similar torque/response curves and similar holding torques. The rotating magnet and sliding magnet designs offer an optimal way of varying holding torque while being least affected by mechanical adjustment tolerances when the user manually adjusts the trigger pull force. A major advantage of the sliding magnet and rotating magnet designs in contrast to just adjusting the width of the control air gap B (via the sliding soft magnetic material plate or wedge control insert designs) is the required precision of the movement over the range necessary to change the torque. When adjusting the reluctance by opening or narrowing the control air gap B via the sliding plate or wedge, it will take a precision adjustment by the user to control the small changes in width of the air gap. Very slight precision changes in control air cap B width have a large impact on the torque. This will require a very tight manufacturing tolerance of the adjustment means to make a reliable and repeatable adjustment. Even with a fine threaded lead-screw, for example, it might only be a fraction of a turn to make a significant adjustment in the effects of the airgap. With the sliding magnet, however, the effective change in magnetic coupling is distributed over a much longer movement from totally open to completely centered in the yoke. Similarly in the rotating magnet design, the adjustment range is from 0 to 90 degrees. The sliding or rotating magnet designs are therefore offer a much less sensitive adjustment that does not require the same great degree of precision adjustment tolerance. The rotating magnet design has the added advantage of occupying less physical space, thereby advantageously allowing for a more compact trigger mechanism construction for placement in the firearm.

The open loop and closed loop sliding wedge designs both have similar torque-displacement curve shapes (i.e. high initial trigger pull holding torque requirement which diminishes over the remainder of the trigger displacement when firing the firearm). The open-loop design though has much lower holding torque due to the magnetic losses in the air which is less desirable, but nonetheless still offers an acceptable magnetic trigger mechanism design.

The analysis confirms that all the closed magnetic loop embodiments documented herein meet the magnetically adjustable trigger design goals of a wide range of adjustable trigger pull force, an adjustment means that is relatively linear, and an adjustment means that is relatively insensitive to normal mechanical tolerances. The magnetic field open loop design mentioned above provides an acceptable means for achieving a viable adjustable trigger. While not optimal in performance, the open loop design is compact and mechanically simple to construct and implement offering certain advantages.

A major feature of one non-limiting preferred closed magnetic loop design of a sliding magnet shown in FIGS. 52-60 is dependent on varying the magnetic reluctance of an air gap in the closed magnetic loop, adjusting the physical coupling of the magnetic flux from a magnet into the closed loop, or a combination of both techniques. Prior magnetic trigger mechanisms do not achieve the design goals for an adjustable trigger that include a wide range of adjustable trigger pull force, an adjustment means that is relatively linear, and an adjustment means that is relatively insensitive to normal mechanical tolerances.

Mechanically detailed preferred embodiments of closed and open magnetic loop trigger mechanism designs will now be described in further detail below, respectively.

Closed Loop Sliding Magnetic Trigger Mechanism

FIGS. 52-60 depict one non-limiting preferred embodiment of a closed magnetic loop sliding magnet type trigger mechanism 1200 which exemplifies to a certain degree the conceptual basic design of FIGS. 44-46, but is not exactly the same in features and construction. In the present embodiment, however, the vertically extending upper working extension or portion 120 of rotating trigger member 104 defines a sear surface 132 configured to releasably engage a firing mechanism component or linkage such as rotatable sear 375 in lieu of the striking member directly such as hammer 130. The sear 375 in turn is configured and operable to act directly on the energy storage device such as the spring-biased linearly movable striker 40 shown in FIG. 30 and previously described herein. Sear surface 132 operates hold to the striker 40 in the rear cocked position until released via a trigger pull to move forward and strike a chambered cartridge for discharging the firearm. Alternatively, the working portion 120 of trigger member 104 may instead act directly on a hammer 130 as shown in FIG. 44. Accordingly, the trigger member 104 may be used to act directly or indirectly on and release the striking member whether it is a hammer or a striker.

The sliding magnet trigger mechanism 1200 includes a front 1230, rear 1231, opposing right and left lateral sides 1232 (side designations when the trigger unit is mounted in a firearm), top 1233, and bottom 1234. Trigger mechanism 1200 generally comprises stationary yoke 102, rotatable trigger member 104, sear 375, and a movable sliding magnet control insert 1031 (a basic version of which is shown in FIG. 44 and described above). The control insert assembly is configured and constructed for varying the static magnetic field in the closed magnetic loop to provide adjustment of the trigger pull force required to be exerted by the user via a trigger pull to release the striking member.

Yoke 102 includes horizontal upper portion 110, horizontal lower portion 112 oriented parallel to the upper portion, and vertical intermediate portion 114 extending therebetween. Control air gap B is formed in intermediate portion 114 and extends completely through the portion. The lower portion 112 may be bifurcated as shown forming a pair of laterally spaced apart arms defining a vertical through opening 1214 therebetween in which the trigger member 104 is pivotably mounted thereto by transverse trigger pivot pin 1205. Yoke 102 is fixedly mounted to the firearm frame 22, receiver 39, or a trigger housing 1220 as shown in the illustrated embodiment so as to remain stationary when the trigger is pulled.

In the embodiment shown in FIGS. 52-56, yoke 102 is fixedly mounted to a trigger housing 1220. These figures are a cutaway of the trigger housing 1220 showing only a portion of a right side plate of the housing in order to better show details of the trigger mechanism assembly. The trigger housing 1220 is mounted in turn via any suitable mechanical means (e.g. fasteners, interlocking features, etc.) to the firearm frame 22 and/or the receiver 39 depending on the type and configuration of the firearm used. Trigger housing 1220 may have any suitable shape and configuration, one example of which is shown in commonly owned U.S. Pat. No. 10,030,926 which is incorporated herein by reference. Other suitable trigger housing designs however may be used. The configuration of the trigger housing does not limit the invention. In lieu of mounting each trigger mechanism component separately in the frame or receiver, the housing makes it easier to mount, test, maintain, or repair the trigger mechanism if needed.

Rotating trigger member 104 includes upper working portion 120 and lower trigger portion 118. Trigger member 104 has a vertically elongated body. Working portion 120 may be linearly straight and have rectilinear transverse cross section (e.g. square or rectangular) in one non-limiting configuration as shown. Lower trigger portion 118 may have an arcuately curved profile by contrast.

Trigger assembly 1202 defined in part by lower trigger portion 118 of trigger member 104 may include an outer trigger 1201 and inner safety trigger 1203 movable relative to the outer trigger. Outer trigger 1201 is pivotably mounted to yoke 102 via first transverse pivot pin 1205 which defines a first pivot axis. Inner safety trigger 1203 includes an enlarged upper mounting portion 1203-1 pivotably mounted to outer trigger 1201 via a second transverse pivot pin 1206 which defines a second pivot axis parallel to the first pivot axis. The safety trigger further includes a lower blade portion 1203-2 depending downwards therefrom for actuation by a shooter or user. The blade portion 1203-2 may have a solid or an open framework construction as shown including an arcuately concave front surface configured to facilitate engagement by the shooter or user's finger. Safety trigger 1203 is pivotable independently of both the outer trigger 1201 between forward and rearward positions. A spring 1204 biases the safety trigger 1203 towards the forward position projecting forward from the vertical slot 1201-1 formed in outer trigger 1201 in which the inner safety trigger 1203 nests. The second pivot axis defined by pivot pin 1206 may be positioned below and behind the first pivot axis defined by pivot pin 1205. A vertical central axis CA and horizontal central axis HA of the trigger mechanism 1200 are defined for convenience of reference which pass through pivot pin 1205 and perpendicularly intersect each other (see, e.g. FIG. 54).

A transversely oriented split trigger safety blocking pin 1207 is fixedly coupled to the trigger housing 1220 and arranged to selectively engage or disengage a cam surface 1203-3 on top of the upper mounting portion 1203-1 of the safety trigger 1203. Safety blocking pin 1207 may have a cylindrical configuration in one embodiment; however, other shapes may be used.

The trigger member 104 may have a one-piece unitary construction such that the lower trigger portion 118 which defines the main outer trigger 1201 of the trigger member is a unitary structural part of the upper working portion 120 which engages the sear 375. Rotating the trigger 1201 about pivot pin 1205 therefore concomitantly rotates the upper working portion 120 in the same direction in unison to open air gap A and release the sear 375 to discharge the firearm. In other embodiment, the lower and upper portions 118, 120 may be separate components which are rigidly coupled together to provide the same action.

An adjustable trigger member travel stop comprises a mounting block 1213 having an internally threaded bore which rotatably receives adjustment screw 1212 therethrough. Block 1213 may be fixedly mounted to the trigger housing 1220 and spaced forward from upper working portion 120 of rotatable trigger member 104 when in the upright un-pulled condition. The shaft end of adjustment screw 1212 opposite its enlarged head used to rotate the screw is variably positionable to selectively engage and bear against the upper working portion 120 of trigger member 104 when rotated forward via a trigger pull. This manually adjustable physical stop limits the travel of the rotating trigger body after release of the sear to ensure the trigger mechanism can properly reset to ready-to-fire condition. One advantageous feature of the magnetic design is that the need for the trigger return spring may be eliminated since the magnet 108 will always be drawn into the control air gap B magnetically, as previously noted. The adjustable stop may alternatively be replaced with a fixed stop in some embodiments that is not adjustable using the mounting block alone or a pin fixedly attached to the trigger housing, frame, or receiver. Based on performance and tolerances, it may be desirable to add a small trigger return spring to account for tolerances of a fixed stop. A trigger return spring may, or may not, be necessary, but if needed would still be smaller and less critical than conventional trigger return spring designs and less noticeable to the operator during trigger recovery.

The sliding magnet control insert 1031 in this embodiment shown in FIGS. 52-60 will now be further described. FIGS. 57-60 show control insert 1031 in isolation. In this embodiment, the permanent magnet 108 of control insert 1031 may be insert or over molded into, or similarly retained via adhesives or fasteners, in a polymeric carrier 1030 (or other non-magnetic material carrier). In other embodiments, the carrier may broadly be made of any suitable non-magnetic material which categorically includes polymers and non-magnetic metals such as without limitation brass, or other. Carrier 1030 preferably has a monolithic unitary body molded, cast, or otherwise formed comprising a single piece of material. In one embodiment, the non-magnetic carrier 1030 may be U-shaped comprising a vertical right and left sidewalls 1035, and rear wall 1034 extending therebetween.

Rear wall 1034 includes a threaded bore 1034 which threadably engages adjustment screw 1211 for linearly translating the carrier relative to the yoke 102.

A vertically and forwardly open cavity 1036 is formed by the sidewalls 1035 and front wall 1034 of carrier 1030. Permanent magnet 108 is mounted in cavity 1036. To assist in retaining the magnet 108 in the cavity 1036, a cross bar 1033 may be molded into the carrier which extends horizontally between the sidewalls 1035 at the front of the carrier body. Cross bar 1033 is insertable into control air gap B, but has no effect on the static magnetic field since the carrier is formed of a non-magnetic material.

Figure 52:
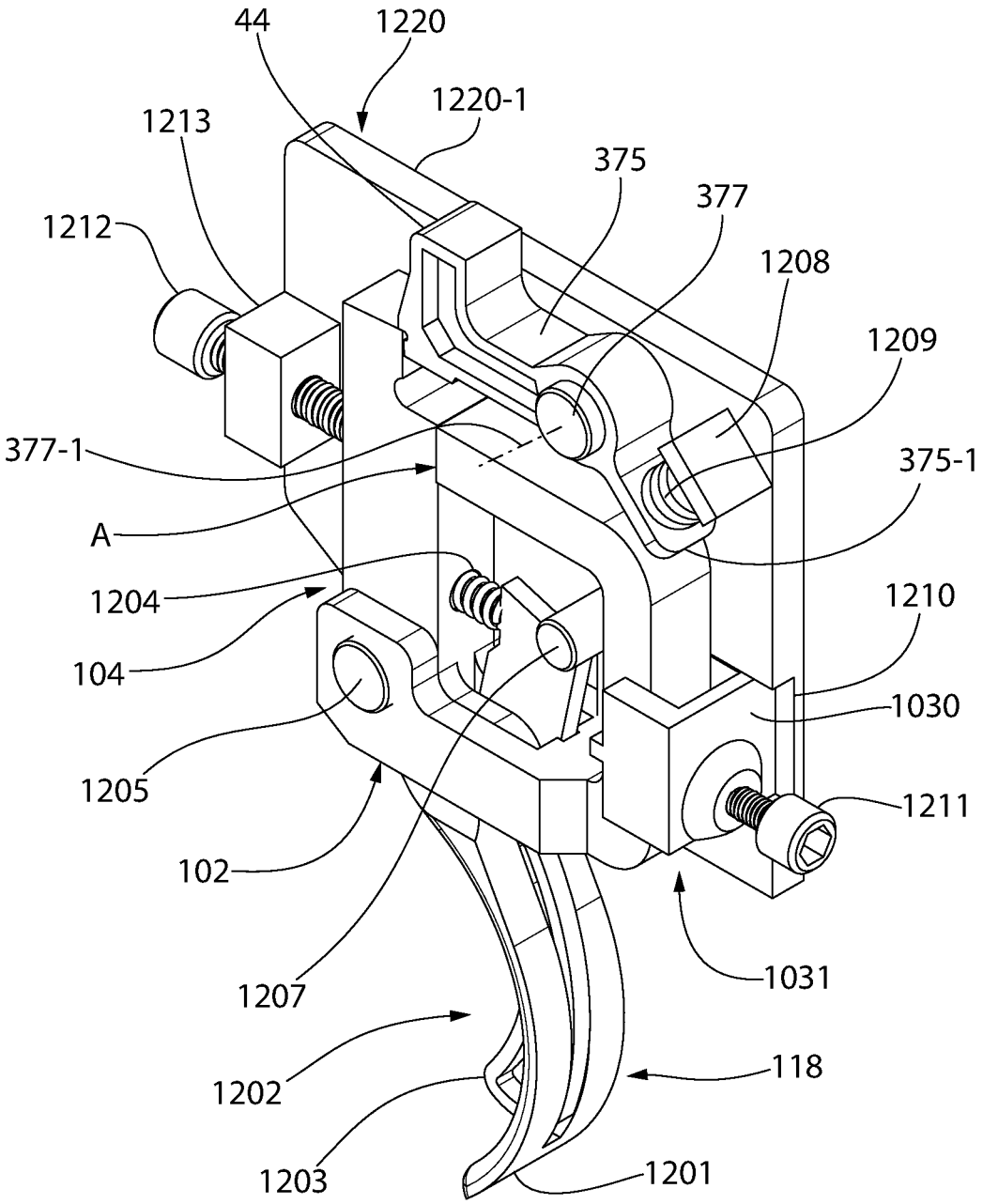
FIG. 52 is a side perspective view of a preferred embodiment of a non-electric closed magnetic loop trigger mechanism of the sliding magnet design.
Figure 53:
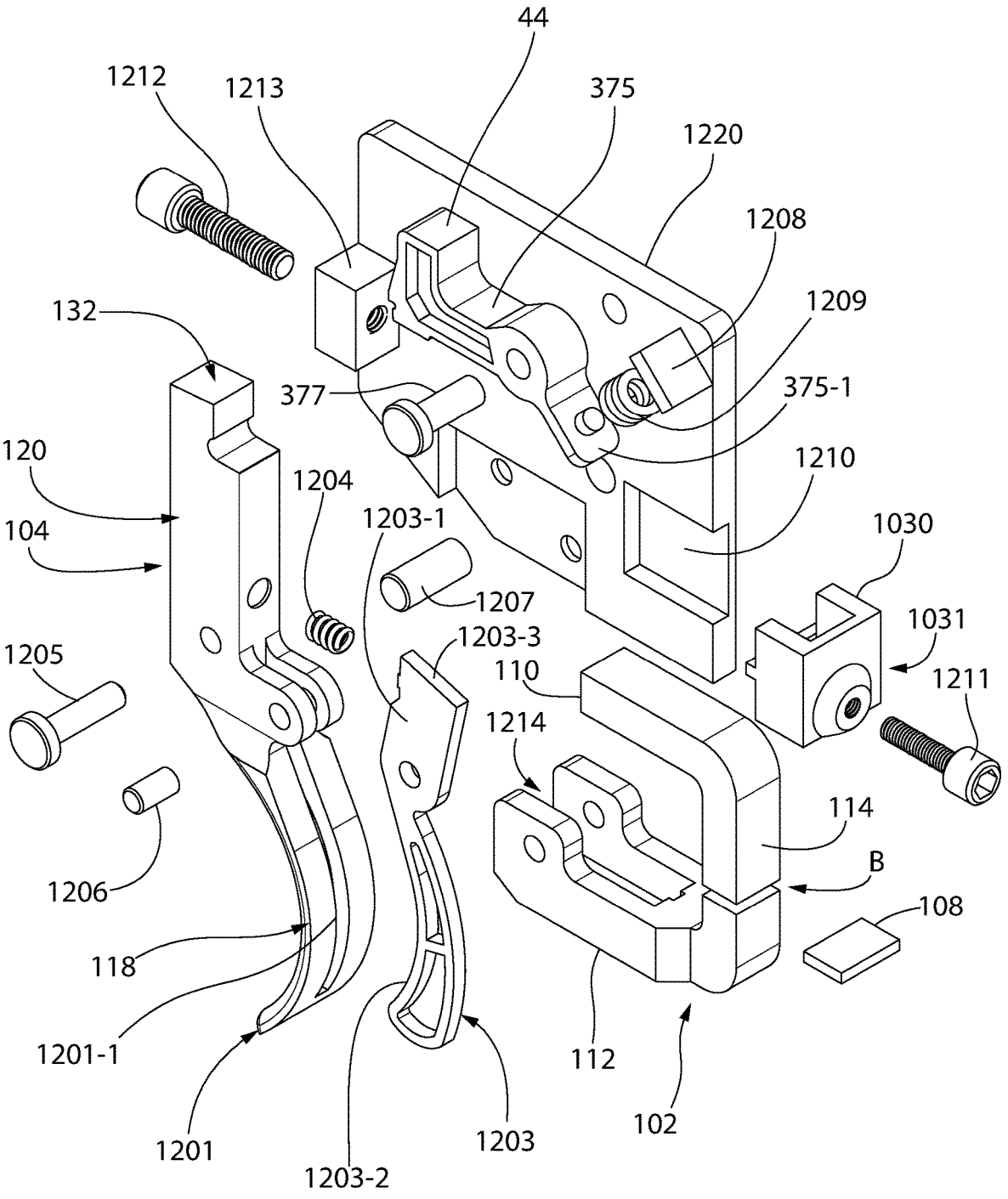
FIG. 53 is an exploded view thereof.
Figure 55:
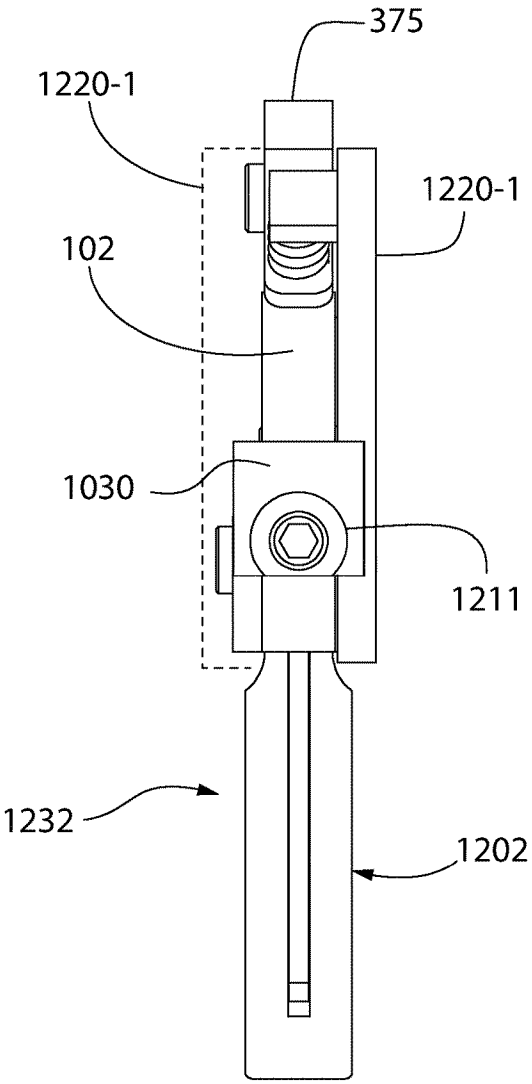
FIG. 55 is a rear view thereof.

Carrier 1030 is slideably mounted between the right and left side plates 1220-1 of trigger housing 1220 in a rearwardly open channel 1210 formed in each side plate. FIGS. 52 and 53 show only the right side plate 1220-1, recognizing that the left side plate 1220-1 may generally be a mirror image thereof (represented schematically in FIG. 55 by dashed lines) to support the various component cross pins from each end. When mounted between the opposing pair of channels 1210 of the trigger housing 1220, the carrier 1030 is trapped but slideably movable forward and rearward in channels 1210 to adjust the position of the carrier and magazine 108 relative to the control air gap B.

Adjustment screw 1211 is fixed in horizontal position in the trigger housing 1220 but rotatable. This can be accomplished by providing a plain unthreaded hole in a rear plate 1220-2 of the trigger housing (shown schematically in dashed lined in FIG. 54), or other via similar approaches. The front end of the screw may abut the yoke 102 in some embodiments as shown in the cross section of FIG. 56. When adjustment screw 1211 is rotated, the screw does not change its horizontal position.

The control insert 1031 can be slideably adjusted along the horizontal central axis HA to move the magnet 108 in carrier 1030 into and out of the control air gap B in the closed-loop magnetic trigger circuit. Rotating screw 1211 in a first direction translates the carrier 1030 forward for increasing the insertion of the permanent magnet 108 in control air gap B of yoke 102 in order to increase the magnet static holding force or torque. Rotating screw 1211 in an opposite second direction withdraws the carrier 1030 rearward for decreasing the insertion of the permanent magnet 108 in control air gap B of yoke 102 to decrease the magnet static holding force or torque. This provides a user selectable adjustment of the trigger pull force or holding torque to suit personal preferences.

It bears noting that other suitable shapes of non-magnetic carriers may be used so long as the permanent magnet 108 may be linearly translated into or out of the control air gap B of yoke 102. Although the magnet 108 is insertable into control air gap B from the rear 1231 of the trigger mechanism 1200, in other possible embodiment the trigger mechanism may be designed to insert the magnet from either two of the lateral sides 1232 into air gap B with equal results. This may be more convenient in some firearm designs and allows the adjustment screw 1211 to be accessible through the trigger housing 1220 from either the right or left sides of the firearm for the user.

It bears noting that the magnet 108 in the control insert 1031 will always try to pull itself into full engagement centered in the control air gap B via the magnetic attraction forces created in the closed loop, which acts like a magnetic biasing spring against the adjustment means. By turning the threaded adjustment screw 1211, the magnet 108 can slide outward from the control air gap B, or allowed to be drawn inward into the air gap. By moving the magnet into and out off the control air gap B, the magnetic flux density in the air gap will approximately vary as a linear function. This is due to the magnetic field strength times the area being preserved across the boundaries. By changing the engagement position of the magnet 108 with yoke 102, the magnetic static holding force at the air gap B between the yoke 102 and the trigger member 104 can be selectively varied by the user.

Sear 375 has already been fully described herein and will not be discussed again in depth for sake of brevity. In general, sear 375 is mounted to trigger housing 1220 via transverse cross pin 377 that defines the pivot axis 376 of the sear. Sear protrusion 44 may be formed on one forward end of sear 375 opposite a rear end having a transverse opening which receives a cross pin 377 that defines pivot axis 376. A rear facing vertical surface on sear protrusion 44 engages a mating front facing surface of catch protrusion 42 on striker 40 to hold the striker in the rearward cocked position (see, e.g. FIG. 30). Sear 375 shown in FIGS. 52-56 includes a rear extension 375-1 acted on by sear spring 1209 which keeps the forward sear protrusion 44 biased normally upwards into engagement with the striker's catch protrusion 42. A mounting plate 1208 may be provided on trigger housing 1220 which acts on the end of the spring opposite the end engaging the rear extension 375-1. Spring 1209 may be a coil compression spring in one embodiment. Other type springs may be used.

Figure 54:
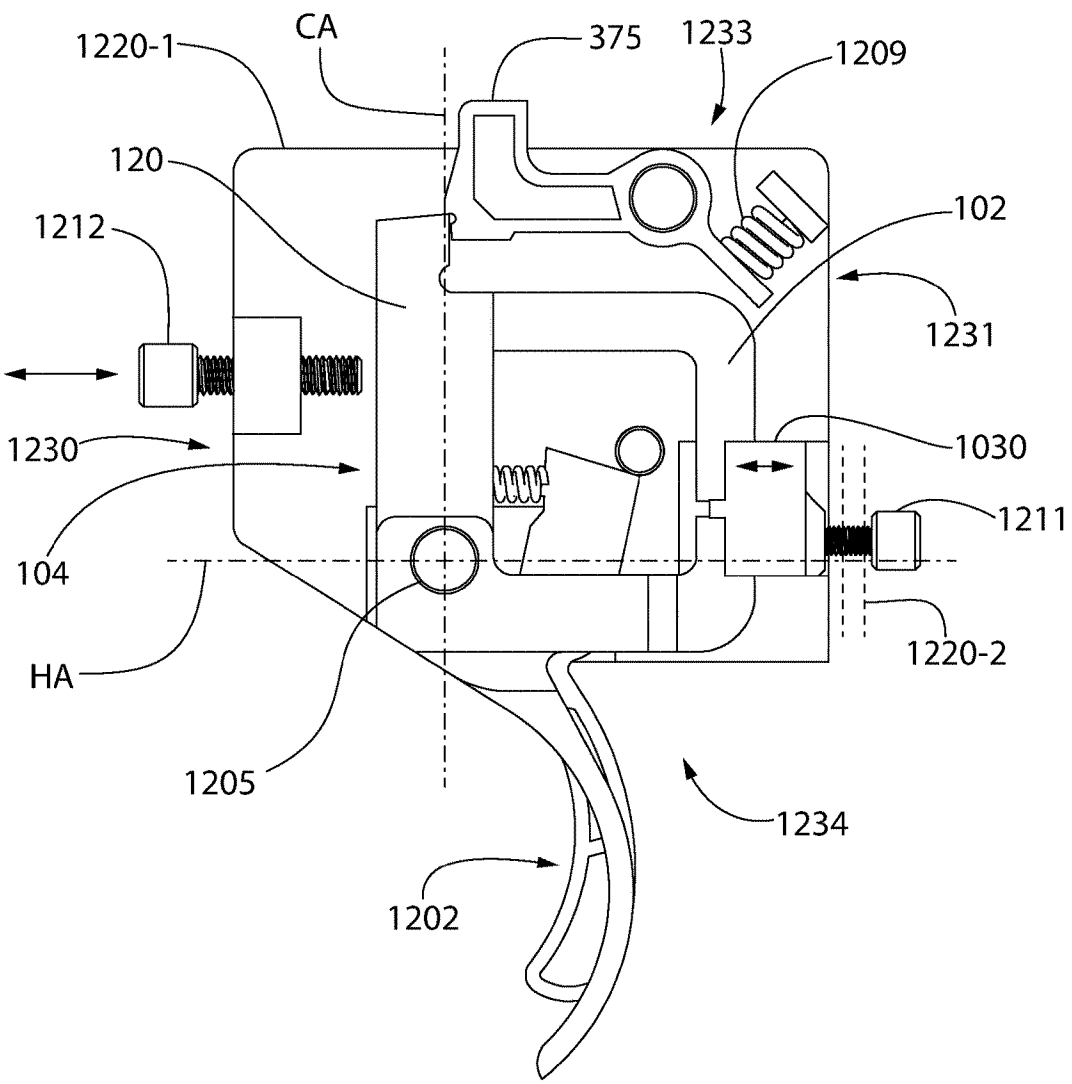
FIG. 54 is a side view thereof.
Figure 56:
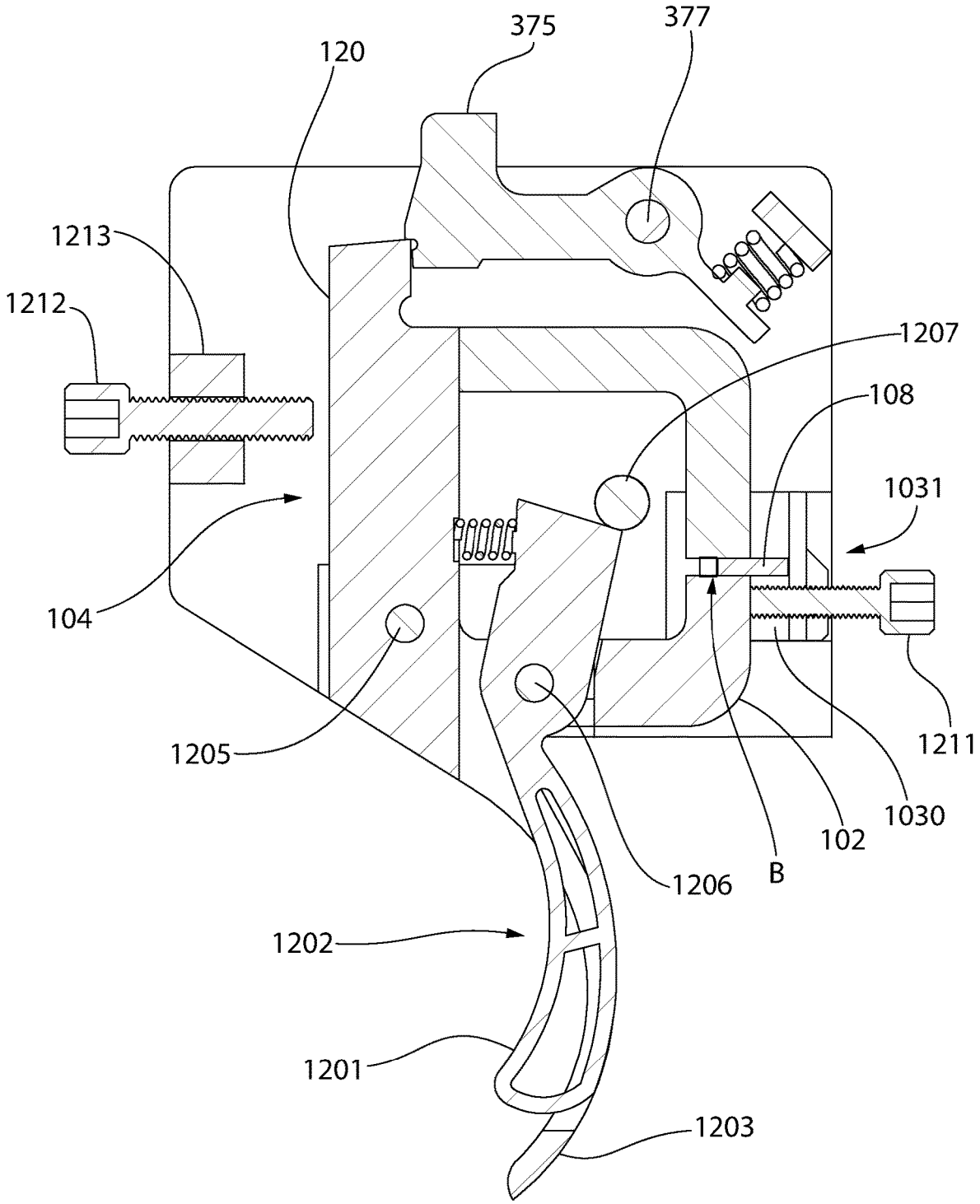
FIG. 56 is a side cross-sectional view thereof.
Figure 57:
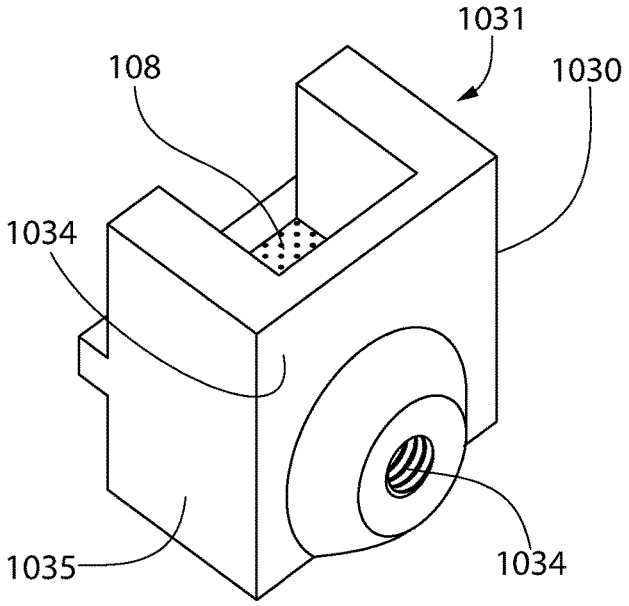
FIG. 57 is a top rear perspective view of the non-magnetic magnet carrier of the trigger mechanism of FIG. 52.
Figure 58:
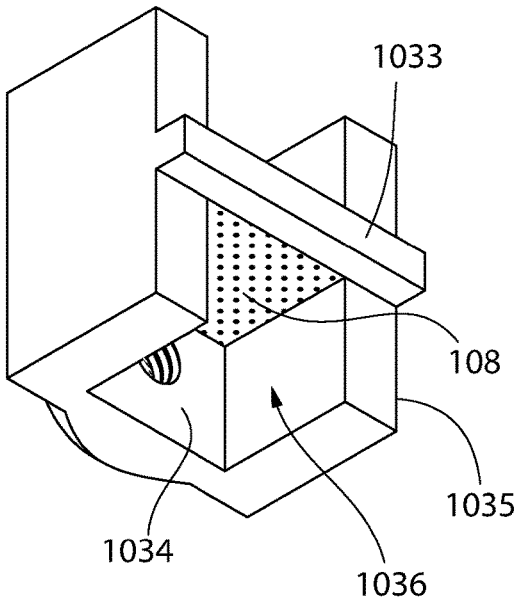
FIG. 58 is a bottom front perspective view thereof.
Figure 59:
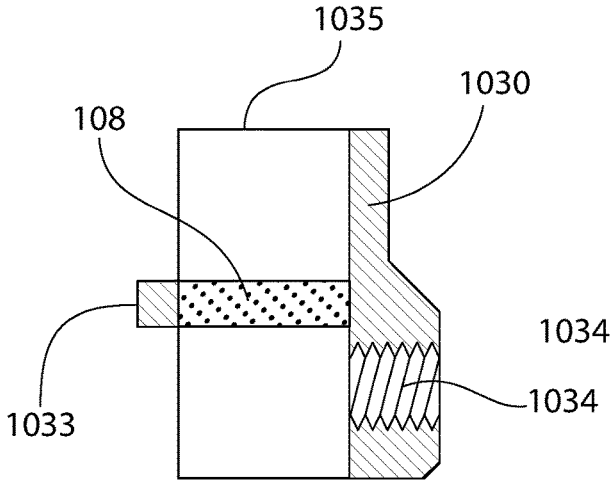
FIG. 59 is a side cross-sectional view thereof.
Figure 60:
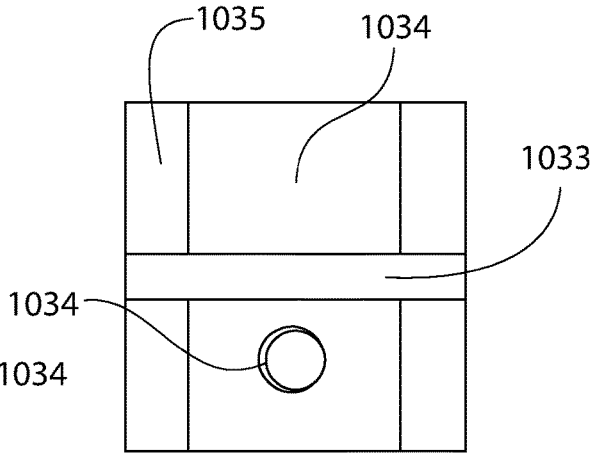
FIG. 60 is a front view thereof.
Figure 61:
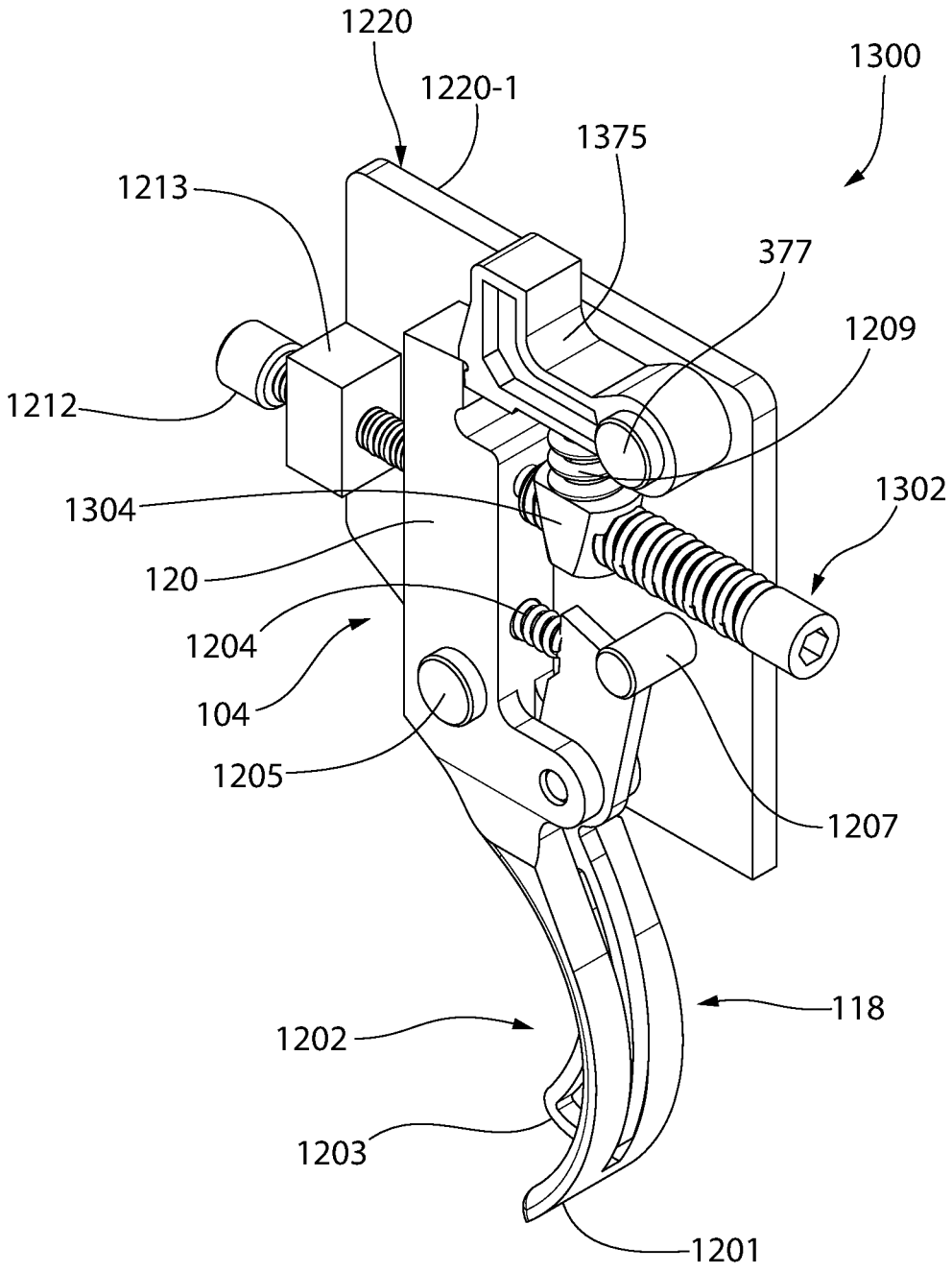
FIG. 61 is a side perspective view of a preferred embodiment of a non-electric open magnetic loop trigger mechanism of the movable magnet design.
Figure 62:
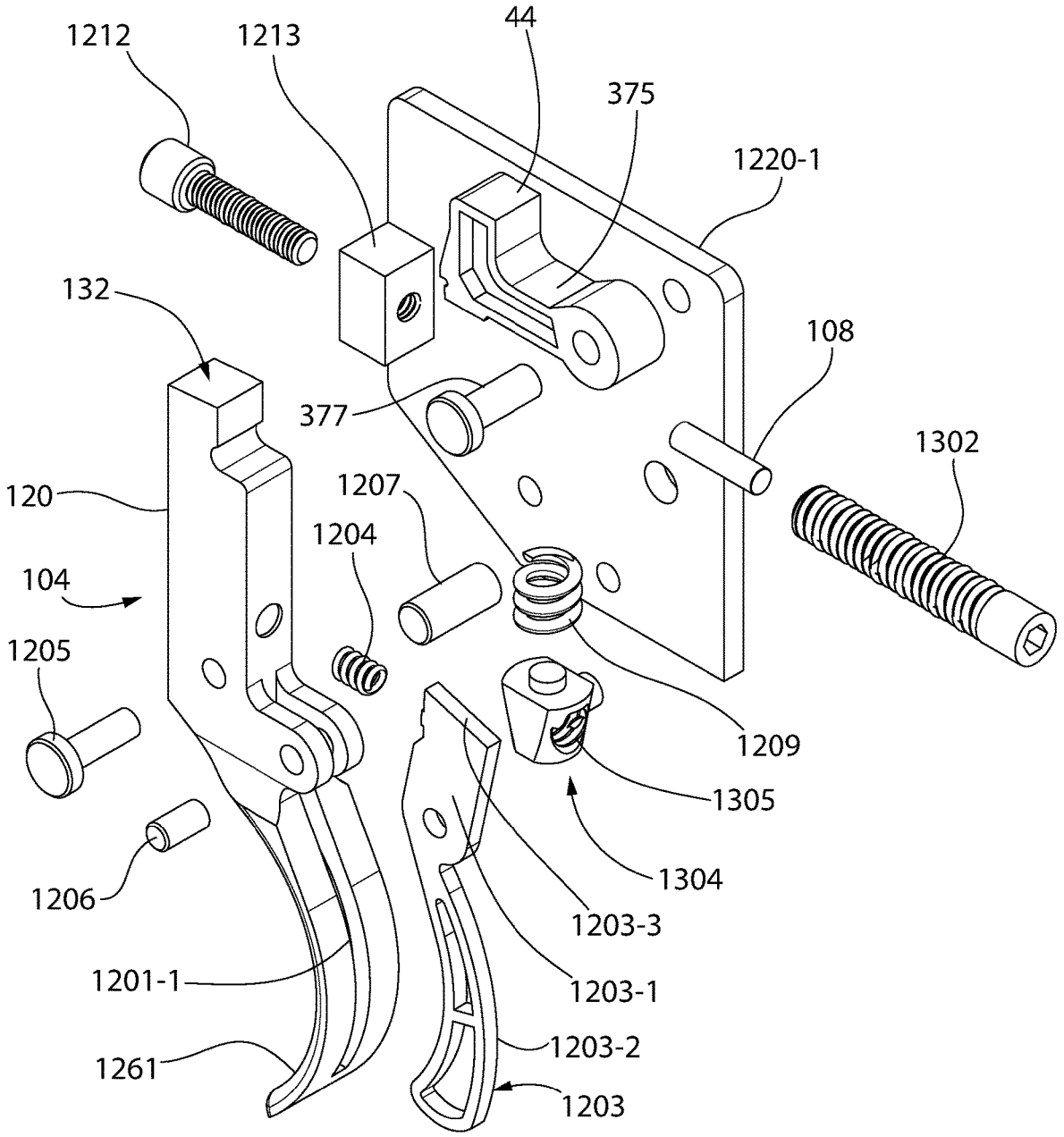
FIG. 62 is an exploded view thereof.

FIG. 54 shows the trigger mechanism 1200 in the ready-to-fire position. The vertically elongated upper working portion of trigger member 104 is parallel to vertical central axis CA in this position. The desired trigger pull force is previously set by the user in the manner described above, In operation, with additional reference to FIG. 30, as the trigger assembly 1202 of the closed magnetic loop trigger mechanism 1300 is initially pulled and displaced by the user to the right, the top trigger safety cam surface 1203-3 of the rotating inner safety trigger 1203 engages and the moves past the safety blocking pin 1207, thereby providing the initial take-up travel of the trigger. As the user continues to pull the full trigger assembly 1202 (outer trigger 1201 and safety trigger 1203), the final release force to rotate the trigger member 104 body and release the firing sear 375 is achieved by pulling the trigger with sufficient force to rotate upper working portion 120 of trigger member 104 forward to break the magnetic and physical engagement with the yoke 102 and open air gap A. In doing so, the static magnetic holding force created by permanent magnet 108 on the trigger member 104 is overcome. The trigger member upper working portion 120 assumes an acute angle to the vertical central axis CA. Concomitantly, contact is broken between the sear surface 132 on trigger member working portion 120. Without support from the trigger member 104, the front end of the sear 375 is forced and rotates downwards about its pivot axis 377-1 by the forwardly spring-biased striker 40 to disengage the sear protrusion 44 from the catch protrusion 42 on the striker. This releases the striker to move along its forward path P between the rearward cocked position and the forwarding firing position contacting and detonating a chambered cartridge C to discharge the firearm.

It bear noting that the sear pin 377, rotatable trigger member pin 1205, safety trigger pin 1206, and the safety blocking pin 1207 are mounted in complementary configured mounting holes formed in the inner surfaces of the trigger housing 1220 right side plate 1220-1 and left side plate (not shown).

A method for adjusting the closed loop magnetic trigger mechanism 1200 described above will now be briefly summarized. The method comprises providing stationary yoke 102 configured for mounting in the firearm, a rotating trigger member 104 pivotably movable about a pivot axis relative to the stationary yoke, the trigger member and stationary yoke collectively configured to form a closed magnetic loop, and an openable and closeable first air gap A being formed between the trigger member and the stationary yoke. The method further includes providing a control insert 1031 comprising a non-magnetic carrier 1030 and a permanent magnet 108 operable to generate a static magnetic field in the closed magnetic loop, the static magnetic field creating a primary resistance force opposing movement of the trigger member 104 when pulled by the user. The method includes: rotating an actuator such as screw 1211 operably coupled to the control insert in a first direction to advance the permanent magnet 108 into a second control air gap B formed in the stationary yoke 102, the magnet creating a first static magnetic field strength in the closed magnetic loop; and rotating the actuator in an opposite second direction to withdraw the magnet from the second control air gap, the magnet creating a second static magnetic field strength in the closed magnetic loop less than the first magnetic field strength. The strength of the static magnetic field is changeable via varying position of the permanent magnet in the control insert relative to the second control air gap to adjust a trigger pull force of trigger mechanism.

Open Loop Magnetic Trigger Mechanism

FIGS. 61-69 depict one non-limiting preferred embodiment of an open magnetic loop sliding magnet type trigger mechanism 1300 which exemplifies to a certain degree the basic design concept of FIG. 50. It will be noted that design and functionality of the trigger assembly 1202 with main outer trigger 1201 and inner safety trigger 1203, sear 375, adjustable trigger member travel stop with travel stop 1212 and mounting block 1213, safety blocking pin 1207, sear 375, and trigger housing 1220 are generally similar to that shown for the closed magnetic loop trigger mechanism 1200 shown in FIG. 52. These features will not be discussed in detail here again for brevity. Sear 375 is generally the same except for a different mounting arrangement of the sear spring 1209, discussed below. Notably, the open magnetic loop trigger mechanism 1300 does not include a stationary yoke, thereby forming the open magnetic circuit.

With continuing reference to FIGS. 61-69, a stationary mounting block 1304 is provided for adjustably mounting a magnet holder 1302 to the trigger mechanism 1300. FIGS. 66-69 show mounting block 1304 in isolation and greater detail. Mounting block 1304 may be fixedly mounted coupled to the trigger housing 1220, such as without limitation to right side plate 1220-1 of the trigger housing 1220 in one embodiment by any suitable means such as fasteners, adhesives, soldering/welding, shrink fitting, or other. In one embodiment, mounting block 1304 may include a laterally extending post 1306 received in a complementary configured hole in the trigger housing 1220 for securing the block to the housing plate. Mounting block 1304 further includes an upwardly extending top post for seating sear spring 1209 thereon between the block and the underside of the sear 375. Spring 1209 acts to bias the sear 375 upwards to a normal ready-to-fire position in which sear protrusion 44 engages catch protrusion 42 on striker 40 as previously described herein. Mounting block 1304 may have any suitable configuration.

Magnet holder mounting block 1304 includes an elongated internally threaded bore 1305 which opens forward and rearward. Bore 1305 extends horizontally parallel to horizontal central axis HA. The magnet holder 1302 may comprise an elongated threaded rod which threadably engages the bore 1305. Holder 1302 includes a first inboard end including a forwardly open receptacle 1310 and a second outboard end which may include a tooling recess 1311 configured for engaging a tool used to turn the holder. Tooling recess 1311 may have any suitable tooling configuration, such as for example without limitation a hex shape for engaging an Allen wrench as shown, or a Philips, slotted, torx, star, square, or other shaped tooling recess for engaging a complementary configured screwdriver.

Permanent magnet 108 is insertably mounted in receptacle 1310. Magnet 108 may be retained in the receptacle by any suitable means, such as adhesives, fasteners, threaded caps, or other techniques. In the illustrated embodiment, magnet 108 may be cylindrical in shape and receptacle 1310 has a complementary configuration. Preferably, the front free end of the magnet 108 protrudes outwards beyond the holder 1302 and receptacle 1310 to directly engage the rear face of the upper working portion 120 of trigger member 104 as shown.

Magnet holder 1302 may be made of any suitable magnetic material or non-magnetic material. In one embodiment, the holder preferably may be made of a non-magnetic, non-ferrous metal such as brass. Non-magnetic material are essentially transparent to the magnet as long as it does not magnetically interfere into control air gap B to limit the range of motion of the magnet into the gap. Magnetic holder materials are less preferred, but may be acceptable as long as the geometry does not allow a magnetic path that would shunt magnetic flux away from the air gap B. In other possible embodiments, holder 1302 may be made of a suitably strong polymeric material.

Rotating magnet holder 1302 alternatingly in opposing directions advances the holder and magnet 108 towards the working portion 120, or retracts the holder and magnet from the working portion of the trigger member. By adjusting the displacement of the magnet 108 with respect to the main rotating upper working portion 120 of the trigger member body, the static magnetic holding force of the magnet can be adjusted by increasing or decreasing the control air gap B between the magnet and the rotating trigger body.

Figure 64:
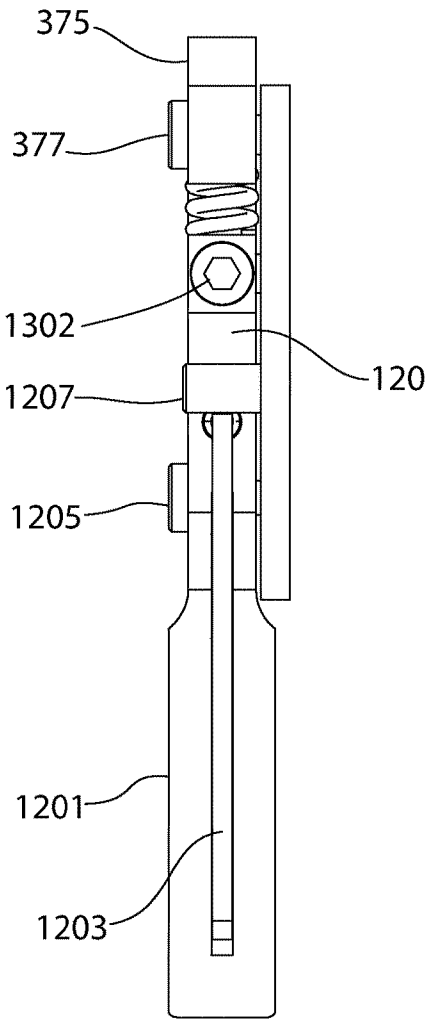
FIG. 64 is a side view thereof.
Figure 63:
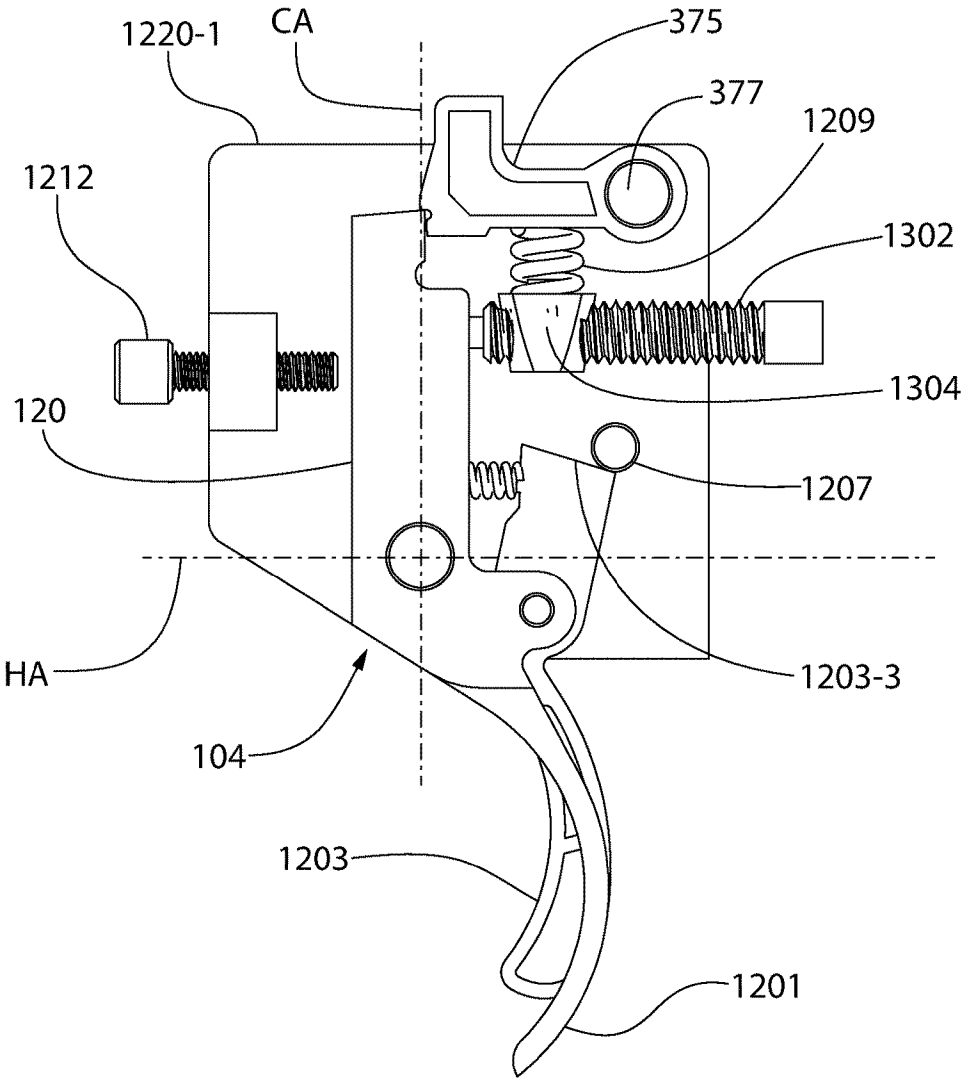
FIG. 63 is a rear view thereof.
Figure 65:
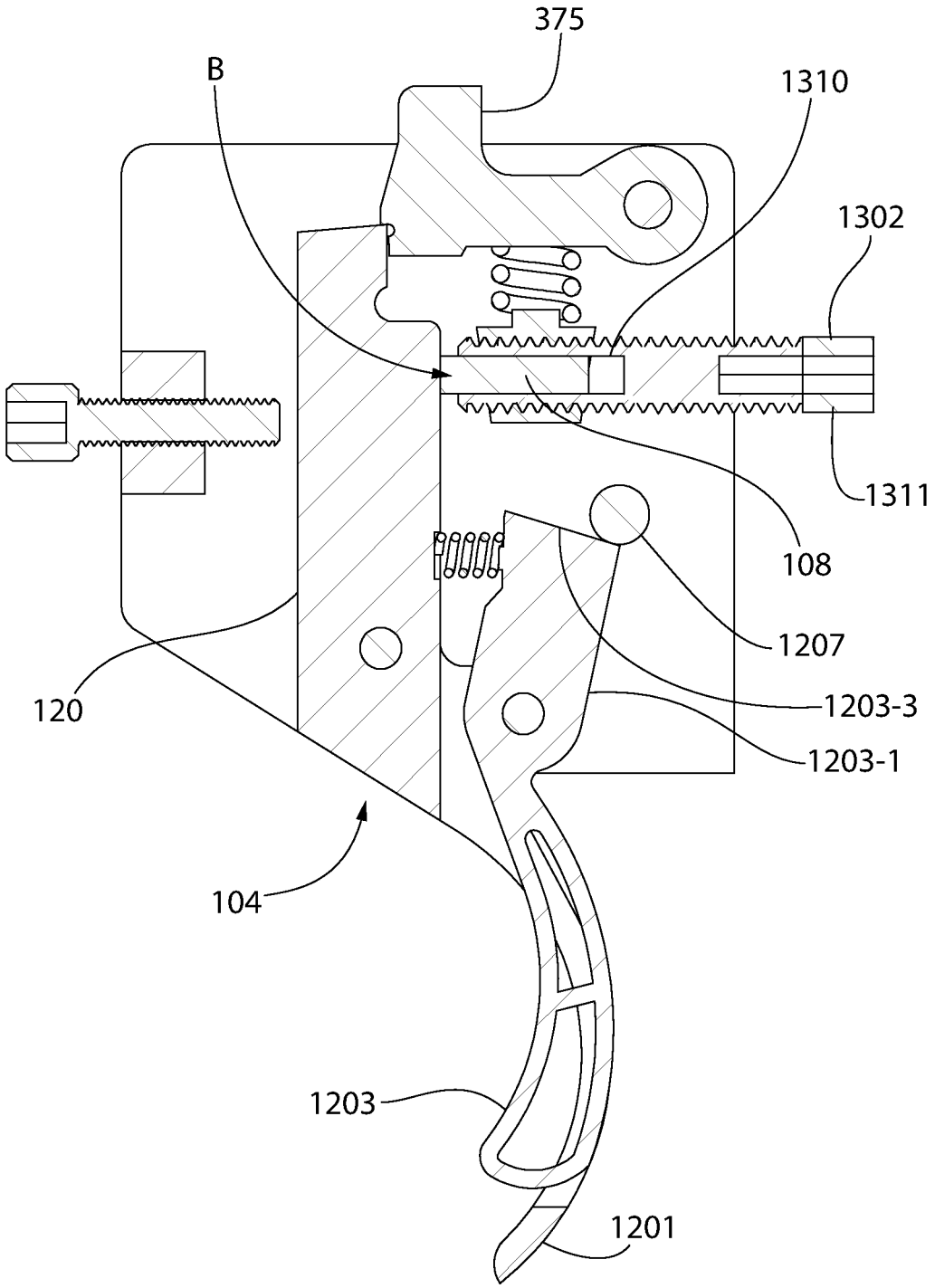
FIG. 65 is a side cross-sectional view thereof.
Figure 66:
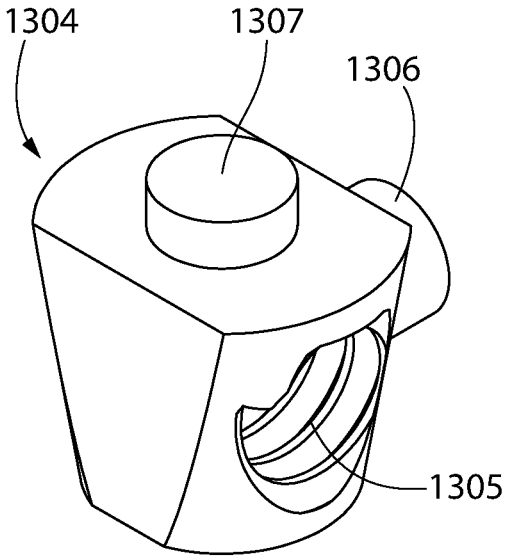
FIG. 66 is a top rear perspective view of the magnet holder mounting block of the trigger mechanism of FIG. 61.
Figure 67:
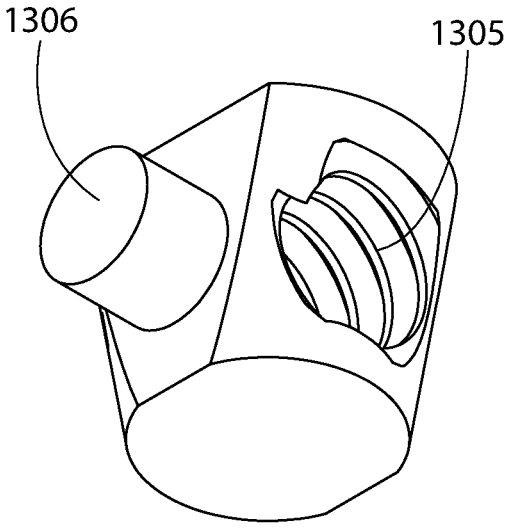
FIG. 67 is a bottom side perspective view thereof.
Figure 68:
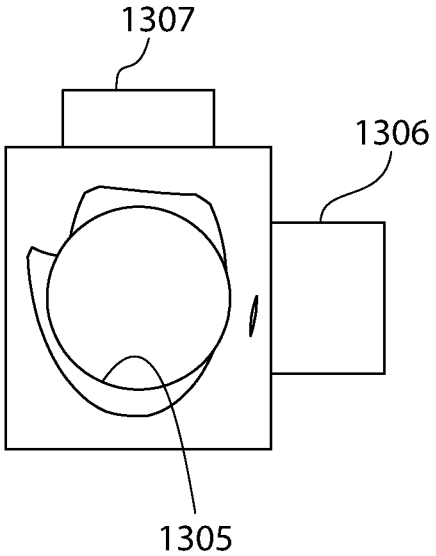
FIG. 68 is a rear view thereof.
Figure 69:
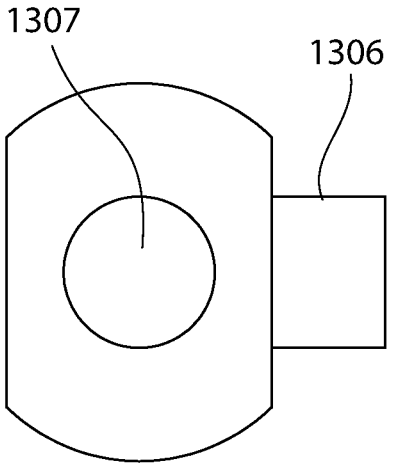
FIG. 69 is a top view thereof.

FIG. 64 shows the trigger mechanism 1300 in the ready-to-fire position. The trigger pull and firing sequence operation for rotating the sear and releasing the striker is similar to the closed magnetic loop trigger mechanism 1200. Those details will not be repeated here.

As the trigger assembly 1202 of the open magnetic loop trigger mechanism 1300 is initially pulled and displaced by the user to the right, the top trigger safety cam surface 1203-3 of the rotating inner safety trigger 1203 engages and the moves past the safety blocking pin 1207, thereby providing the initial take-up travel of the trigger. As the user continues to pull the full trigger assembly 1202 (outer trigger 1201 and safety trigger 1203), the final release force to rotate the trigger member 104 body and release the firing sear 375 is dependent on the magnetic flux density created between the magnet 108 and the rotating upper working portion 120 of the trigger body. The flux density is dependent on the magnetic properties of the permanent magnet, the physical geometry of the magnet, and the displacement between the magnet and the rotating trigger body. In general, the trigger release magnetic static holding force is adjusted by changing the displacement and position of the magnet 108 relative to the rotating trigger body at control air gap B, which in turn changes the magnetic flux contribution to the trigger release holding force.

When the trigger is reset after releasing the sear 375, the movement of the safety trigger 1203 cams down as it resets past the safety blocking pin 1207 and applies a leveraged pressure on the rotating trigger body upper mounting portion 120 to help position the trigger body closer to the magnet. This camming action assists in driving the rotating trigger body back into the reset position where the magnetic forces are re-established and accelerates the re-establishment of the magnetic pull strength necessary to reset the sear 375. The combination of the trigger safety camming force and the magnetic pull forces of the magnet will advantageously allow for the potential removal of the traditional trigger return spring. The elimination of the trigger return spring allows a much crisper trigger reaction when the sear releases and more range of possible trigger pull adjustment, which is considered a significant advantage of both this open magnetic loop design and the closed magnetic loop designs.

It bears mention that the foregoing camming force of the split trigger safety and the leveraging of the magnetic attraction force at control air gap B to reset the rotating trigger arm 104 and potentially eliminate the need for a trigger return spring is a significant advantage of both the open and closed loop magnetic designs.

Figure 70:
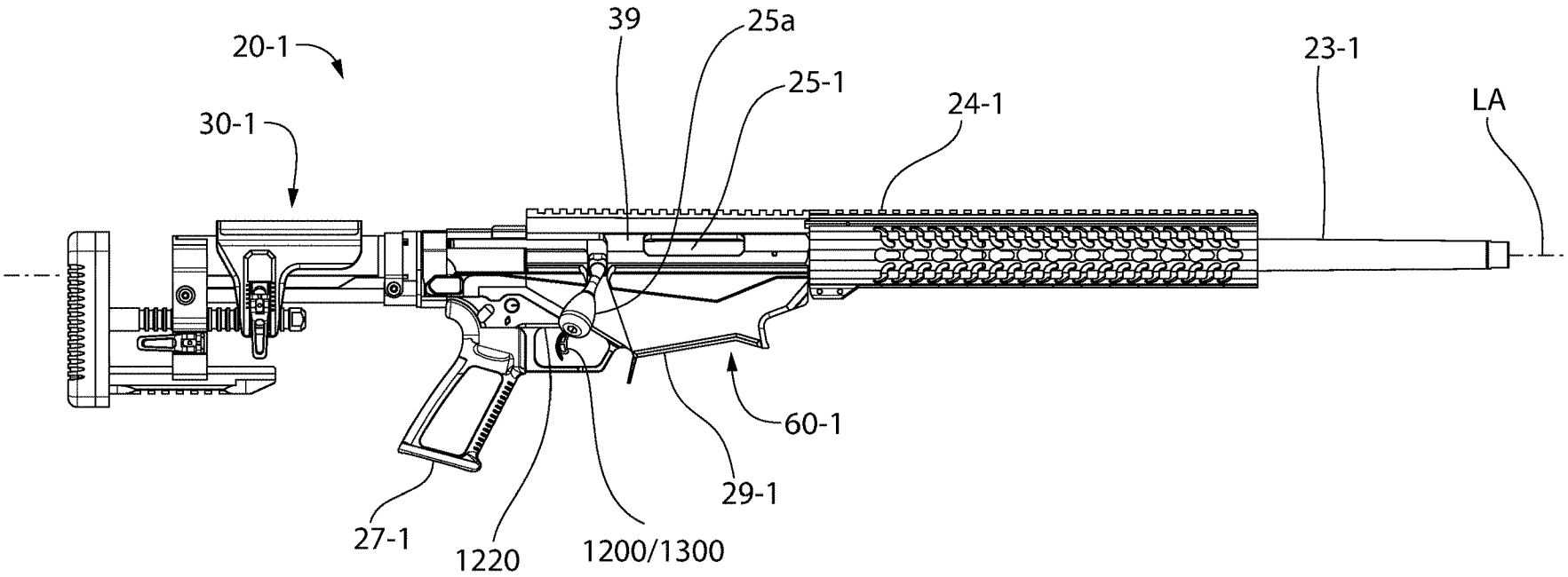
FIG. 70 is a right side view of a long gun in the form of a rifle incorporating a trigger housing including the trigger mechanisms of FIG. 52 or 61.

FIG. 70 depicts one non-limiting example of long gun 20-1 in the form of a rifle 20-1 in which the closed or open loop trigger mechanisms 1200, 1300 described above may be used. Rifle 20-1 generally includes a chassis or frame 60-1 supporting a stationary receiver 39 and an elongated barrel 23-1 coupled to the receiver. Barrel 23-1 includes a longitudinally-extending bore defining longitudinal axis LA, a rear chamber for holding the cartridge, and a forward projectile pathway through which the bullet, slug, or shot travels. Rifle 20-1 further includes buttstock 30-1 supported by the frame 60-1. Frame 60-1 includes a downwardly open magazine well 29-1 for removably receiving an ammunition magazine and optionally a grip handle 27-1. An axially movable bolt 25-1 is mounted in the receiver 39 for forming an open and closed breech. Rifle 20-1 depicts a manually operated bolt 25-1 which includes a bolt handle 25-1 for opening and closing the breech. In other embodiments, rifle 20-1 may be an automatic or semi-automatic rifle in which the bolt 25-1 reciprocates automatically upon firing to open and close the breech for ejecting a spent cartridge case and chambering a fresh cartridge. Such a firearm may have a direct or indirect gas-operated action, or be a blowback type action. Trigger mechanisms 1200 or 1300 may be mounted in a trigger unit or housing 1220 previously described herein, which is mounted to the frame 60-1. The trigger mechanisms 1200 or 1300 operate in the manner already discussed to fire the rifle 20-1.

In other possible embodiments, the closed or open loop trigger mechanisms 1200 or 1300 may instead be mounted in a handgun such as firearm 20 shown in FIG. 30 having a reciprocating slide (receiver).

It bear noting that the sear pin 377, rotatable trigger member pin 1205, safety trigger pin 1206, and the safety blocking pin 1207 are mounted in complementary configured mounting holes formed in the inner surfaces of the trigger housing 1220 right side plate 1220-1 and left side plate (not shown).

A method for adjusting the open loop magnetic trigger mechanism 1300 described above will now be briefly summarized. The method comprises providing a rotating trigger member 104 pivotably movable about a pivot axis relative to a frame 22, receiver 39, or trigger housing 1220 of a firearm 20 or 20-1, and a threaded magnet holder 1302 holding a permanent magnet 108 in proximity to the trigger member. The permanent magnet 108 is operable to generate a static magnetic field attracting the trigger member to the magnet 108, the static magnetic field creating a primary resistance force opposing movement of the trigger member 104 when pulled by the user. The method includes: rotating the magnet holder 1302 in a first direction to advance the permanent magnet 108 towards the trigger member at a control air gap B formed between the magnet and trigger member, the magnet creating a first static magnetic field strength; and rotating the magnet holder in an opposite second direction to withdraw the magnet from trigger member, the magnet now creating a second static magnetic field strength less than the first magnetic field strength. The strength of the static magnetic field is changeable via varying position of the permanent magnet relative to the trigger member at the control air gap to adjust a trigger pull force of trigger mechanism.

The trigger mechanisms disclosed herein are all generally amenable for use in any type of small arms or light weapons using a trigger mechanism, including for example handguns (pistols and revolvers), rifles, carbines, shotguns, grenade launchers, etc.

Hybrid Single Closed Loop Electromagnetic Trigger Mechanism

FIGS. 71-77 depict one non-limiting embodiment of an electrically adjustable and variable hybrid single closed loop electromagnetic firing or trigger mechanism 1400 having a user adjustable trigger force. In the hybrid trigger system, however, the function of the permanent magnet which provides static holding force on the trigger creating resistance to a trigger pull by the user has been replaced by a mechanical means such as a trigger spring. Trigger mechanism 1400 adopts and shares similar aspects and features with some of the trigger mechanisms previously described herein, such as those shown for example FIGS. 6-7, 16-30, and 52-56. Accordingly, similar parts are numbered the same and not discussed in great detail here for the sake of brevity recognizing that those parts are similar to those already described.

The hybrid electromagnetic firing or trigger mechanism 1400 may generally comprise the following parts: a lower rotatable trigger member 1430, an upper rotatable trigger bar 1410, an electrical (aka electromagnetic) coil 106, a magnetic stationary yoke 102, a selectively openable/closeable air gap A formed between the trigger bar and yoke, a rotatable sear 375, a sear spring 1421, a trigger spring 1420, and a trigger displacement sensor or force sensor 1440, such as without limitation force sensing resistor 370 in one embodiment. Displacement type sensors 159 (shown in dashed lines in FIG. 74) of the types previously described herein (e.g. Hall effect sensors, magnetoresistive sensors, and optical or mechanical switches or sensors) may alternatively be used to monitor and detect movement of the trigger member 1430 for actuating the electromagnetic automatically via the controller to adjust the trigger pull force. Each of the foregoing components and operable interaction for adjusting the trigger pull force to meet user's preferences is further described below.

Referring now again to FIGS. 71-77, hybrid electromagnetic trigger mechanism 1400 generally includes a magnetic stationary yoke 102, rotatable trigger bar or member 1430, and an electromagnet coil 106 connected to an electric power source. Selectively openable and closeable air gap A is formed between the yoke and trigger member. Coil 106 may be disposed and wound around a portion of the stationary yoke 102 as shown, or alternatively the trigger member 1430 in other embodiments. The yoke 102 may be fixedly but preferably removably mounted to and supported by an available support structure of the firearm 20, which may be in various non-limiting embodiments may be but is not limited to the chassis/frame 60-1 or the receiver 39 of a rifle 20-1 (see, e.g. FIG. 70) or shotgun (not shown), grip frame 22 of a pistol 20 (see, e.g. FIG. 30) or revolver (not shown), or a removable trigger mechanism unit or housing 1220 previously described herein which may be detachably mounted in a receptacle of either a frame or receiver of a long gun (e.g. frame 60-1 of rifle 20-1 shown in FIG. 70). The term "support structure" shall be broadly construed to cover any of the foregoing examples or other available structures of a firearm depending on its type and design which may directly or indirectly (via intermediate elements) provide support for the yoke. Yoke 102 may be affixed to any of the forgoing support structures by any suitable means, including for example without limitation threaded fasteners, couplers, pins, interlocking features, etc. The mode of attachment is not limiting of the invention.

The hybrid electromagnetic trigger mechanism 1400 defines a front 1401, rear 1402, opposing right and left lateral sides 1403, 1404 (side designations when the trigger unit is mounted in a firearm), top 1405, and bottom 1406. A vertical central axis CA and horizontal central axis HA of the trigger mechanism 1200 are defined for convenience of reference each of which pass through trigger pivot pin 101 and perpendicularly intersect each other (see, e.g. FIG. 54).

Trigger mechanism 1400 may have a generally annular shape in one embodiment which is collectively formed by the yoke 102 in part and in the remaining part by the rotatable trigger member 1430 to complete the annulus. An open central space 103 is defined by the trigger mechanism 1400 between the yoke 102 and trigger member 1430. This central space 103 provides room for receiving a portion of the coil 106 therein when wound around the yoke or trigger member.

The stationary yoke 102 of the electromagnetic trigger mechanism 100 may be substantially C-shaped in one embodiment including a horizontal upper portion 110, horizontal lower portion 112 spaced apart and parallel to the upper portion, and a vertical intermediate portion 114 extending between the upper and lower portions. The intermediate portion 114 may be integrated with captive end portions of the upper and lower portions 110, 112 being a unitary structural part of the entire yoke 102 in one embodiment. The lower portion 112 may be bifurcated as shown forming a pair of laterally spaced apart arms 112-1 defining a vertical through opening 1214 therebetween in which a portion of the trigger member 1430 and trigger bar 1410 are pivotably mounted thereto by transverse pivot pin 101. The yoke portions 110, 112, and 114 may have any suitable transverse cross-sectional shape including polygonal such as rectilinear as shown, non-polygonal (e.g. circular), or combinations thereof which lend themselves to winding the coil 106 thereto. Although the stationary yoke 102 is illustrated herein as have a C-shaped configuration, it will be appreciated that other configurations of the yoke are possible and may be used. The combination of the C-shaped yoke 102 and vertical rotatable trigger member 1430 collectively define a closed loop magnetic flux circuit which is openable and closeable at air gap A.

The trigger member 1430 and trigger bar 1410 may each be arranged and lie in the same vertical reference plane Vp as the yoke 102; each being pivotably movable within that plane for opening and closing air gap A. The vertical reference plane Vp includes and intersects vertical central axis CA and preferably longitudinal axis LA of the firearm in one embodiment such that the trigger mechanism is located evenly between the right and left sides of the firearm. In the present non-limiting embodiment, the yoke 102 is disposed forward of the trigger member 1430.

Rotatable trigger member 1430 and trigger bar 1410 are each pivotably disposed in the frame of the firearm. In one non-limiting embodiment, rotatable trigger member 1430 and trigger bar 1410 may each be pivotably coupled to stationary yoke 102 about a shared or common pivot axis PA3 defined by transversely mounted cross pin 101. Pivot axis PA3 is oriented transversely to the longitudinal axis LA of the firearm and vertical central axis CA of the trigger mechanism 1400 (see, e.g. FIGS. 72-77). As shown, rotatable trigger member 1430 may be pivotably coupled to the lower portion 112 of yoke 102 at a terminal end thereof. The rotatable trigger member 1430 and trigger bar 1410 are thus each configured to receive pivot 101 therethrough for forming the pivotable coupling to yoke 102. It bears noting that in the present embodiment, the trigger member 1430 and trigger bar 1410 are each pivotable movable relative to not only the yoke, but to each other as well for interaction with the force sensor arranged therebetween, as further described herein.

It will be appreciated that in alternative embodiments contemplated, the rotatable trigger member 1430 may alternatively be pivotably mounted to the frame 22, removable trigger housing 1220, or other support structure of the firearm instead of to yoke 102 and trigger bar via pivot pin 101, thereby achieving the same manner of relative movement to each other and the yoke 102. The trigger bar 1410 would still preferably be pivotably coupled to the yoke to complete the close magnetic loop. In such embodiments, the separate pivot axis and pin of the trigger member is preferably located proximate to the trigger bar such at the operating extension 1432 of the trigger member forms the same interface 1413 with the actuating extension 1412 of the trigger bar 1410.

With reference to FIGS. 71-77, the rotatable trigger member 1430 may have a generally L-shaped body configuration in one embodiment including a lower finger grip portion 1431 and a cantilevered upper rear operating extension 1432 intersecting the grip portion. Extension 1432 extends rearwardly from and substantially perpendicularly to finger grip portion 1431, and may be formed integrally therewith as a unitary structural portion of the trigger member 1430 such that pulling and pivoting the finger grip portion rearward to discharge the firearm concomitantly pivots/rotates the operating extension upwards bout pivot axis PA3. Finger grip portion 1431 is substantially vertical when not pulled and may be arcuately curved in shape to define a conventional-looking trigger 121 of the trigger mechanism 1400. Finger grip portion 1431 is thus oriented substantially parallel to vertical central axis CA absent a trigger pull (allowing for its arcuate curved shape to facilitate engaging the user's finger) and operating extension is substantially perpendicular to axis CA and horizontal (i.e. substantially but not necessarily perfectly parallel to horizontal axis HA).

Both finger grip portion 1431 and operating extension 1432 may be elongated structures or elements in one embodiment. At least the top surface 1432-1 of rear operating extension 1432 may preferably be substantially planar or flat for interfacing with a cooperating bottom surface 1412-1 of the trigger bar 1410. The bottom surface 1432-2 of the rear operating extension 1432 may be any shape, and may be planar/flat as illustrated in one non-limiting embodiment. The finger grip portion 1431 and rear operating extension 1432 of trigger member 1430 may be angularly disposed to each other, such as for example without limitation about 90 degree or another suitable angle. Rear operating extension 1432 may be substantially horizontal in orientation (i.e. substantially but not necessarily perfectly parallel to horizontal axis HA) when the trigger is un-pulled.

The trigger member 1430 is pivotably coupled to the yoke 102 at the angled intersection of the grip portion 1431 and rear operating extension 1432. The intersection defines a coupling portion 1451 which includes an aperture for receiving pivot pin 101 and a forwardly open vertical slot. The coupling portion 1451 is received in turn in the rearwardly open through opening 1214 between the arms 112-1 of the yoke 102.

In some embodiments, trigger member 1430 may be a two-piece trigger assembly which includes an outer trigger 1201 and inner safety trigger 1203 of the type shown in FIG. 52-56 or another. In such a case, the rotatable trigger member 1430 substitutes for and performs the function of the outer trigger.

Trigger bar 1410 may have a generally L-shaped body configuration in one embodiment including a vertically elongated upper working portion 1411 and an elongated cantilevered lower rear actuating extension 1412. Extension 1412 extends rearwardly from and substantially perpendicularly to working portion 1411, and may be formed integrally therewith as a unitary structural portion of the trigger bar 1410 such that moving actuating extension 1412 upwards via a trigger pull concomitantly pivots/rotates the working portion 1411 of trigger bar 1410 forwards about pivot axis PA3. Upper working portion 1411 is substantially vertical when the trigger is not pulled and thus oriented substantially parallel to vertical central axis CA. Rear actuating extension 1412 is substantially perpendicular to axis CA and horizontal (i.e. substantially but not necessarily perfectly parallel to horizontal axis HA).

At least the bottom surface 1412-1 of rear actuating extension 1412 may preferably be substantially planar or flat for interfacing with a cooperating top surface 1432-1 of the trigger bar 1410 (rear operating extension 1432). The top surface 1412-2 may be any shape, and may be planar/flat as illustrated in one non-limiting embodiment for engaging the bottom end of trigger spring 1420. The top end of spring 1420 engages a spring seating surface 1420-1 of the trigger mechanism or firearm support structure for compressing the seating surface and top surface 1412-2 of the rear actuating extension. The upper working portion 1411 of trigger bar 1410 and rear actuating extension 1412 of the trigger bar may be angularly disposed to each other, such as for example without limitation about 90 degree or another suitable angle.

The trigger bar 1410 is pivotably coupled to the yoke 102 at the angled intersection of the vertically elongated working portion 1411 and rear actuating extension 1412. The intersection may include a downwardly extending coupling lobe 1450 defining an aperture for receiving pivot pin 101. Lobe 1450 is received in the forwardly open vertical slot of the trigger member coupling portion 1451, which in turn is received in the through opening 1214 between the arms 112-1 of the yoke 102.

The trigger bar 1410 is manually movable by a user from a forward position to a rearward position which rotates the rotating member from the upright unactuated position to the forwardly angled actuated position for discharging the firearm.

It bears noting that the arrangement and interaction between the present trigger member 1430 and trigger bar 1410 is analogous and similar to rotating member 304 and outer trigger 321 of trigger mechanism actuator 350 shown in FIGS. 16-30 previously described herein. The trigger member 1430 and trigger bar 1410 thus are movable together and apart relative to each other, and cooperate with the trigger force sensor 1440 interposed therebetween to activate the electric coil 106 of the present trigger mechanism 1400 for altering the trigger resistance and force required to be exerted by the user to overcome the primary mechanical holding or resistance force generated by the trigger spring 1420 to discharge the firearm.

Accordingly, the cantilevered rear operating arm or extension 1432 of trigger member 1430 is arranged to engage the rear actuating extension 1412 of the trigger bar 1410. In one embodiment, operating extension 1432 protrudes rearwardly from the mounting portion 362 of outer trigger 321 over at least a portion of the top of actuating extension 1413 in closely spaced relation forming a relatively small gap or interface 1413 therebetween. In one embodiment, operating extension 1432 defines a flat or planar upwardly facing operating surface 1432-1 directly opposed to downwardly facing flat or planar actuation surface 1412-1 of actuation extension 1412. The interface 1413 between the operating surface 1432-1 and actuation surface 1412-1 is one of a flat-to-flat interface in one embodiment as shown (see, e.g. FIGS. 71, 74, and 75). Actuating extension 1412 of trigger bar 1410 is biased downward by trigger spring 1420 towards engagement with operating extension 1432 of trigger member 1430. This in turn biases trigger member 1430 (i.e. trigger 121) forward towards the un-pulled and upright ready-to-fire position shown in FIGS. 70-75. The spring 1420 maintains continuous mutual engagement between the trigger member 1430 and the trigger bar 1410 (with thin film force sensing resistor 370 interspersed in at least a portion of the interface 1413 between the trigger member operating surface 1432-1 and trigger bar actuation surface 1412-1).

In one embodiment, the force sensor 1440 such as thin film force sensing resistor 370 previously described herein may be interposed at the substantially flat-to-flat interface 1413 between the upward facing operating surface 1432-1 of the operating extension 1432 of rotatable trigger member 1430, and the downward facing actuation surface 1412-1 of the rear actuating extension 1412 of rotatable trigger bar 1410. Force sensing resistor 370 measures an applied pressure or force between the two mating surfaces created during a trigger pull event. Thin film force sensing resistors are well known in the art and commercially available from numerous suppliers. Force sensing resistor 370 is operably and communicably coupled to microcontroller 200 (shown in FIGS. 7, 9, 30, and 35). Force sensing resistor 370 is configured and arranged to detect and measure an applied trigger force F exerted by the operating extension 1432 of rotatable trigger member 1430 upwards on rear actuating extension 1412 of rotatable trigger bar 1410 via a trigger pull by a user to fire the firearm 20. The force sensing resistor is compressed between the mating surfaces 1431-1 and 1412-1 generating a measurable compressive force. When paired with a trigger force setpoint preprogrammed into microcontroller 200, this serves as a basis for intermittently energizing the electric coil 106 of the electromagnetic upon comparison by the microcontroller to a measured real-time actual sensed trigger force (in the same manner previously described herein). Energizing the coil 106 when the measured user-applied trigger force F meets or exceeds the preprogrammed trigger force setpoint creates a dynamic electromagnetic force in the trigger mechanism 1400 which acts through the closed loop magnetic flux circuit that counteracts the primary holding force imparted to trigger member 1430 via the trigger spring 1420. The energized coil 106 draws the trigger bar 1410 forward to close air gap A and assists the user in overcoming the primary resistance or holding force imparted to the trigger member 1430 by trigger spring 1420.

In one embodiment, with continuing reference to FIGS. 71-77, the top end 1411-1 of working portion 1411 of the rotatable trigger bar 1410 defines an upward facing sear surface 132 which is engageable with sear 375. The sear surface 132 is selectively operable to either engage or disengage the sear 375 via a trigger pull. When sear surface 132 is engaged with sear 375, the sear is held in the vertically upright standby or ready-to-fire position in turn engaged with the spring-biased striking member 130 (see FIG. 30) holding it in the cocked rearward position (absent a trigger pull). Sear 375 in turn drops to the downward fire position when not supported by and disengaged from trigger bar sear surface 132 via a trigger pull event. This releases the movable striking member which then travels forward for discharging the firearm in the usual manner. In one embodiment, the front end of sear 375 may include a sear notch comprising downward facing engagement surface 46 which may be formed on a forwardly extending ledge-like protrusion of the sear which is selectively engageable with the upward facing sear surface 132 of the trigger bar working portion 1411. An edge of sear surface 132 may engage the sear notch engagement surface 46 of sear 375 in one embodiment as shown. Mutual engagement between these surfaces maintains the sear 375 in the upward standby/ready-to-fire position until a trigger pull event. Sear 375 may be biased towards the upper ready-to-fire position by sear spring 1421 as further described herein.

The free terminal end surface 110-1 of upper portion 110 of the yoke 102 and top free terminal end portion of the working portion 1411 of trigger bar 1410 adjacent the sear surface 132 are movable together and apart at air gap A via the pivoting action of the pivotable trigger bar relative to the stationary yoke. Accordingly, openable and closeable air gap A at the interface between the yoke 102 and movable trigger bar 1410 is controlled by manually pulling and pivoting the trigger member 1430 operably coupled to the trigger bar 1410 through the force sensing resistor. The rotatable trigger member 1430 is pivotably movable between two actuation states or positions by a user. Trigger member 1430 is movable between a first unactuated or ready-to-fire position in which trigger bar working portion 1411 is vertical and parallel to the vertical central axis CA when the trigger is not pulled, and a second actuated or fire position in which trigger bar working portion 1411 moves forward towards the yoke 102 and assumes an angularly tilted position relative to the central axis CA when the trigger is pulled to discharge the firearm. In the actuated position, air gap A is closed and thus smaller than in the open unactuated position. Also in the actuated position, the axis of tilt of the rotating trigger bar working portion 1411 is obliquely oriented and angled to the central axis CA of trigger mechanism 1400, whereas the trigger bar 1410 is not angularly tilted when the working portion 1411 is in the upright unactuated position.

Sear 375 of trigger mechanism 1400 has already been fully described herein and will not be discussed again in depth for sake of brevity. In general, sear 375 may be somewhat L-shaped in one non-limiting embodiment including upwardly extending sear protrusion 44 arranged to engage and hold the striking member 130 in the rearward cocked position. Sear 375 is rotatably disposed in the firearm and may be mounted thereto (e.g. trigger housing 1220, frame 22 or 60-1, etc.) via transverse cross pin 1422 that defines the pivot axis PA4 of the sear. The vertical sear protrusion 44 may be formed on the forward end of sear 375 opposite a rear end having a transverse opening which receives a cross pin 1422 that defines pivot axis 376. Pivot axes PA4 of the sear and PA3 of trigger member 1430 are parallel to each other and perpendicular to vertical central axis CA.

In one embodiment, the rear facing vertical surface on sear protrusion 44 engages a mating front facing surface of catch protrusion 42 on the spring-biased striking member 130 which may be a linearly movable striker 40 in one non-limiting embodiment. Striker 40 is selectively held in and released from the rearward cocked position by actuating the sear via a trigger pull (see, e.g. FIG. 30). Sear 375 includes rear portion or extension 375-1 acted on its underside by sear spring 1421. This biases the forward sear protrusion 44 upwards into engagement with the striker's downward extending catch protrusion 42. A horizontal surface such as formed by a mounting plate 1208 may be provided on trigger housing 1220 or frame of the firearm which supports the bottom end of the sear spring 1421 opposite the top end of the spring engaging the sear rear extension 375-1. Spring 1421 may be a helical coil compression spring in one embodiment. Other type springs may be used. In other embodiments, the spring arrangement shown in FIG. 52 may be used which includes mounting plate 1208 disposed on trigger housing 1220 or alternatively directly on the frame of the firearm if a trigger housing is not used.

It bears noting that the sear 375 of hybrid electromagnetic trigger mechanism 1400 may be configured and arranged to operably interface with other types of spring-biased striking member 130 used in the firing mechanism of any suitable type of long gun or handgun. Accordingly, besides use with the linearly movable striker 40 of a pistol firing mechanism described above, trigger mechanism 1400 in some embodiment may be used in a shotgun or rifle such as a bolt-action rifle 20-1 shown in FIGS. 70 and 71 and previously described herein. In this application, the sear 375 of trigger mechanism 1400 acts on the firing pin cocking piece 36 affixed to the linearly movable spring-biased firing pin 26. Firing pin 26 is movably disposed inside the linearly movable bolt 25 of the firing mechanism which defines a front breech face for forming a closed or open breech. Bolt 25 is axially slideable forward/rearward inside the receiver 39. Main spring 35 biased the firing pin forward to strike a chambered ammunition cartridge when released by the sear 375 from the rear cocked position. The cocking piece 36 is coupled to rear end of the firing pin 26 and defines a front facing catch or stop surface 52 which is acted on by the rear facing blocking surface on the sear protrusion 44. Pulling the trigger member 1430 disengages the trigger bar 1410 from the sear 375, which drops downwards and breaks contact with the firing pin cocking piece 36. This releases the firing pin 26 forward under the biasing action of the main spring 35 to strike the chambered cartridge and discharge the firearm.

In yet other possible embodiments and applications, the striking member 130 may be a pivotably movable spring-biased hammer such as shown in FIG. 5 which is acted on directly by the trigger bar 1410 to release the hammer for discharging the cocked hammer for discharging the firearm without use an intermediary sear. Accordingly, there are many variations and options available for using the hybrid electromagnetic trigger mechanism 1400 in various types of firing mechanisms.

With continuing reference to FIGS. 71-77, the electromagnet coil 103 of the trigger mechanism 100 is electrically coupled to and energized by an electric power source 122 (examples of which are shown in FIGS. 7, 9, 30) of suitable voltage and current to control operation of the trigger mechanism 1400 for adjusting and altering the trigger pull force and profile. The power source 122 is preferably mounted on-board the firearm and may comprise a single use or rechargeable replaceable battery in some embodiments. In one embodiment, electric coil 106 may be wound around and supported by the upright or vertical intermediate portion 114 of the stationary yoke 102 as shown which collectively forms an electromagnet when the coil is energized. In one embodiment, a protective casing (not shown) such as an electrical resin encapsulate or potting compound may be provided to at least partially enclose and protect the coil 106 in a usual manner.

The stationary yoke 102 and rotatable trigger bar 1410 may be formed of any suitable soft magnetic metal capable of being magnetized, such as without limitation iron, low-carbon steel, nickel-iron, cobalt-iron, etc. In some embodiments, the trigger member 1430 may be formed of the same or a different material which may or may not be capable of being magnetized since the trigger member does not form part of the closed magnetic flux loop or circuit.

Figure 72:
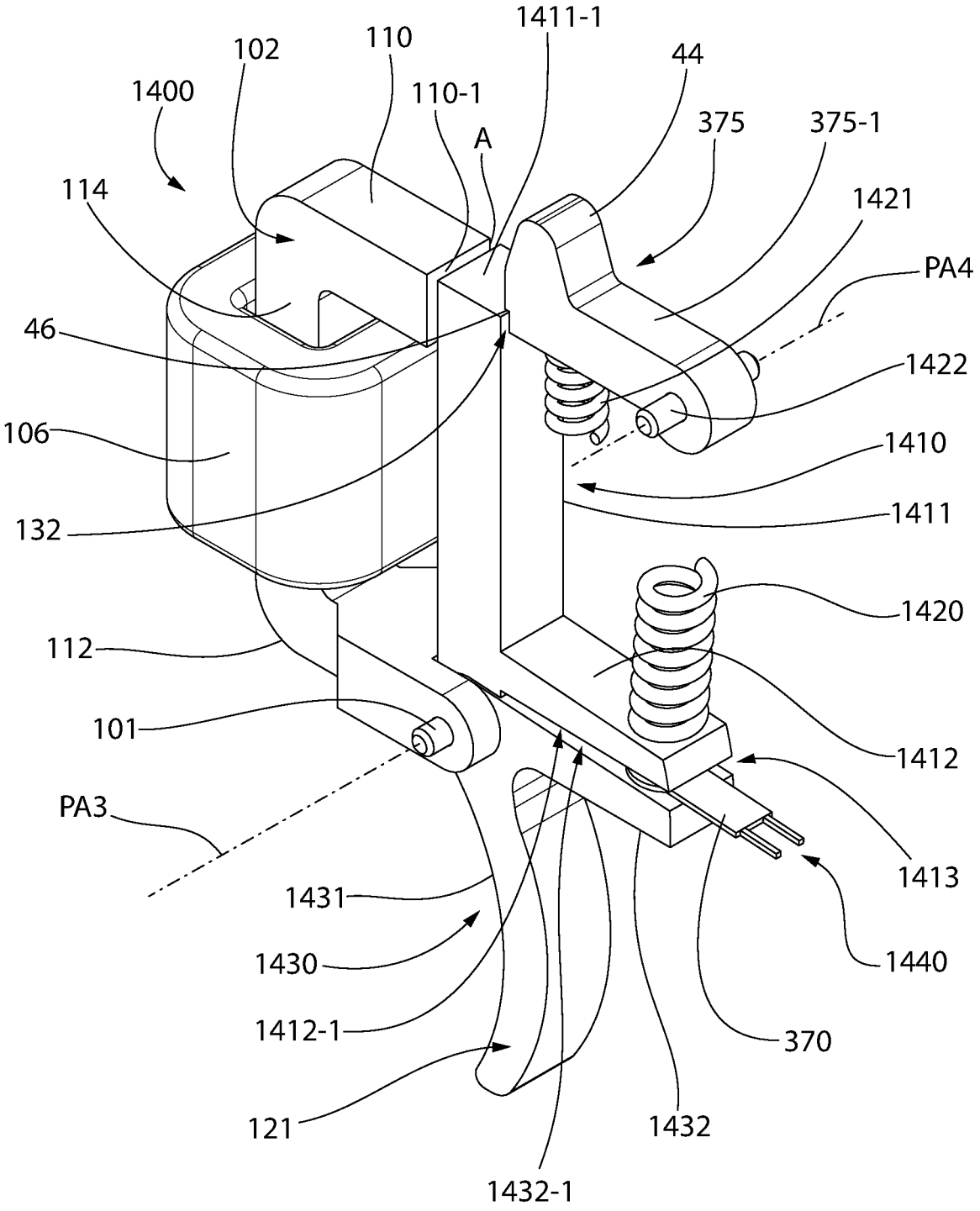
FIG. 72 is a perspective view of the trigger mechanism of FIG. 71.
Figure 73:
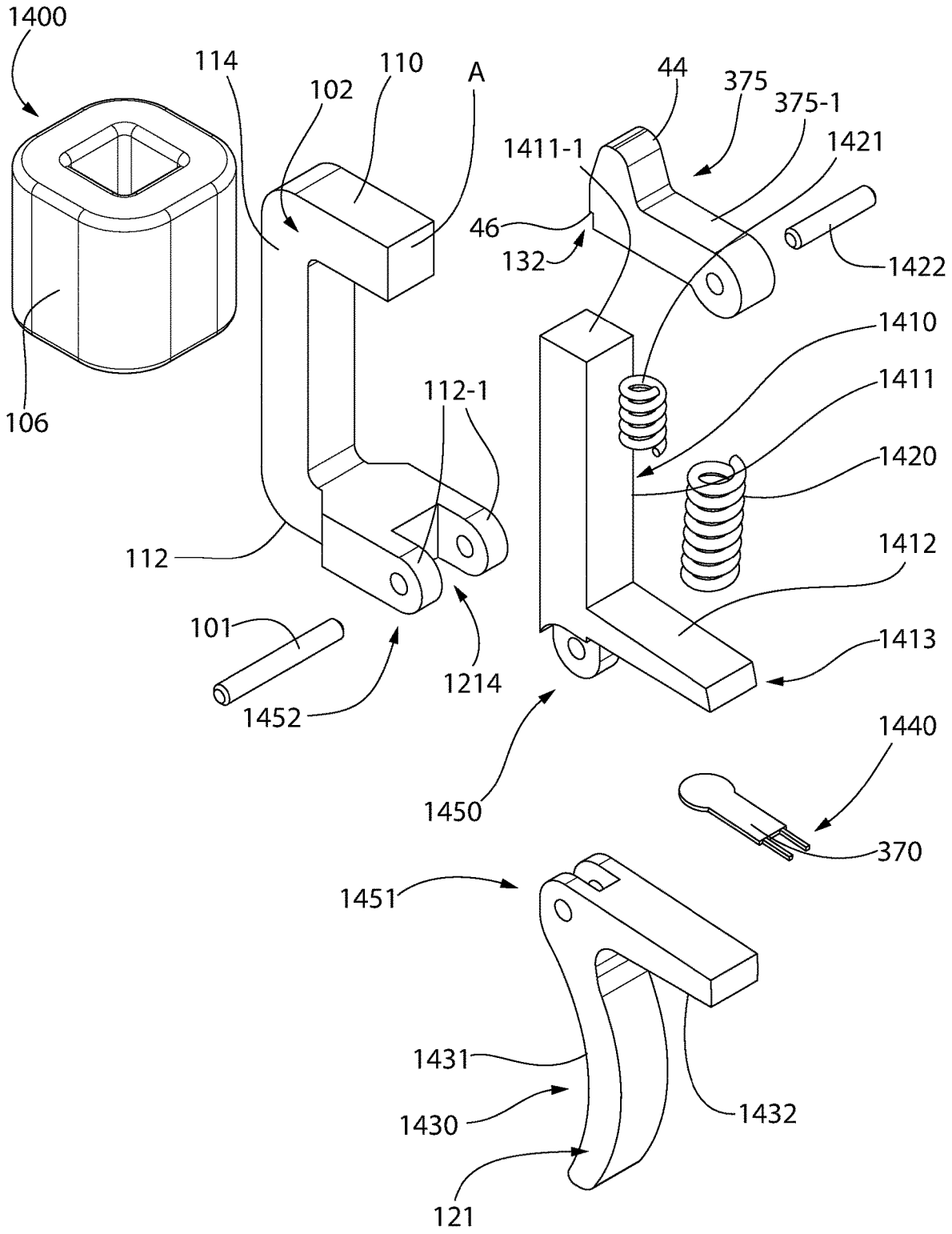
FIG. 73 is an exploded view thereof.
Figure 74:
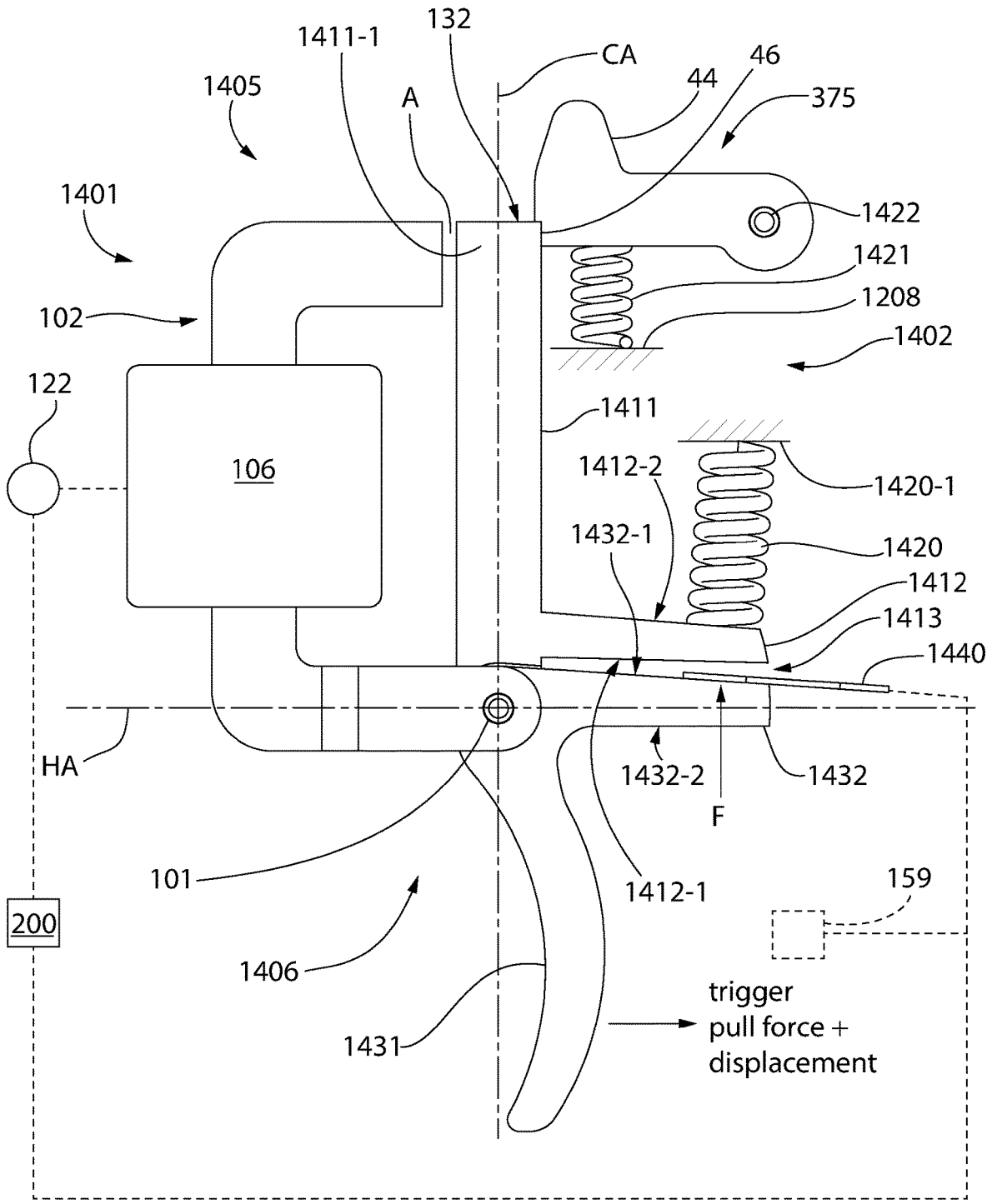
FIG. 74 is a side view thereof.
Figure 75:
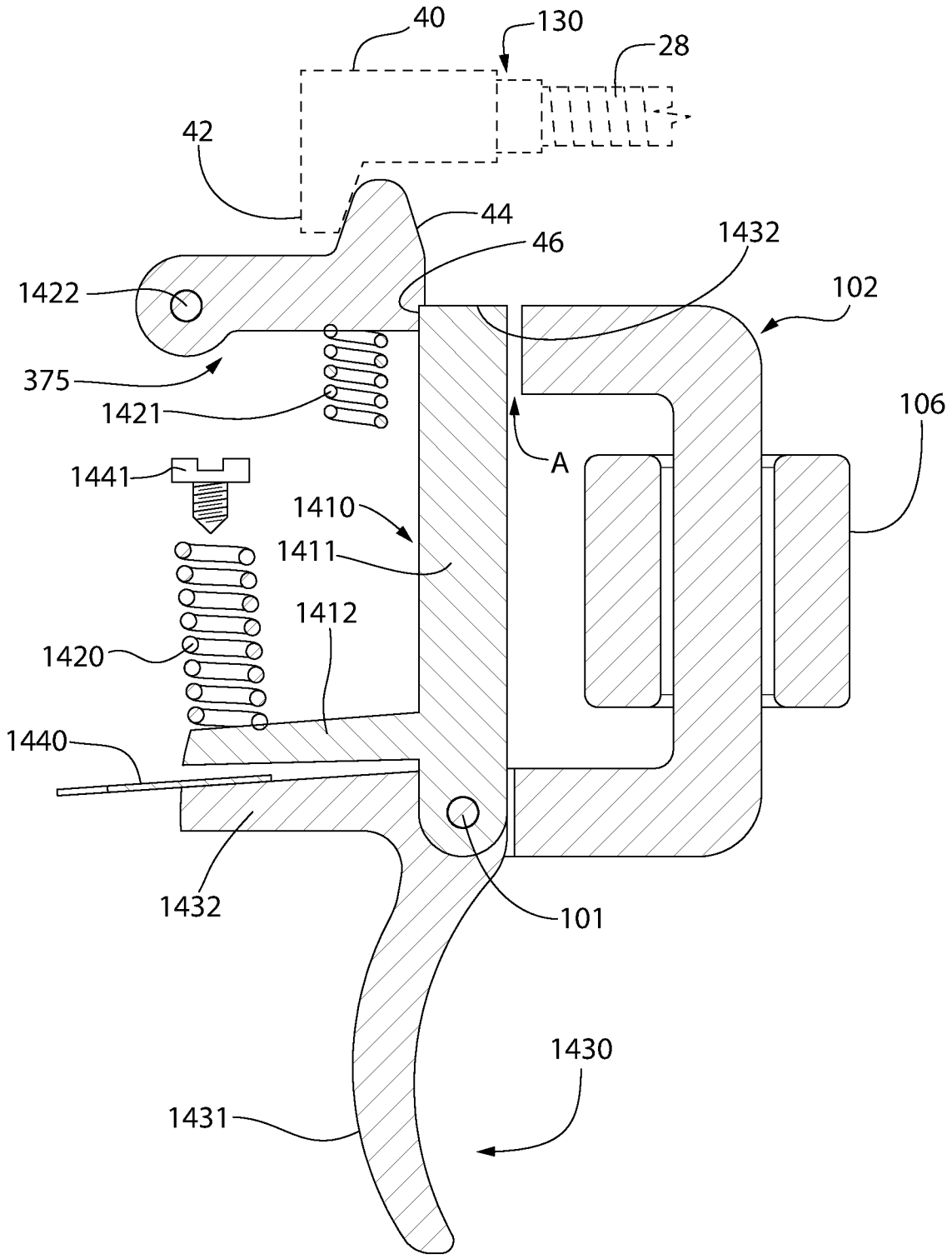
FIG. 75 is a side cross-sectional view thereof.
Figure 76:
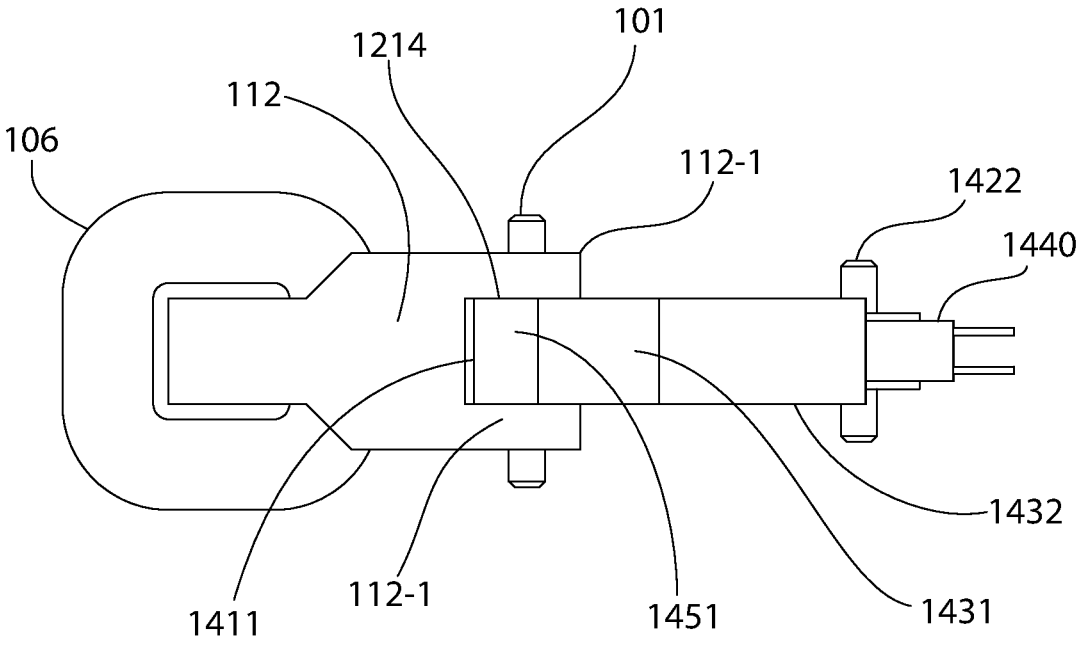
FIG. 76 is a bottom view thereof.
Figure 77:
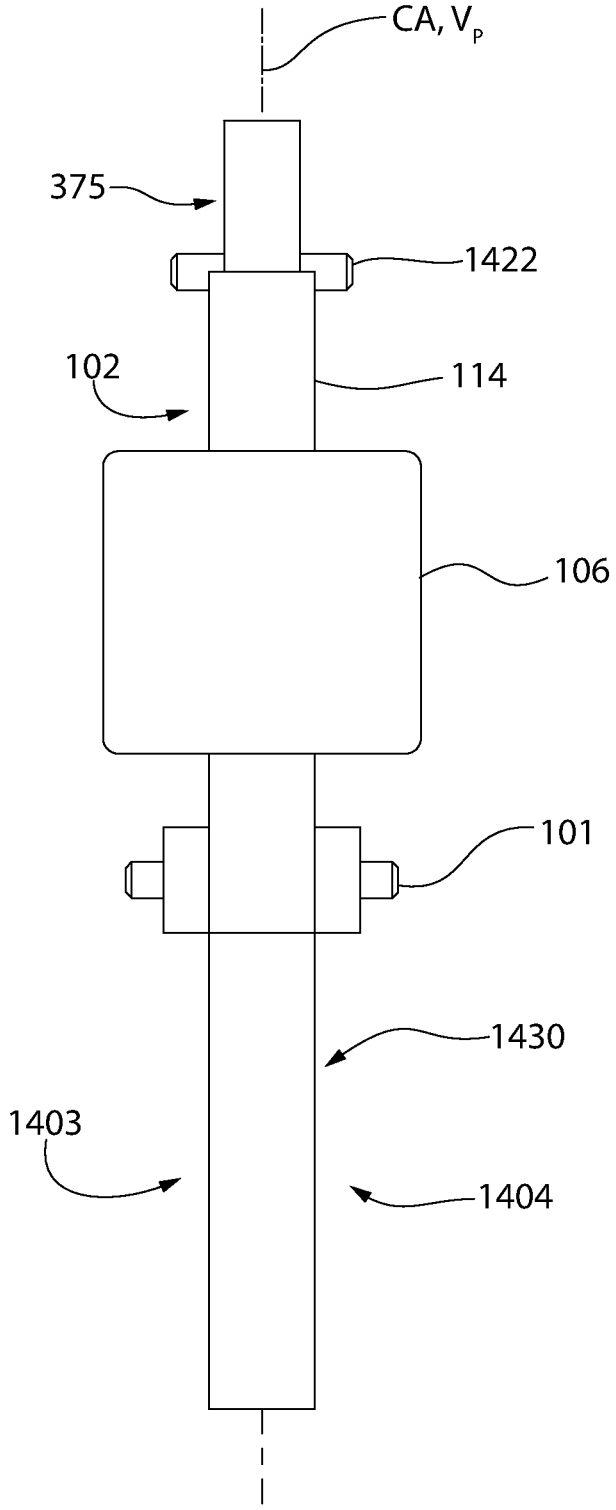
FIG. 77 is a front view thereof.

The hybrid electromagnetic trigger mechanism 1400 is configured for mounting to a frame of a firearm, which may be any type including long guns (e.g. rifles, shotguns, and carbines) or handgun (e.g. pistols and revolvers). FIGS. 72, 74, and 75 show the orientation of parts of the trigger mechanism 1400 when the firing mechanism is in the cocked, ready-to-fire state. The spring-biased cocked striking member 130 which may be the linearly movable striker 40 of the pistol shown in FIG. 30 in one non-limiting embodiment exerts a large downward biasing force on the sear 375. This biasing force is much larger than the upward force of the sear spring 1421; the function of sear spring being to reset the sear when the action and striker 40 are to recock the firearm. The external downward force of the striker 40 is prevented from moving the sear further downward out of engagement with the striker by the engagement of the trigger bar 1410 (i.e. sear surface 132 of upper working portion 1411) with the sear. This engagement between the trigger bar and the sear 375 is maintained by the torque produced by the downward force of the trigger spring 1420 acting on the rear actuating extension 1412 of trigger bar 1410 as previously described herein.

Figure 71:
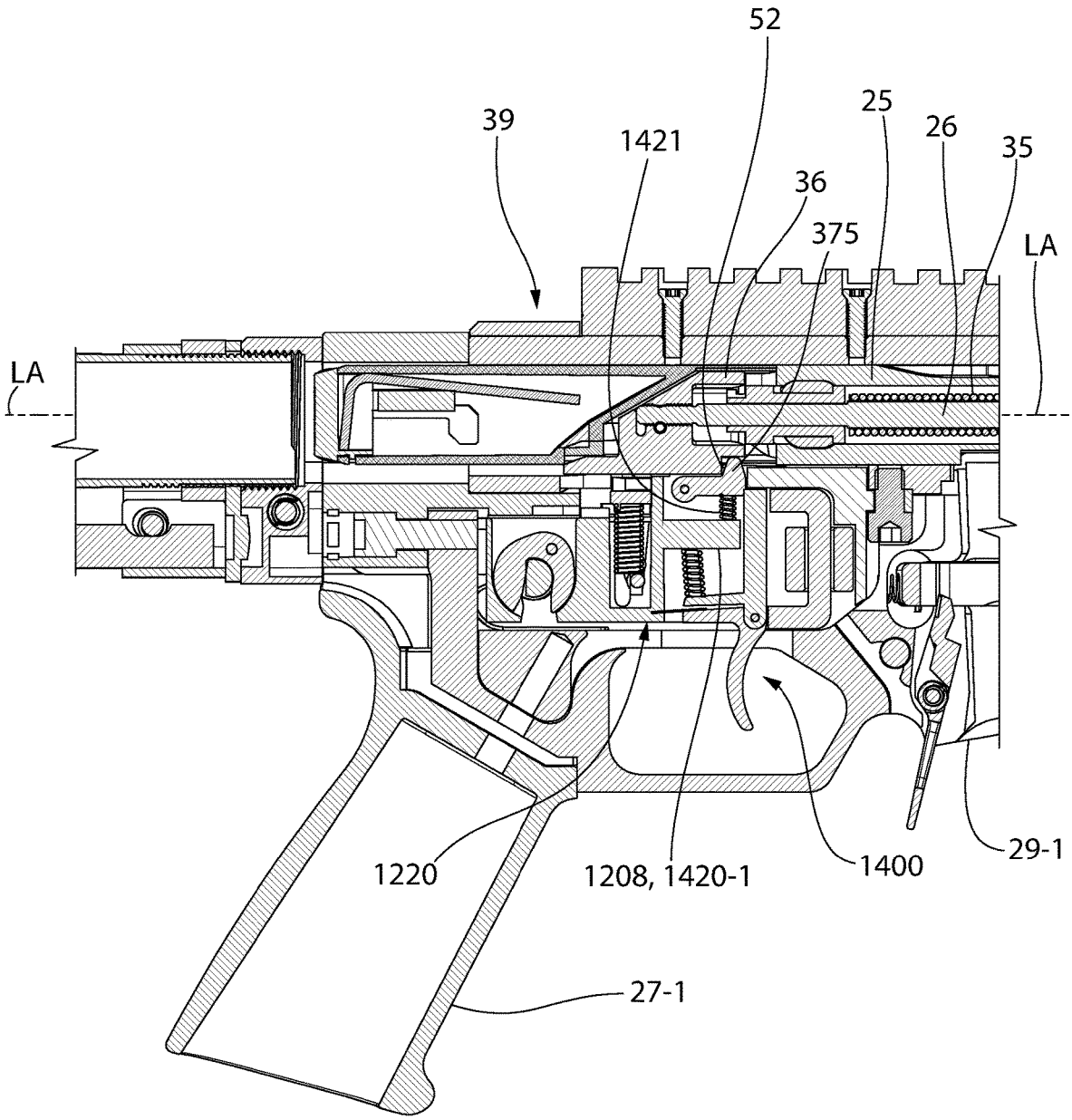
FIG. 71 is a side cross-sectional of the action of the long gun of FIG. 70 incorporating a hybrid electromagnetic trigger mechanism.

In other embodiments in which the hybrid electromagnetic trigger mechanism 1400 may be used in a rifle such as a bolt-action rifle shown in FIGS. 70 and 71, the trigger bar 1410 acts on the sear 375 which may be used to control the release of the spring-biased firing pin 26 in the bolt 25 as previously described herein and disclosed in U.S. Pat. No. 10,030,926 which is incorporate herein by reference in its entirety. Operation of the trigger mechanism 1400 is the same in either case.

A method for operating the hybrid electromagnetic trigger mechanism 1400 will now be described. The trigger bar 1410 of trigger mechanism 1400 is initially in its upright unactuated position being relatively vertical in orientation. The firearm may be fired by the user pulling on the trigger member 1430. In strictly mechanical terms without any assistance from the electric coil 106 of the electromagnet, the trigger member 1430 rotates about the trigger pivot axis PA3 (counterclockwise as depicted in FIG. 74) independently of the trigger bar 1410 which remains stationary until the trigger member rear operating extension 1432 engages the rear actuating extension 1412 of the trigger bar 1410 mechanically through the force sensor 1440 (e.g. thin film force sensing resistor 370). A small gap may be present between the operating and actuating extensions before the trigger is pulled to avoid detection of a force by thin film force sensing resistor 370. The applied trigger pull force F on the trigger member 1430 imparted by the user is then communicated into the trigger bar 1410 (i.e. rear actuating extension 1412) through the operating extension 1432 which moves in unison with the integral finger grip portion 1431 of the trigger member 1430.

If the applied trigger pull force F is sufficient to overcome the primary downward force or resistance created on rear actuating extension 1412 of trigger bar 1410 by the trigger spring 1420, the trigger bar 1410 will rotate about the trigger pivot axis PA3 causing the upper working portion 1411 to move forward away from its engagement point with the sear 375 (counterclockwise as depicted in FIG. 74) to close previously open control air gap A and engage upper portion 110 of stationary yoke 102. The trigger bar 1410 has thus moved to its forwardly angled actuated position. Once the rotation is complete, the trigger bar 1410 disengages the sear 375 (breaking contact between the trigger bar 1410 and sear 375) so that the sear is now free to drop downward and releases the spring-biased cocked striking member 130 (e.g. striker, firing pin, or hammer). In this present strictly mechanical and un-assisted firing scenario and case being described, the user must supply a trigger pull force F sufficient to overcome the downward acting biasing force of the trigger spring 1420 and the static frictional forces of the system. Without assistance from the electric coil 106 of the electromagnet, this strictly mechanical operation and trigger force produces a "heavy" trigger feel. It bears noting that trigger mechanism 1400 is fully capable of discharging the firearm in this pure mechanical mode of operation.

Figure 78:
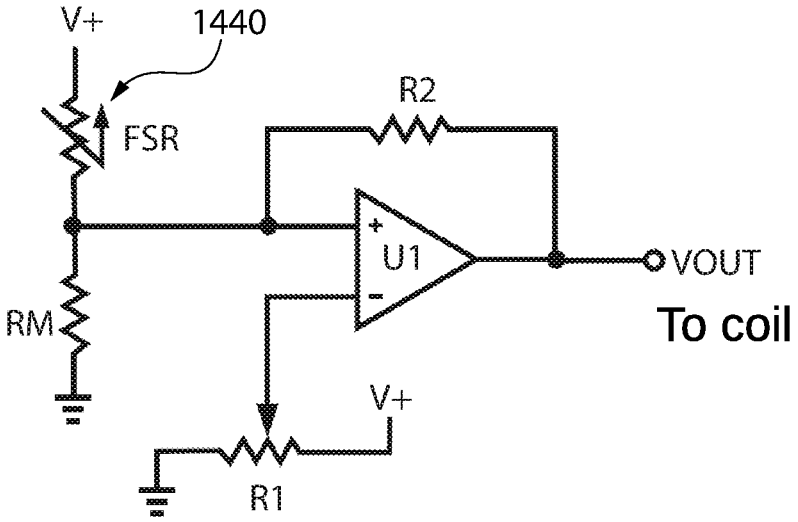
FIG. 78 is a schematic diagram of a manually adjustable analog potentiometer circuit including provisions for a force sensor which may be used to control operation of the hybrid electromagnetic trigger mechanism of FIGS. 71-77.

According to the present hybrid electromagnetic trigger mechanism 1400, however, the firearm may alternatively be fired with a magnetic assist provided by the electric coil 106 to dynamically vary the trigger force electromagnetically. This produces a "lighter" trigger feel for the user. In this electromagnetically-assisted firing scenario, electric current can be supplied via the electronic control system such as an analog actuation control circuit (see, e.g. FIG. 33 and particularly FIG. 78 with force sensor), or a digital actuation control circuit 202 with microcontroller 200 (see, e.g. FIGS. 8 and 9) to selectively energize the electric coil 106 at a predetermined point during the trigger pull event, thereby producing magnetic flux within the magnetic yoke 102. This magnetic flux is communicated through the control air gap A into the trigger bar 1410 and flows back to the magnetic yoke 102 via the lower pivot coupling of the trigger bar to yoke in a circular magnetic flux path, thereby forming a single closed loop magnetic circuit within the trigger bar and yoke collectively. The electric coil 106 may be energized by microcontroller 200 based on sensing a user-applied trigger pull force F via force sensor 1440. When the sensed trigger pull force F is compared by microcontroller 200 to and reaches (i.e. meets or exceeds) the preprogrammed trigger pull force setpoint, the microcontroller energizes the coil 106 of the electromagnet which automatically assists and completes the full trigger pull for the user without any application of any additional trigger pull force F by the user beyond the point where the coil is energized. The trigger pull force setpoint may be changed in the control system by the user to suit individual preferences via programming the user-adjustable control circuitry of microcontroller 200.

The magnetic flux generated within the control air gap A by the electromagnet described above produces an attractive force between the magnetic yoke 102 and the trigger bar 1410 (upper working portion 1411) at the air gap which draws the trigger bar forward towards the yoke to close the air gap. This attractive force produces a strong force or torque acting about the trigger pivot axis PA3 which directionally opposes the primary holding force or torque (i.e. resistance) produced by the downward force exerted on the trigger bar (rear actuating extension 1412) by the trigger spring 1420. The net effect is to counterbalance and reduce the static holding force created by trigger spring 1420 required by the user to fully pull the trigger into the fire position.

The electromagnetic trigger pull assist is user adjustable in preferred embodiments. The trigger pull assist described above can be varied up or down by the user to increase or decrease the trigger pull force requirements by changing the electrical current supplied to the electric coil 106 and/or timing of energizing the electromagnetic coil 106 at a certain point during the trigger travel. Control of the current can be achieved by using the foregoing electronic control system, which may include a properly configured analog circuit (see, e.g. FIG. 33 or 78 with additional of the force sensor 1440) or a digital circuit such as actuation control unit or circuit 202 with operably coupled microcontroller 200 (see, e.g. FIGS. 8-9 and 74). In one embodiment, actuation control circuit 202 may employ for example without limitation pulse modulation to feed the current into the coil. Pulse modulation techniques are well known in the field without undue description here. Using pulse modulation, the actuation control circuit 202 is configurable by the user via preprogramming to change a magnitude of the current fed to the electromagnetic coil via pulse modulation; the magnitude of the current increasing or decreasing the magnetic field of the electromagnetic coil 106 which changes the trigger pull force F required to overcome the primary resistance force created by the trigger spring 1420 on the rear actuating extension 1412 of the trigger bar 1410. Increasing the current concomitantly increases the magnetic field and force, thereby providing a greater assist to the user which decreases the trigger pull force required to be applied to overcome the primary resistance of the trigger spring 1420 to fully actuate the trigger and fire the firearm. Conversely, decreasing the current concomitantly decreases the magnetic field and force, thereby providing a lesser assist to the user which increases the trigger pull force required to be applied to fully actuate the trigger.

In some embodiments, timing and initiation of the pulsed current to electromagnetic coil 106 may also be controlled by the programmable processor-based microcontroller 200 operably coupled to the actuation control circuit 202; the microcontroller being preprogrammed with the trigger force setpoint described above, or in alternative embodiments a trigger displacement setpoint if a displacement type sensor is used instead which option was previously noted herein. The microcontroller 200 is operably coupled to the on-firearm power source 122 (e.g. battery) and the electromagnetic coil 106 (see, e.g. FIGS. 9 and 74). In such a case, the microcontroller 200 may continuously monitor force sensor 1440 (e.g. thin film force sensing resistor 370 or other) for detection of a trigger pull force F on trigger member 1430 by the user. The microcontroller compares the measured force F with the preprogrammed trigger force setpoint. When the setpoint is met or exceeded, an electric pulse is sent by the microcontroller to energize the electric coil 106 and snap the trigger bar 1410 abruptly forward to close control air gap A and release the sear 375 or other firing mechanism component to discharge the firearm in the manner previously described herein. The electric pulse is preferably momentary, such as for a fraction of a second. When the pulse is terminated, this allows the trigger spring 1420 to rapidly reset the trigger bar 1410 and trigger member 1430 of the trigger mechanism 1400 once the trigger is released by the user from the fire state to the ready-to-fire state readied for the next shot. This allows the firearm to be fired in usual rapid succession mode.

The magnitude of the current pulse applied to electromagnetic coil 106 may be adjusted and selected by the user via pulse modulation described above to vary the level of "assist" provided to the user to complete the trigger pull. The electromagnetic field produced in the present closed loop magnetic flux circuit when the coil is energized generates an attractive magnetic force which counterbalances the primary trigger resistance or force (or torque) imparted to the trigger mechanism by the trigger spring 1420 which acts in an opposite direction to the magnetic attractive force between the yoke 102 and trigger bar 1410 at air gap A.

In summary, it bears special noting that the electromagnetic assist advantageously cooperates with the force sensor 1440 and preprogrammed trigger force setpoint in microcontroller 200 to produce a precise user-adjustable trigger pull force. As noted above, as the user pulls the trigger member 1430, the force between trigger and trigger bar 1410 is continuously measured by the force sensor 1440. When this force reaches the user selectable threshold or setpoint preprogrammed into microcontroller 200, or alternatively into a configured analog/digital control circuit alone without aid of a microcontroller, the electric coil 106 can be energized with a temporary brief large current pulse sufficient to pull the trigger bar 1410 forward under magnetic force developed in the air gap A. This transient momentary magnetic force, in effect, causes the firearm to fire under user control. The user, however, will experience and "feel" only the force related to the threshold force or setpoint, and then under magnetic assist as the energized electromagnetic completes the trigger action, the firearm will fire. The reader will realize that in this case, the magnetic force may be controlled either in an analog fashion or in a purely digital, "on"/"off" fashion. In either case, the transient magnetic force may be made sufficient to overcome the static trigger holding force attributed to trigger spring 1420 and fire the firearm. The important feature of hybrid trigger mechanism 1400 is that the user will only "feel" the force related to the user selectable threshold trigger force setpoint measured by the force sensor 1440, thereby producing a user-selectable variable "lighter" trigger pull force F than the force required to overcome the purely mechanical biasing force of the trigger spring alone. The ability to produce a light trigger force and crisp firing action is particularly of importance in competitive shooting.

Based upon the above description of some preferred but non-limiting embodiments of the invention, however, it will be clear to the reader that there are alternative embodiments which preserve the spirit of the invention. For example, non-linear coil trigger springs 1420 can be substituted for linear coil springs as depicted. In this case, the downward force exerted by the variable force trigger spring will vary as the user pulls the trigger member 1430. The electric coil 106 can optionally be equivalently positioned about the vertical working portion 1411 of trigger bar 1410 instead of the magnetic yoke 102 to form the single closed loop magnetic circuit.

In some embodiments, the tension in trigger spring 1420 may adjustable to provide an additional means beyond the electromagnetic coil 106 for adjusting the static resistance or trigger pull force required by the user to discharge the firearm. This may be accomplished by providing an adjustment set screw 1441 threadably mounted to the firearm frame, trigger housing, or other portion of the firearm which acts on the top end of coil spring 1420 opposite its bottom end that acts directly on the lower horizontal rear actuating extension 1412 of the trigger bar 1410 (see, e.g. FIG. 75). Rotating the set screw partially compresses the spring to set a pre-tension therein that alters the mechanical static trigger pull force. Where non-adjustable spring tension is provided, the top end of the spring 1420 merely acts against a part of the firearm frame or other part of the firearm as previously described herein.

It bears noting that in the present invention includes a failsafe provision. In the event that the electromagnetic circuit became inoperable during use of the firearm due to some reason (e.g. depleted battery, etc.), the firearm can still advantageously be fired by relying on operation of the trigger spring 1420 which causes the trigger mechanism to operate in a purely mechanical mode as previously described herein. Although the trigger pull will be heavier than with the magnetic assist, this still provides a fully functional firing mechanism allowing the firearm to be discharged if needed until the firearm can be attended to properly for maintenance or repair. This aspect makes the hybrid variable trigger mechanism 1400 suitable for law enforcement and military use during exigent circumstances.

While the foregoing description and drawings represent exemplary (i.e. example) embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. An electromagnetically variable trigger mechanism for a firearm comprising:

a stationary yoke configured for attachment to a support structure of the firearm;

a movable trigger bar pivotably coupled to the stationary yoke, the trigger bar and yoke collectively configured to form a closed magnetic flux loop;

a trigger member operably interacting with the trigger bar at an interface, the trigger member manually movable by a user to rotate the trigger bar for discharging the firearm;

a trigger biasing member acting on the trigger bar, the biasing member creating a mechanical primary resistance force opposing movement of the trigger when pulled by the user; and an electromagnetic coil operably coupled to a power source and disposed on the stationary yoke or trigger bar;

the electromagnet coil when energized generating a user-adjustable magnetic field interacting with the primary resistance force to dynamically change a trigger pull force required to be exerted by a user to overcome the primary resistance force and discharge the firearm.

2. The trigger mechanism according to claim 1, wherein the magnetic field creates a magnetic force which acts in a direction opposite to the primary resistance force created by the trigger biasing member to draw the trigger bar towards the stationary yoke.

3. The trigger mechanism according to claim 2, further comprising an actuation control circuit operably coupled to the power source and the electromagnetic coil, the actuation control circuit configurable by the user to selectively time energizing the electromagnetic coil during a trigger pull event when the trigger pull force reaches a preprogrammed trigger pull setpoint.

4. The trigger mechanism according to claim 3, further comprising a force sensor operably coupled to the actuation control circuit, the force sensor configured to sense the trigger pull force applied by the user to the trigger.

5. The trigger mechanism according to claim 4, wherein the electromagnetic coil is energized by the actuation control circuit when the sensed trigger pull force reaches a preprogrammed user-selected trigger pull force setpoint.

6. The trigger mechanism according to claim 5, wherein the force sensor is disposed at the interface between the trigger bar and the trigger.

7. The trigger mechanism according to claim 6, wherein the force sensor is a thin film force sensing resistor disposed at the interface between the trigger and trigger bar, the force sensor being compressed between the trigger and trigger bar when the trigger is pulled and measuring the trigger pull force.

8. The trigger mechanism according to claim 1, further comprising an openable and closeable control air gap formed between stationary yoke and trigger bar, wherein the control air gap is open when the trigger is not pulled and automatically closes when the trigger is pulled and the electromagnetic coil is energized.

9. The trigger mechanism according to claim 8, wherein the trigger bar is movable via pulling the trigger between an upright unactuated position associated with an open control air gap and an angled actuated position associated with a closed control air gap for discharging the firearm.

10. The trigger mechanism according to claim 9, wherein energizing the electromagnetic coil creates a magnetic attractive force between the trigger bar and stationary yoke which draws the trigger bar towards the stationary yoke to close the air gap.

11. The trigger mechanism according to claim 9, wherein the trigger bar comprises an upper working portion defining a sear surface operably coupled directly or indirectly to a spring-biased striking member of the firearm, the striking member movable between a rearward cocked position and forward firing position for discharging the firearm.

12. The trigger mechanism according to claim 11, wherein the sear surface engages a cockable hammer or a rotatable sear engaged with a cockable striker.

13. The trigger mechanism according to claim 8, wherein the trigger bar comprises an upright working portion engageable with the stationary yoke at the control air gap and a rearwardly extending actuating portion acted on by the trigger biasing member.

14. The trigger mechanism according to claim 13, wherein pulling the trigger member forces the actuating portion upwards which rotates the working portion forward to close the control air gap.

15. The trigger mechanism according to claim 1, wherein the interface between the trigger and trigger bar is formed between an operating extension of the trigger member engageable with a cooperating actuation extension of the trigger bar.

16. The trigger mechanism according to claim 15, wherein the actuating extension defines a first planar surface engageable with a second planar surface defined by the operating extension.

17. The trigger mechanism according to claim 15, wherein the trigger biasing member biases the actuating extension of the trigger bar towards engagement with the operating extension of the trigger member.

18. The trigger mechanism according to claim 1, wherein the stationary yoke is C-shaped.

19. The trigger mechanism according to claim 3, further comprising a displacement sensor operable to measure a trigger displacement when pulled by the user, wherein the electromagnetic coil is energized when the measured trigger displacement reaches a preprogrammed user-selected trigger displacement setpoint.

20. The trigger mechanism according to claim 19, wherein the displacement sensor is selected from the group consisting of a Hall effect sensor, a magnetoresistive sensor, an optical switch, and a mechanical switch.

21. The trigger mechanism according to claim 3, further comprising a programmable microcontroller operably coupled to the actuation control circuit, the microcontroller configured to time energizing the electromagnetic coil in accordance with the trigger pull setpoint which is preprogrammed into the microcontroller.

22. The trigger mechanism according to claim 3, wherein the actuation control circuit is configurable by the user to change a magnitude of the current fed to the electromagnetic coil via pulse modulation, the magnitude of the current increasing or decreasing the magnetic field of the electromagnetic coil which changes the trigger pull force required to overcome the primary resistance force created by the trigger biasing member.

23. A user-adjustable closed loop electromagnetically variable trigger mechanism for a firearm, the trigger mechanism comprising:

a support structure;

a stationary yoke supported by the support structure;

a trigger bar pivotably movable relative to the yoke, the trigger bar and yoke collectively configured to form a closed magnetic flux loop openable and closeable at a control air gap controlled by the trigger bar;

the trigger bar comprising a vertically elongated working portion configured to engage a firing component of a firing mechanism of the firearm and a cantilevered actuating extension angularly disposed to the working portion;

a trigger member pivotably coupled to the stationary yoke about a first pivot axis, the trigger member operably interacting with the trigger bar at an interface and comprising a downwardly extending grip portion for grasping, and a cantilevered operating extension angularly disposed to the grip portion;

the trigger bar movable via pulling the trigger portion between an upright unactuated position associated an open control air gap and an angled actuated position associate with a closed control air gap for discharging the firearm;

a trigger spring biasing the trigger bar towards the unactuated position, the biasing member creating a mechanical primary resistance force opposing movement of the trigger when pulled by the user; and an electromagnetic coil disposed on the stationary yoke or trigger bar, the electromagnetic coil operably coupled to a power source and selectively energized via pulling the trigger member;

the electromagnet coil when energized generating a user-adjustable magnetic field counterbalancing a primary resistance force generated by the trigger spring which pulls the trigger bar towards the stationary yoke into the actuated position, thereby lessening a trigger pull force required to be exerted by a user to discharge the firearm.

24. The trigger mechanism according to claim 23, wherein the trigger spring biases the actuating extension of the trigger bar downward, which in turn biases the working portion rearward toward the unactuated position.

25. The trigger mechanism according to claim 23, wherein the magnetic field creates a magnetic force which acts in a direction opposite to the primary resistance force created by the trigger biasing member to draw the trigger bar towards the stationary yoke.

26. The trigger mechanism according to claim 25, further comprising an actuation control circuit operably coupled to the power source and the electromagnetic coil, the actuation control circuit configurable by the user to selectively time energizing the electromagnetic coil during a trigger pull event when the trigger pull force reaches a preprogrammed trigger pull setpoint.

27. The trigger mechanism according to claim 26, further comprising a force sensor operably coupled to the actuation control circuit and configured to sense the trigger pull force applied by the user to the trigger member, the force sensor disposed in the interface and compressed between the trigger bar and the trigger member when the trigger is pulled.

28. The trigger mechanism according to claim 27, wherein the force sensor is a thin film force sensing resistor.

29. The trigger mechanism according to claim 23, wherein the working portion of trigger bar defines a sear surface operably coupled directly or indirectly to a spring-biased striking member of the firearm, the striking member movable between a rearward cocked position and forward firing position for discharging the firearm via rotating the working portion into the actuated position via a trigger pull.

30. The trigger mechanism according to claim 29, wherein the sear surface engages a cockable hammer or a rotatable sear engaged with a cockable striker.

31. An electromagnetically variable trigger mechanism for a firearm comprising:

a stationary yoke configured for attachment to a support structure of the firearm;

a movable trigger bar having a lower portion pivotably coupled to the stationary yoke and an upper portion selectively engageable with the stationary yoke at a control air gap, the trigger bar and yoke collectively configured to form a closed magnetic flux loop;

a trigger member rotatably coupled to the stationary yoke and operably interacting with the trigger bar at an interface;

the trigger bar pivotably movable via a trigger pull between an unactuated position associated with an open control air gap, and an actuated position associated with a closed control air gap for discharging the firearm;

a trigger spring biasing the trigger bar towards the unactuated position, the trigger bar creating a mechanical primary resistance force opposing movement of the trigger when pulled by the user;

an electromagnetic coil operably coupled to a power source and disposed on the stationary yoke or trigger bar;

an actuation control circuit operably coupled to power source, the actuation control circuit configured to selectively energize the electromagnetic coil at a predetermined trigger pull setpoint during a trigger pull event which creates an electromagnetic field in the closed magnetic flux loop;

the electromagnetic field interacting with the primary resistance force to dynamically change a trigger pull force required to be exerted by a user to overcome the primary resistance force and discharge the firearm.

32. The trigger mechanism according to claim 31, wherein electromagnetic field creates a magnetic attractive force between the trigger bar and stationary yoke at the control air gap which draws the trigger bar towards the actuated position into engagement with the stationary yoke.

33. The trigger mechanism according to claim 32, further comprising a force sensor operably coupled to the actuation control circuit and configured to sense the trigger pull force applied by the user to the trigger member, the actuation control circuit configurable by the user to selectively time energizing the electromagnetic coil during the trigger pull event when the trigger pull force reaches the preprogrammed trigger pull setpoint.

34. The trigger mechanism according to claim 31, further comprising a programmable microcontroller operably coupled to the actuation control circuit, the microcontroller configured to time energizing the electromagnetic coil in accordance with the predetermined trigger pull setpoint which is preprogrammed into the microcontroller.

35. A method for operating a closed loop electromagnetic trigger mechanism of a firearm, the method comprising:

providing a stationary yoke disposed in the firearm, a pivotably movable trigger bar selectively engageable with the stationary yoke at a control air gap, an electromagnetic coil disposed on the stationary yoke or trigger bar, and a rotatable trigger member operably engaged with the trigger bar, the trigger member operable to rotate the trigger bar, the stationary yoke and trigger bar forming a closed magnetic flux loop;

providing a control system having a preprogrammed trigger pull setpoint;

applying a biasing force on the trigger bar which is biased into an unactuated position disengaged from the stationary yoke at the control air gap, the biasing force creating a mechanical primary resistance force on the trigger member;

applying a trigger pull force to the trigger member to rotate the trigger member from a forward position towards a rearward position;

measuring the trigger pull force with a sensor operably coupled to the control system, the control system comparing the measured trigger pull force with the trigger pull setpoint;

energizing the electromagnetic coil when the measured trigger pull force reaches the trigger pull setpoint to create a force in the closed magnetic flux loop acting in a direction opposite the biasing force;

the magnetic force drawing the trigger bar into engagement with the stationary yoke at the control air gap, the trigger bar being in an actuated position;

wherein the magnetic force counterbalances the biasing force to lessen the trigger pull force required to be exerted by a user to fully pull the trigger member to discharge the firearm.

* * * * *